US007032361B2

(12) United States Patent
Kadota et al.

(10) Patent No.: US 7,032,361 B2
(45) Date of Patent: Apr. 25, 2006

(54) METHOD OF AND SYSTEM FOR AUTOMATICALLY PACKAGING ROLLS

(75) Inventors: Norihiro Kadota, Minamiashigara (JP); Kazuo Okutsu, Minamiashigara (JP); Koji Tsujimura, Minamiashigara (JP); Katsumi Tashiro, Minamiashigara (JP); Kunihiro Sumida, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/327,979

(22) Filed: Dec. 26, 2002

(65) Prior Publication Data

US 2003/0115835 A1 Jun. 26, 2003

(30) Foreign Application Priority Data

Dec. 25, 2001 (JP) ..... 2001-392431

(51) Int. Cl.
*B65B 11/04* (2006.01)
*B65B 25/24* (2006.01)

(52) U.S. Cl. ..... 53/409; 53/465; 53/204; 53/214

(58) Field of Classification Search ..... 53/409, 53/465, 204, 211, 214, 372.9
See application file for complete search history.

(56) References Cited

U.S. PATENT DOCUMENTS

| | | | | |
|---|---|---|---|---|
| 3,342,014 | A * | 9/1967 | Prager | 53/214 |
| 3,407,565 | A * | 10/1968 | Bender et al. | 53/214 |
| 3,494,095 | A * | 2/1970 | Valvano | 53/465 |
| 3,740,924 | A * | 6/1973 | Becker | 53/372.9 |
| 3,856,141 | A * | 12/1974 | Reed | 53/409 |
| 4,011,155 | A * | 3/1977 | Feurstein et al. | 53/53 |
| 4,307,555 | A * | 12/1981 | Mlodozeniec et al. | 53/53 |
| 4,485,612 | A * | 12/1984 | Piesen et al. | 53/214 |
| 4,498,588 | A * | 2/1985 | Scott | 53/410 |
| 4,524,562 | A * | 6/1985 | Yagi et al. | 53/409 |
| 4,744,198 | A * | 5/1988 | Hood et al. | 53/415 |
| 4,911,299 | A * | 3/1990 | Peeters | 53/409 |
| 5,337,536 | A * | 8/1994 | Takahashi et al. | 53/204 |
| 5,388,384 | A * | 2/1995 | Purkey et al. | 53/64 |
| 5,501,058 | A * | 3/1996 | Sonoyama et al. | 53/204 |
| 5,515,970 | A | 5/1996 | Ritchie et al. | |
| 5,533,321 | A * | 7/1996 | Hooper et al. | 53/372.9 |
| 5,803,255 | A | 9/1998 | Peeters et al. | |
| 6,098,376 | A * | 8/2000 | Hailes et al. | 53/409 |
| 6,178,385 | B1 * | 1/2001 | Takahashi et al. | 53/204 |
| 6,523,328 | B1 * | 2/2003 | De Cardenas et al. | 53/399 |

FOREIGN PATENT DOCUMENTS

| | | |
|---|---|---|
| EP | 0 487 107 A1 | 5/1992 |
| EP | 0 499 954 A1 | 8/1992 |
| EP | 0 681 212 A1 | 11/1995 |
| EP | 0 729 889 A2 | 9/1996 |
| EP | 1 113 319 A1 | 7/2001 |
| JP | 6-8593 | 3/1994 |

(Continued)

*Primary Examiner*—John Sipos
(74) *Attorney, Agent, or Firm*—Sughrue Mion, PLLC

(57) ABSTRACT

A system for automatically packaging photosensitive rolls includes a flanged member installing device for selecting flanged members corresponding to a photosensitive roll and automatically installing the flanged members respectively on opposite ends of the photosensitive roll, a tape member applying device for automatically applying a joint tape to an end of the photosensitive roll, a packaging sheet working device for automatically processing light-shielding leaders to dimensions corresponding to the photosensitive roll, an applying mechanism for automatically applying the processed light-shielding leaders to the photosensitive roll, and a packaging sheet takeup device for automatically winding the light-shielding leaders around the photosensitive roll.

20 Claims, 168 Drawing Sheets

FOREIGN PATENT DOCUMENTS

| | | |
|---|---|---|
| JP | 6-214350 | 8/1994 |
| JP | 8-240887 | 9/1996 |
| JP | 8-292523 | 11/1996 |
| JP | 10-307369 | 11/1998 |
| JP | 2000-310834 A | 11/2000 |
| JP | 2001-188322 A | 7/2001 |
| JP | 2002-337810 A | 11/2002 |
| JP | 2002-337816 A | 11/2002 |

* cited by examiner

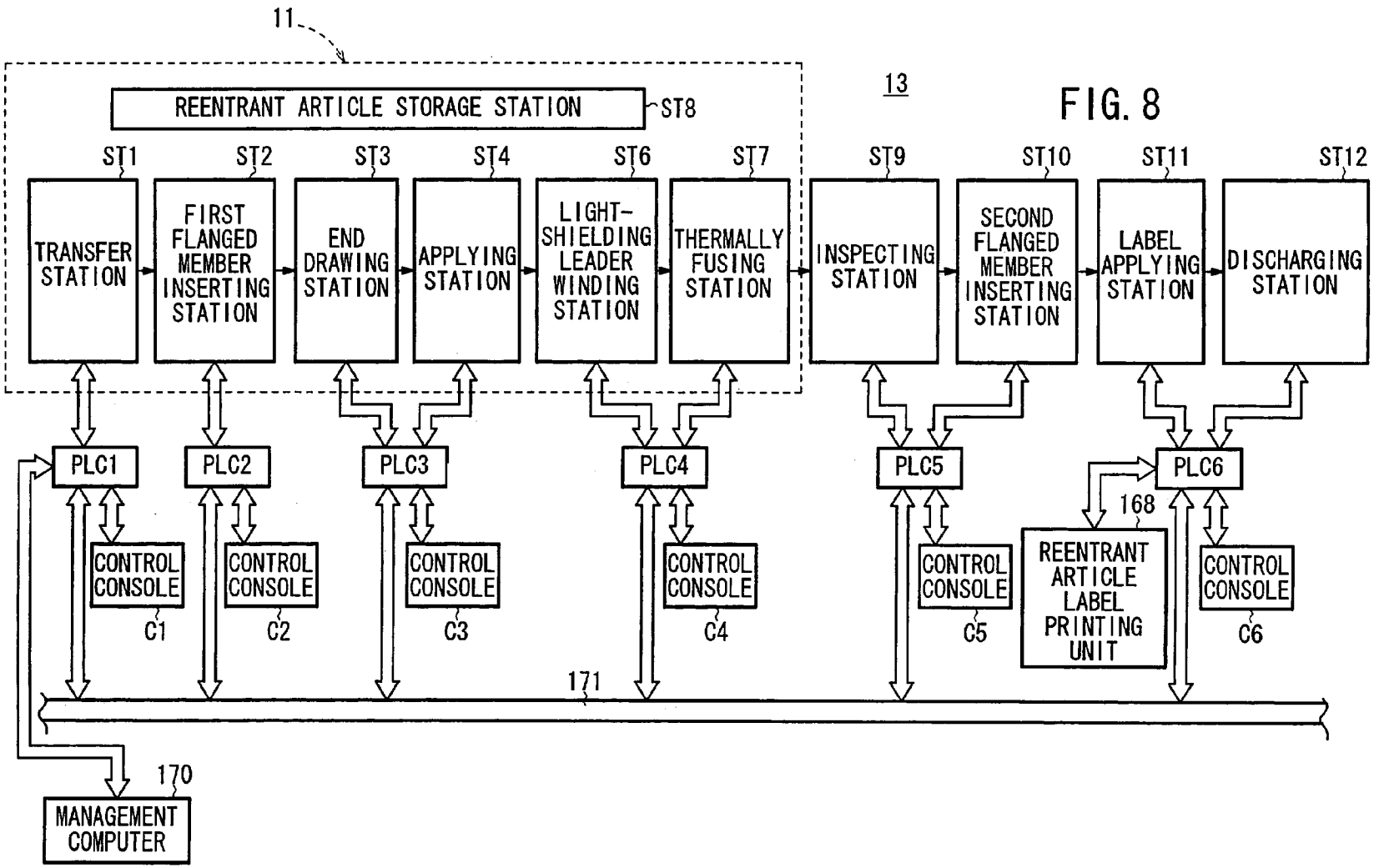
FIG. 8
11
13
REENTRANT ARTICLE STORAGE STATION
ST8
ST1
TRANSFER STATION
ST2
FIRST FLANGED MEMBER INSERTING STATION
ST3
END DRAWING STATION
ST4
APPLYING STATION
ST6
LIGHT-SHIELDING LEADER WINDING STATION
ST7
THERMALLY FUSING STATION
ST9
INSPECTING STATION
ST10
SECOND FLANGED MEMBER INSERTING STATION
ST11
LABEL APPLYING STATION
ST12
DISCHARGING STATION
PLC1
PLC2
PLC3
PLC4
PLC5
PLC6
CONTROL CONSOLE C1
CONTROL CONSOLE C2
CONTROL CONSOLE C3
CONTROL CONSOLE C4
CONTROL CONSOLE C5
CONTROL CONSOLE C6
168
REENTRANT ARTICLE LABEL PRINTING UNIT
171
170
MANAGEMENT COMPUTER

878

FIG. 106
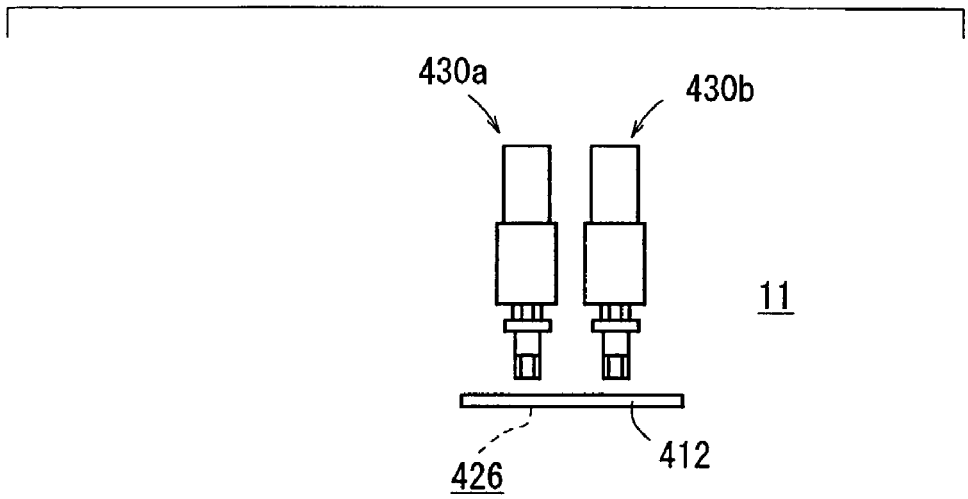
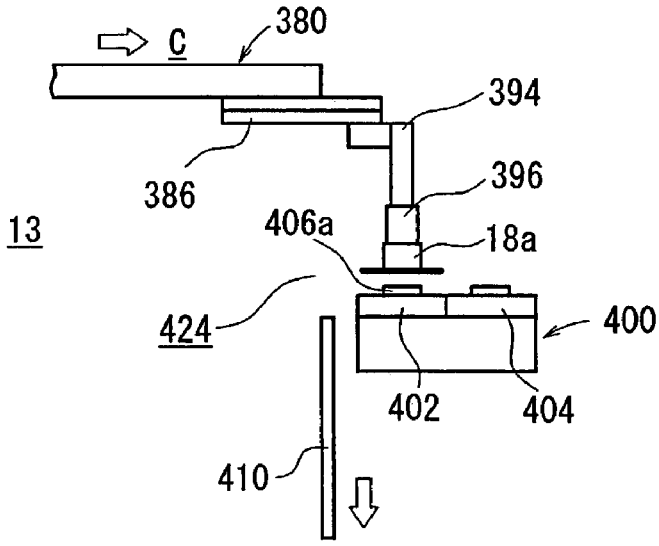

METHOD OF AND SYSTEM FOR AUTOMATICALLY PACKAGING ROLLS

BACKGROUND OF THE INVENTION

1. Field of the Invention

The present invention relates to a method of and a system for automatically packaging various rolls having at least different roll widths, different roll diameters, or different package forms.

2. Description of the Related Art

Films for use in the field of platemaking for printing are in the form of a light-shielded photosensitive roll comprising an elongate photosensitive sheet wound around a core, a pair of light-shielding members mounted respectively on the opposite ends of the wound photosensitive sheet, and a light-shielding sheet (leader) wound around the photosensitive sheet.

Various light-shielded photosensitive rolls have heretofore been proposed in the art. The applicant of the present application has filed a patent application on a process for easily manufacturing such a light-shielded photosensitive roll (see Japanese Laid-Open Patent Publication No. 2000-310834).

According to the process disclosed in the above patent publication, as shown in FIG. 168 of the accompanying drawings, two disk-shaped light-shielding members (flanged members) 2 are attached respectively to opposite ends of a photosensitive material roll 1, and an elongate heat-shrinkable light-shielding leader 3 which is longitudinally shrinkable with heat is wound around the photosensitive material roll 1, the light-shielding leader 3 having and end fixed to the photosensitive roll 1 by tapes 4. Then, the photosensitive roll 1 is placed in a shrink tunnel and heated to shrink the light-shielding leader 3. The light-shielding leader 3 is shrunk with heat to have its opposite edges brought into close contact with the outer edges of the disk-shaped light-shielding members 2, whereupon a light-shielded photosensitive roll 5 is completed.

The light-shielded photosensitive roll 5 is produced in different diameters. Specifically, there are available cores of different diameters, e.g., 2 inches and 3 inches, for supporting the photosensitive material roll 1 thereon, and the photosensitive material roll 1 is wound to different outside diameters on each of those cores. For example, the photosensitive material roll 1 is wound to four different outside diameters on cores having a diameter of 2 inches, and wound to two different outside diameters on cores having a diameter of 3 inches, so that a total of six different types of the light-shielded photosensitive roll 5 may be manufactured. In addition, the light-shielded photosensitive roll 5 is produced in different roll widths, and hard flanged members may be inserted as the disk-shaped light-shielding members 2. Therefore, the light-shielded photosensitive roll 5 is available in different package forms.

Usually, the light-shielded photosensitive roll 5 is manufactured according to a continuous packaging process for one roll size. When the light-shielded photosensitive roll 5 needs to be produced in a different roll diameter, a different roll width, or a different package form, the production facility requires a certain changeover, and the light-shielding leader 3 and the disk-shaped light-shielding members 2 need to be replaced.

Since such preparatory operations are considerably time-consuming, the overall efficiency of the packaging process is lowered, resulting in a failure to increase the productivity of the system for producing light-shielded photosensitive rolls 5. Furthermore, because photosensitive material rolls 1 of different sizes and forms need to be kept in temporary stock, the space and cost required for keeping them in temporary stock are large.

SUMMARY OF THE INVENTION

It is a major object of the present invention to provide a method of and a system for automatically packaging various different rolls efficiently with a simple process and arrangement.

According to the present invention, flanged members corresponding to one of rolls having at least different roll widths, different roll diameters, or different package forms are selected and automatically installed respectively on opposite ends of the roll. Thereafter, a tape is automatically applied to an end of the roll in a transverse direction thereof. Then, a packaging sheet is automatically processed to dimensions corresponding to the roll, after which the processed packaging sheet is automatically applied to the end of the roll with the tape. The roll is rotated to automatically wind the packaging sheet around the roll.

Therefore, the production facility does not require a changeover and the packaging sheet does not need to be replaced each time a different roll width, roll diameter, or packaged form is used, and hence preparatory operations can be carried out in a short period of time. The overall packaging process is thus carried out with increased efficiency for increased productivity. Since rolls of different sizes and forms do not need to be kept in temporary stock, the space and cost required for keeping such rolls in temporary stock are not required.

A heating head corresponding to the diameter of the roll is selected, and opposite outer edges of heat-shrinkable skirt members disposed individually or integrally on transversely opposite edges of the packaging sheet wound around the roll are heated by the heating head to automatically bond the opposite outer edges of heat-shrinkable skirt members to the roll. Then, a bonded state of the opposite outer edges of the heat-shrinkable skirt members is automatically inspected. Therefore, various rolls of different diameters can easily and well be handled, providing a heating process of increased versatility.

The flanged member is automatically assembled of a cap and a ring which are selected depending on the diameter of the roll. It is thus not necessary to manufacture in advance a number of types of flanged members corresponding to different roll diameters, so that the cost of manufacturing flanged members and the cost of storing flanged members can effectively be reduced.

The packaging sheet is automatically produced by applying heat-shrinkable skirt members to respective opposite edges of a sheet, and partly applying end fastening tapes to a winding terminal end of the sheet for fixing the sheet to an outer circumferential surface of the roll. Therefore, packaging sheets depending on roll types can efficiently and automatically produced, resulting in a highly efficient packaging process.

A roll packaging system according to the present invention has a pallet for placing a roll thereon and a feed device for feeding the pallet, the feed device being engageable with and disengageable from the pallet. The pallet has a pair of placement bases for supporting the roll thereon, the placement bases being positionally adjustable in the transverse direction of the roll. The feed device has base actuating mechanisms for automatically positionally adjusting the placement bases.

A roll having free ends can be held by the pair of placement bases, and roll having different roll widths can reliably be held by the single pallet. Consequently, the pallet is of a small size and can be manufactured at a reduced cost.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 8 is a block diagram showing the relationship between working stations and a control system thereof;

FIG. 106 is an elevational view showing the manner in which a first flanged member is fed to the lifter;

FIG. 120 is a plan view showing the manner in which the centering mechanism is spaced from the photosensitive roll after the end pressing mechanism has been actuated;

FIG. 121 is a plan view showing the manner in which the outer circumferential surface of the photosensitive roll is held by the centering mechanism after the centering mechanism has been positioned;

FIG. 122 is a plan view showing the manner in which the end pressing mechanism is lowered while the outer circumferential surface of the photosensitive roll is being held again by the centering mechanism;

FIG. 123 is a plan view showing the manner in which the insertion heads are removed from the opposite ends of the photosensitive roll;

FIG. 124 is a plan view showing the manner in which the photosensitive roll is released from the centering mechanism and placed on the pallet;

FIG. 125 is a view showing the manner in which an end of a photosensitive sheet is gripped by a gripper;

FIG. 126 is a view showing the manner in which the end of the photosensitive sheet is drawn by the gripper;

FIG. 127 is a view showing the manner in which a joint tape is wound around a suction roller;

FIG. 128 is a view showing the manner in which the joint tape is partly applied to the end of the photosensitive sheet;

FIG. 129 is a view showing the manner in which the joint tape is applied to the end of the photosensitive sheet transversely thereacross;

FIG. 130 is a view showing the manner in which the suction roller is driven after the joint tape is applied to the end of the photosensitive sheet;

FIG. 131 is a view showing the manner in which the joint tape is cut off;

Figure 132:
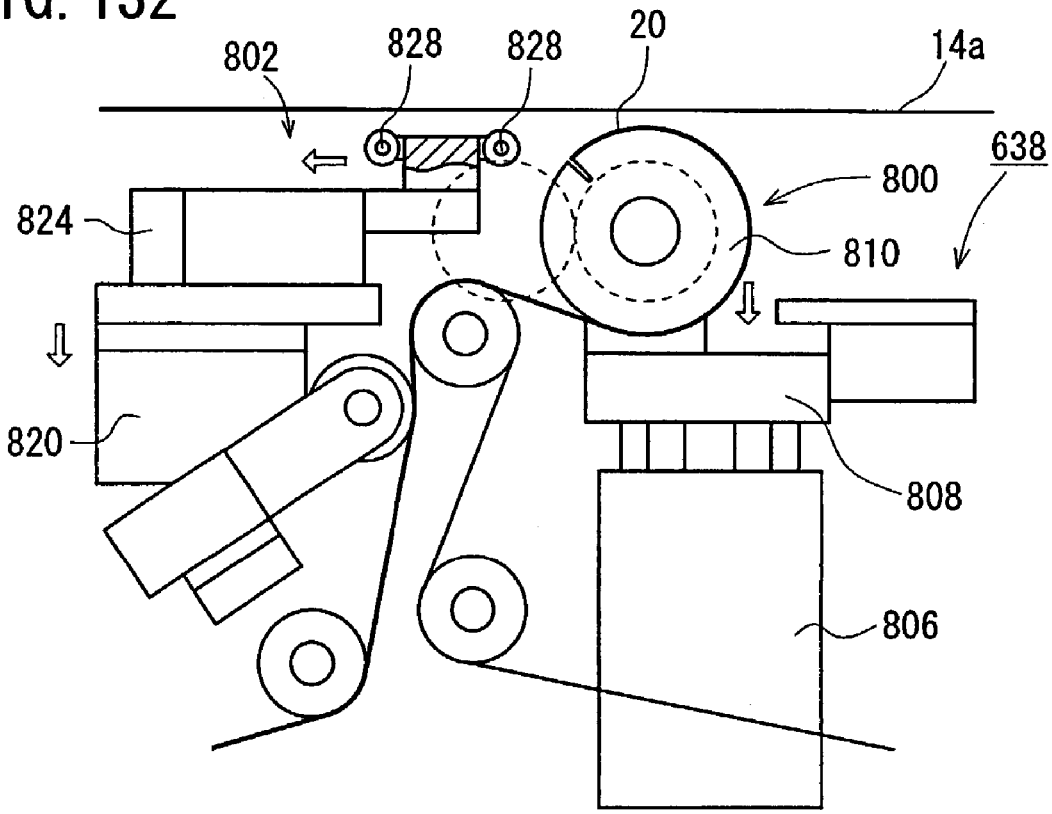
Figure 133:
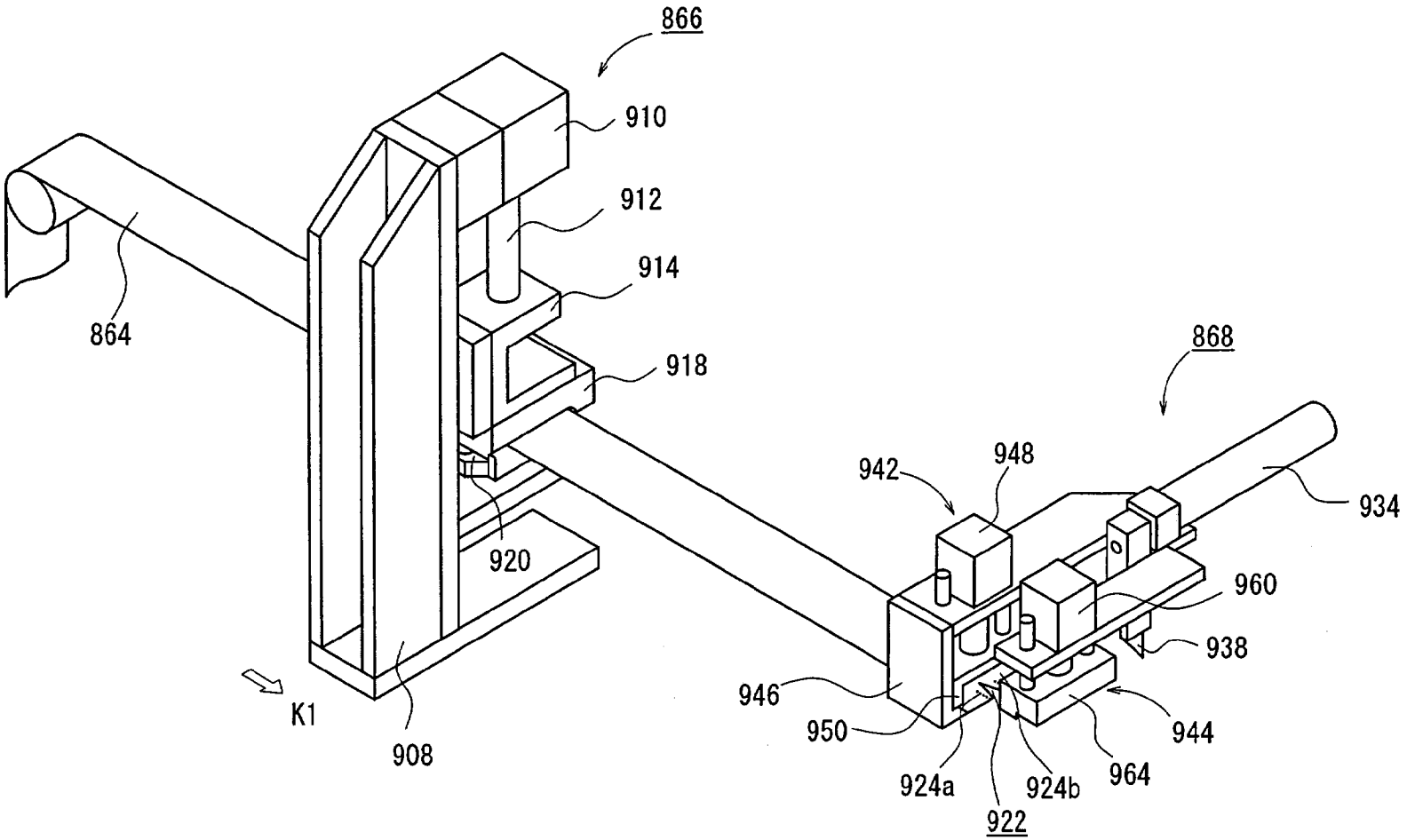
Figure 134:
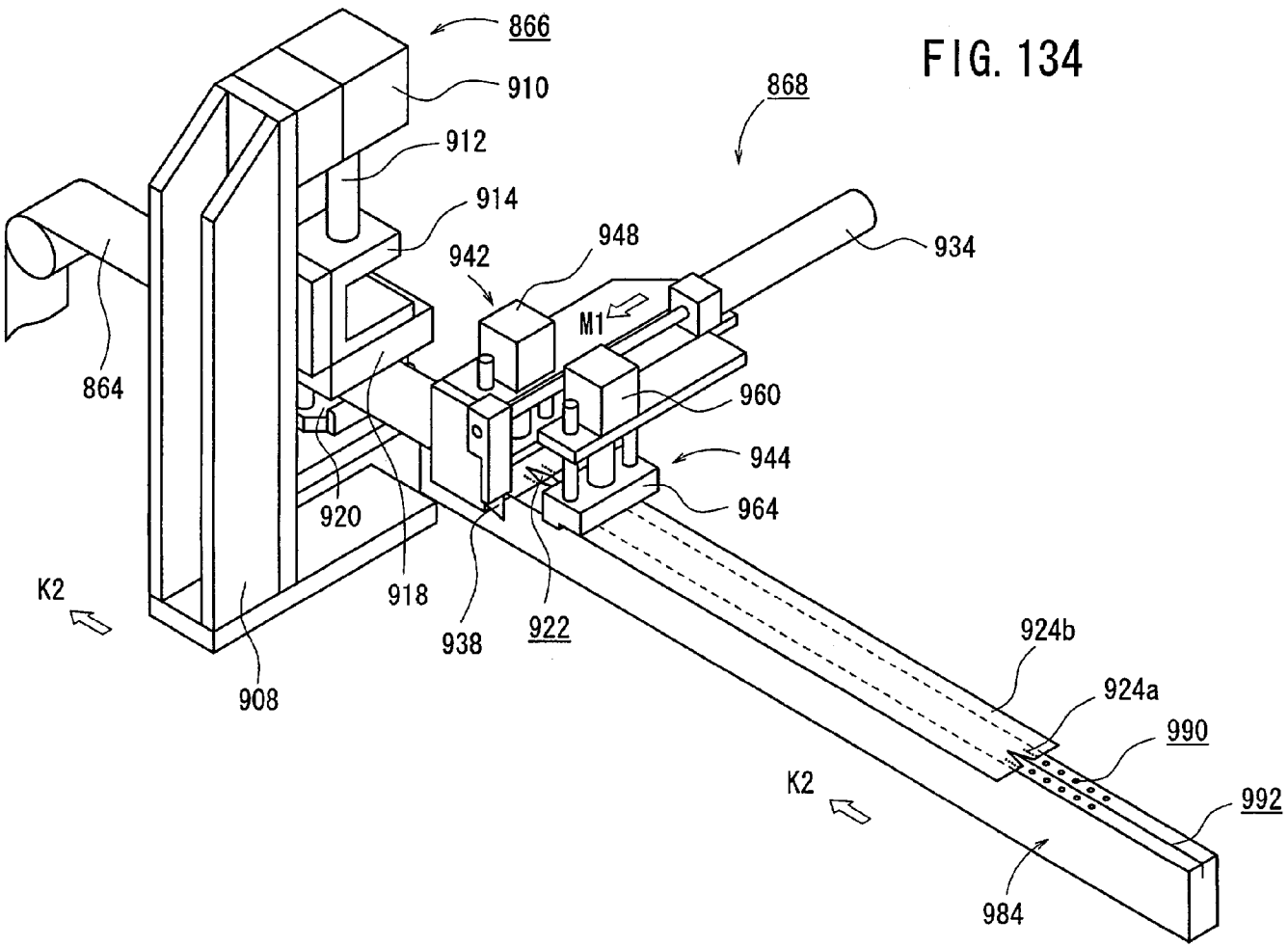
Figure 135:
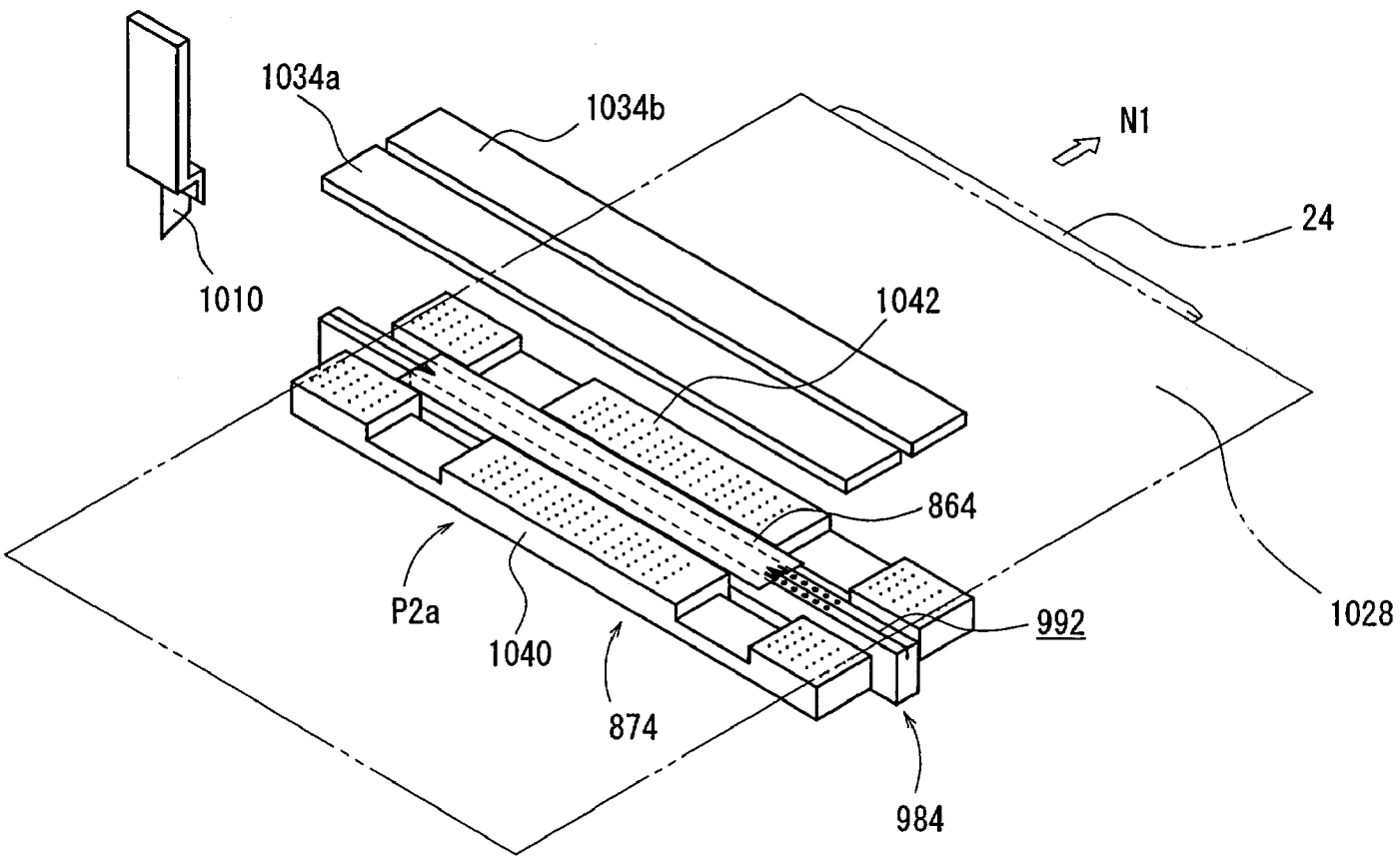
Figure 136:
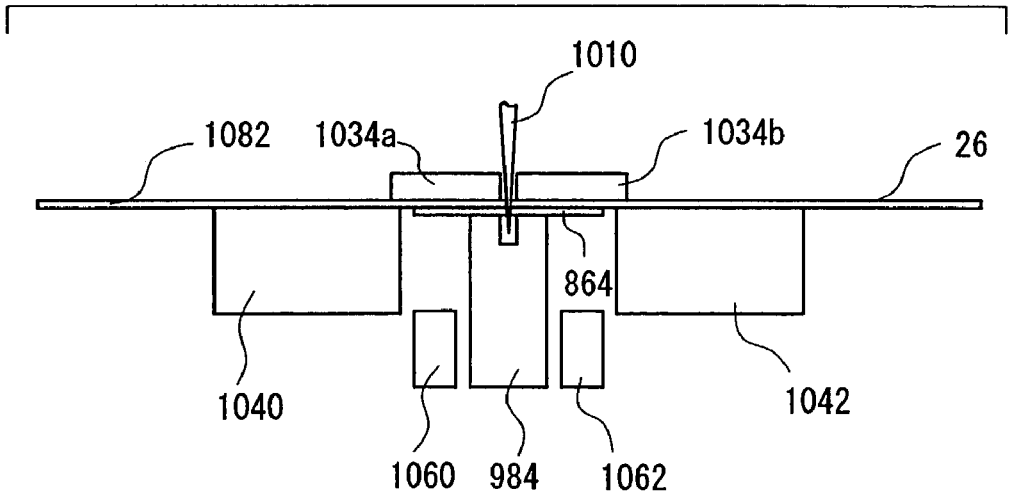
Figure 137:
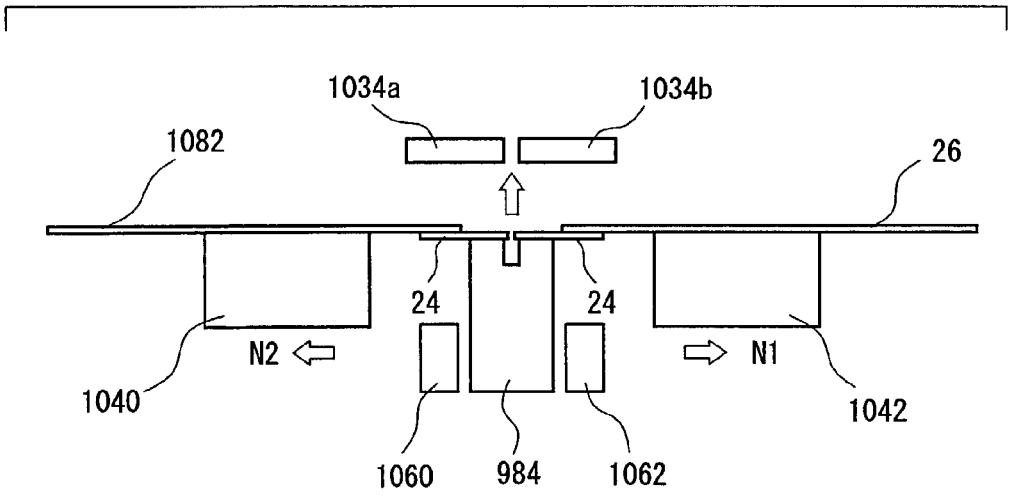
Figure 138:
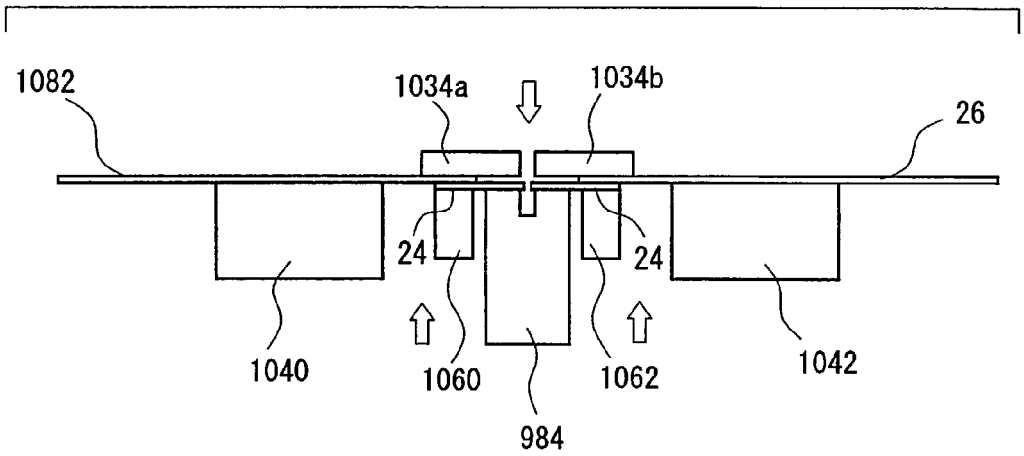
Figure 139:
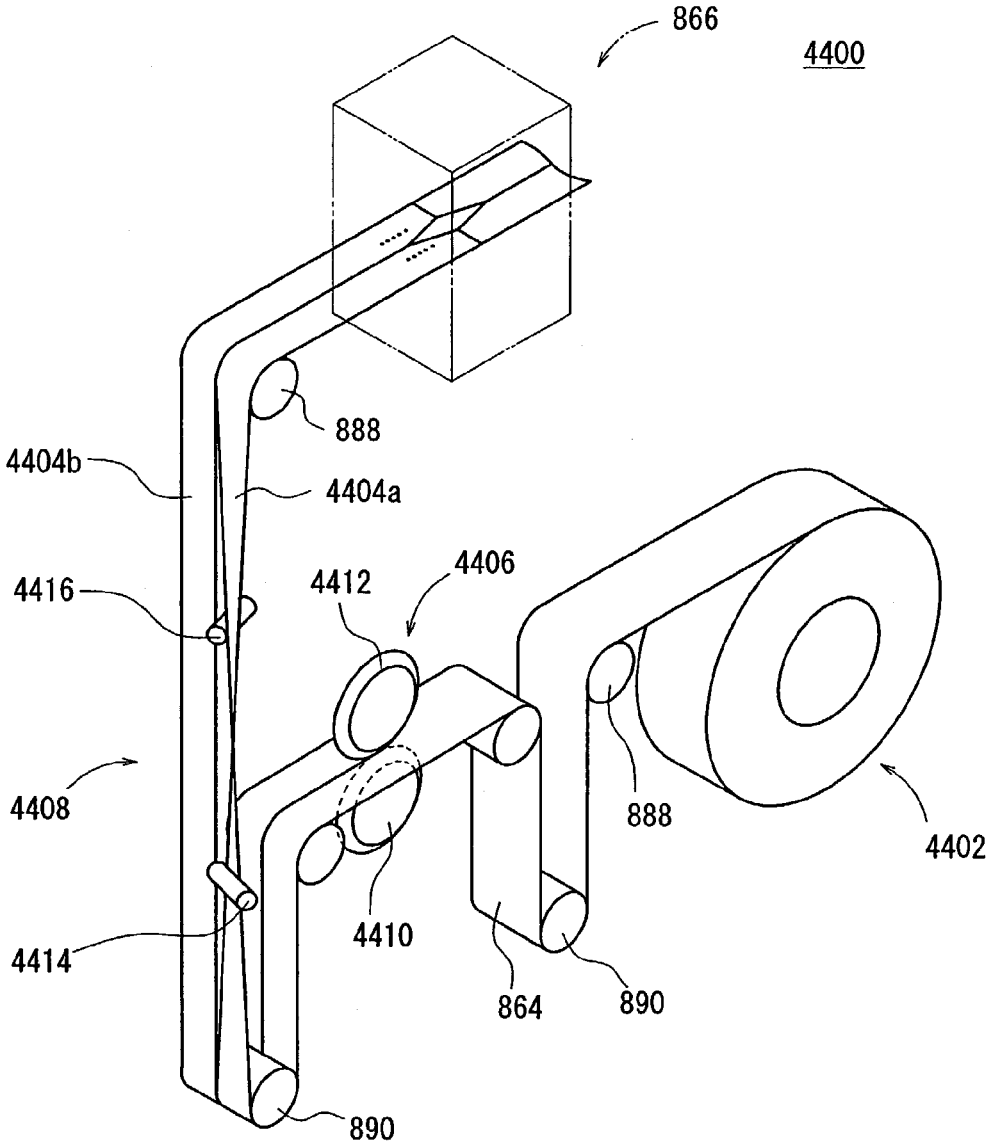
Figure 140:
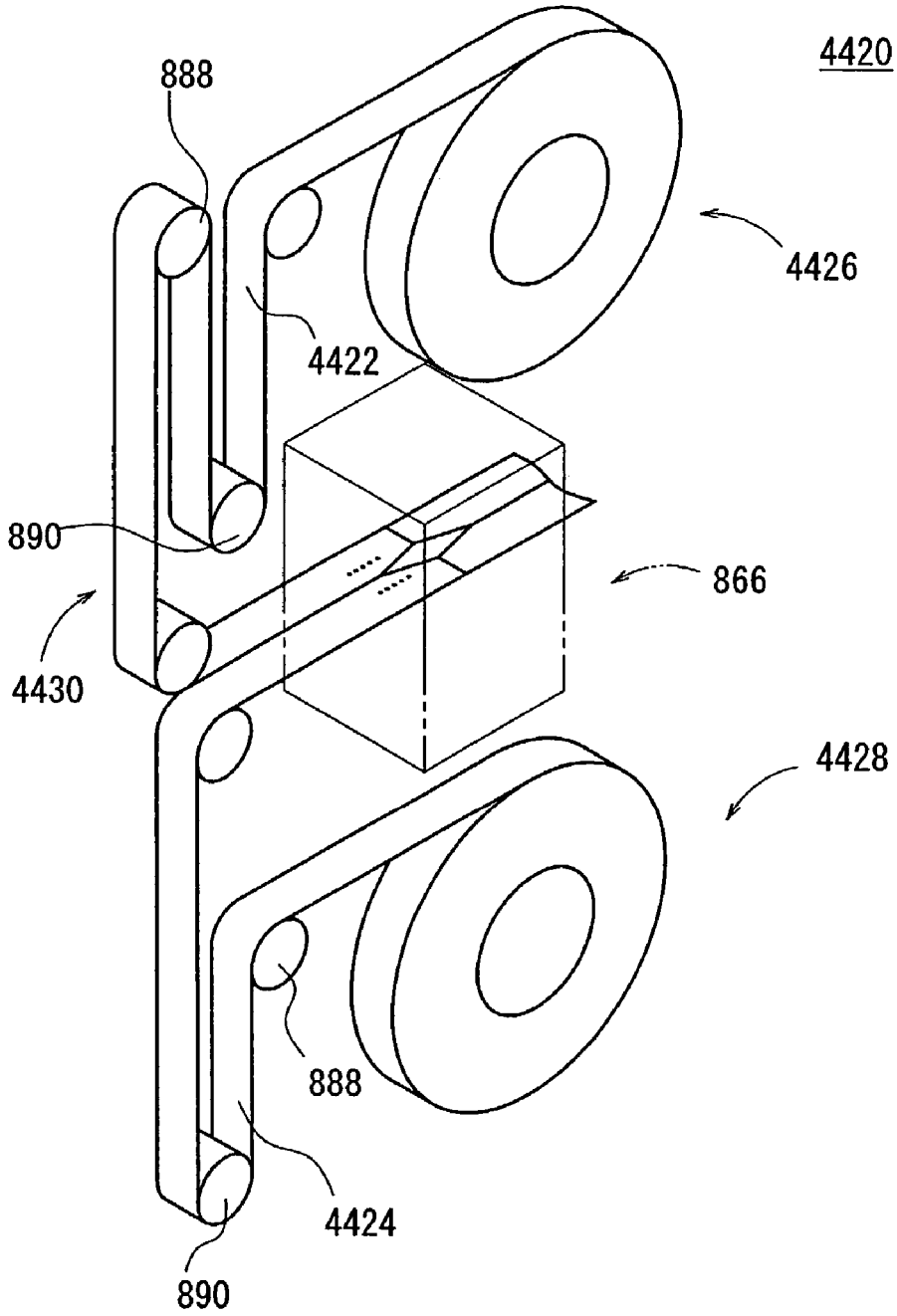
Figure 141:
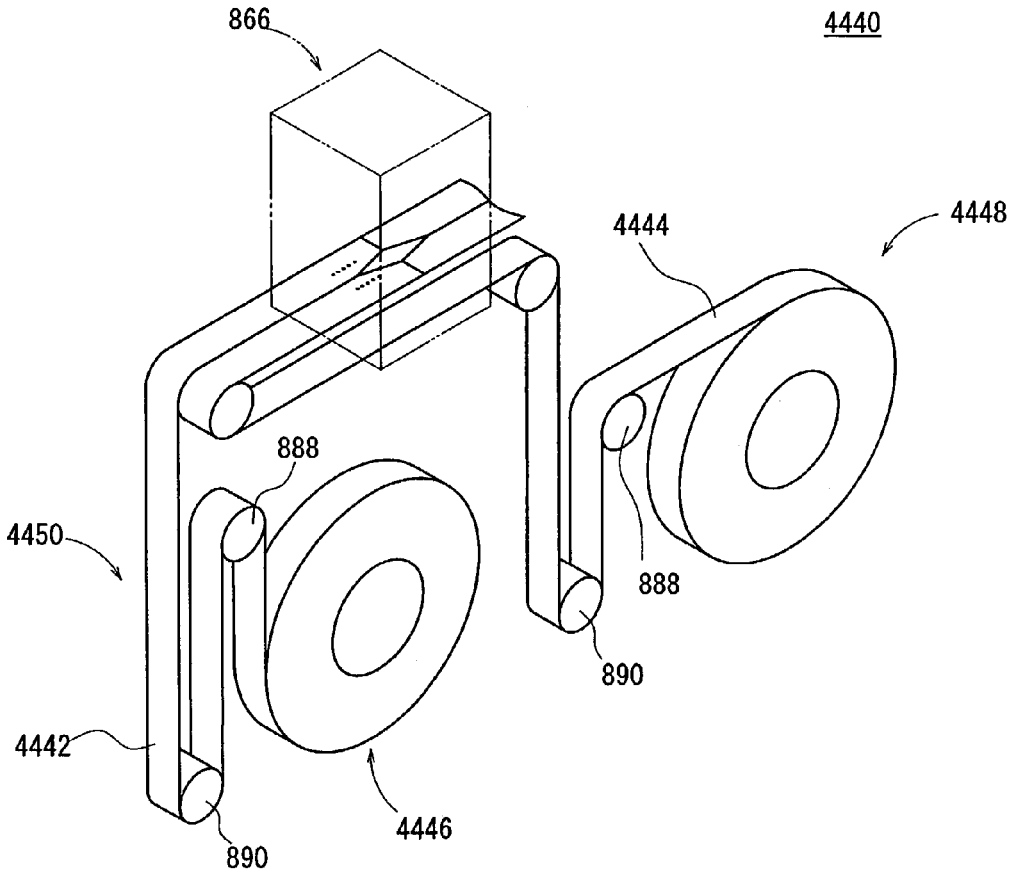
Figure 142:
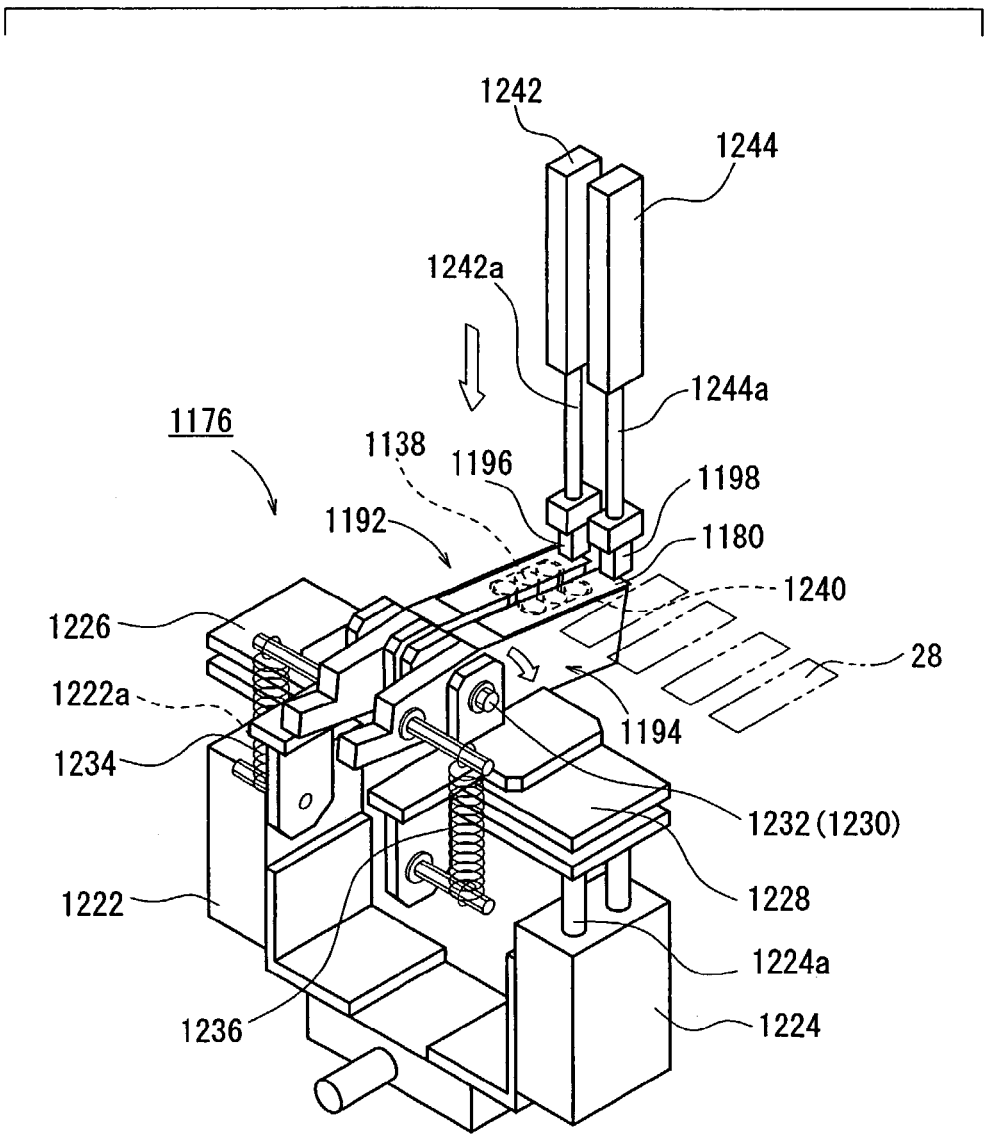
Figure 143:
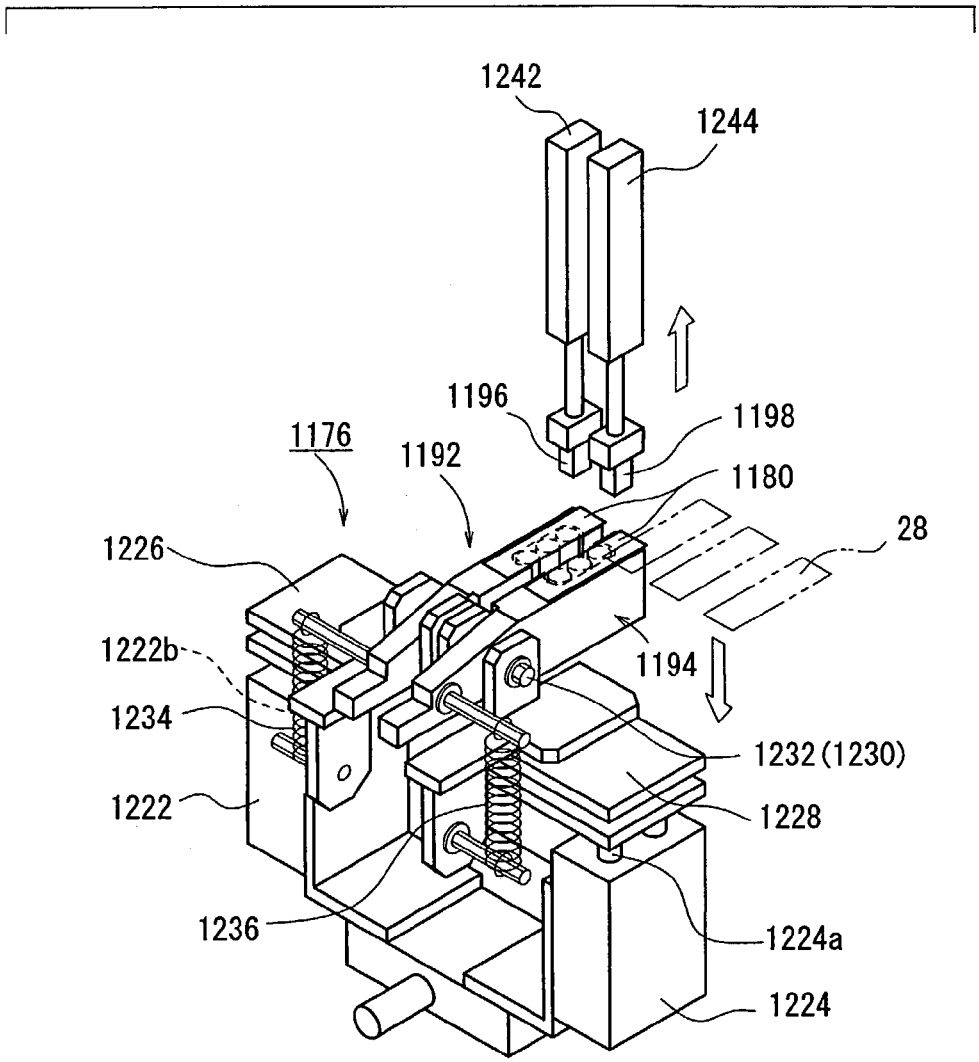
Figure 144:
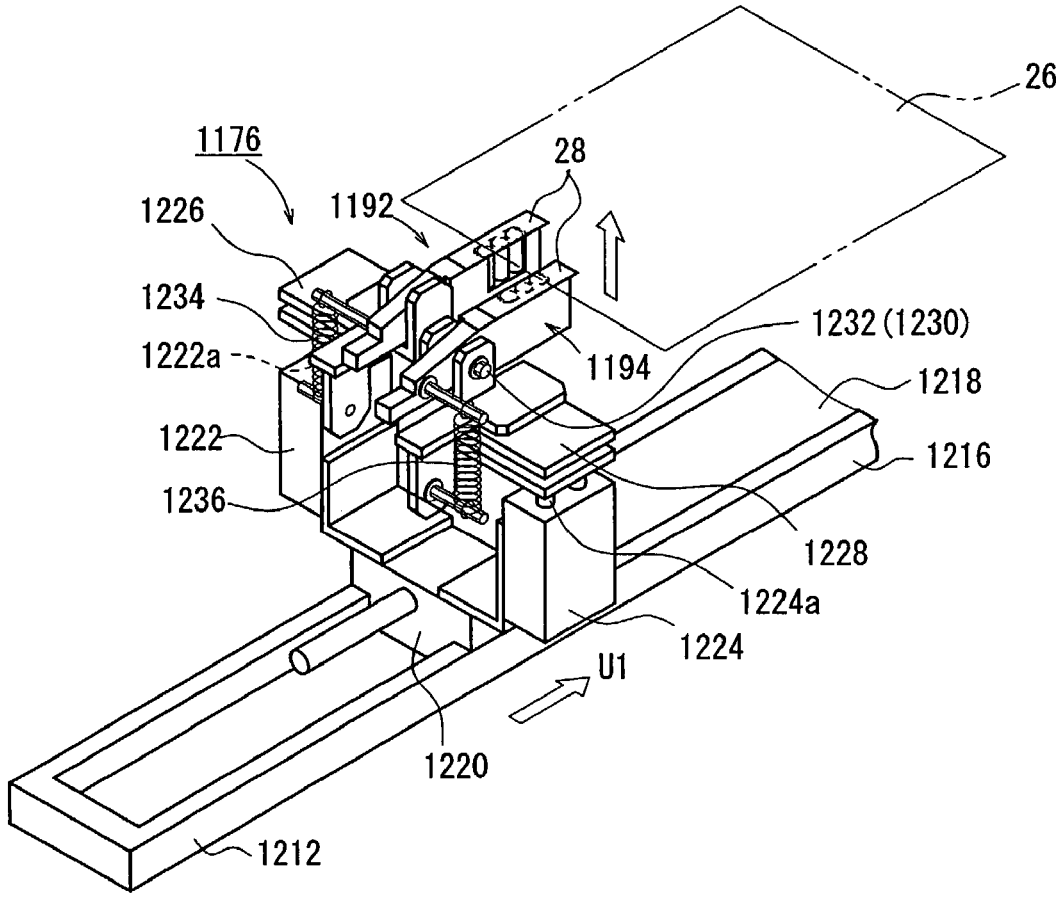
Figure 145:
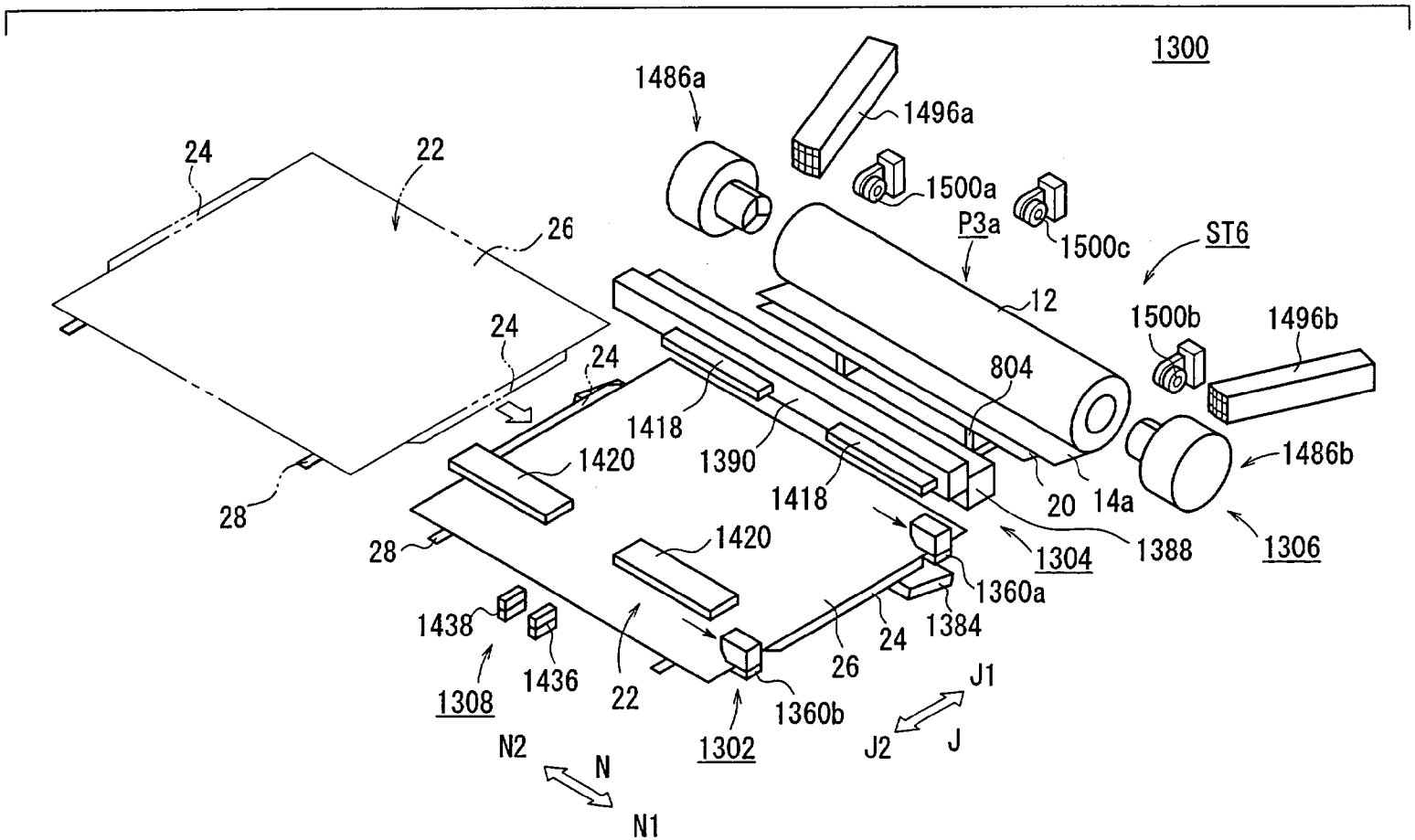
Figure 146:
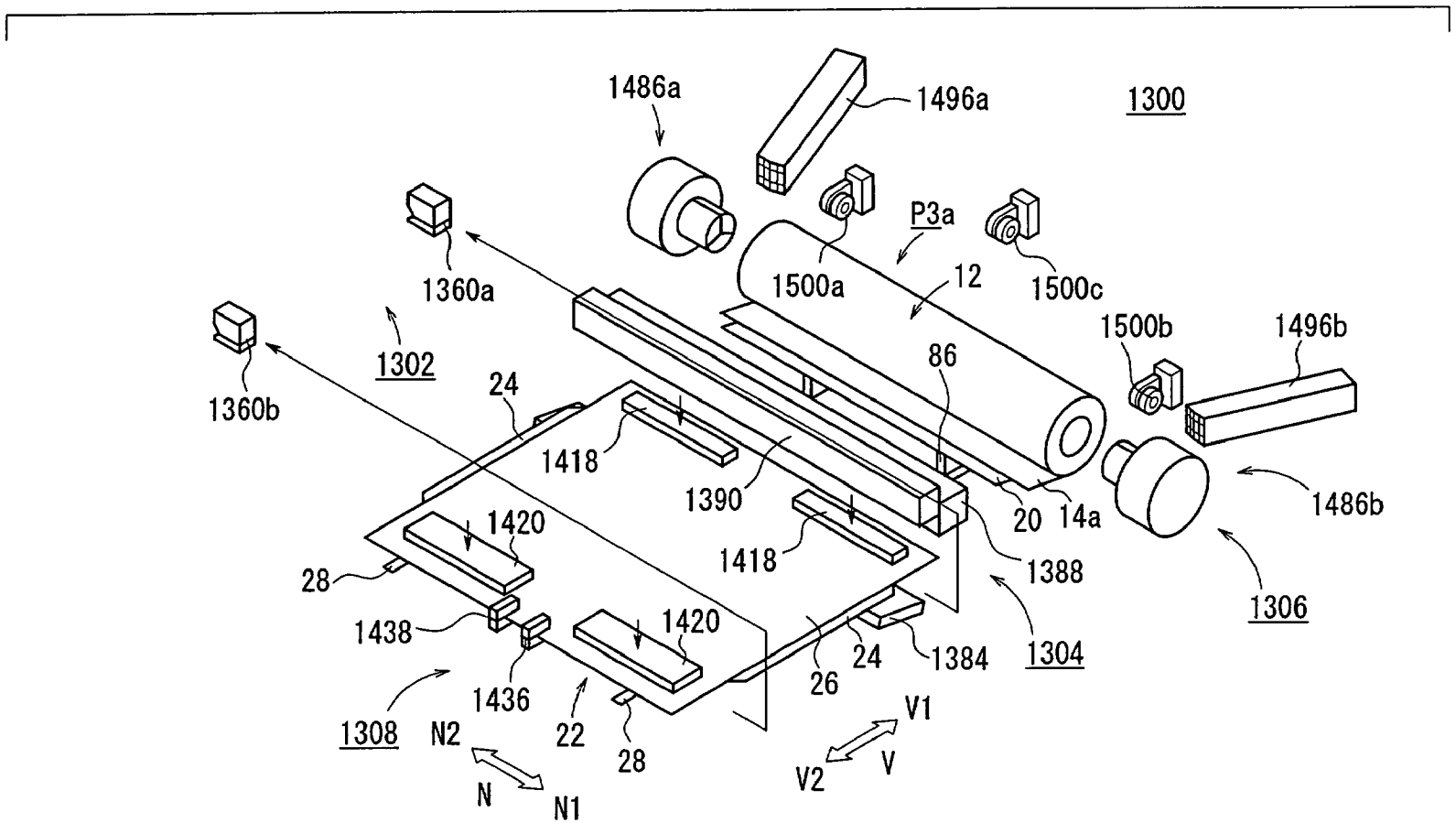
Figure 147:
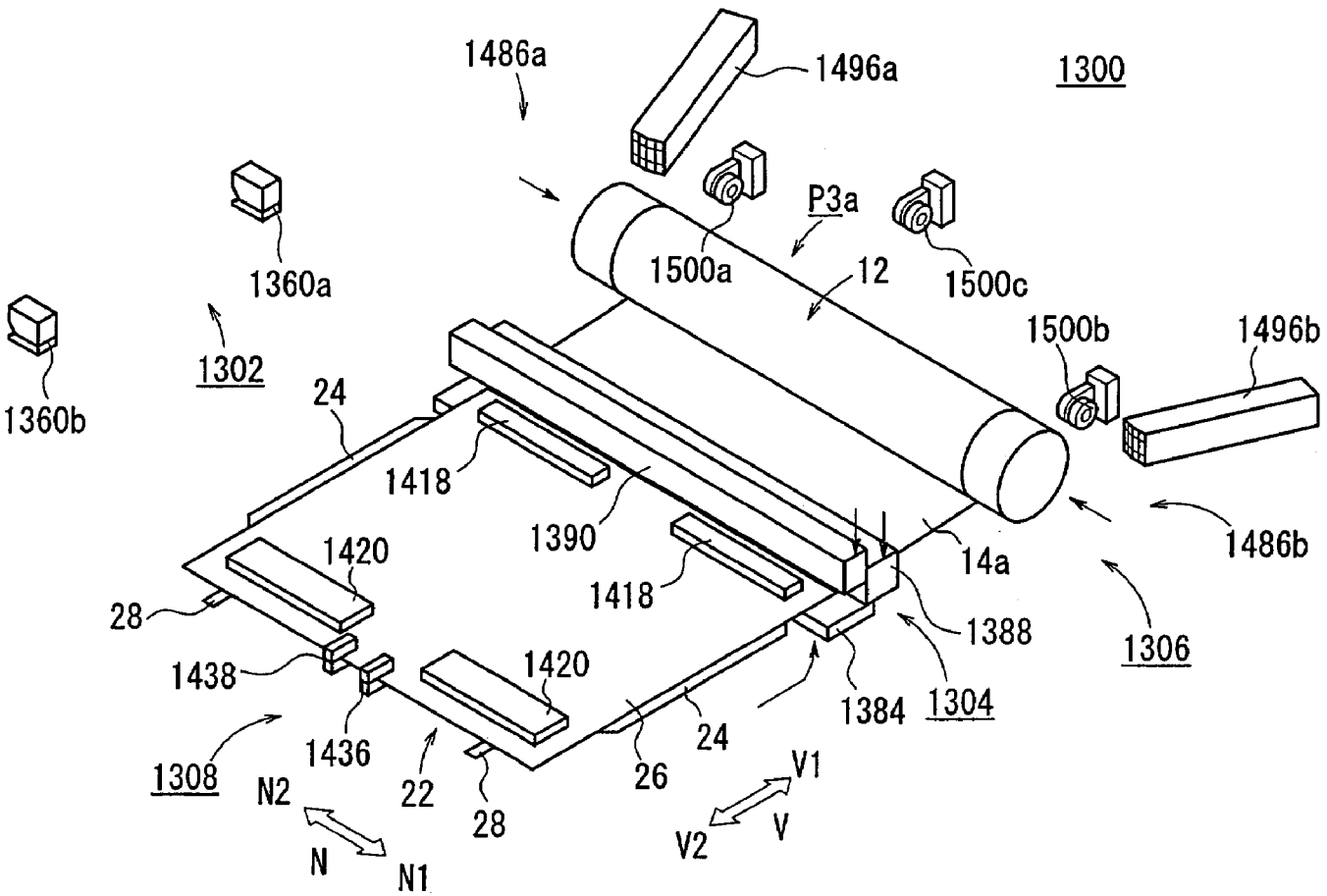
Figure 148:
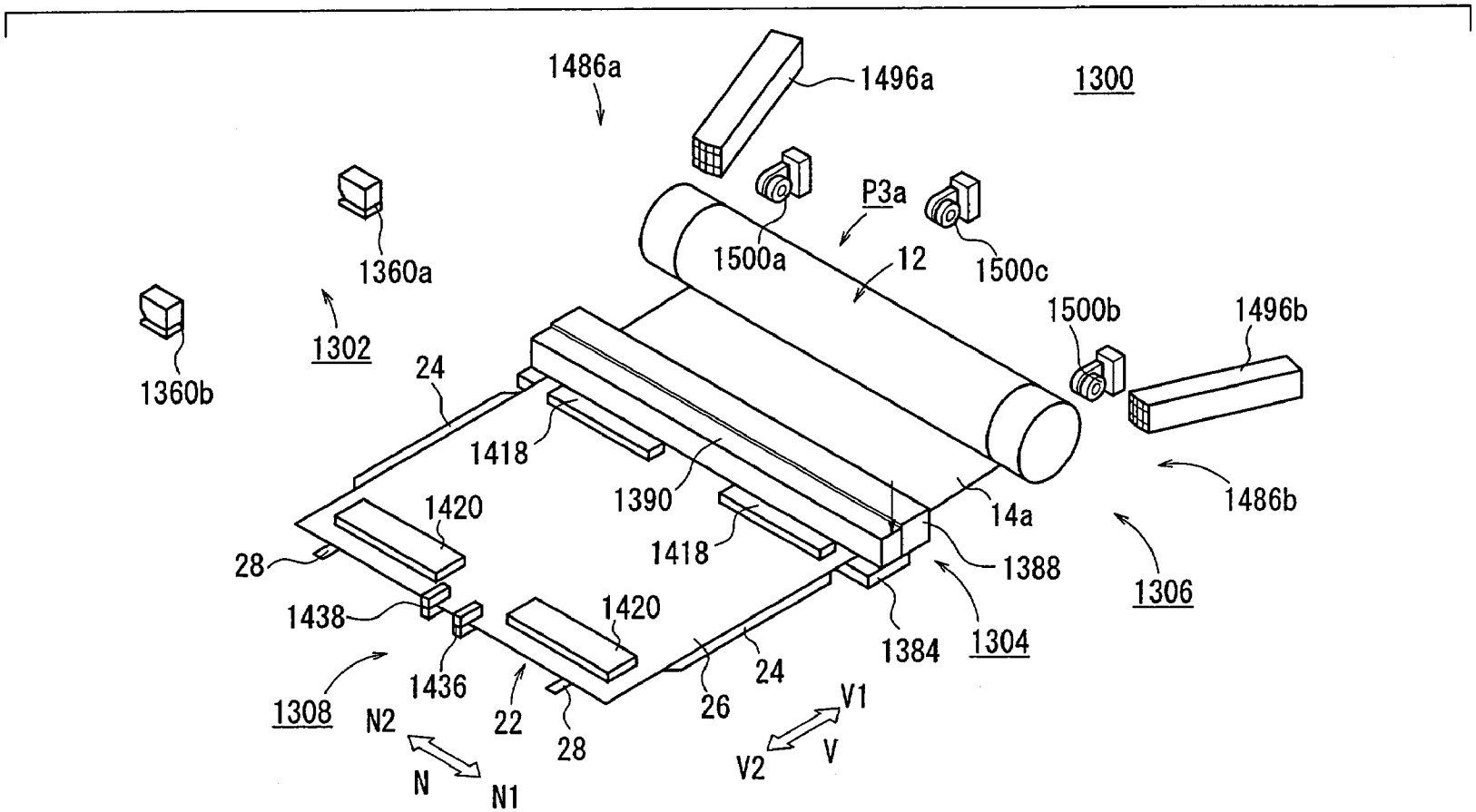
Figure 149:
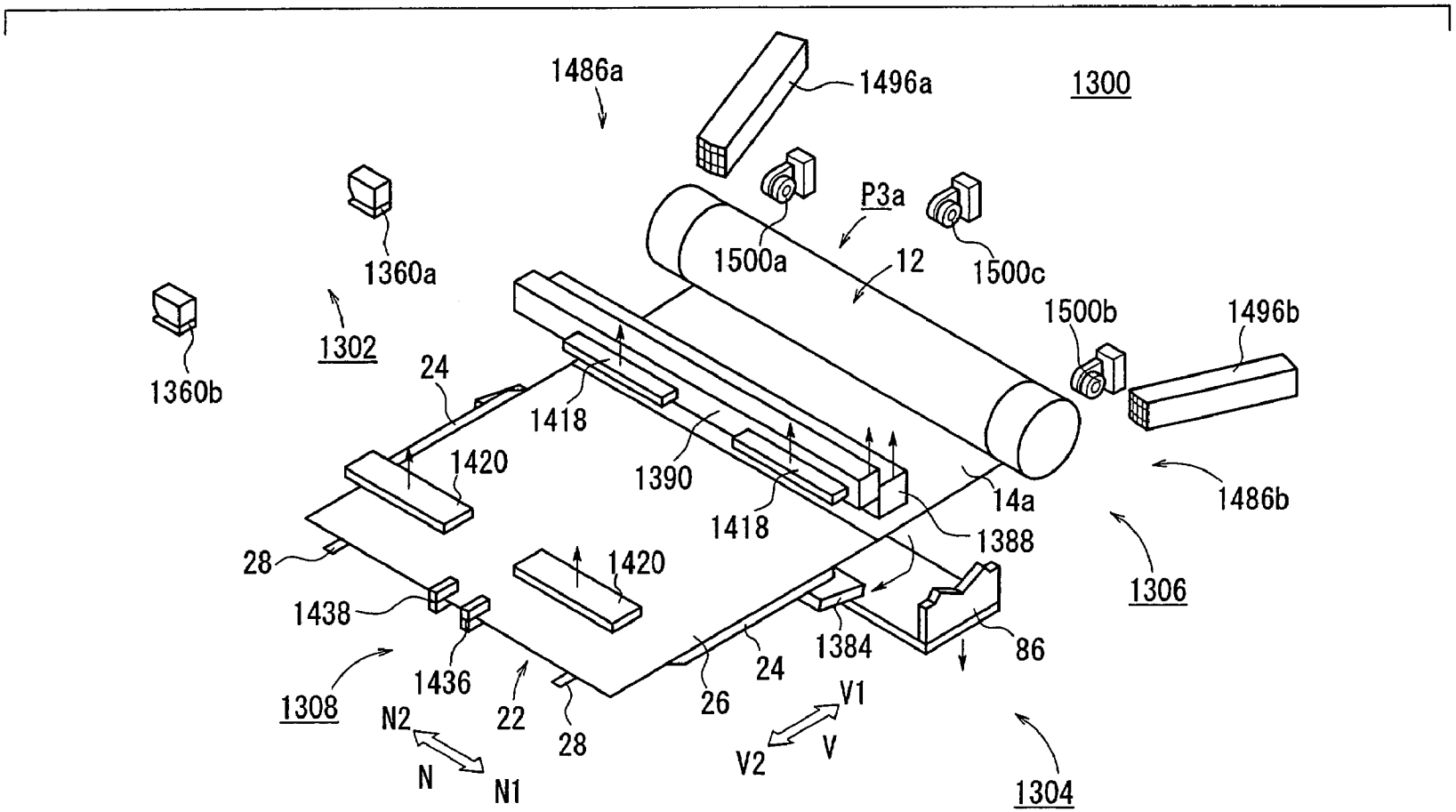
Figure 150:
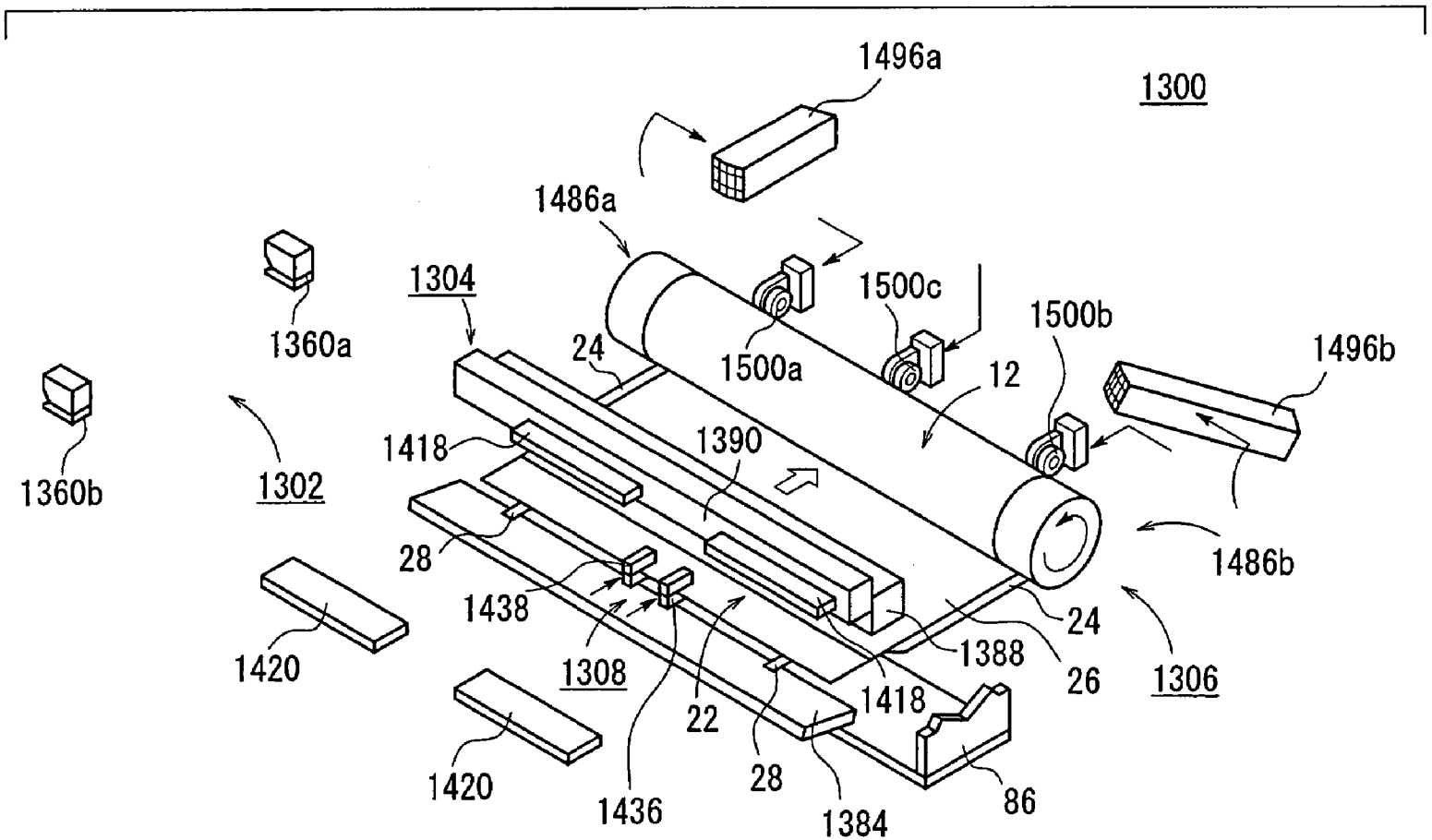
Figure 151:
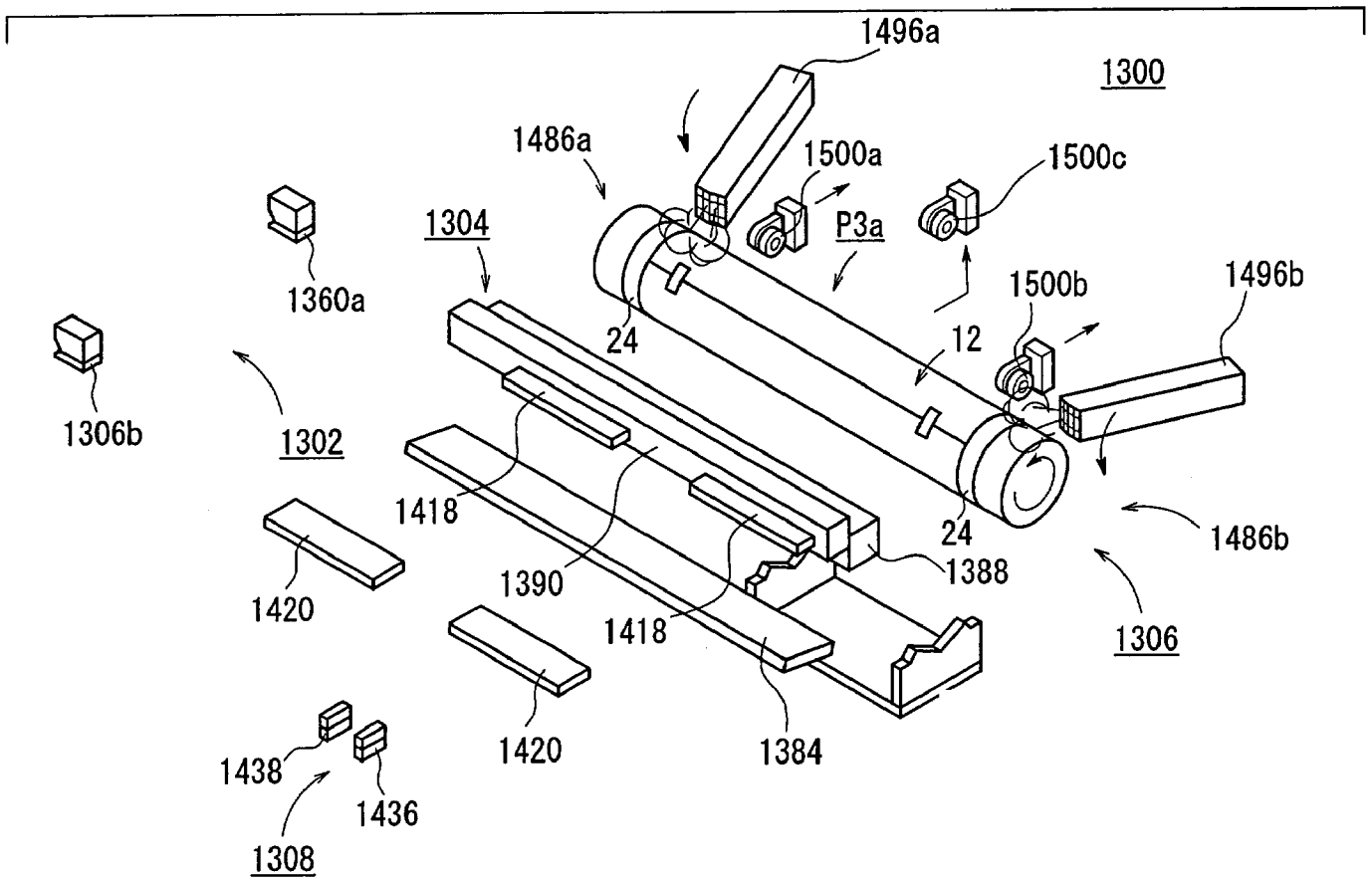
Figure 152:
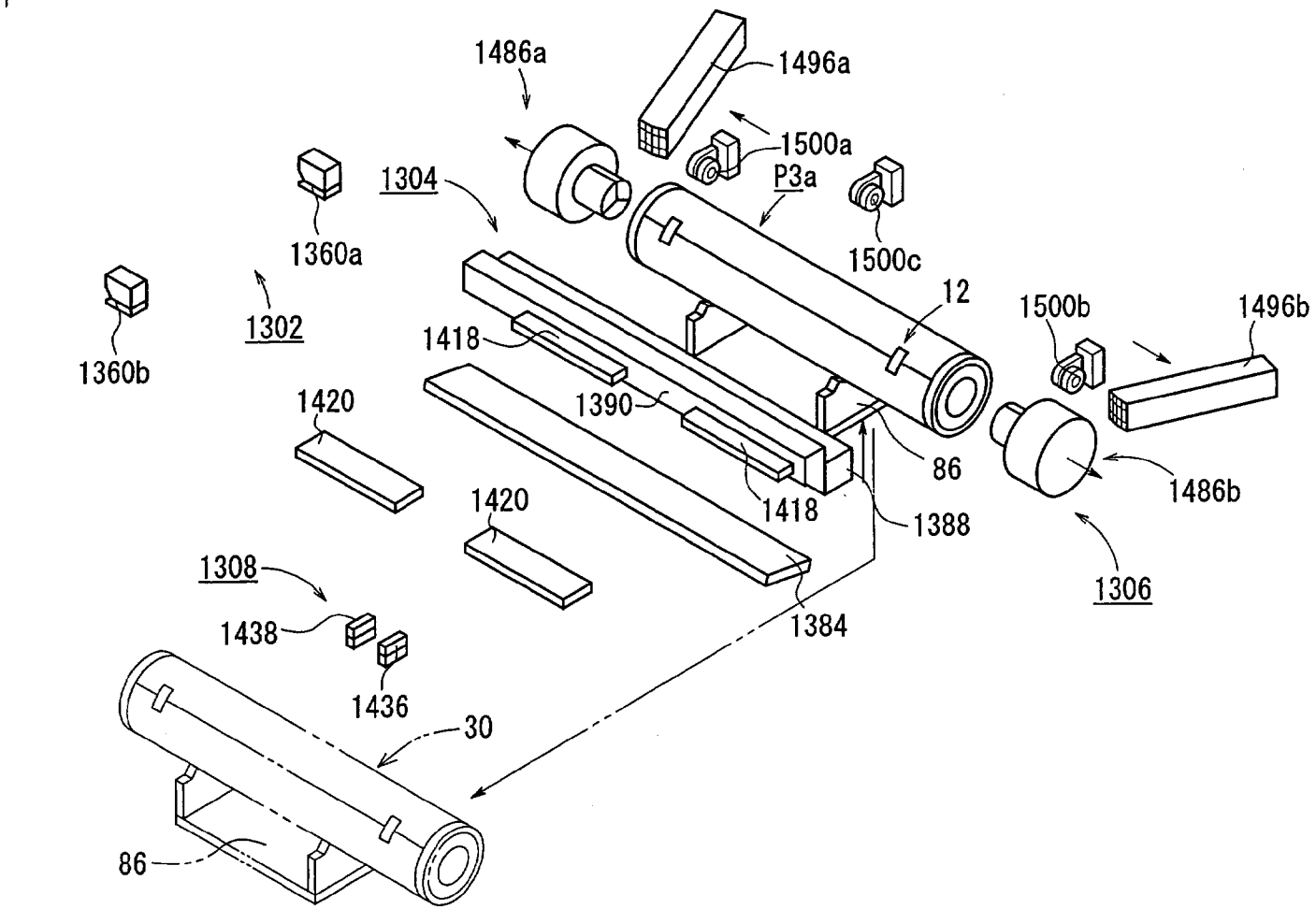
Figure 153:
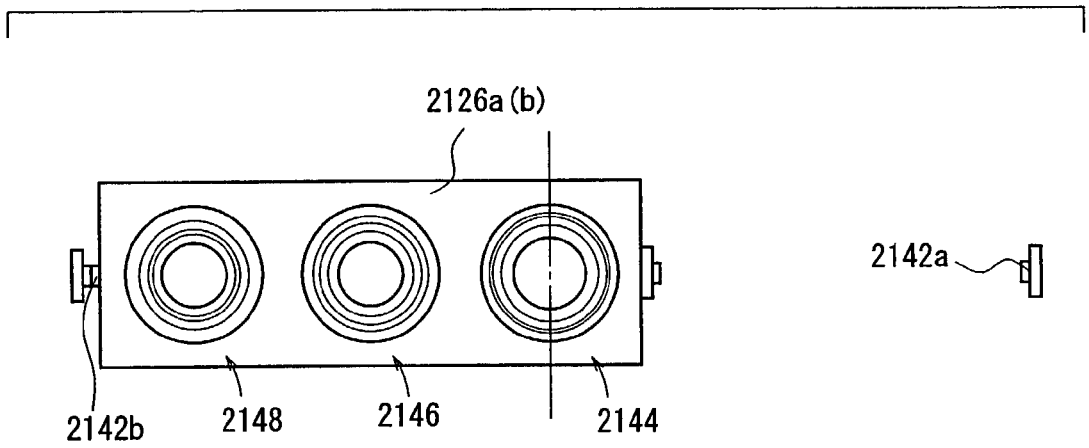
Figure 154:
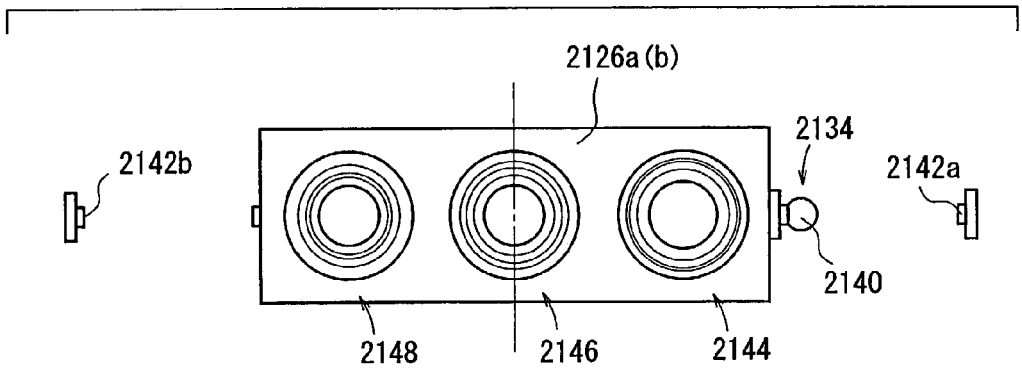
Figure 155:
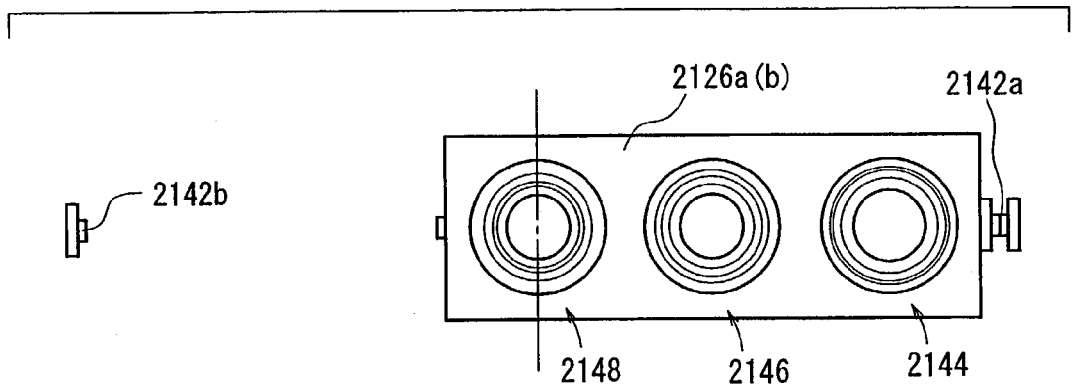
Figure 156:
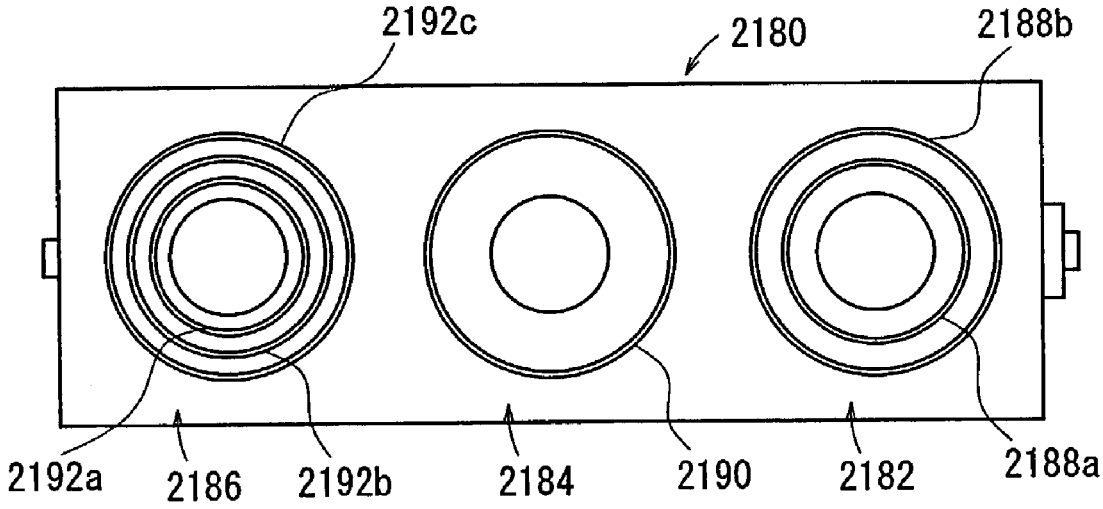
Figure 157:
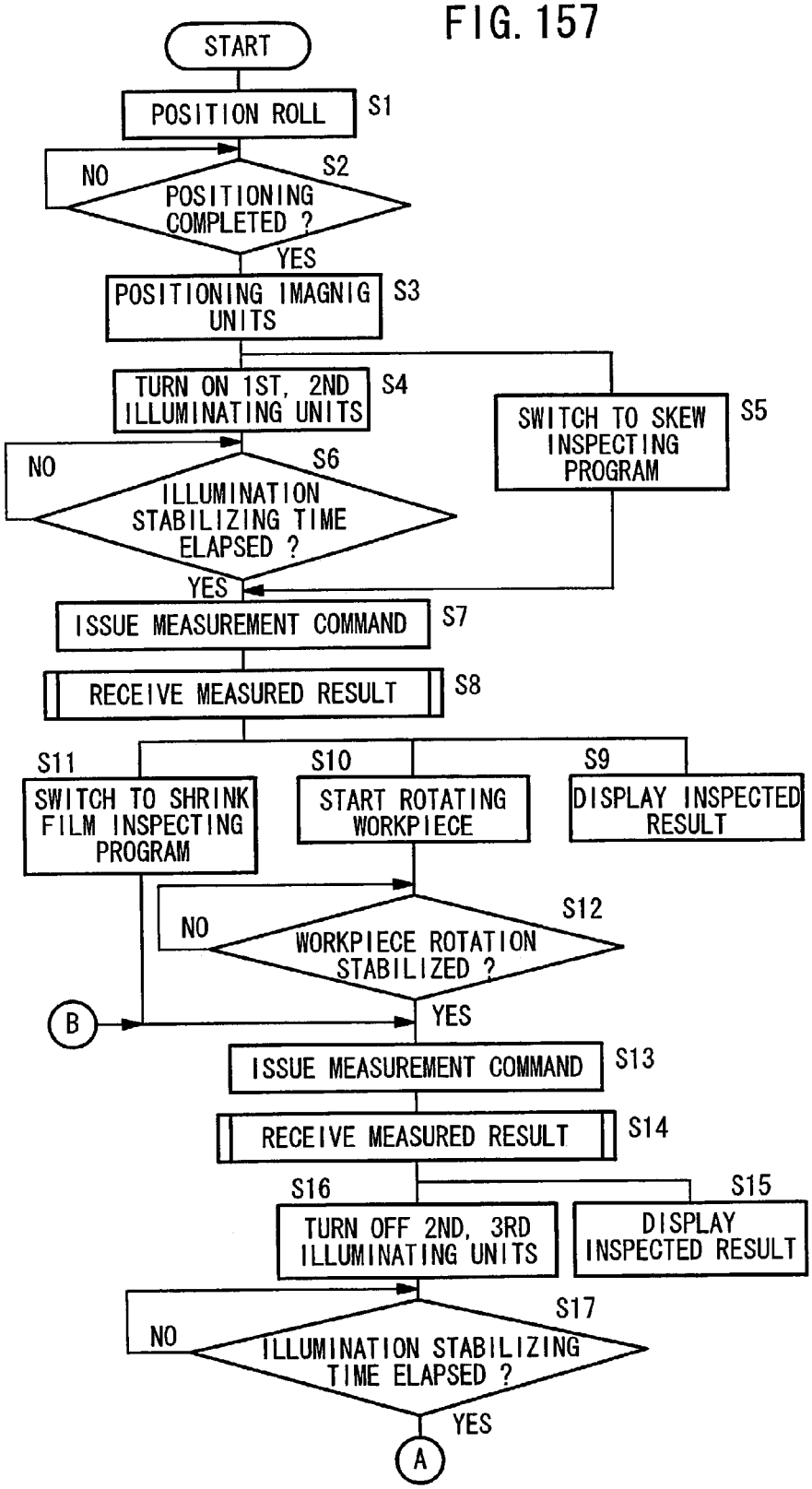
Figure 158:
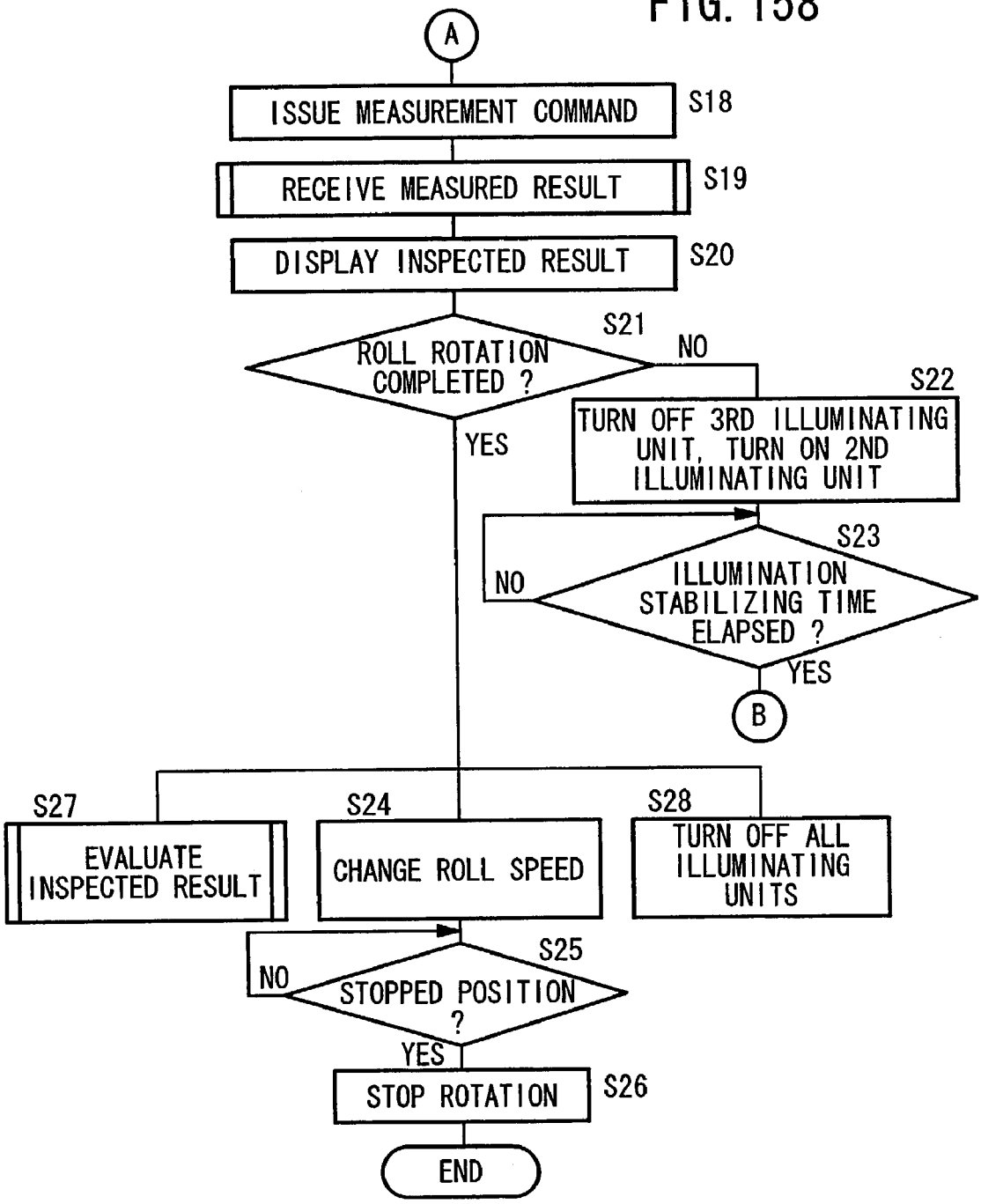
Figure 159:
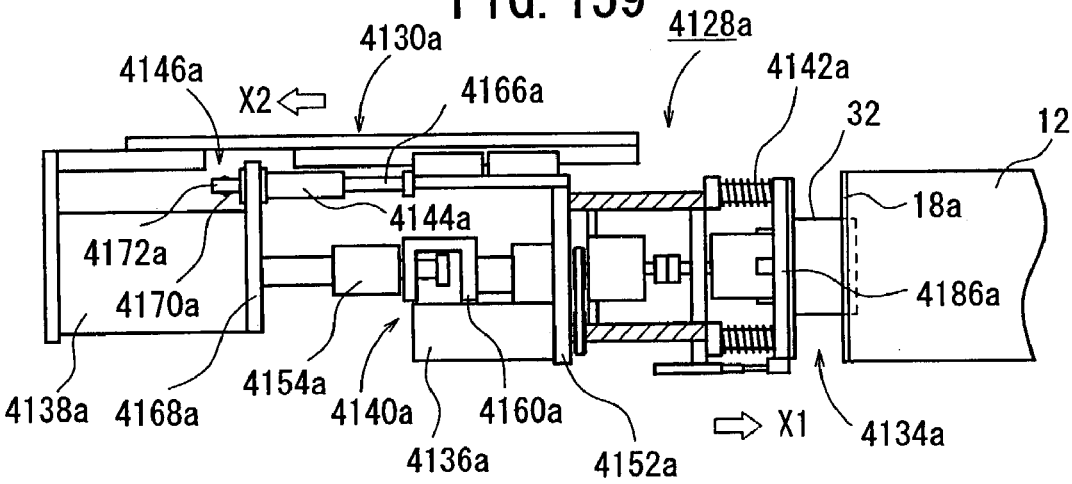
Figure 160:
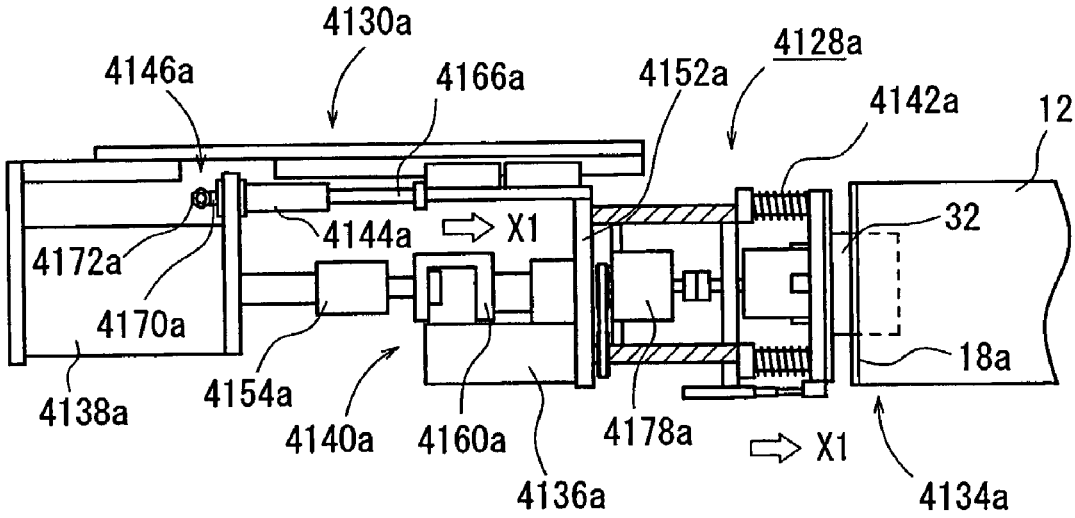
Figure 161:
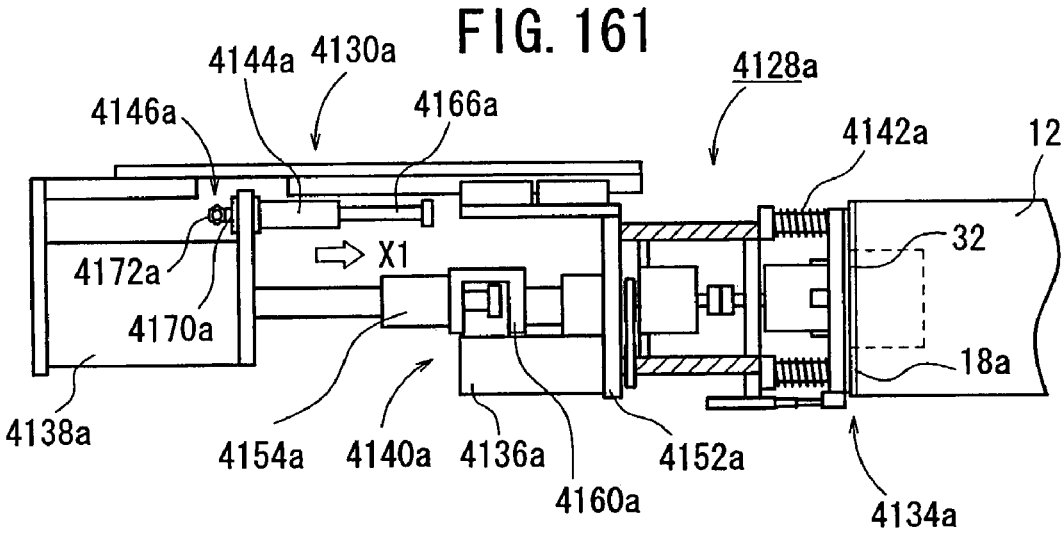
Figure 162:
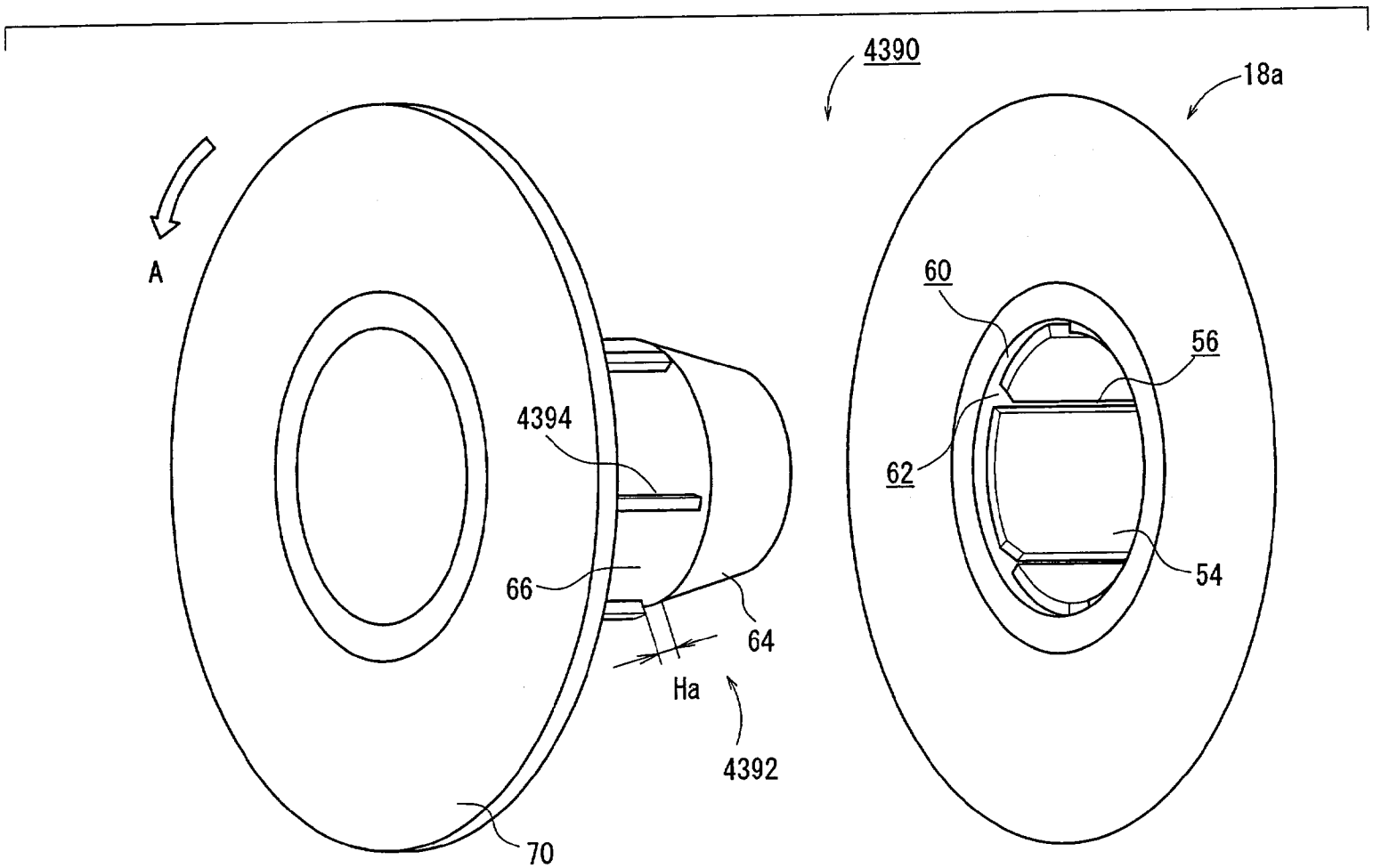
Figure 163:
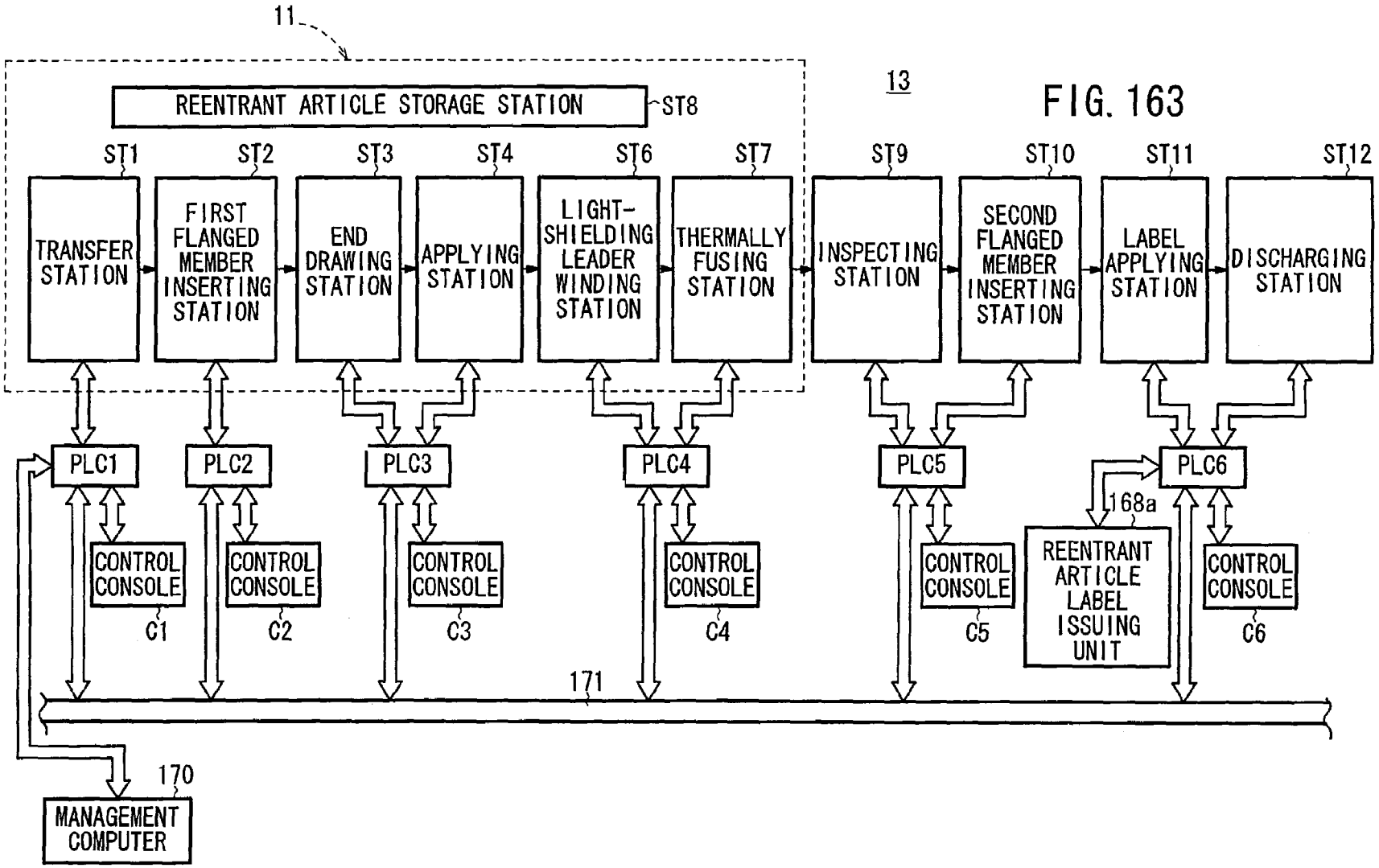
Figure 164:
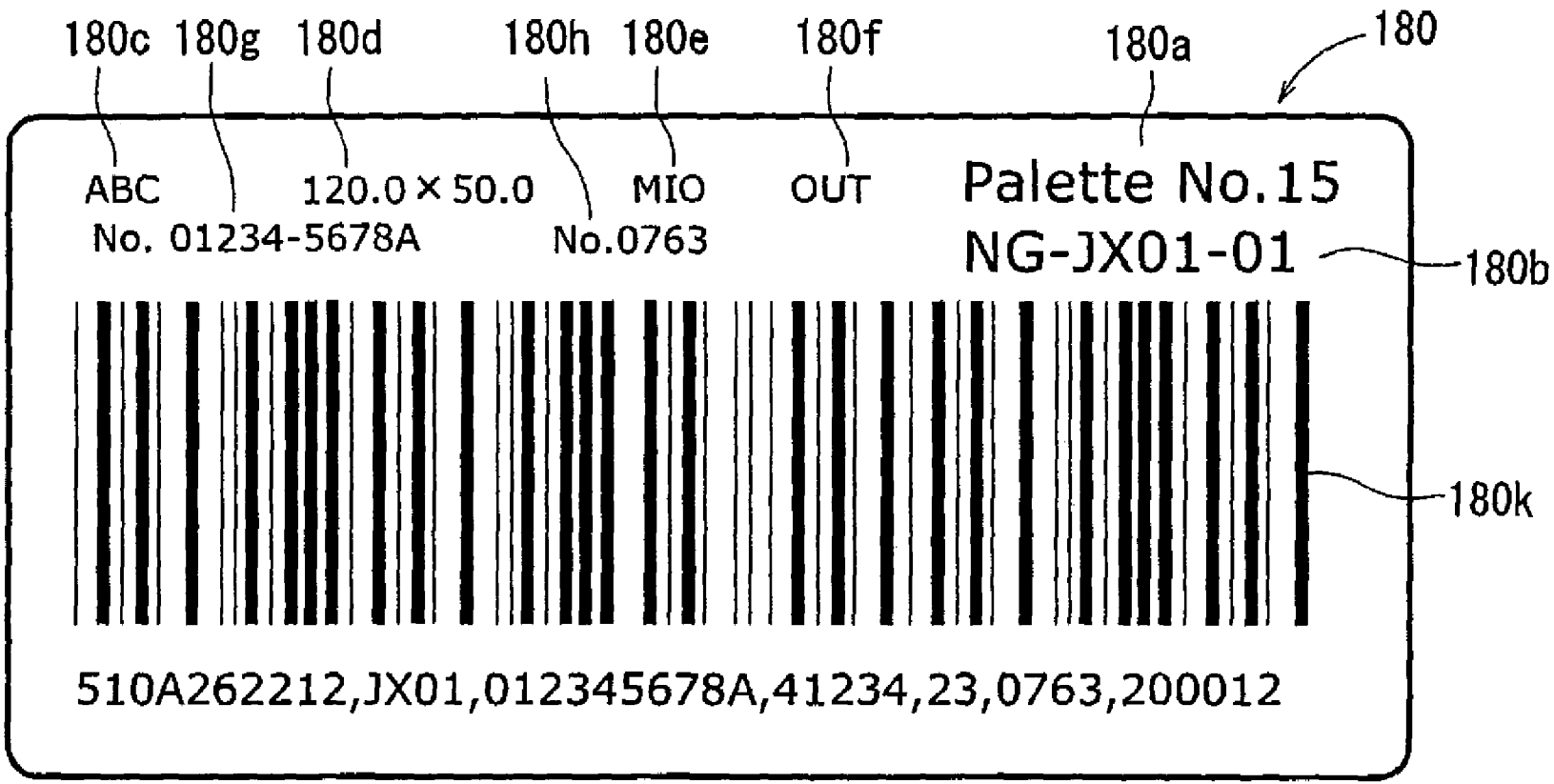
Figure 165:
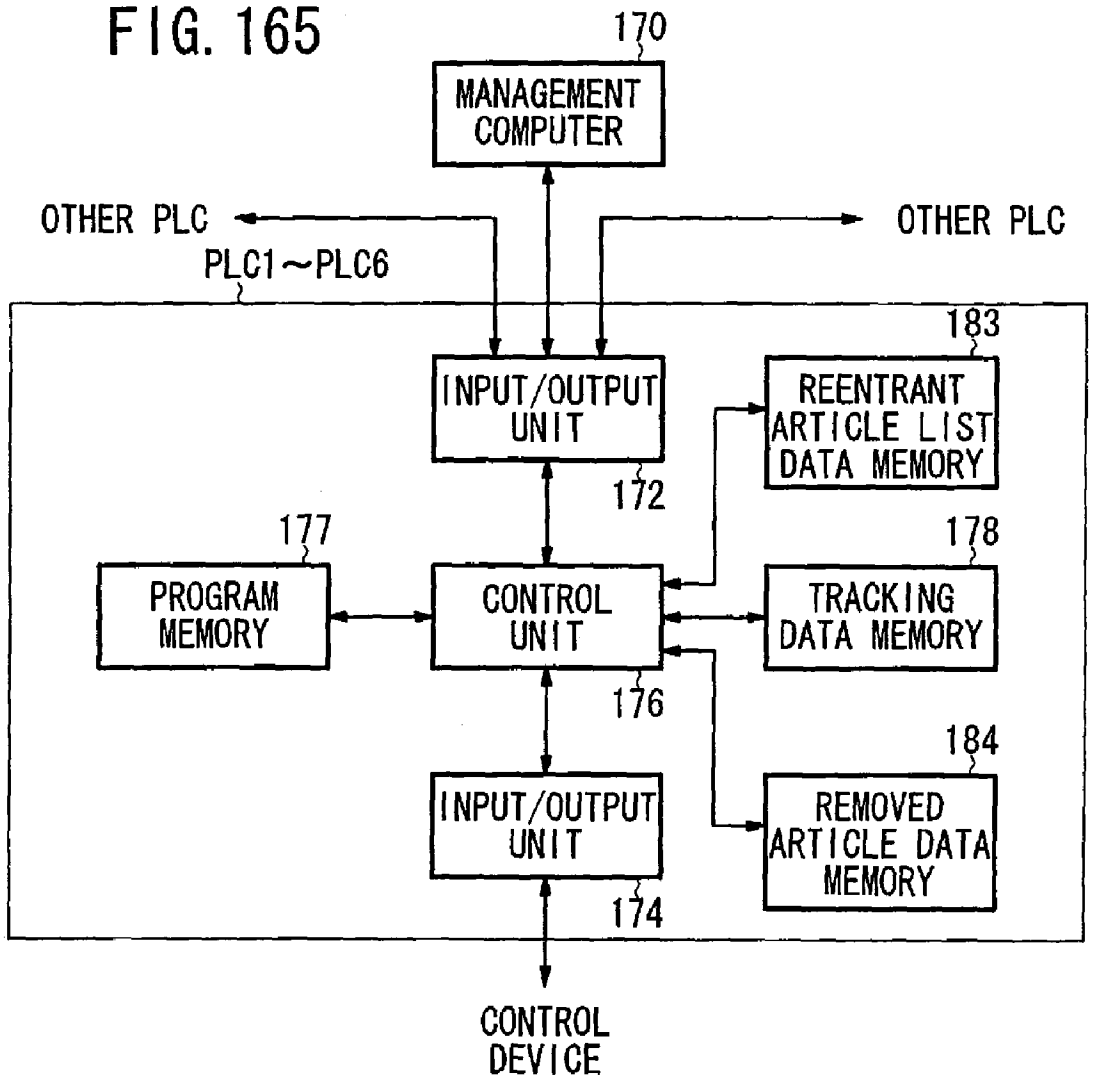
Figure 166:
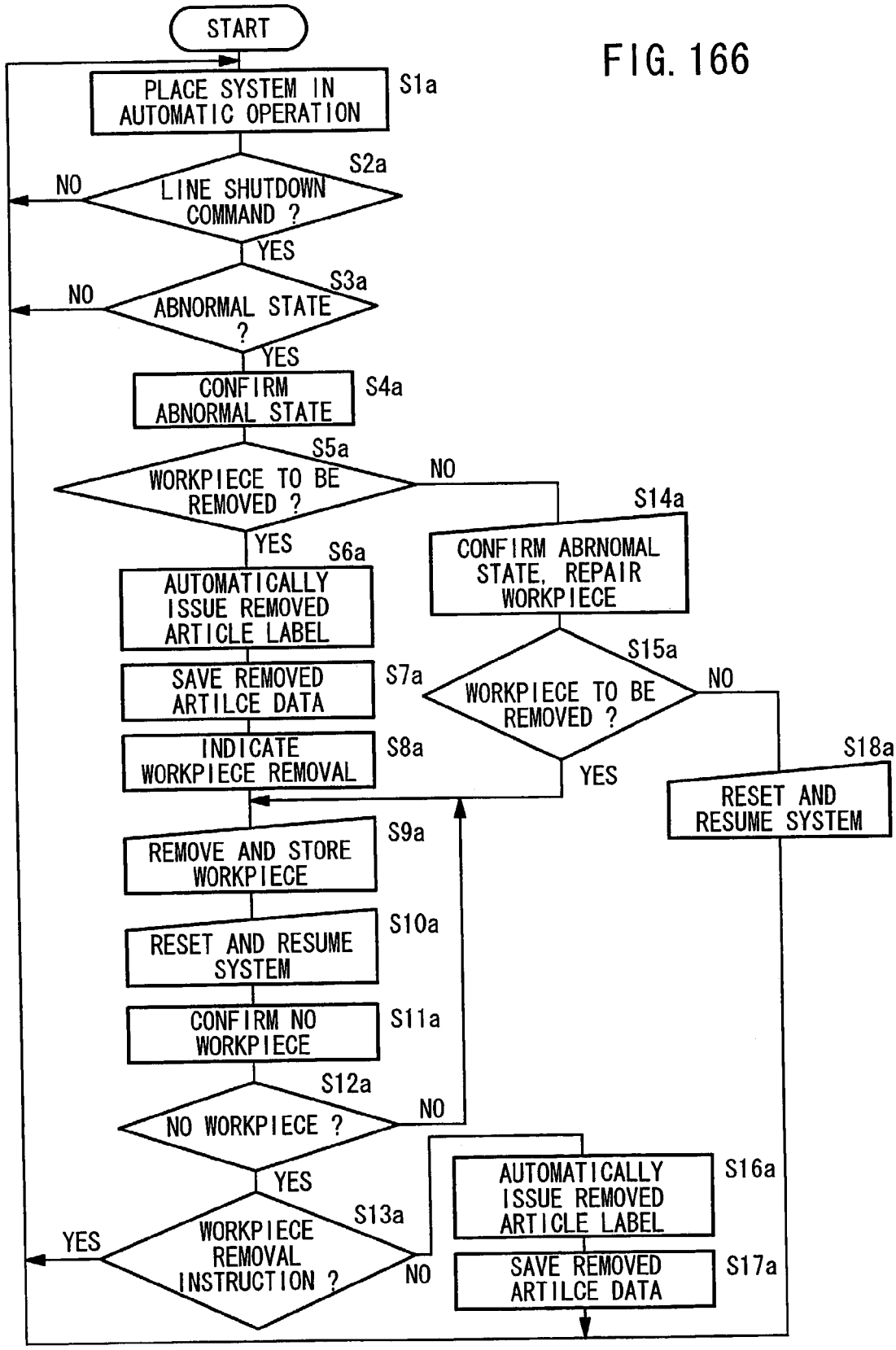
Figure 167:
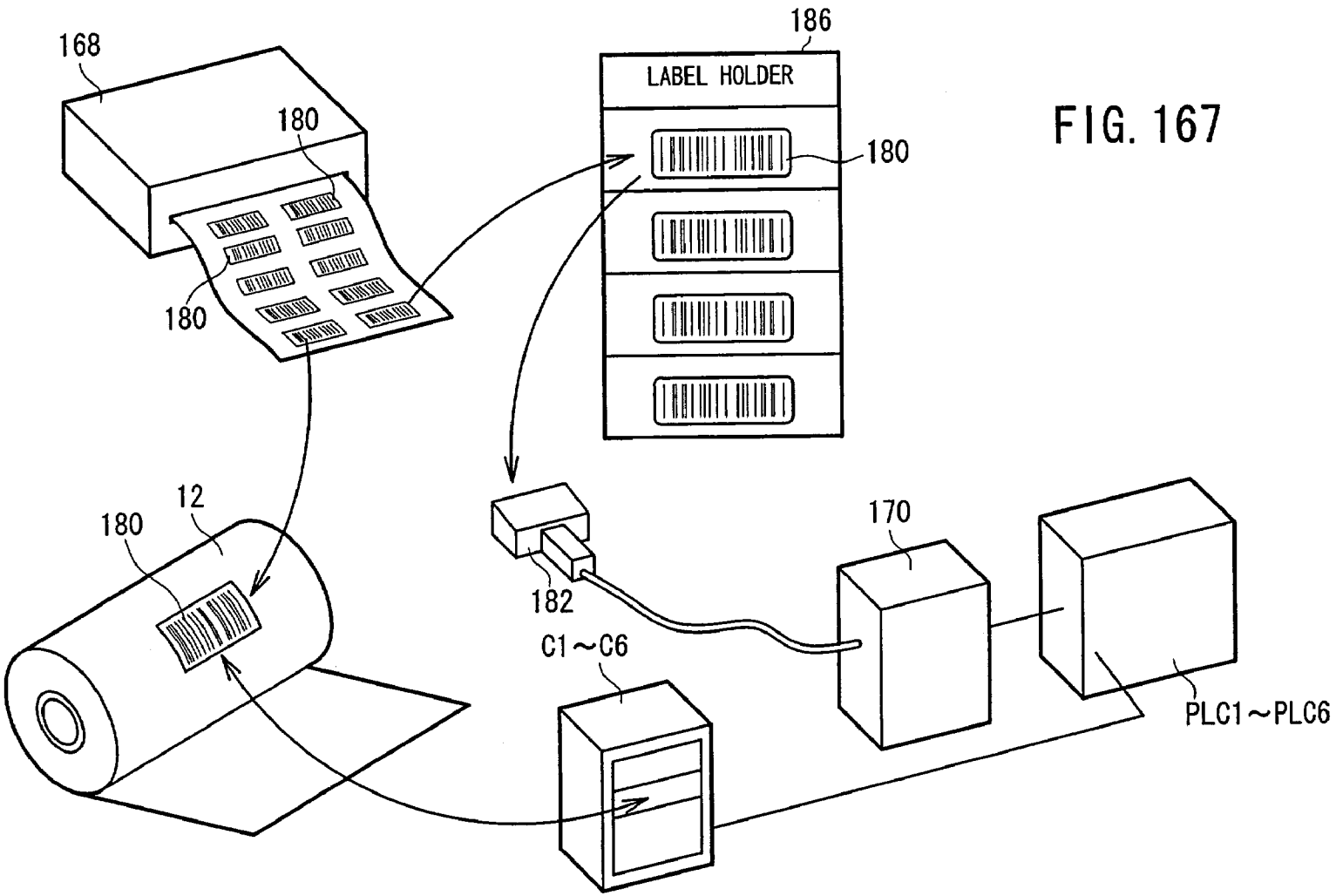
Figure 168:
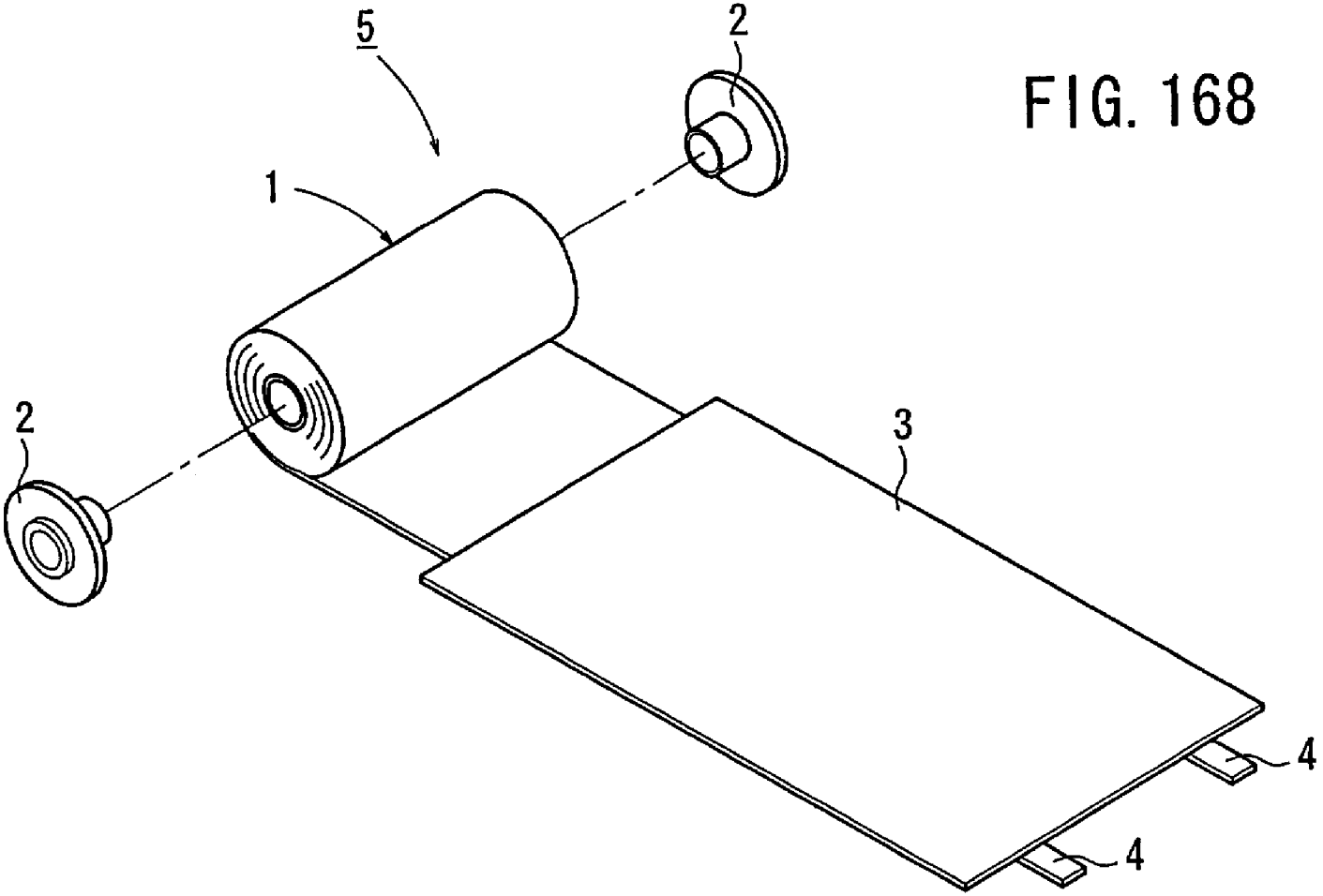

FIG. 132 is a view showing the position of the parts after the joint tape is cut off;

FIG. 133 is a perspective view showing the manner in which a strip-like skirt member is blanked;

FIG. 134 is a perspective view showing the manner in which the strip-like skirt member is cut off transversely thereacross while it is being held under suction;

FIG. 135 is a perspective view showing a joined region;

FIG. 136 is a view showing the manner in which the strip-like skirt member and a light-shielding sheet are cut off;

FIG. 137 is a view showing the manner in which cut ends of the light-shielding sheet are spaced from each other;

FIG. 138 is a view showing the manner in which a light-shielding shrink film is applied to the light-shielding sheet;

FIG. 139 is a perspective view of another working device;

FIG. 140 is a perspective view of still another working device;

FIG. 141 is a perspective view of yet another working device;

FIG. 142 is a perspective view showing the manner in which first and second pressers are lowered to press adhesive-free areas of end fastening tapes;

FIG. 143 is a perspective view showing the manner in which the end fastening tapes are held under suction by the first and second suction heads and thereafter retracted;

FIG. 144 is a perspective view showing the manner in which the end fastening tapes held by the first and second suction heads are fed to a light-shielding sheet;

FIG. 145 is a perspective view showing the manner in which a light-shielding leader is placed in a winding position;

FIG. 146 is a perspective view showing the manner in which the light-shielding leader is held by a light-shielding leader holding mechanism;

FIG. 147 is a perspective view showing the manner in which the applying mechanism operates;

FIG. 148 is a perspective view showing the manner in which the applying mechanism operates;

FIG. 149 is a perspective view showing the manner in which the light-shielding leader holding mechanism operates;

FIG. 150 is a perspective view showing the manner in which the light-shielding leader is wound;

FIG. 151 is a perspective view showing the manner in which hot air blowers operate;

FIG. 152 is a perspective view showing the manner in which a pallet is lifted after the light-shielding leader is applied;

FIG. 153 is a view showing the manner in which the first heating head is placed in a thermally fusing position;

FIG. 154 is a view showing the manner in which the second heating head is placed in the thermally fusing position;

FIG. 155 is a view showing the manner in which the third heating head is placed in the thermally fusing position;

FIG. 156 is a front elevational view of a slide plate having another structure;

FIGS. 157 and 158 are flowchart of an operation sequence of the packaged state inspecting device;

FIG. 159 is a view showing the manner in which the second flanged member held by the insertion head is brought into abutment against a first flanged member;

FIG. 160 is a view showing the manner in which the insertion head is turned to bring ridges and grooves into alignment with each other;

FIG. 161 is a view showing the manner in which the second flanged member is inserted into the first flanged member;

FIG. 162 is an exploded perspective view of another flanged structure;

FIG. 163 is a block diagram showing the relationship between working stations and a control system thereof in an automatic packaging system according to a second embodiment of the present invention;

FIG. 164 is a view of a removed workpiece label which is issued by a removed workpiece label issuing unit shown in FIG. 163;

FIG. 165 is a block diagram of a programmable controller;

FIG. 166 is a flowchart of a workpiece removing process carried out by the automatic packaging system;

FIG. 167 is a schematic perspective view showing the concept of the workpiece removing process carried out by the automatic packaging system; and FIG. 168 is an exploded perspective view of a conventional photosensitive roll.

DESCRIPTION OF THE PREFERRED EMBODIMENTS

Figure 1:
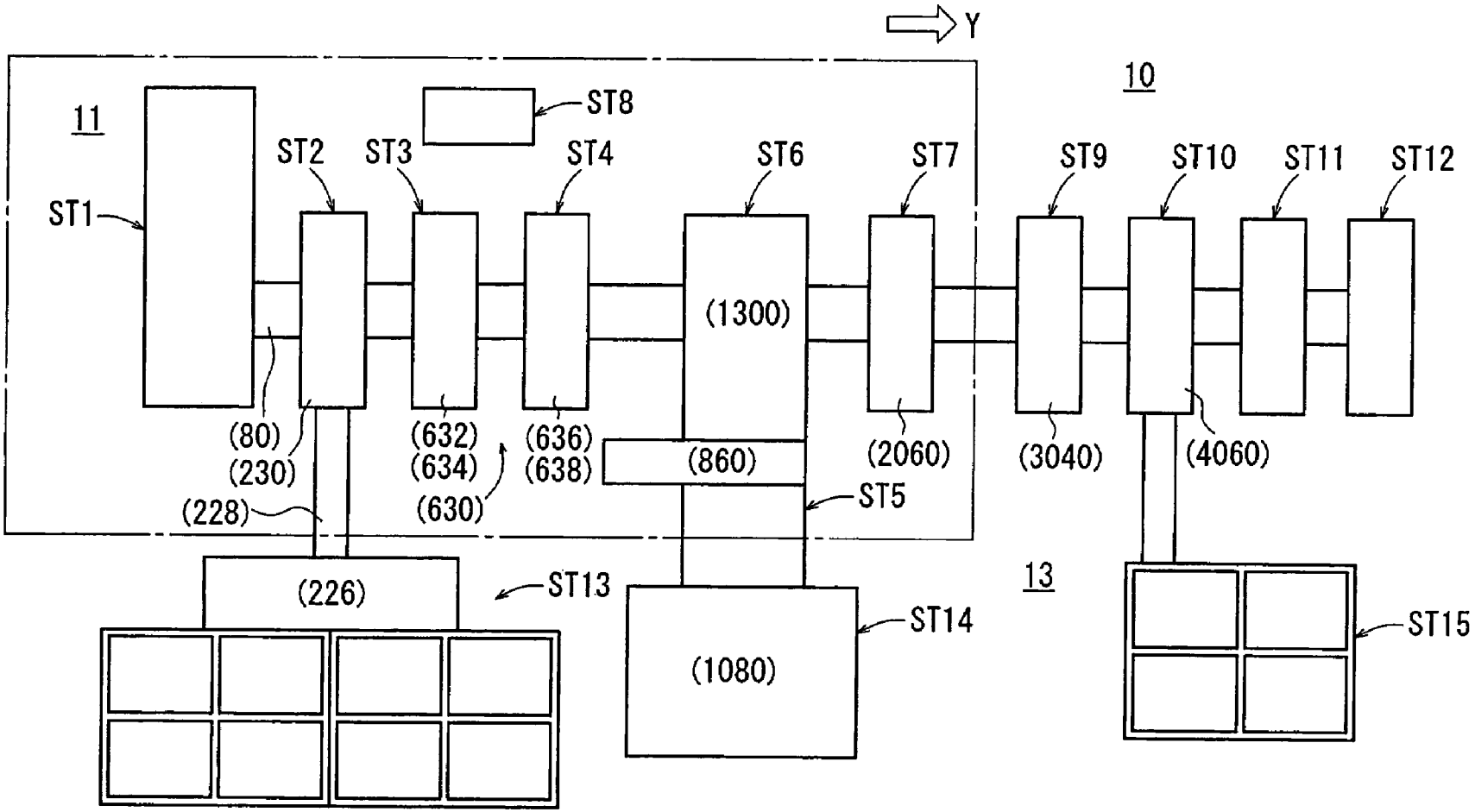
FIG. 1 is a block diagram of an automatic packaging system for carrying out a method of automatically packaging a roll according to a first embodiment of the present invention.
Figure 2:
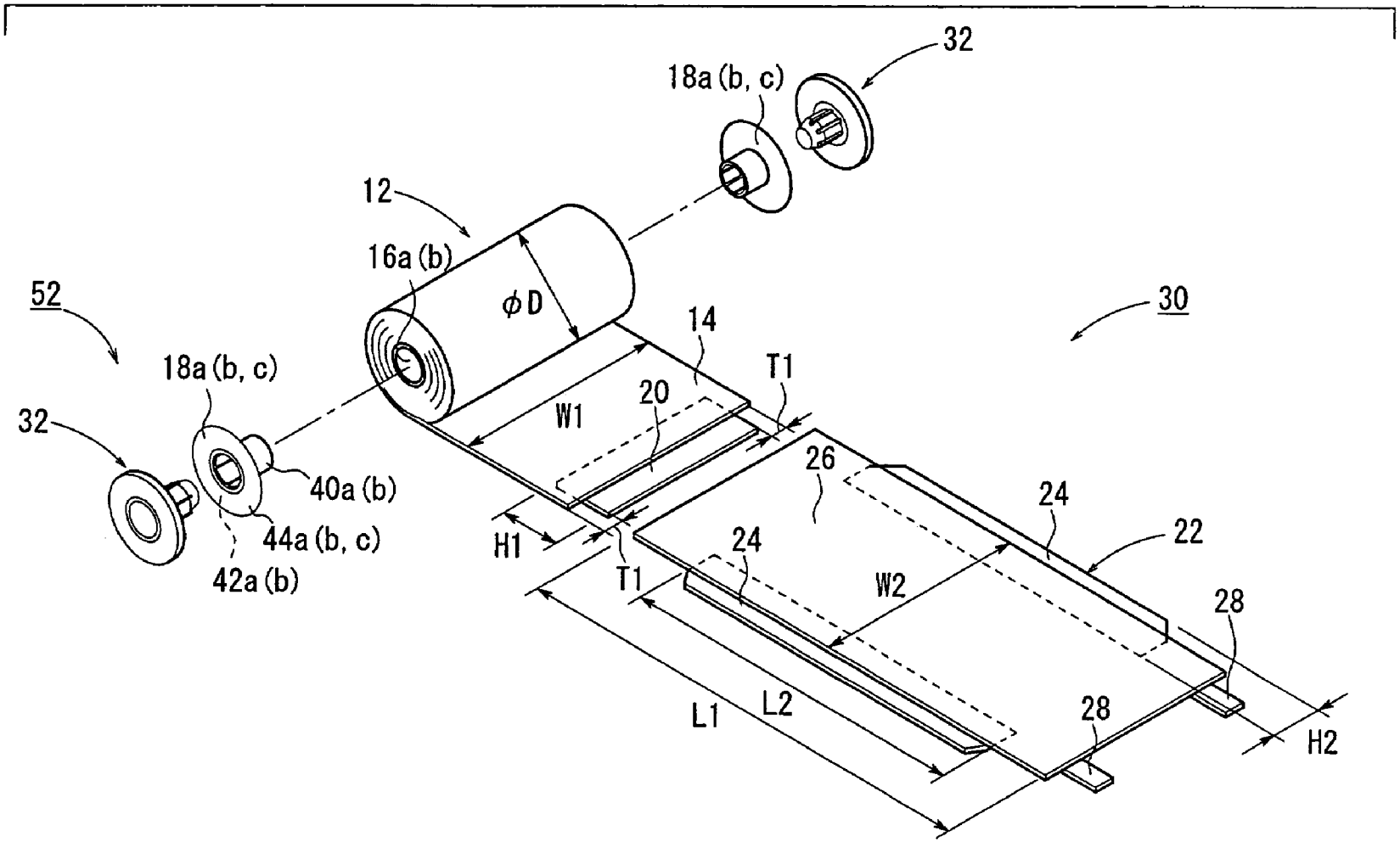
FIG. 2 is an exploded perspective view of a photosensitive material roll as the roll.

FIG. 1 shows in block form an automatic packaging system 10 for carrying out a method of automatically packaging a rolled article according to a first embodiment of the present invention, and FIG. 2 shows in exploded perspective view a photosensitive roll 30 to be automatically packaged by the automatic packaging system 10.

The automatic packaging system 10 has various working stations disposed in a dark chamber 11 which include a transfer station ST1 for transferring a photosensitive roll 12 comprising an elongate photosensitive sheet 14 wound around a core 16*a* or 16*b*, a first flanged member inserting station ST2 for assembling first flanged members (light-shielding members) 18*a*, 18*b*, or 18*c* (hereinafter referred to as "first flanged members 18*a*") on respective opposite ends of the photosensitive roll 12, an end drawing station ST3 for drawing an end 14*a* of the photosensitive sheet 14 to a prescribed length, an applying station ST4 for applying a joint tape 20 to the end 14*a* as drawn to the prescribed length, a light-shielding leader assembling station ST5 for applying light-shielding shrink films (skirt members) 24 as packaging members to transversely opposite edges of a light-shielding sheet (sheet member) 26 and applying a pair of end fastening tapes 28 to the leading end of the light-shielding sheet 26, thus assembling a light-shielding leader (packaging sheet) 22, a light-shielding leader winding station ST6 for winding the light-shielding leader 22 around the photosensitive roll 12 after the light-shielding leader 22 is applied to the end 14*a*, a thermally fusing station ST7 for thermally fusing (bonding) the light-shielding shrink films 24 to respective opposite outer circumferential edges of the photosensitive roll 12, and a reentrant article storage station ST8 for temporarily storing a photosensitive roll 12 for reentry after the photosensitive roll 12 is removed from a working station for the reason of some fault or checking purpose.

The automatic packaging system 10 also has an inspecting station ST9 for inspecting a light-shielded photosensitive roll 30 manufactured in the dark chamber 11 for its light-shielded state, a second flanged member inserting station ST10 for inserting hard second flanged members 32 into respective opposite ends of the light-shielded photosensitive roll 30, a label applying station ST11 for applying a product label (not shown) printed with product information of the light-shielded photosensitive roll 30, and a discharging station ST12 for discharging the light-shielded photosensitive roll 30 to a next working station. These stations ST9, ST10, ST11, ST12 are successively arrayed in the direction indicated by the arrow Y along a path extending from the dark chamber 11 into a bright chamber 13.

The first flanged member inserting station ST2 is associated with a first flanged member assembling station ST13 for selecting caps and rings from two types of caps 40*a*, 40*b* and three types of rings 44*a*, 44*b*, 44*c* depending on the diameter of the core of the photosensitive roll 12 and assembling first flanged members 18*a* through 18*c*. The light-shielding leader assembling station ST5 is associated with a leader feeding station ST14 for feeding out a rolled strip-like light-shielding sheet (described later on). The second flanged member inserting station ST10 is associated with a hard flanged member supplying station ST15 for supplying the second flanged members 32.

As shown in FIG. 2, the first flanged members 18*a*, 18*b*, or 18*c* comprise caps 40*a* or 40*b* to be fitted into the respective ends of a core 16*a* or 16*b*, and rings 44*a*, 44*c*, or 44*b* fixedly bonded (heat-sealed) to respective flanges 42*a* or 42*b* of the caps 40*a* or 40*b*. The cores 16*a*, 16*b* have a diameter of 2 inches or 3 inches, for example.

The light-shielding leader 22 comprises a light-shielding sheet 26 and two light-shielding shrink films 24 applied to transversely opposite edges of the light-shielding sheet 26. The light-shielding sheet 26 and the photosensitive sheet 14 are joined to each other by a joint tape 20. A pair of laterally spaced end fastening tapes 28 is attached to the leading end of the light-shielding sheet 26. The light-shielding leader 22 is wound around the photosensitive roll 12 and fastened thereto by the end fastening tapes 28, thus making up the light-shielded photosensitive roll 30. The light-shielding leader 22 and the light-shielding shrink films 24 may be integrally formed of the material of the light-shielding shrink films 24.

In the present embodiment, the joint tape 20 has a width H1 of 25 mm, for example, and includes a substantially half portion projecting from the end of the photosensitive sheet 14, the substantially half portion having a width which is substantially half the width H1, i.e., a width of 12.5 mm±1 mm. The remaining half portion of the joint tape 20 is to be bonded to the end of the photosensitive sheet 14 and has a width of 12.5 mm. The joint tape 20 has opposite ends spaced inwardly from the transversely opposite edges of the photosensitive sheet 14 by a distance T1 in the range from 0 to 10 mm.

The photosensitive roll 12 has a diameter D, the photosensitive sheet 14 has a width W1, the light-shielding sheet 26 has a width W2 and a length L1, and each of the light-shielding shrink films 24 has a width H2 and a length L2. The width W2 is substantially equal to the width W1 (W2≈W1) or slightly greater than the width W1 (W2>W1). The length L2 is related to the diameter D by L2>3.14×D, and the lengths L1, L2 are related to each other by L1>L2+200 mm.

The light-shielding sheet 26 has an end superposed on and bonded to the end 14*a* of the photosensitive sheet 14 by the joint tape 20, the bonded end of the light-shielding sheet 26 having a width of about 20 mm. The width H2 of each of the light-shielding shrink films 24 is set to 25 mm, for example, and the light-shielding shrink films 24 have respective outer edges projecting outwardly from the outer edges of the light-shielding sheet 26 by a distance of 9 mm. The length L1 of the light-shielding sheet 26 is set to 900 mm, for example, and the length L2 of each of the light-shielding shrink films 24 is set to 500 mm or 600 mm, for example.

Figure 3:
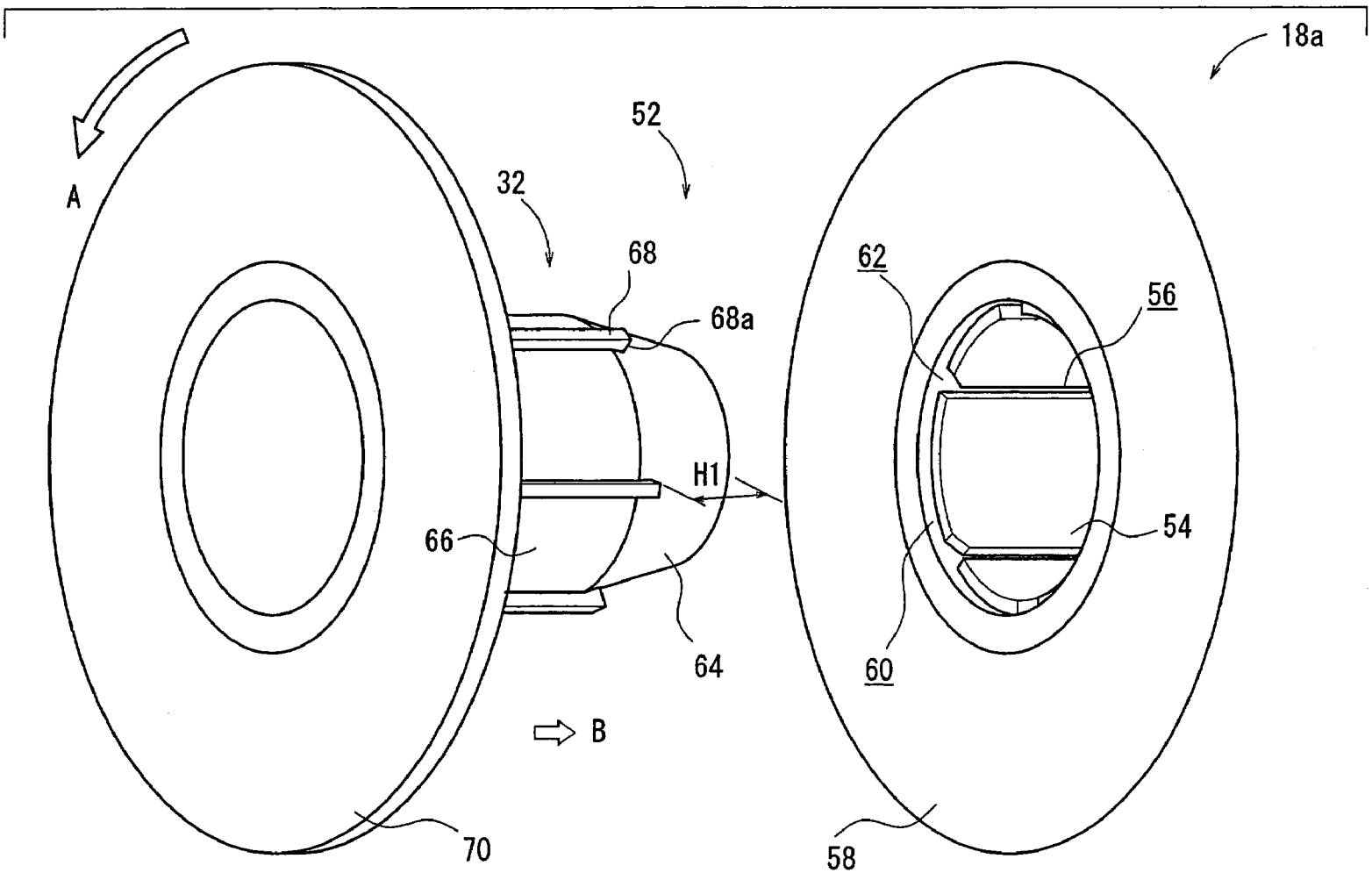
FIG. 3 is an exploded perspective view of a flanged structure.
Figure 4:
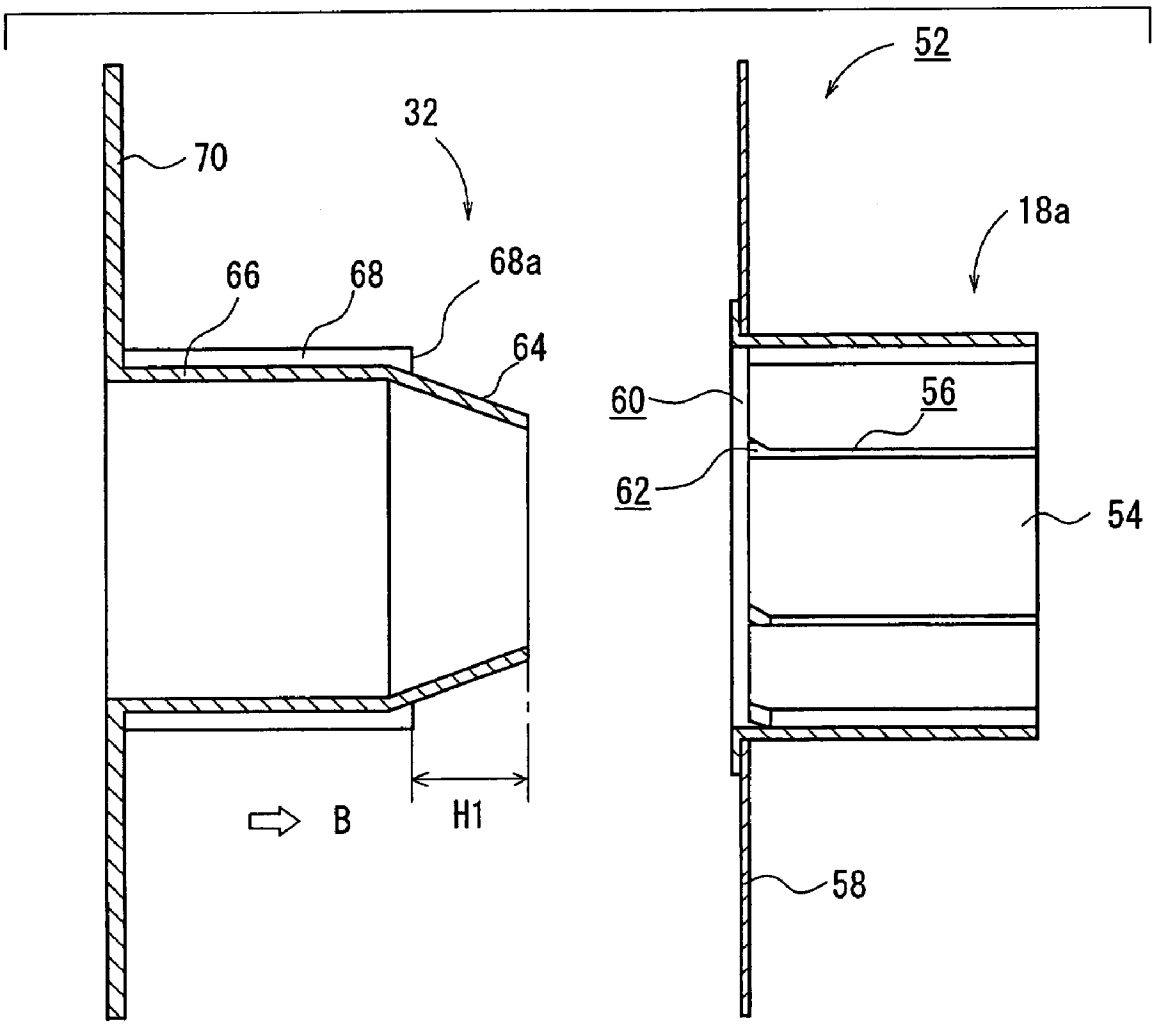
FIG. 4 is a cross-sectional view of the flanged structure.

The second flanged member 32 which is harder than the first flanged member 18*a* is inserted into the first flanged member 18*a*, making up a flanged structure 52. As shown in FIGS. 3 and 4, the first flanged member 18*a* has a plurality of (e.g., six) angularly spaced, axially extending grooves 56 defined in an inner circumferential surface 54 thereof, and a step 60 of increased diameter disposed on the inner circumferential surface 54 closer to a flange 58 at an end into which the second flanged member 32 is to be inserted. The inner circumferential surface 54 has guide recesses 62 defined therein which extend obliquely from the step 60 toward the respective ends of the grooves 56 in the direction indicated by the arrow A in which the second flanged member 32 is rotated upon insertion into the first flanged member 18*a*.

The second flanged member 32 has, on an outer circumferential surface thereof, a tapered tip 64 which is progressively smaller in diameter toward the tip end thereof in a direction in which the second flanged member 32 is inserted into the first flanged member 18*a*, and a straight barrel 66 contiguous from a larger-diameter end of the tapered tip 64. The second flanged member 32 also has, disposed on the straight barrel 66, a plurality of (e.g., six) angularly spaced, axially extending ridges 68 extending axially along the straight barrel 66 toward a flange 70 in alignment with the grooves 56. The ridges 68 have respective straight end faces 68*a* spaced axially from the smaller-diameter tip end of the tapered tip 64 toward the straight barrel 66 by a given distance H1 smaller than the full length of the tapered tip 64, i.e., positioned substantially at the larger-diameter end of the tapered tip 64, and extending radially outwardly to respective radial positions corresponding to the diameter of the step 60 of the first flanged member 18*a*.

Figure 5:
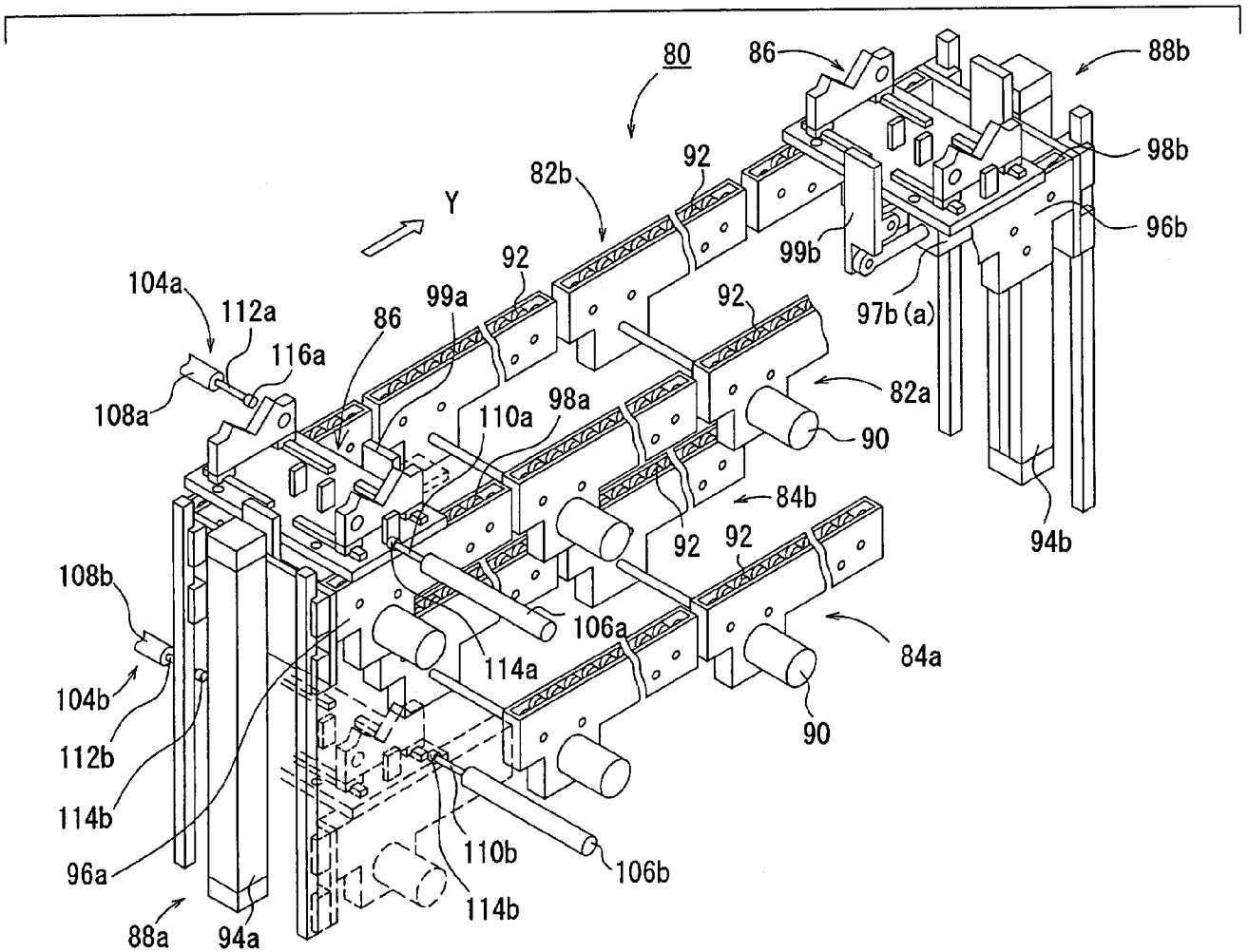
FIG. 5 is a perspective view of a feed device for feeding a pallet.

As shown in FIG. 5, a succession of photosensitive rolls 12 are fed in the direction indicated by the arrow Y by a feed device 80. The feed device 80 has upper feed conveyors 82*a*, 82*b* spaced a predetermined distance from each other and extending parallel to each other, lower feed conveyors 84*a*, 84*b* spaced a predetermined distance from each other and extending parallel to each other, and first and second lifters 88*a*, 88*b* for transferring pallets 86 which support respective photosensitive rolls 12 thereon between the upper feed conveyors 82*a*, 82*b* and the lower feed conveyors 84*a*, 84*b*.

The upper feed conveyors 82*a*, 82*b* and the lower feed conveyors 84*a*, 84*b* are divided into a plurality of segments for keeping themselves out of interference with photosensitive rolls 12 when the photosensitive rolls 12 are processed. The divided segments of the upper feed conveyors 82*a*, 82*b* and the lower feed conveyors 84*a*, 84*b* are actuated by respective motors 90. Each of the upper feed conveyors 82*a*, 82*b* and the lower feed conveyors 84*a*, 84*b* has a plurality of rotatable rollers 92 for holding pallets 86 in given positions while they are in operation.

The first and second lifters 88*a*, 88*b* have respective first and second bases 96*a*, 96*b* that are vertically movable by respective first and second cylinders 94*a*, 94*b*. The first and second bases 96*a*, 96*b* have a pair of left and right endless conveyors 98*a*, 98*b* that can travel in circulation, and respective swing arms 99*a*, 99*b* for pressing and holding pallets 86 with respective cylinders 97*a*, 97*b*.

Figure 6:
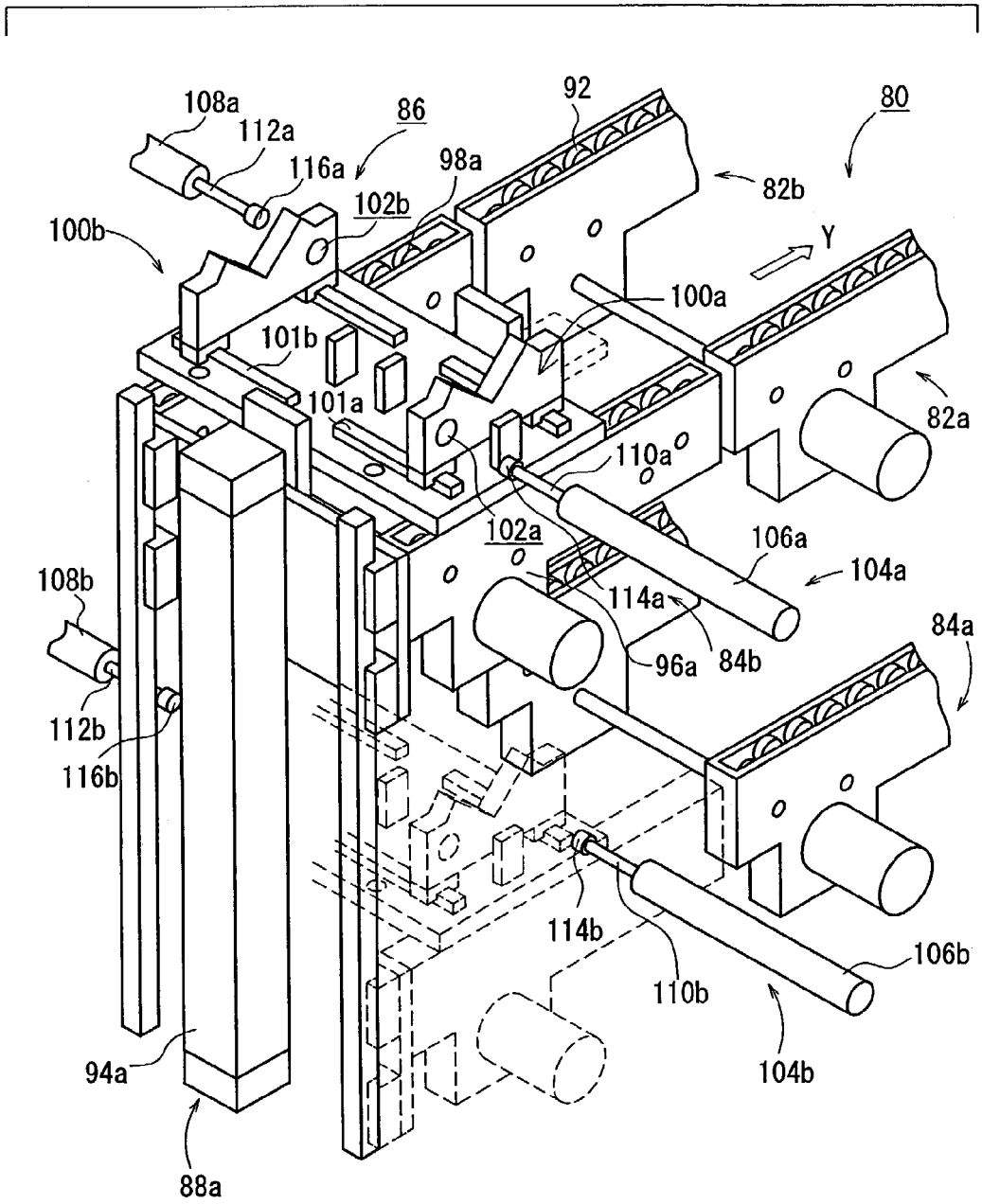
FIG. 6 is a perspective view of the feed device.

As shown in FIG. 6, each of the pallets 86 has a pair of placement bases 100*a*, 100*b*, each having a substantially V-shaped cross section, movably disposed thereon by rails 101*a*, 101*b*. A photosensitive roll 12 is placed on the placement bases 100*a*, 100*b*. The placement bases 100*a*, 100*b* have holes 102*a*, 102*b* defined respectively therein at positions offset from each other. First and second base actuating mechanisms 104*a*, 104*b* for adjusting the distance between the placement bases 100*a*, 100*b* are disposed in upstream positions on the upper feed conveyors 82*a*, 82*b* and the lower feed conveyors 84*a*, 84*b* in the direction indicated by the arrow Y.

The first base actuating mechanism 104*a* has cylinders 106*a*, 108*a* disposed outside of the placement bases 100*a*, 100*b* in alignment with the holes 102*a*, 102*b*, respectively. Pressers 114*a*, 116*a* are fixed to respective rods 110*a*, 112*a* extending respectively from the cylinders 106*a*, 108*a*. The pressers 114*a*, 116*a* are moved by the respective cylinders 106*a*, 108*a* to pass through the holes 102*a*, 102*b* and press the respective surfaces of the placement bases 100*b*, 100*a* for thereby displacing the placement bases 100*b*, 100*a* from each other.

The second base actuating mechanism 104*b* has cylinders 106*b*, 108*b* disposed outside of the placement bases 100*a*, 100*b* in alignment with the holes 102*b*, 102*a*, respectively. Pressers 114*b*, 116*b* are fixed to respective rods 100*b*, 112*b* extending respectively from the cylinders 106*b*, 108*b*. The pressers 114*b*, 116*b* are moved by the respective cylinders 106*b*, 108*b* to press the respective surfaces of the placement bases 100*a*, 100*b* for thereby displacing the placement bases 100*a*, 100*b* toward each other.

Figure 7:
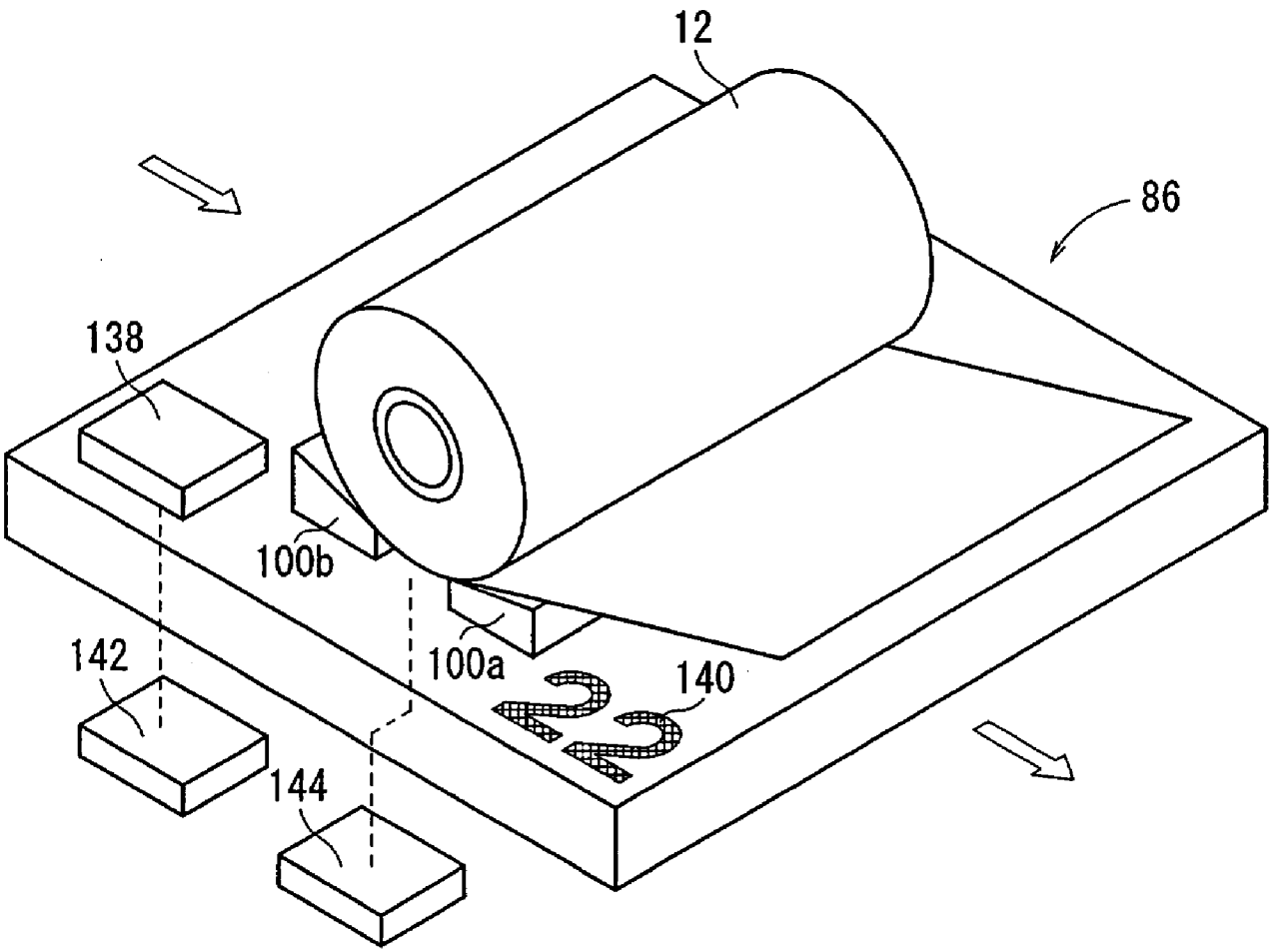
FIG. 7 is a perspective view of the pallet.

As shown in FIG. 7, a memory medium (identification data memory means, read-only memory element) 138 for storing identification data inherent in the pallet 86 is disposed on the pallet 86. The memory medium 138 may comprise a data carrier or an IC memory which is capable of electrically recording identification data and can be accessed from an external circuit to read recorded identification data out of contact therewith. The pallet 86 is printed with an identification number 140 thereof which corresponds to the identification data and which can visually be recognized by the operator.

Each of the working stations at which the pallet 86 arrives has a data reader (identification data reading means) 142 for reading the identification data stored in the recording medium 138, and a workpiece detector (workpiece detecting means) 144 for detecting whether there is a photosensitive roll 12 or a light-shielded photosensitive roll 30 on the pallet 86 or not.

Figure 9:
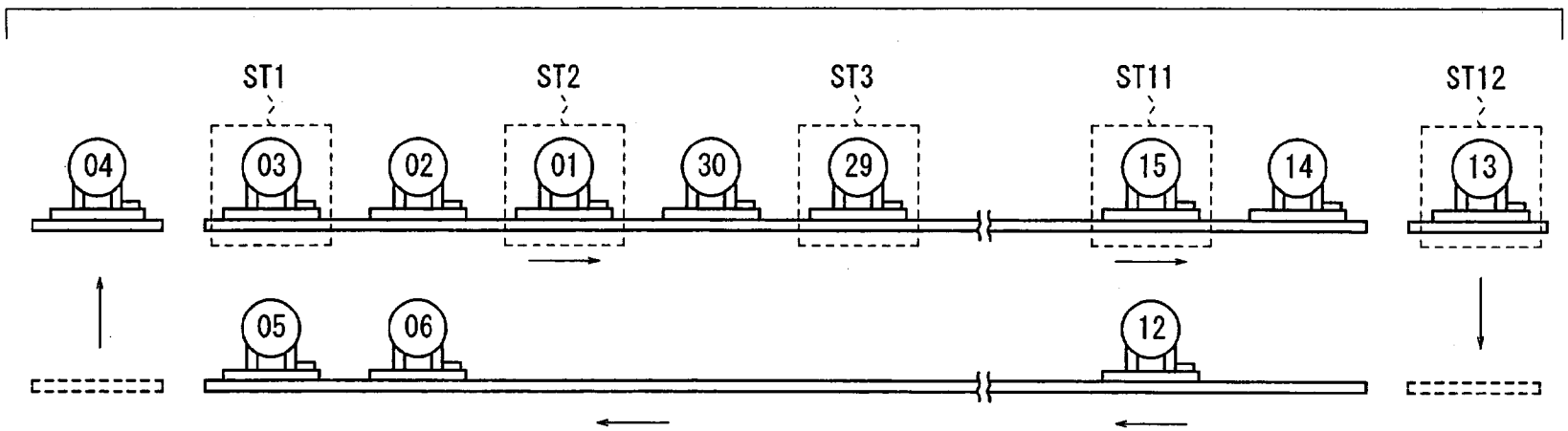
FIG. 9 is a view showing how pallets are fed in circulation.

FIG. 8 shows in block form the relationship between the working stations for manufacturing light-shielded photosensitive rolls 30 from photosensitive rolls 12 supplied from the dark chamber 11, and a control system thereof. FIG. 9 shows how pallets 86 are fed in circulation.

Control devices in the working stations are controlled by programmable controllers PLC1 through PLC6 having respective control consoles C1 through C6. The control consoles C1 through C4 and the programmable controllers PLC1 through PLC4 may be installed in the dark chamber 11 insofar as light emitted from display means of the control consoles C1 through C4 and the programmable controllers PLC1 through PLC4 does not adversely affect the photosensitive material used.

The programmable controller PLC1 controls the transfer station ST1, the programmable controller PLC2 controls the first flanged member inserting station ST2, the programmable controller PLC3 controls the end drawing station ST3 and the applying station ST4, the programmable controller PLC4 controls the light-shielding leader winding station ST6 and the thermally fusing station ST7, the programmable controller PLC5 controls the inspecting station ST9 and the second flanged member inserting station ST10, and the programmable controller PLC6 controls the label applying station ST11, the discharging station ST12, and a reentrant article label issuing unit 168. The reentrant article label issuing unit 168 issues an reentrant article label to be applied to a reentrant photosensitive roll 12 which is removed from any of the working stations or a photosensitive roll 12 which is judged as being defective. Of these programmable controllers PLC1 through PLC6, the programmable controller PLC1 is connected to a management computer 170. The programmable controllers PLC1 through PLC6 are connected to each other through a bus line 171.

Figure 10:
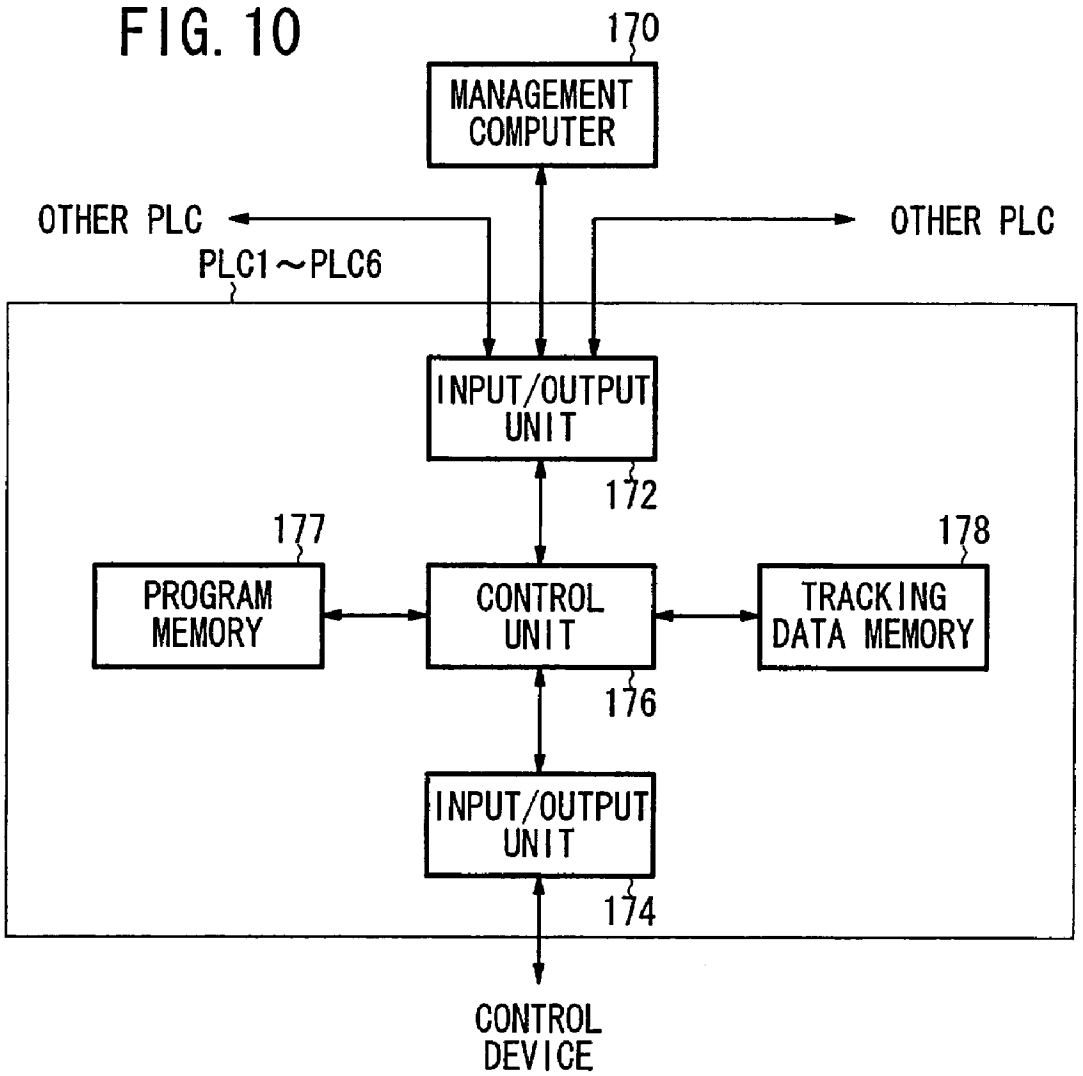
FIG. 10 is a block diagram of a programmable controller.

FIG. 10 shows in block form each of the programmable controllers PLC1 through PLC6. As shown in FIG. 10, each of the programmable controllers PLC1 through PLC6 comprises an input/output unit 172 for sending data to and receiving data from the management computer 170 and the other programmable controllers, an input/output unit 174 for sending data to and receiving data from the control devices in the working stations, a control unit 176 for controlling the data and performing a control process according to a given control program, a program memory 177 for storing operating programs for the control devices in the working stations which are connected to the programmable controllers PLC1 through PLC6, and a tracking data memory (identification data/specification data association memory means) 178 for storing tracking data which are specification data relative to photosensitive rolls 12 or light-shielded photosensitive rolls 30 which are fed to the working stations that are controlled by the programmable controllers PLC1 through PLC6.

Figure 11:
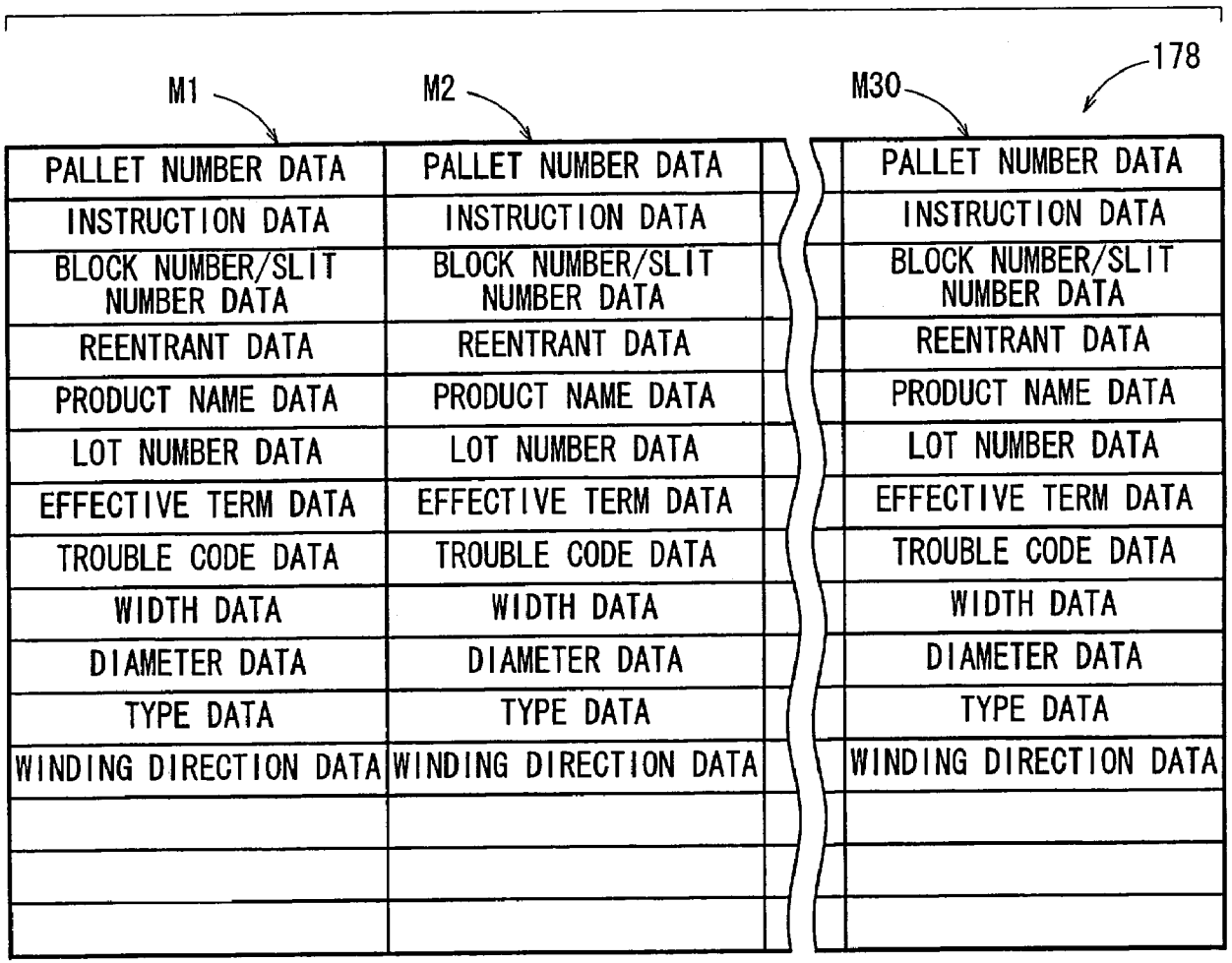
FIG. 11 is a diagram showing data stored in a tracking data memory of the programmable controller shown in FIG. 10.

FIG. 11 illustrates data stored in the tracking data memory 178 of the programmable controller PLC1 which controls the transfer station ST1. The tracking data memory 178 of the programmable controller PLC1 has data areas M1 through M30 corresponding to respective pallets 86 that are used between the transfer station ST1 through the discharging station ST12. In the present embodiment, it is assumed that 30 pallets 86 are in service at all times. Each of the tracking data memories 178 of the other programmable controllers PLC2 through PLC6 has data areas M1 through M30 relative to pallets 86 that are fed to the working stations controlled by the programmable controllers PLC2 through PLC6.

The data areas M1 through M30 store pallet number data (identification data), in the order of 1 through 30, for example, of pallets 86 corresponding to an identification number 140. The data areas M1 through M30 also store, in connection with the pallet number data, specification data relative to photosensitive rolls 12 or light-shielded photosensitive rolls 30 carried on the pallets 86. The specification data include instruction data for the control devices, block number/slit number data, reentrant data, product name data, lot number data, effective term data, trouble code data, width data, diameter data, type data, winding direction data, and work attribute data managing attributes of photosensitive rolls 12 or light-shielded photosensitive rolls 30.

The block number data are data specifying regions where photosensitive rolls 12 are cut from a wide film roll (not shown) in its longitudinal direction. The slit number data are data specifying regions where photosensitive rolls 12 are cut from a wide film roll (not shown) in its transverse direction. The reentrant data are data which are set when a photosensitive roll 12 or a light-shielded photosensitive roll 30 which has been removed from the production line is repaired if necessary and reentered into the production line. The trouble code data are data representing defect details when a photosensitive roll 12 or a light-shielded photosensitive roll 30 which has been inspected is judged as a defective product. The width data are data representing widths of photosensitive rolls 12, and the diameter data are data representing diameters of photosensitive rolls 12. The type data are data representing the type of an emulsion or the like used in the photosensitive material. The winding direction data are data representing the direction in which the emulsion surfaces of photosensitive rolls 12 face.

The workpiece attribute data are data managing working states of photosensitive rolls 12 or light-shielded photosensitive rolls 30. For example, the workpiece attribute data include data representing whether photosensitive rolls 12 or light-shielded photosensitive rolls 30 have been worked upon in the working stations, whether photosensitive rolls 12 or light-shielded photosensitive rolls 30 are defective or not in the working stations, and whether there are photosensitive rolls 12 or light-shielded photosensitive rolls 30 in the working stations.

Figure 12:
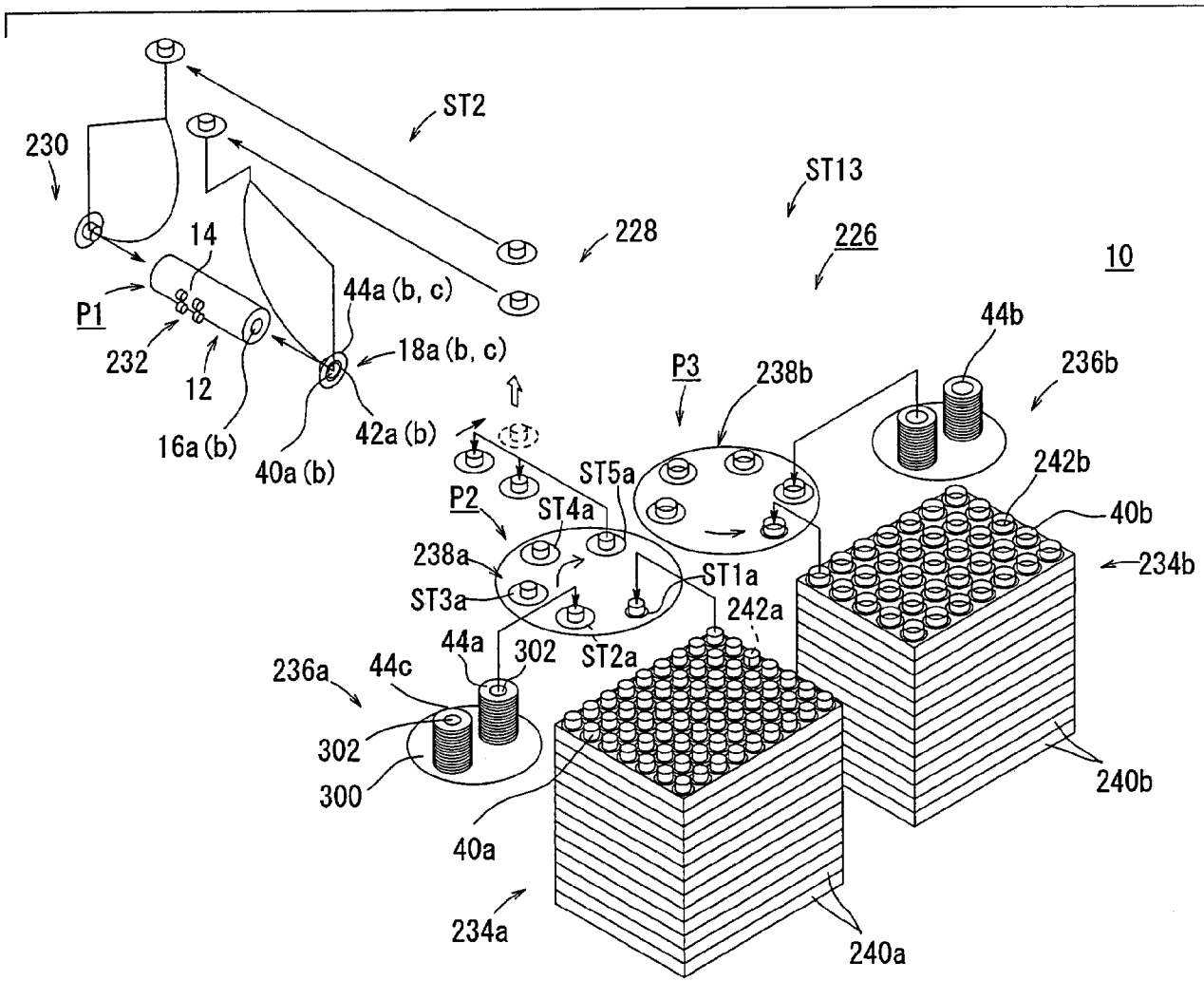
FIG. 12 is a schematic perspective view of a flanged member assembling device and a flanged member installing device.

Structural details of the automatic packaging system 10 will be described below. As shown in FIG. 12, the first flanged member assembling station ST13 has a flanged member assembling device 226 for selecting two types of caps 40*a*, 40*b* and three types of rings 44*a*, 44*b*, 44*c* depending on the diameter of the core of the photosensitive roll 12 and assembling first flanged members 18*a* through 18*c*. The assembled first flanged members 18*a* through 18*c* are transferred by a first flanged member feeding device 228 to a flanged member installing device 230 disposed in the first flanged member inserting station ST2.

Figure 13:
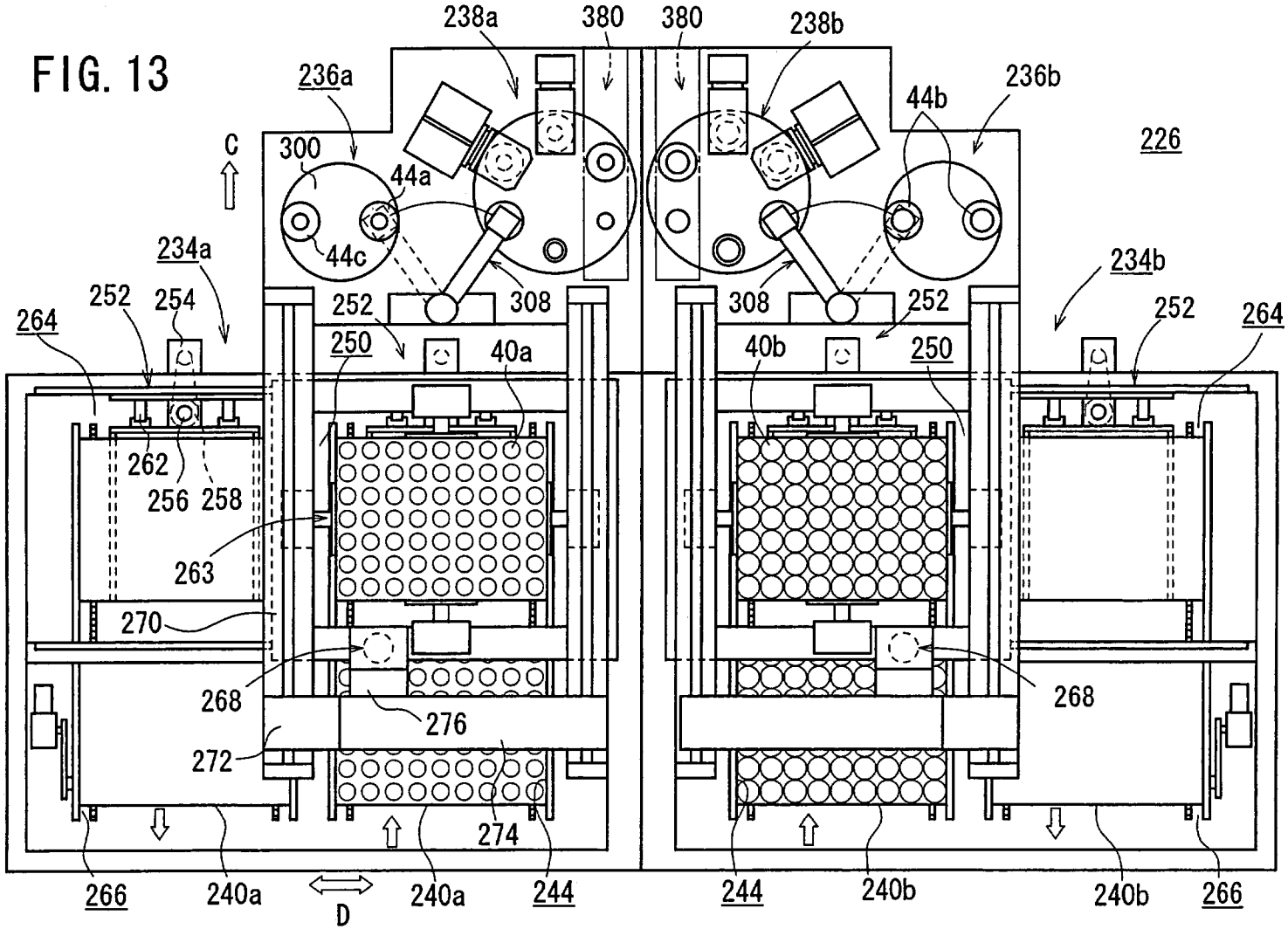
FIG. 13 is a plan view of the flanged member assembling device.

As shown in FIGS. 12 and 13, the flanged member assembling device 226 has first and second cap supplies 234*a*, 234*b* for placing two types of caps 40*a*, 40*b* depending on the diameter of the core of the photosensitive roll 12 and supplying desired caps 40*a*, 40*b* to first and second light-shielding member assembling positions P2, P3, first and second ring supplies 236*a*, 236*b* for placing rings 44*a*, 44*c* of different outside diameters to be joined to caps 40*a* and rings 44*b* to be joined to caps 40*b* and supplying desired rings 44*a* (44*c*), 44*b* to the first and second light-shielding member assembling positions P2, P3, and first and second index tables 238*a*, 238*b* positioned respectively at the first and second light-shielding member assembling positions P2, P3.

Figure 14:
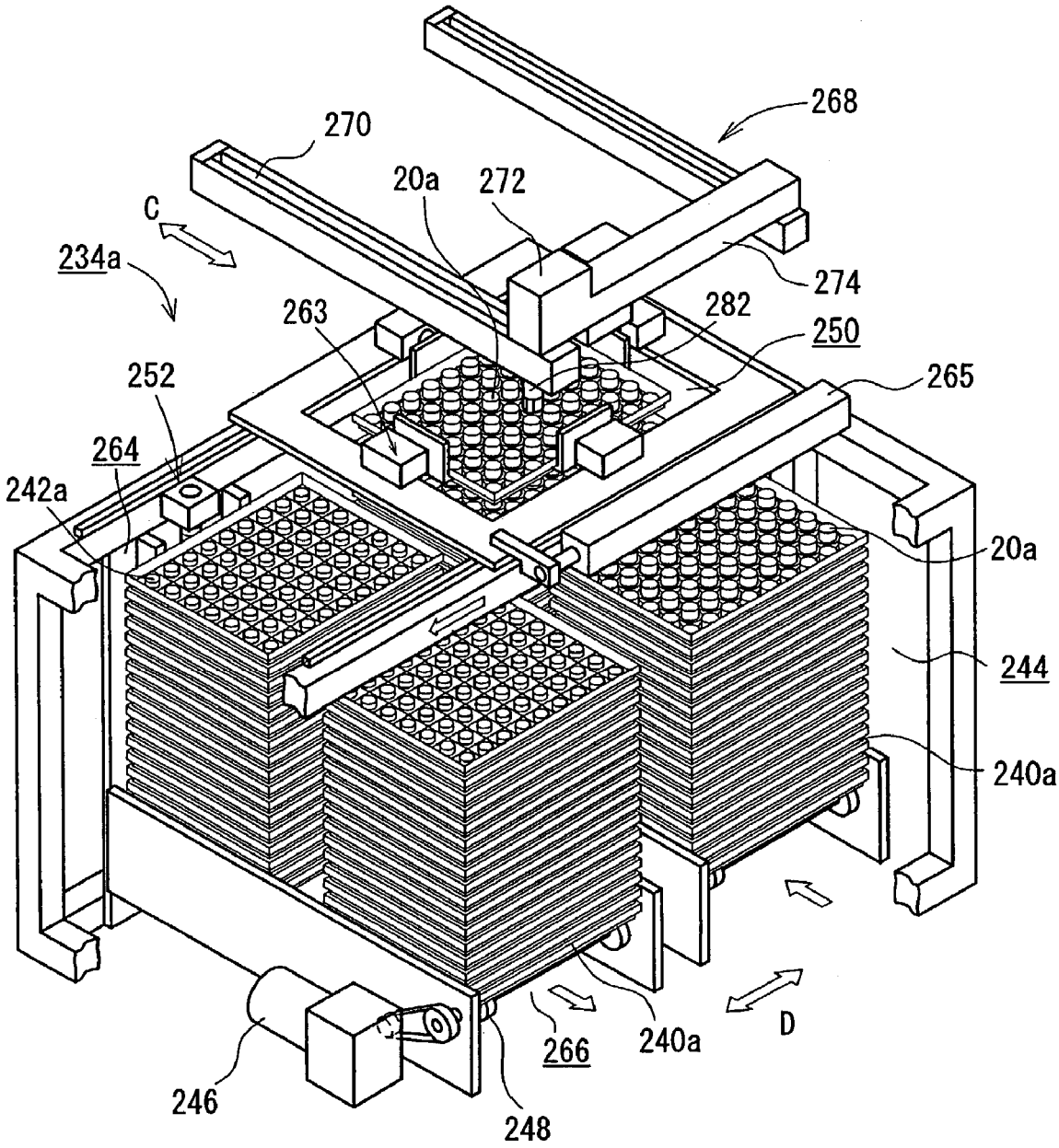
FIG. 14 is a perspective view of a first cap supply of the flanged member assembling device.

The first and second cap supplies 234*a*, 234*b* are supplied with a predetermined number of caps 40*a*, 40*b* carried in trays 240*a*, 240*b* which have bosses 242*a*, 242*b* for fitting in the caps 40*a*, 40*b*. As shown in FIGS. 13 and 14, the first cap supply 234*a* has a tray loading region 244 for being loaded with a plurality of stacked trays 240*a* each carrying a predetermined number of caps 40*a*. The stacked trays 240*a* which are loaded into the tray loading region 244 are successively delivered to a cap removing region 250 by belts 248 which are rotated in circulation by a motor 246.

Figure 15:
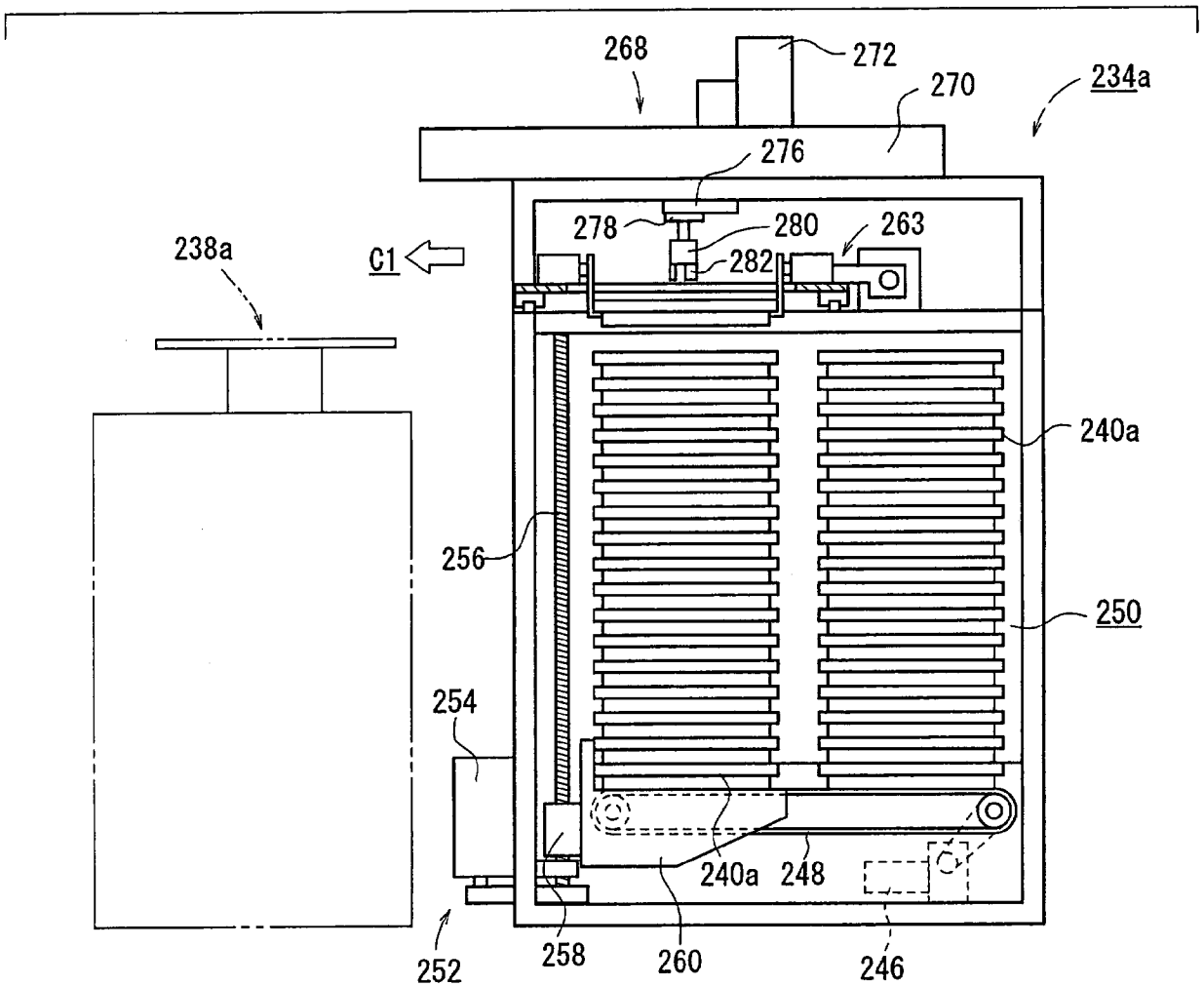
FIG. 15 is a front elevational view of the first cap supply.

As shown in FIG. 15, the cap removing region 250 accommodates therein a lifting and lowering means 252 which comprises a vertically extending rotatable ball screw 256 coupled to a motor 254 and threaded through a nut 258 which is connected to a vertically movable base 260. When the motor 254 is energized, the vertically movable base 260 is vertically moved by the ball screw 256 threaded through the nut 258 while being guided by guide rails 262 which are disposed one on each side of the ball screw 256 (see FIG. 13). A tray holding means 263 for positioning and holding an uppermost tray 240*a* of the tray stack is disposed in the cap removing region 250.

An empty tray stacking region 264 is disposed parallel to the cap removing region 250. An empty tray 240*a* from which all caps 40*a* have been removed in the cap removing region 250 is delivered into the empty tray stacking region 264 by a cylinder 265 of the tray holding means 263 (see FIG. 14). The empty tray stacking region 264 accommodates therein a lifting and lowering means 252, and is connected to an empty tray unloading region 266 by the motor 246 and the belts 248.

A cap removing means 268 for feeding caps 40*a* to a cap placing station ST1*a* on the first index table 238*a* is disposed over the cap removing region 250. The cap removing means 268 has a self-propelled carriage 272 movable along rails 270 extending toward the first index table 238*a* (in the direction indicated by the arrow C). The self-propelled carriage 272 has a guide rail 274 extending in the direction indicated by the arrow D which is perpendicular to the direction indicated by the arrow C. A movable base 276 is movably supported on the guide rail 274.

Figure 16:
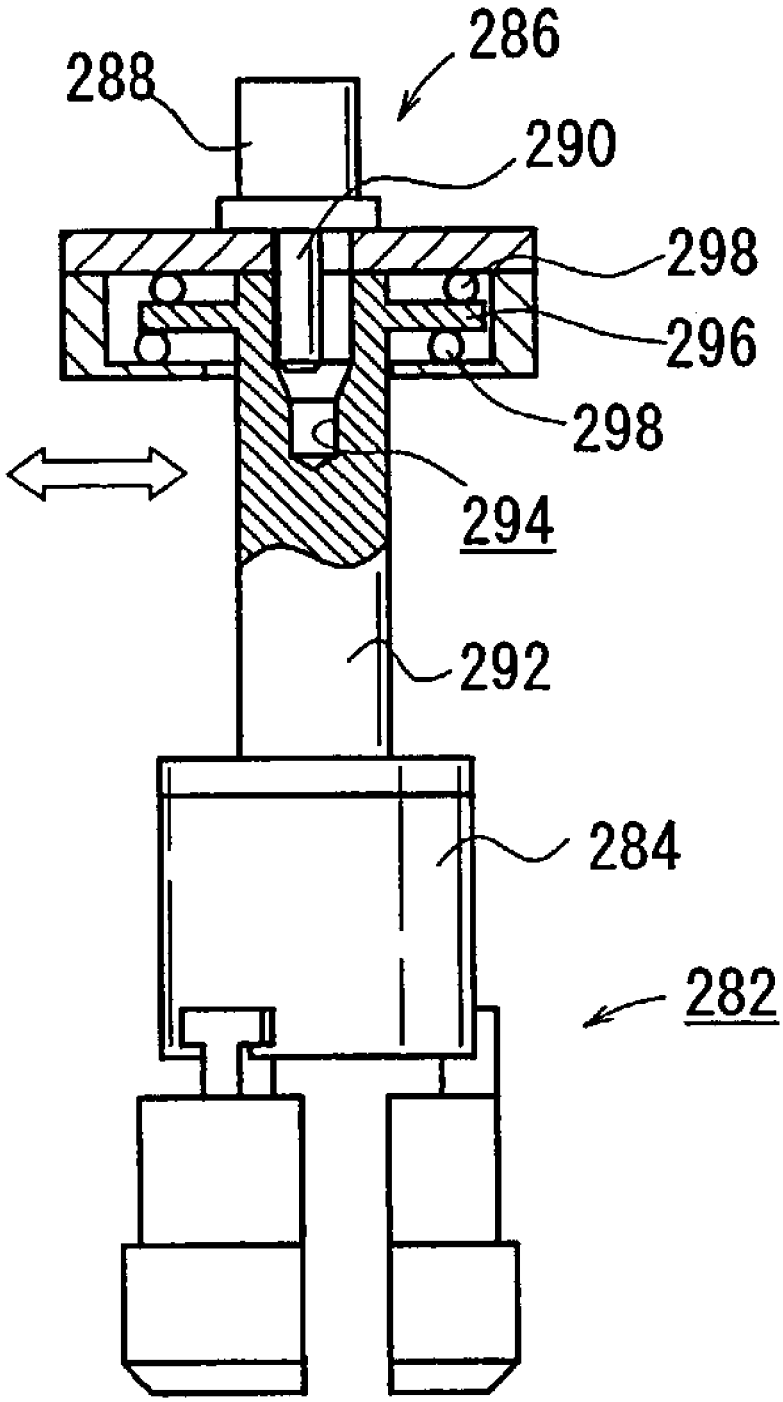
FIG. 16 is an elevational view, partly in cross section, of a cap removing chuck of a cap removing means.

As shown in FIG. 15, a cylinder 278 is mounted on the movable base 276 for vertically moving a vertically movable base 280 with a cap removing chuck 282 mounted on a lower end thereof. As shown in FIG. 16, the cap removing chuck 282 is radially movable inwardly and outwardly, i.e., radially expandable and contractible, by a cylinder 284, and has an upper end connected to a floating structure 286.

The floating structure 286 is arranged to move the cap removing chuck 282 horizontally. The floating structure 286 includes an air cylinder 288 having a positioning pin 290 fixedly fitted in a hole 294 defined in a shank 292 of the cap removing chuck 282. The shank 292 has a flange 296 disposed on an upper end thereof and guided by a plurality of steel balls 298 for moving the cap removing chuck 282 horizontally.

As shown in FIGS. 12 and 13, the first ring supply 236*a* has a turntable 300 having a pair of support posts 302 mounted thereon for being inserted in respective rings 44*a*, 44*c* to stack a predetermined number of rings 44*a*, 44*c* on the turntable 300.

Figure 17:
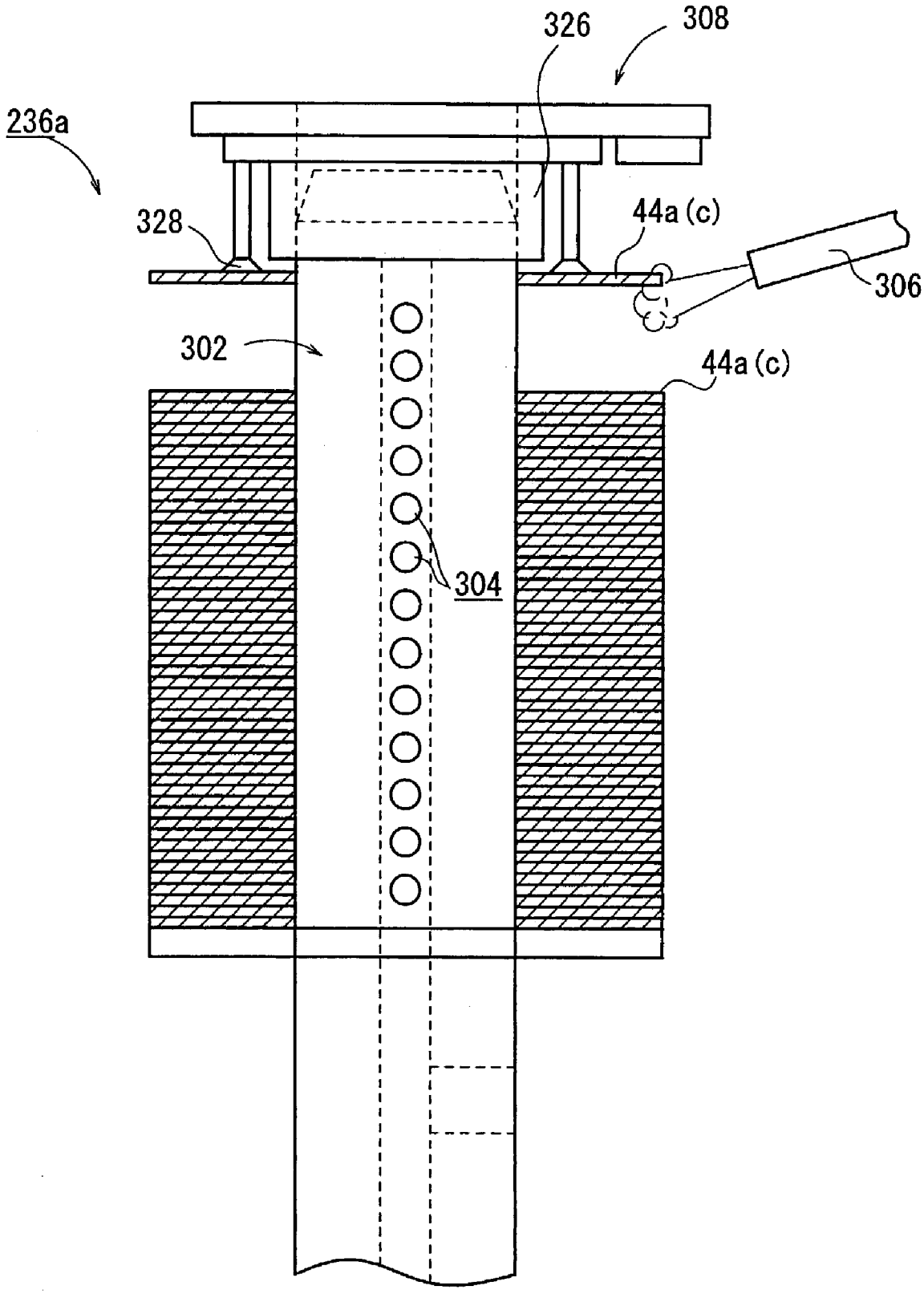
FIG. 17 is an elevational view of a first ring supply.

As shown in FIG. 17, each of the support posts 302 has a plurality of axially spaced ejection ports 304 defined in a circumferential wall thereof for ejecting separating air toward the stack of rings 44*a*, 44*c*. An air nozzle 306 for ejecting separating air obliquely toward an upper portion of the support post 302 is disposed in radially spaced relation to the upper portion of the support post 302.

Figure 18:
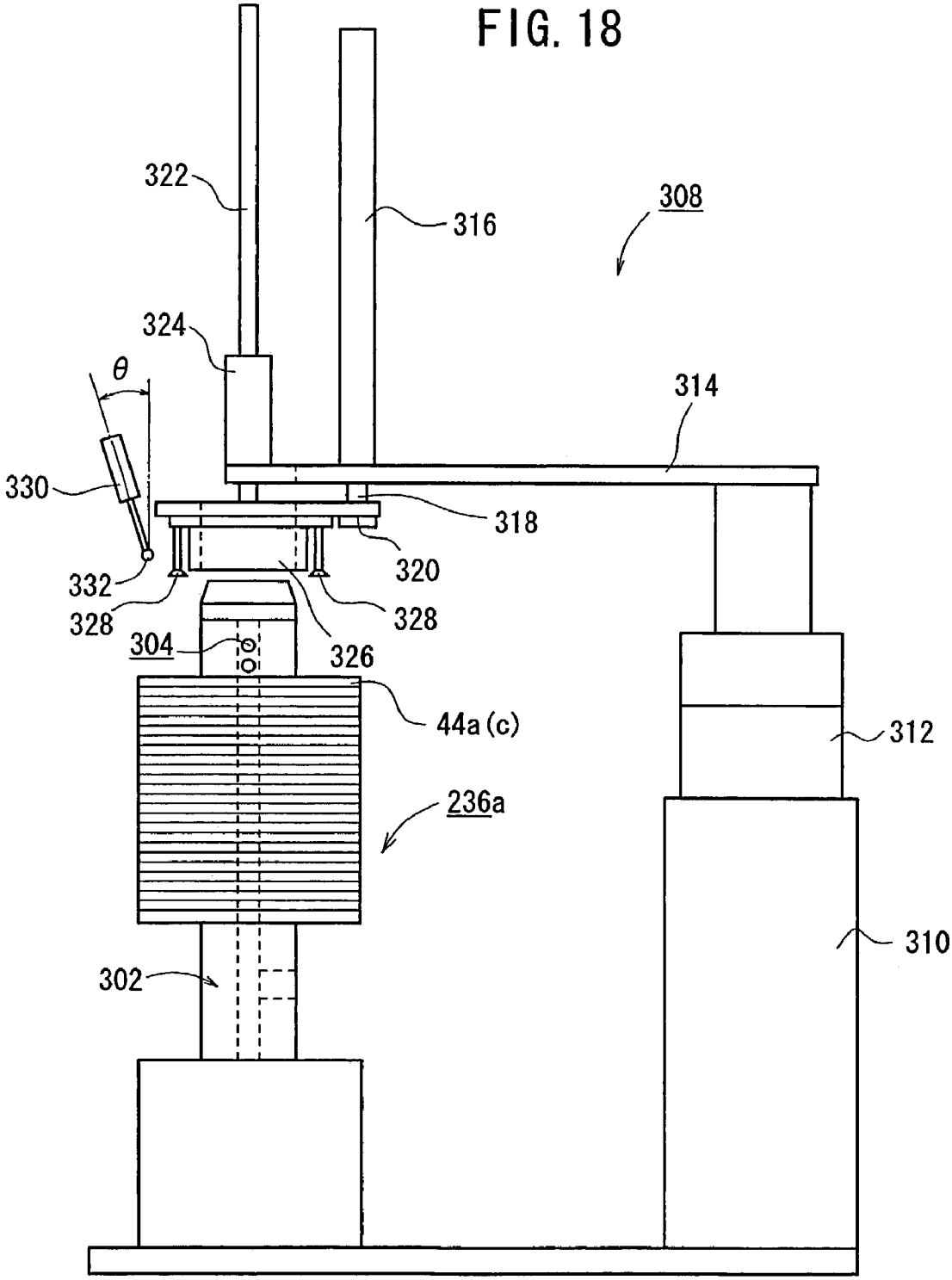
FIG. 18 is a side elevational view of a suction means.

The first ring supply 236*a* has a suction means 308 for removing uppermost rings 44*a*, 44*c*, one at a time, from the stack of rings 44*a*, 44*c* supported on the support post 302. As shown in FIG. 18, the suction means 308 has a rotary actuator 312 mounted on a support post 310 and fixed at an upper end thereof to an and of a swing arm 314. The other end of the swing arm 314 supports thereon a vertical cylinder 316 having a downwardly extending rod 318 which supports a vertically movable base 320 mounted thereon. The vertically movable base 320 is vertically movable with respect to the swing arm 314 by the cylinder 316 while being guided by a pair of guide rods 322 slidably extending through respective linear bushings 324 mounted on the swing arm 314.

Figure 19:
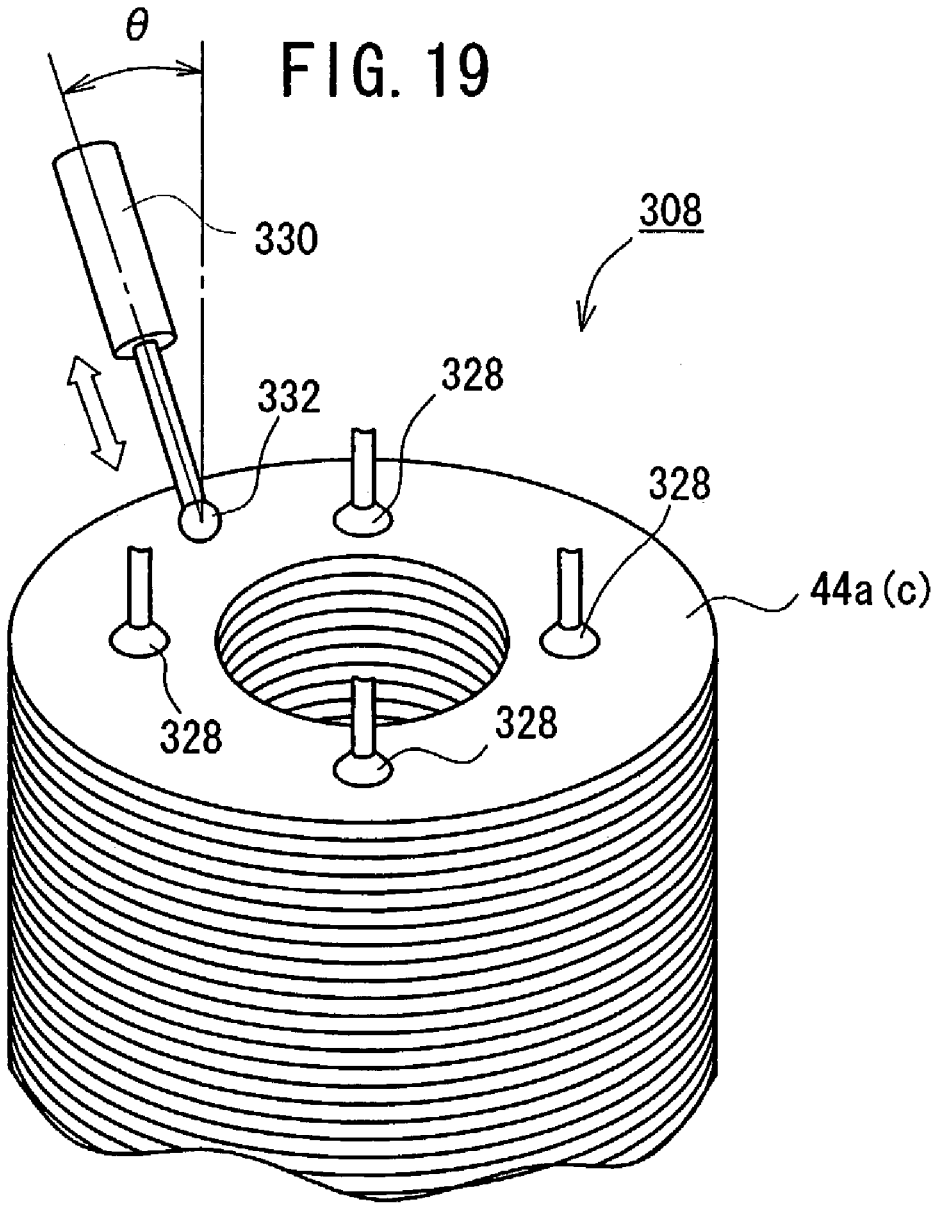
FIG. 19 is a fragmentary perspective view of the suction means.

The vertically movable base 320 supports on its lower surface a cylindrical sleeve 316 and a plurality of, e.g., four, suction pads 328 positioned around the cylindrical sleeve 316. A squeezing member 332 axially movable by a cylinder 330 is disposed adjacent to the vertically movable base 320 (see FIG. 19). The squeezing member 332 extends obliquely to the direction perpendicular to the planes of the rings 44*a*, 44*c* at an angle θ ranging from 0° to 90°. The swing arm 314 is angularly movable in a predetermined angle of 90°, for example, for moving the suction pads 328 selectively to a position above the support post 302 and a ring placing station ST2*a* on the first index table 238*a*.

Figure 20:
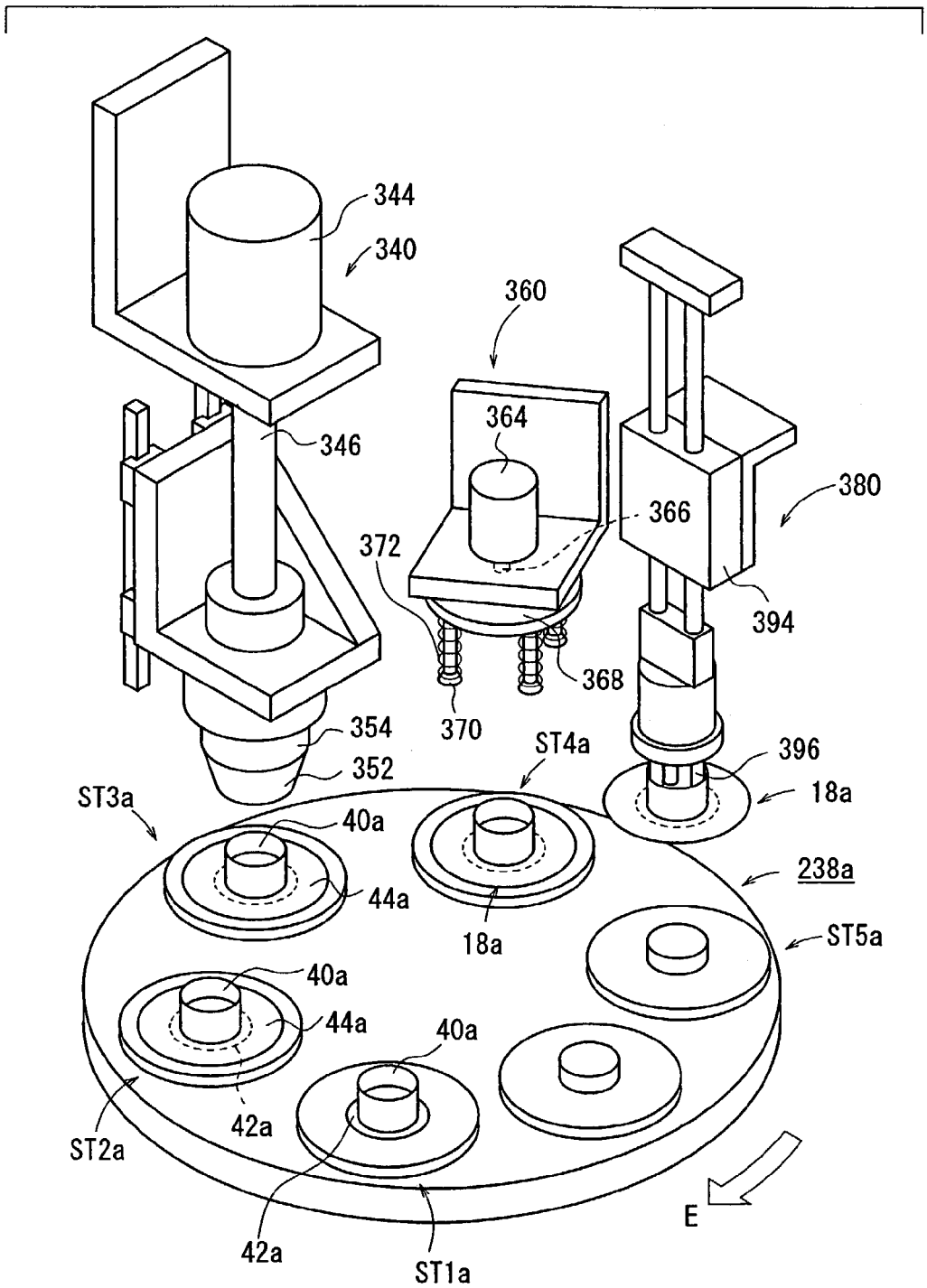
FIG. 20 is a perspective view of a fist index table.

As shown in FIG. 20, the first index table 238*a* has the cap placing station ST1*a*, the ring placing station ST2*a*, a joining station ST3*a* for joining (heat-sealing) a ring 44*a* or 44*c* to a cap 40*a*, an inspecting station ST4*a* for inspecting a joined state of the ring 44*a* or 44*c* joined to the cap 40*a*, and a light-shielding member removing station ST5*a* for removing a joined first flanged member 18*a* or 18*c*.

Figure 21:
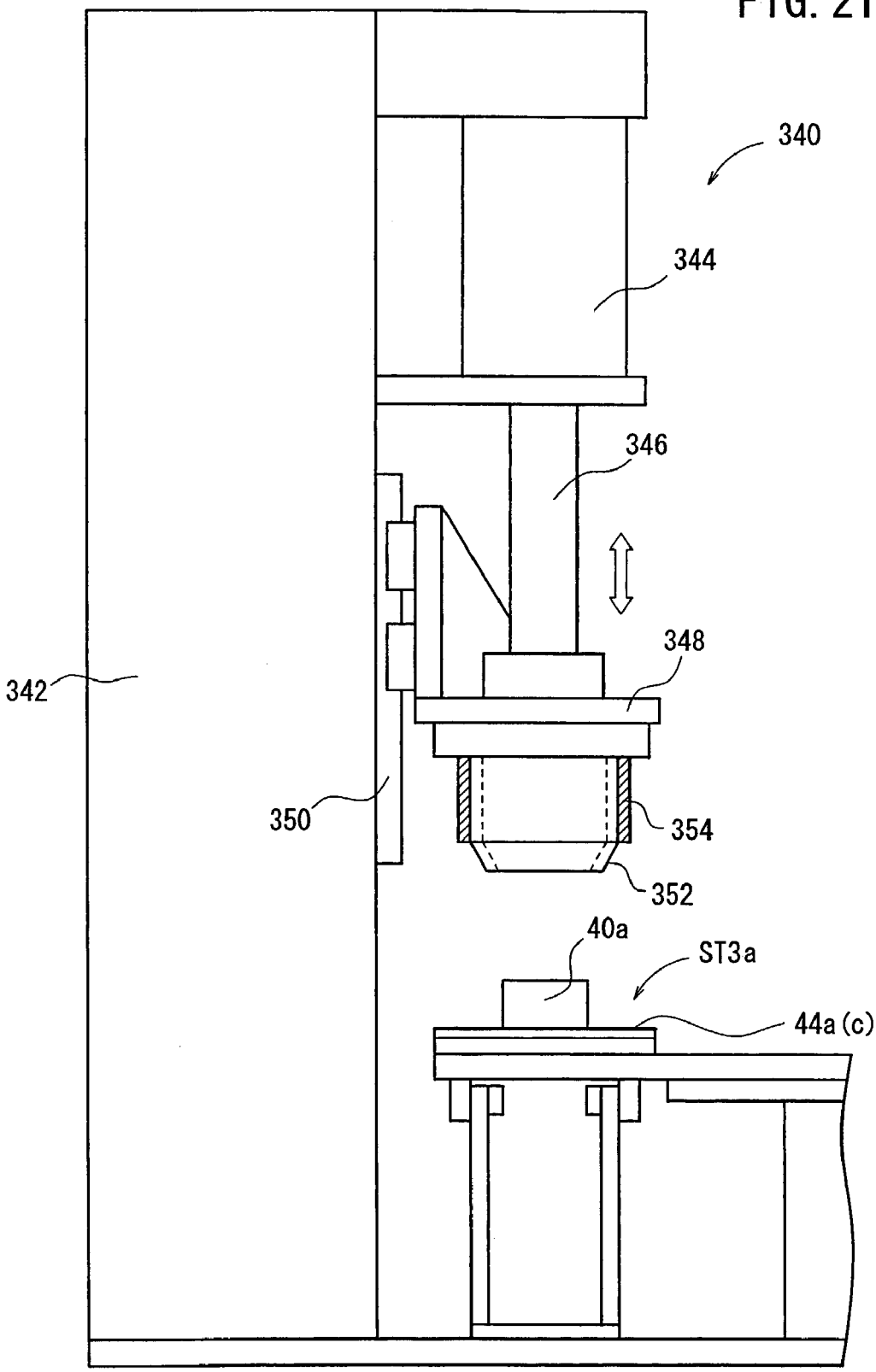
FIG. 21 is a front elevational view of a heat sealer.

As shown in FIGS. 20 and 21, a heat sealer 340 is disposed in the joining station ST3*a*. The heat sealer 340 has a support post 342 with a cylinder 344 mounted on an upper portion thereof. The cylinder 344 has a downwardly extending rod 346 supporting a vertically movable base 348 coupled to a lower end thereof. The vertically movable base 348 is supported on a pair of linear guides 350 vertically mounted on a wall surface of the support column 342. A heater head 352 with a band heater 354 fitted thereover is fixedly mounted on a lower surface of the vertically movable base 348. The heater head 352 has a lower tip end tapered downwardly such that its diameter decreases gradually in the downward direction.

Figure 22:
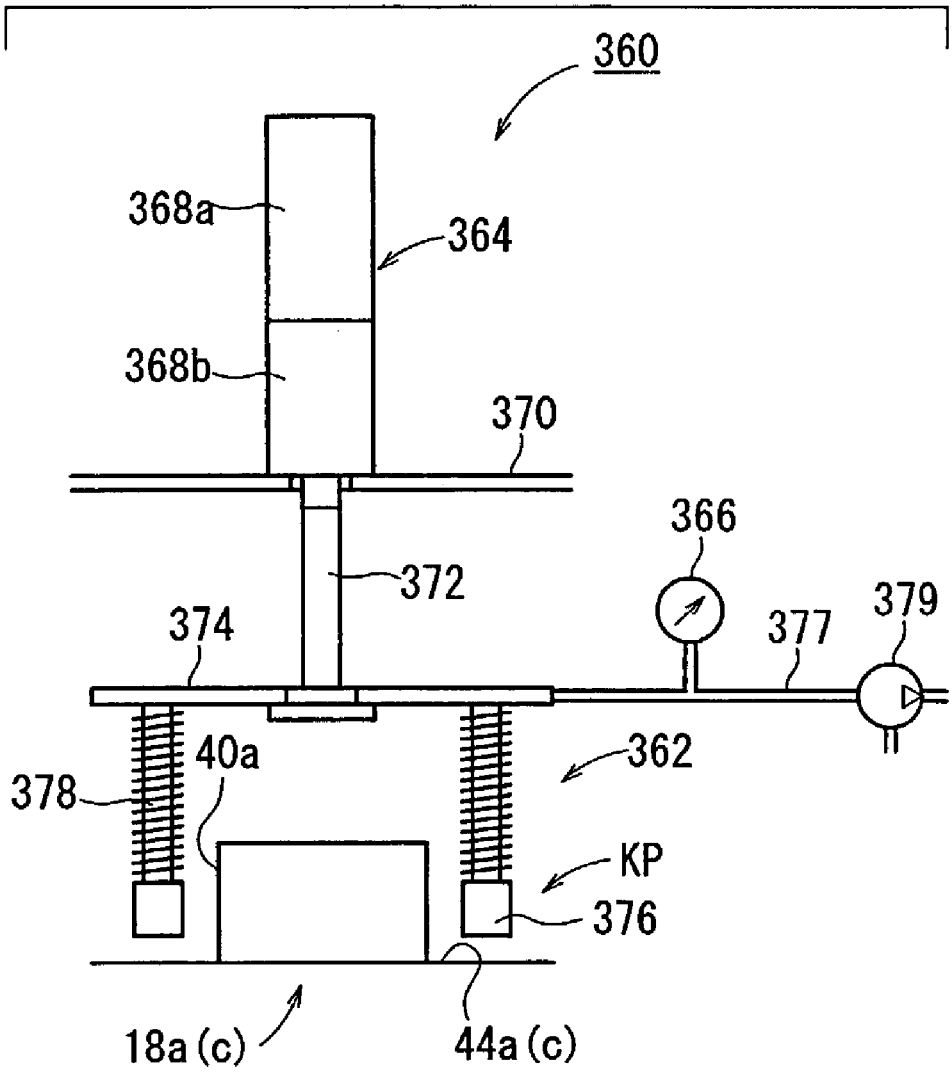
FIG. 22 is an elevational view of an inspecting device of the flanged member assembling device.

An inspecting device 360 is disposed in the inspecting station ST4*a*. As shown in FIGS. 20 and 22, the inspecting device 360 comprises a suction means 362 for attracting a ring 44*a*, 44*c*, a moving means 364 for moving the suction means 362 toward and away from the ring 44*a*, 44*c* and placing the suction means 362 in an inspecting position KP which is spaced a given distance from the position where the suction means 362 attracts the ring 44*a*, 44*c*, and a pressure meter (pressure detecting means) 366 for detecting a pressure acting on the suction means 362 while the suction means 362 is in the inspecting position KP.

As shown in FIG. 22, the moving means 364 comprises first and second cylinders 368*a*, 368*b* coupled coaxially to each other and supported on a support post (not shown) by an attachment plate 370. A vertically movable base 374 is mounted on a lower end of a rod 372 extending downwardly from the first and second cylinders 368*a*, 368*b*. Four suction pads 376 for attracting the ring 44*a*, 44*c* are movably mounted on the vertically movable base 374 with respective springs 378 interposed therebetween.

The suction pads 376 can be placed selectively in three positions by the first and second cylinders 368*a*, 368*b*, i.e., a lowered position in which the suction pads 376 contact the upper attracted surface of the ring 44*a*, 44*c*, the inspecting position KP, and a lifted position. Each of the suction pads 376 communicates with a negative pressure pump (negative pressure generating source) 379 via a pipe 377. The pressure meter 366 is connected to the pipe 377 for inspecting whether the suction pads 376 attract the ring 44*a*, 44*c* based on changes in the vacuum pressure in the pipe 377.

Figure 23:
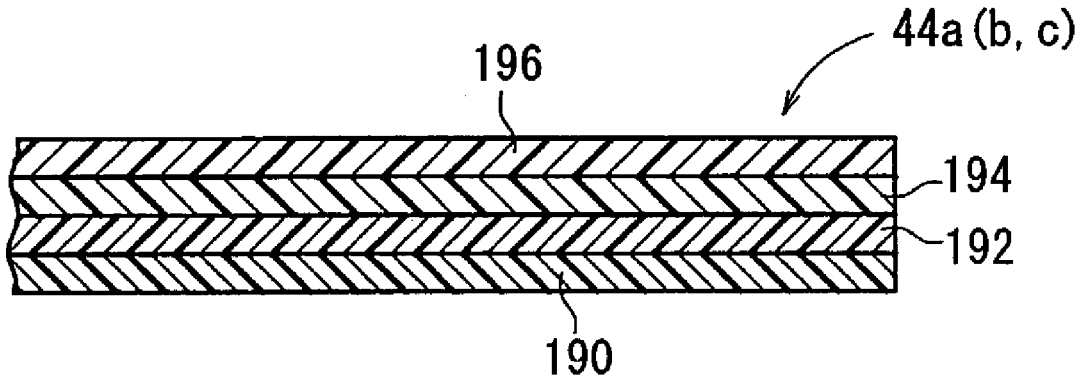
FIG. 23 is a fragmentary cross-sectional view of a ring of a first flanged member.

As shown in FIG. 23, each ring 44*a*, 44*b*, 44*c* has an adhesive layer 190 on a reverse surface thereof (one of its surfaces), and a light-shielding layer 192, a PET layer 194, and a surface layer 196 which are successively laminated on the adhesive layer 190. The surface layer 196 serves as a colored layer which is colored gray, for example.

Figure 24:
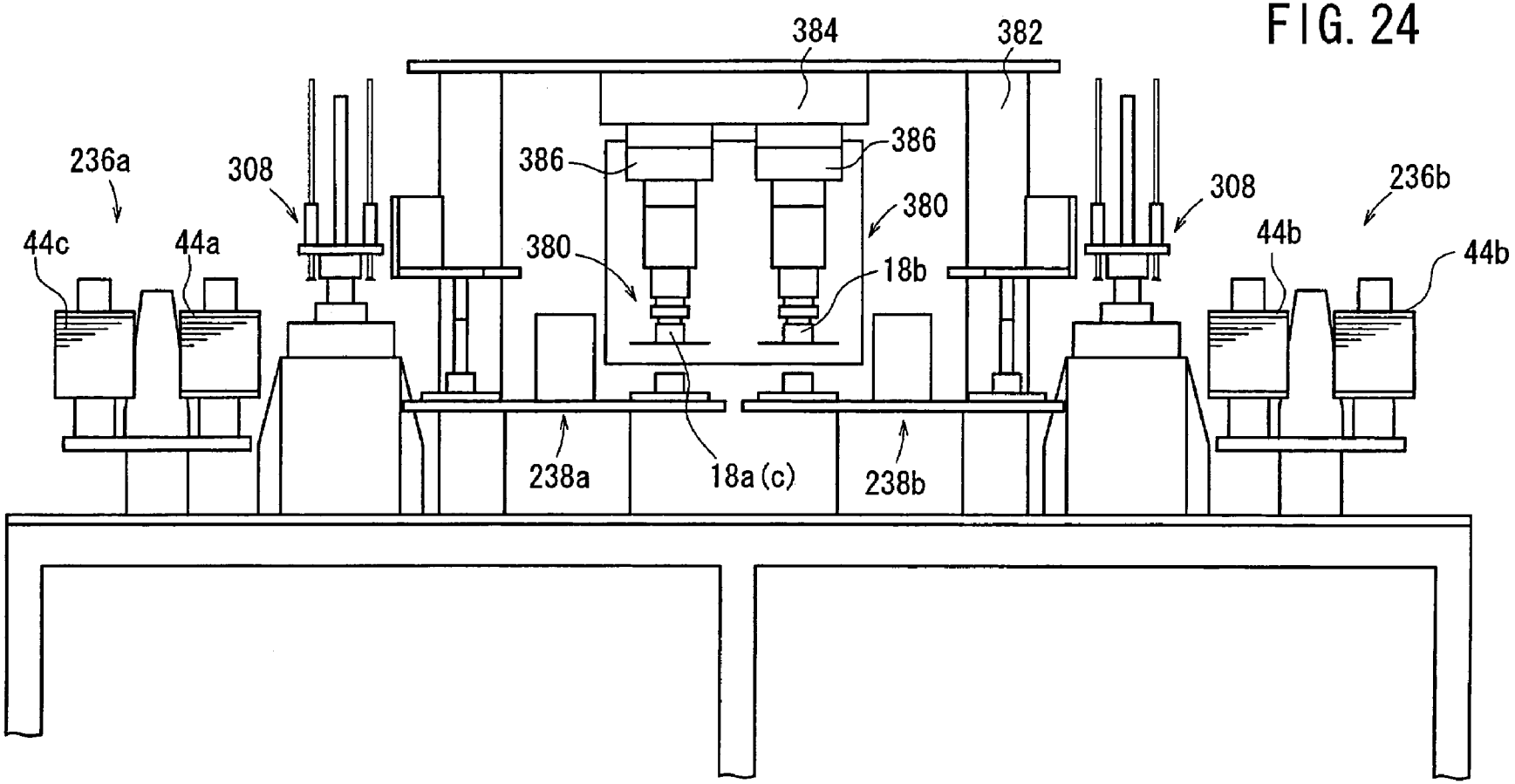
FIG. 24 is a front elevational view of first and second ring supply units and first and second index tables.
Figure 25:
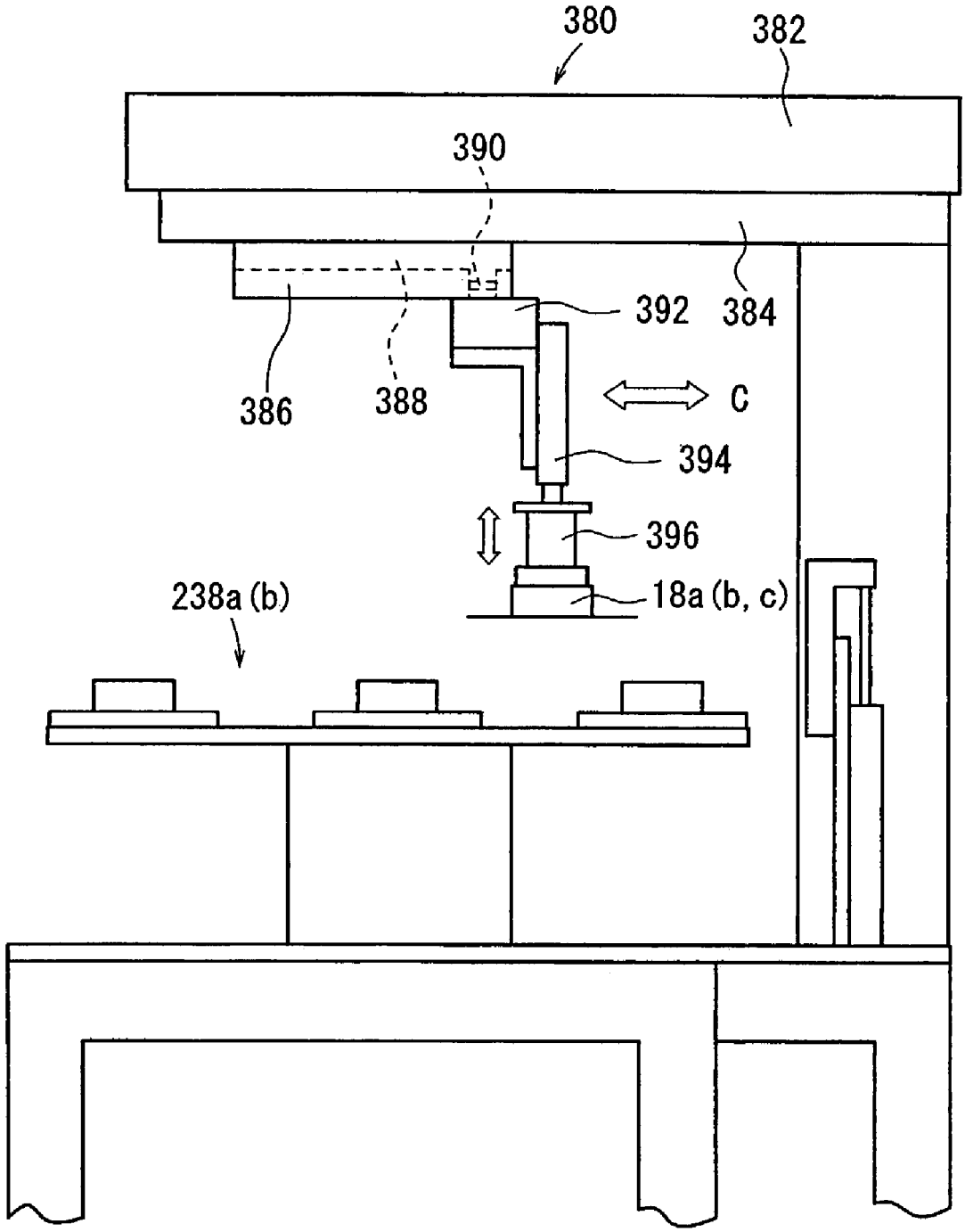
FIG. 25 is a side elevational view of the first and second index tables and a light-shielding member removing means.

Light-shielding member removing means 380 are disposed in the light-shielding member removing station ST5*a*. As shown in FIGS. 24 and 25, the light-shielding member removing means 380 have a guide rail 384 fixed to a frame 382 and extending in the direction indicated by the arrow A over the light-shielding member removing station ST5*a* on the first index table 238*a*.

Self-propelled carriages 386 are supported on the guide rail 384. A cylinder 388 is horizontally mounted in each of the self-propelled carriages 386. A movable base 392 is coupled to a rod 390 which extends from the cylinder 388 in the direction indicated by the arrow C. A light-shielding member chuck 396 which can be moved radially inwardly and outwardly is mounted on the movable base 392 by a lifting and lowering cylinder 394.

The first cap supply 234*a*, the first ring supply 236*a*, and the first index table 238*a* are constructed as described above. The second cap supply 234*b*, the second ring supply 236*b*, and the second index table 238*b* are structurally identical to the first cap supply 234*a*, the first ring supply 236*a*, and the first index table 238*a*. Those parts of the second cap supply 234*b*, the second ring supply 236*b*, and the second index table 238*b* which are identical to those of the first cap supply 234*a*, the first ring supply 236*a*, and the first index table 238*a* are denoted by identical reference characters, and will not be described in detail below.

Figure 26:
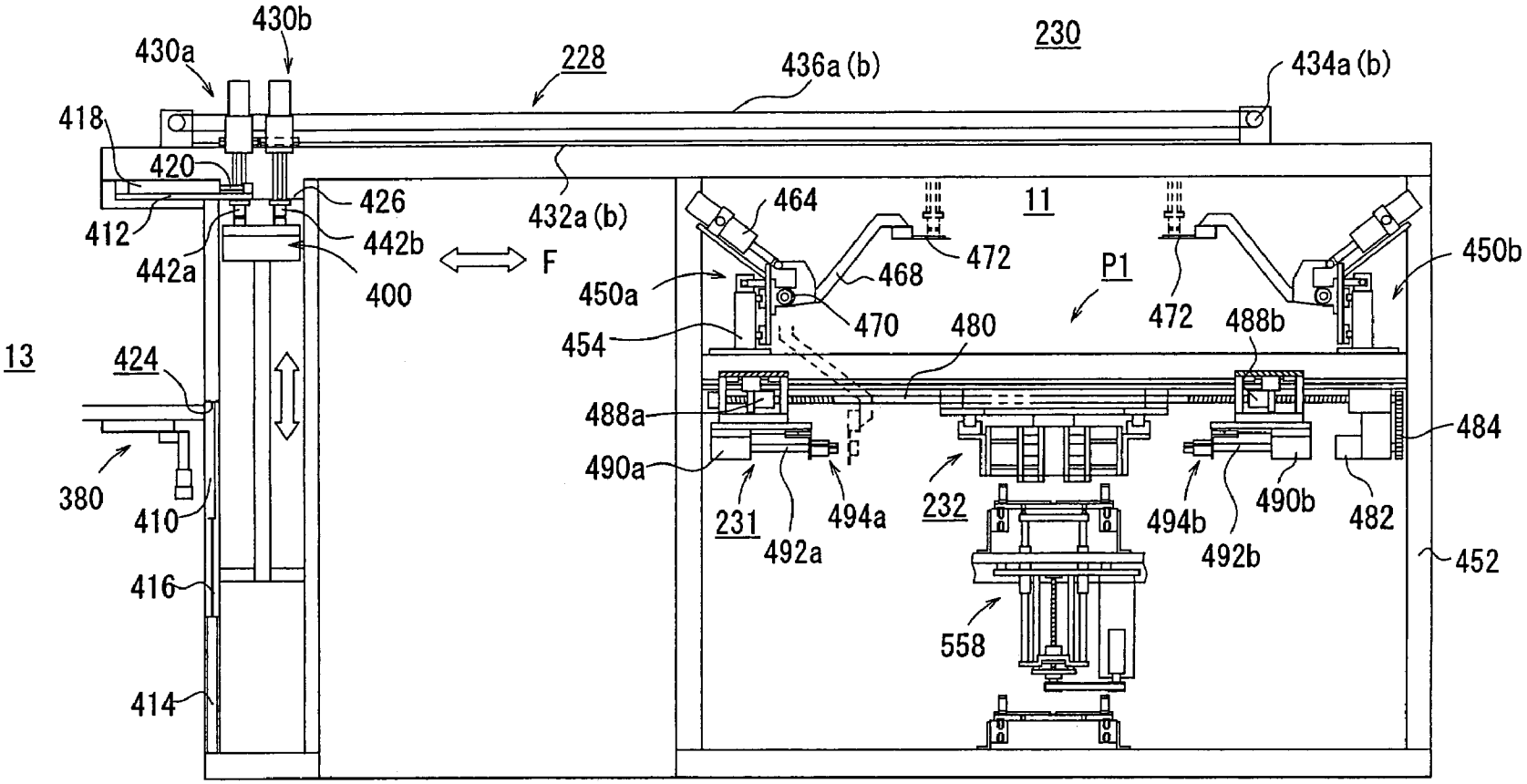
FIG. 26 is a front elevational view of a lifter and the flanged member installing device.
Figure 27:
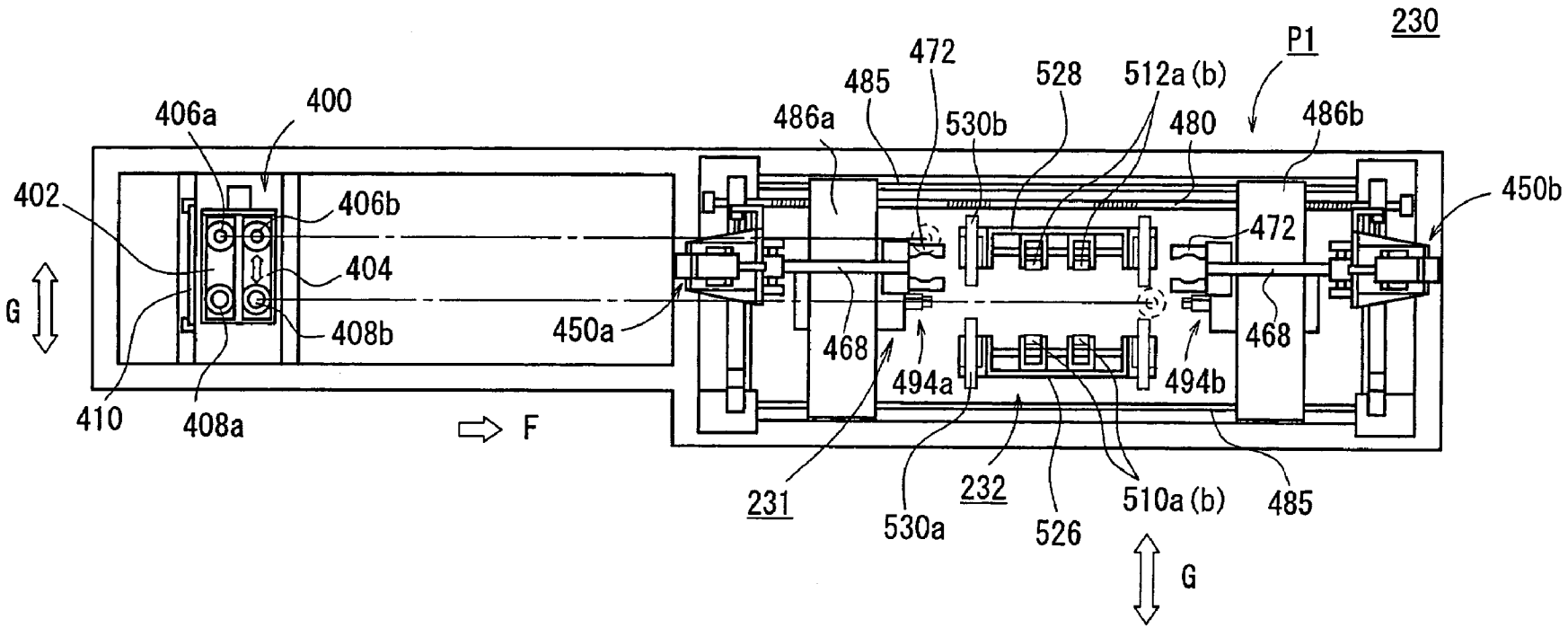
FIG. 27 is a plan view of the lifter and the flanged member installing device.

As shown in FIG. 26, the first flanged member feeding device 228 has a lifter 400 disposed near a foremost position to which the light-shielding member removing means 380 can move. As shown in FIG. 27, the lifter 400 has a fixed placement base 402 and a movable placement base 404. The fixed placement base 402 supports thereon a first rest 406*a* for placing thereon a 2-inch first flanged member 18*a*, 18*c* and a second rest 406*b* for placing thereon a 3-inch first flanged member 18*b*. Similarly, the movable placement base 404 supports thereon a first rest 406*b* for placing thereon a first flanged member 18*a*, 18*c* and a second rest 408*b* for placing thereon a first flanged member 18*b*. The movable placement base 404 is movable in the direction indicated by the arrow G which is perpendicular to the direction indicated by the arrow F, by an actuator such as a cylinder or the like (not shown).

The flanged member installing device 230 comprises an inserting mechanism 231 for installing first flanged members 18*a* through 18*c* on the opposite ends of the photosensitive roll 12, and a centering mechanism 232 for positioning and holding the outer circumferential surface of the photosensitive roll 12 in a light-shielding member installing position P1.

First and second shutters 410, 412 which are alternately openable and closable to keep the dark chamber 11 shielded against entry of light are disposed near respective lowermost and uppermost positions of the lifter 400. The first shutter 410 is disposed vertically near a terminal end of the guide rail 384 of the light-shielding member removing means 380. The first shutter 410 is vertically movable by a rod 416 fixed thereto which extends upwardly from a cylinder 414. The second shutter 412 is disposed horizontally near the uppermost position of the lifter 400, and fixed to a rod 420 extending horizontally from a cylinder 418.

Figure 28:
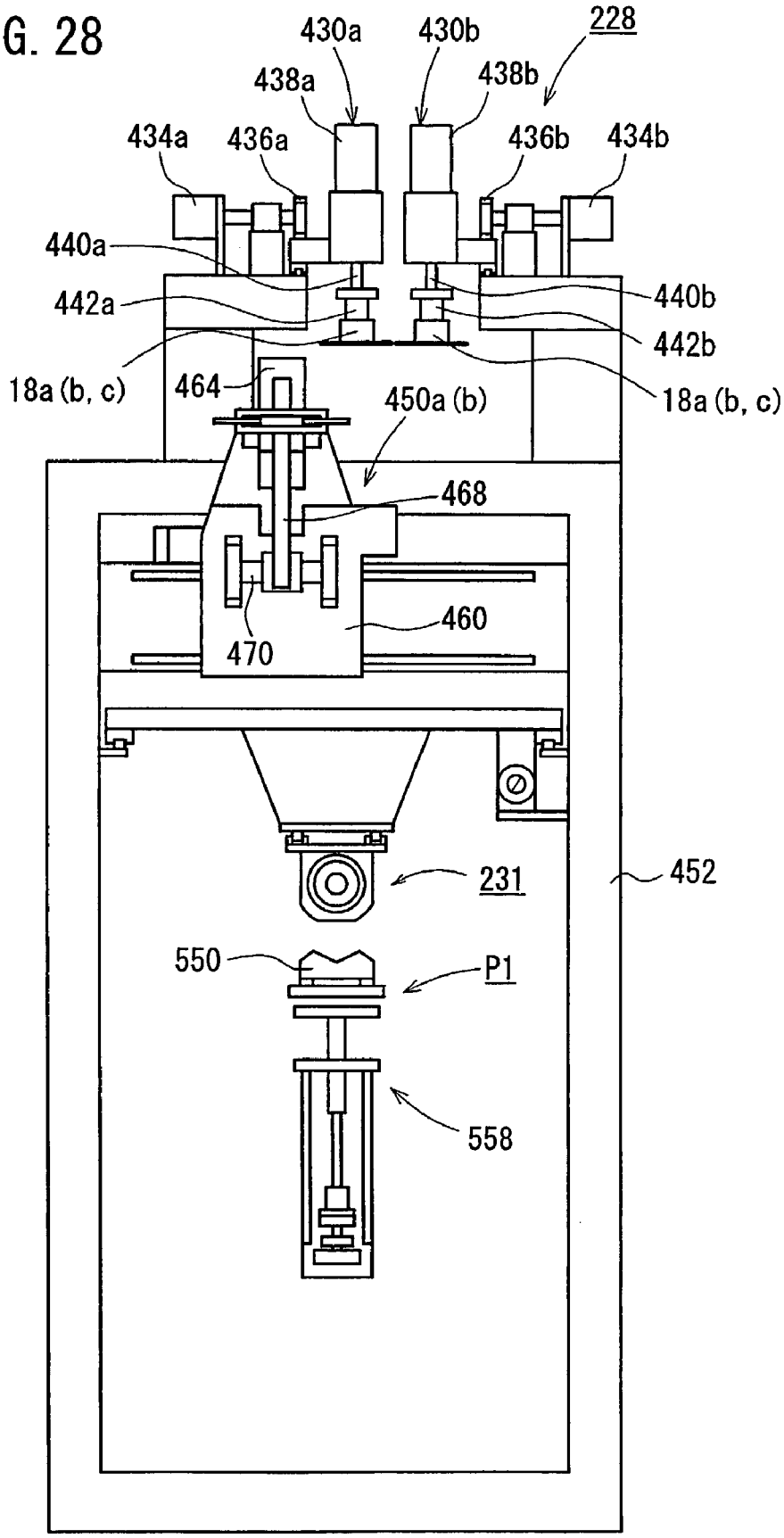
FIG. 28 is a side elevational view of the flanged member installing device.

The first and second shutters 410, 412 are disposed on a light-shielding member feed path, and alternately opens and closes first and second openings 424, 426. The first flanged member feeding device 228 has first and second horizontal feed means 430*a*, 430*b* disposed for movement along respective guide rails 432*a*, 432*b* in a region of the dark chamber 11 which is closed by the second shutter 412. As shown in FIG. 28, the first and second horizontal feed means 430*a*, 430*b* are fixed to respective belts 436*a*, 436*b* which are driven in circulation by respective motors 434*a*, 434*b*, and movable to a position above the light-shielding member installing position P1 along the guide rails 432*a*, 432*b*.

The first and second horizontal feed means 430*a*, 430*b* have respective vertical cylinders 438*a*, 438*b* having respective downwardly extending rods 440*a*, 440*b* which support thereon respective chucks 442*a*, 442*b* for holding 2-inch first flanged member 18*a*, 18*c* and a 3-inch first flanged member 18*b* at their inner circumferential surfaces.

Figure 29:
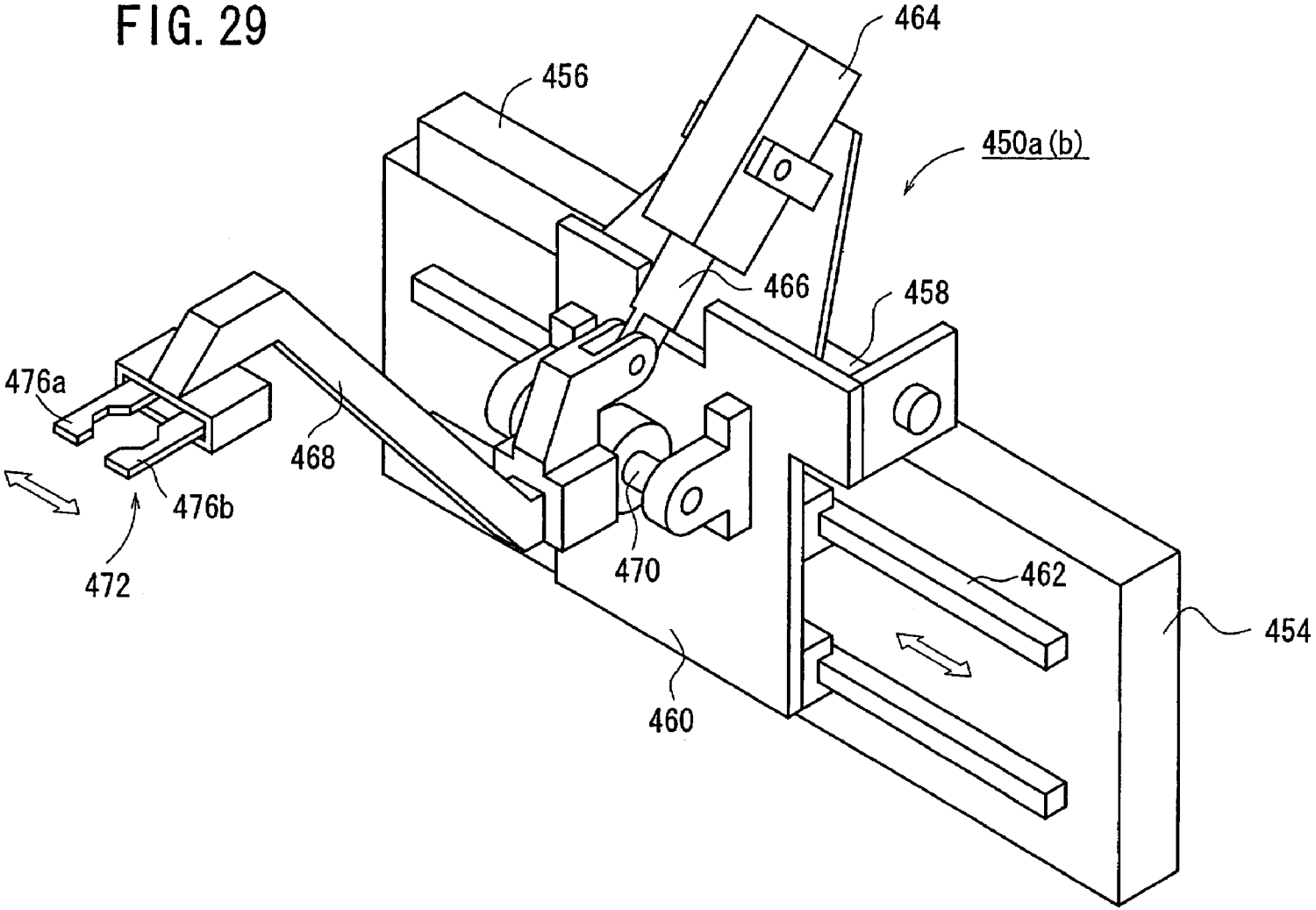
FIG. 29 is a perspective view of first and second light-shielding member transfer means.
Figure 30:
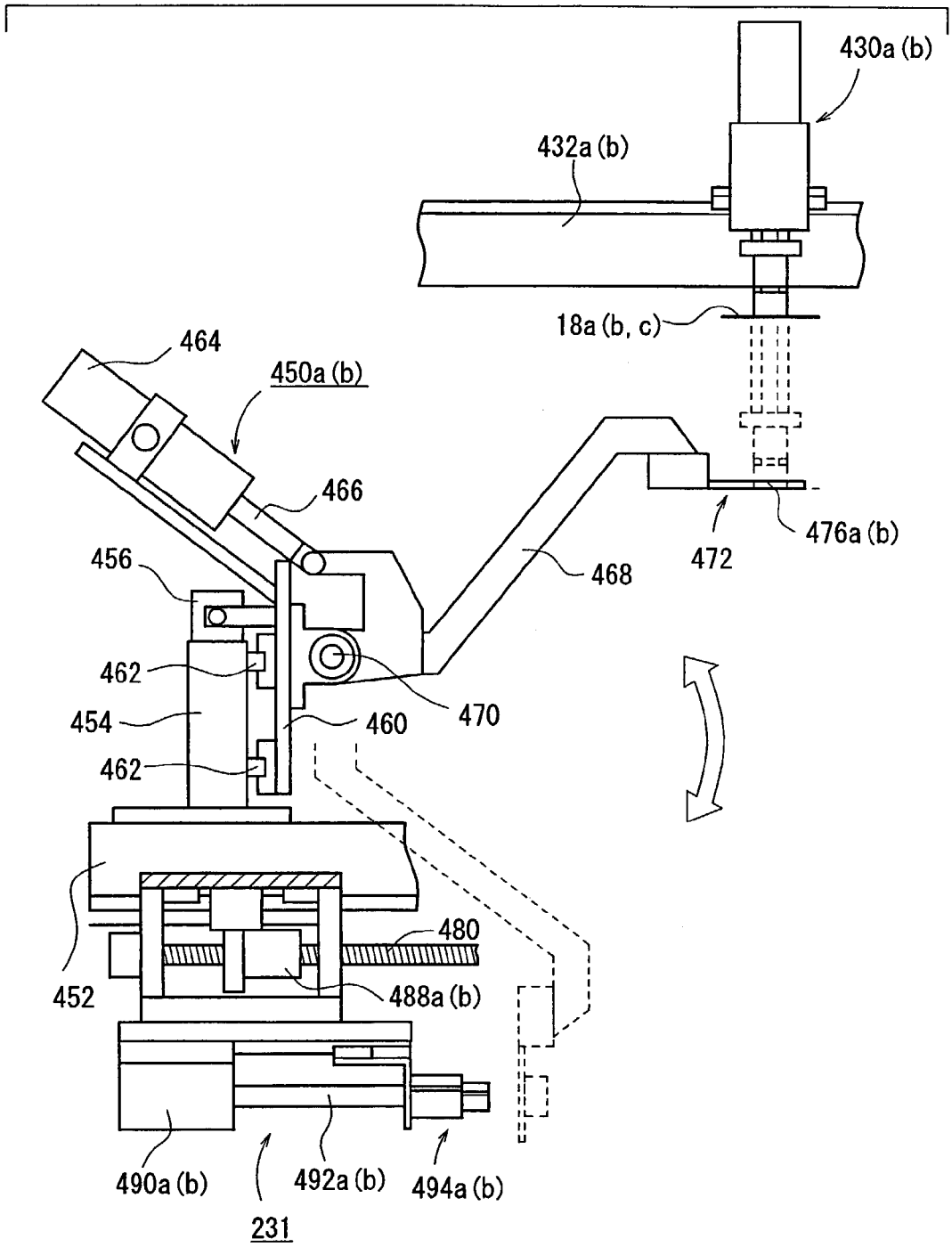
FIG. 30 is a front elevational view of the first and second light-shielding member transfer means.

The first flanged member 18*a*, 18*b*, or 18*c* (hereinafter referred to as "first flanged member 18*a*") fed by the first and second horizontal feed means 430*a*, 430*b* is received by first and second light-shielding member transfer means 450*a*, 450*b*, which transfer the first flanged member 18*a* to the inserting mechanism 231. Each of the first and second light-shielding member transfer means 450*a*, 450*b* has a base 454 fixedly mounted on a frame 452. As shown in FIGS. 29 and 30, a cylinder 456 is horizontally mounted on the base 454 and has a rod 458 fixed to a base 460. The base 460 is supported on the base 454 by linear guides and horizontally movable along the linear guides 462.

A cylinder 464 is mounted on the base 460 and has a rod 466 engaging a swing arm 468. The swing arm 468 is swingable in an angular range of about 90° about a support shaft 470, and supports a chuck 472 on its distal end. The chuck 472 has a pair of fingers 476*a*, 476*b* movable toward and away from each other.

The inserting mechanism 231 is disposed in a lowermost position to which the swing arm 468 is angularly movable. As shown in FIG. 26, the inserting mechanism 231 has a ball screw 480 extending in the axial direction (transverse direction) of the photosensitive roll 12 and rotatably supported on the frame 452. The ball screw 480 is rotatable about its own axis by a motor 482 through a gear train 484. A pair of guide rods 485 (see FIG. 27) extends parallel to the ball screw 480, and first and second slide bases 486*a*, 486*b* are supported on the guide rods 485.

The first and second slide bases 486*a*, 486*b* have respective nuts 488*a*, 488*b* threaded over the ball screw 480. The ball screw 480 has reversely threaded structures one on each side of its center, so that the first and second slide bases 486*a*, 486*b* can move in unison in directions toward and away from each other. Cylinders 490*a*, 490*b* are mounted respectively on the first and second slide bases 486*a*, 486*b* and have respective horizontal rods 492*a*, 492*b* with respective inserters 494*a*, 494*b* coupled to their distal ends.

Figure 31:
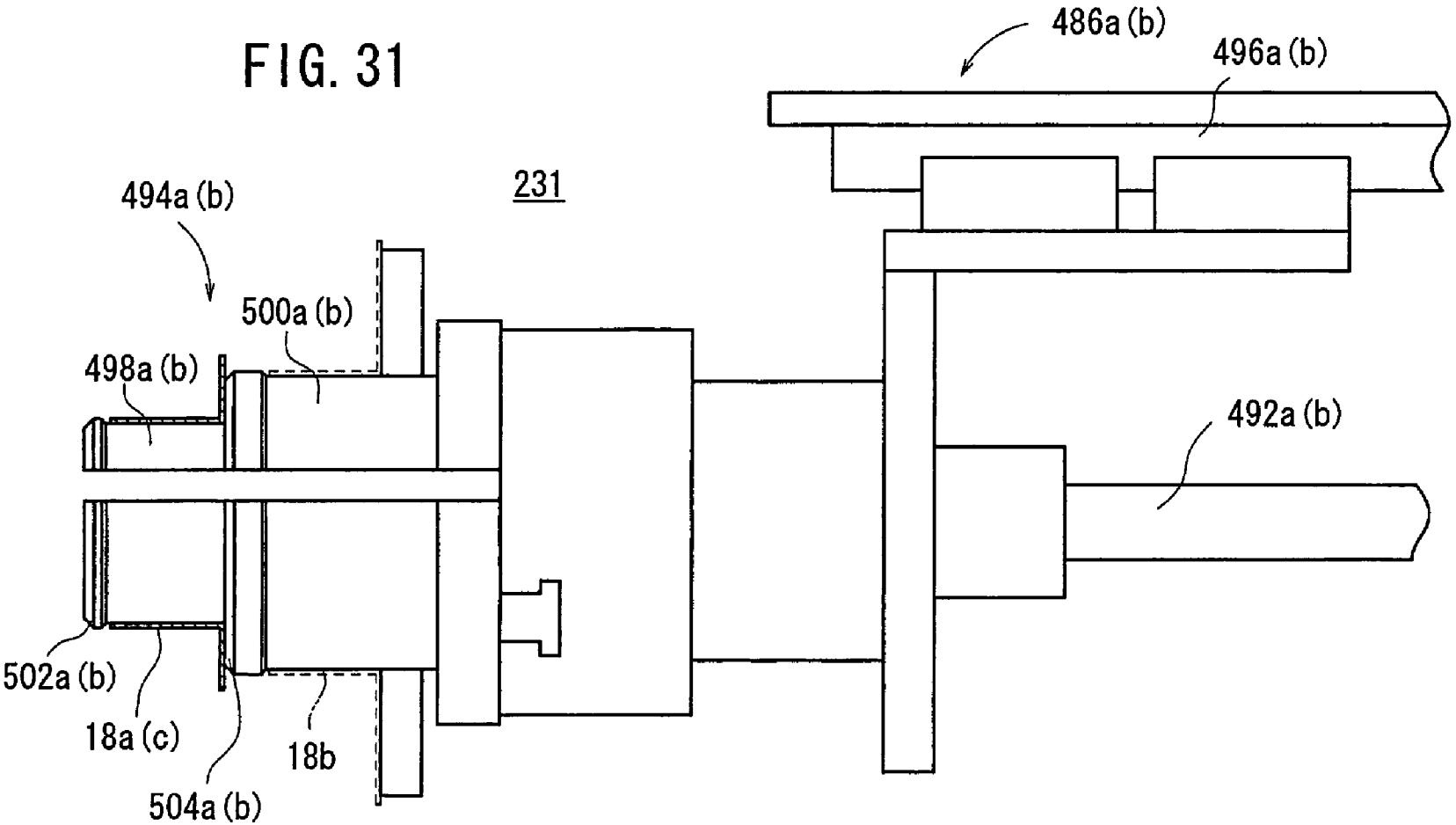
FIG. 31 is an enlarged side elevational view of an inserter of an inserting mechanism.

As shown in FIG. 31, the inserters 494*a*, 494*b* are movable in opposite directions along the respective first and second slide bases 486*a*, 486*b* by respective guides 496*a*, 496*b*. Radially expandable and contractible chucks 498*a*, 498*b* and 500*a*, 500*b*, which have different diameters, are coaxially mounted on distal end portions of the inserters 494*a*, 494*b*. The radially expandable and contractible chucks 498*a*, 498*b* are capable of holding the inner circumferential surface of the 2-inch first flanged member 18*a* (18*c*), whereas the radially expandable and contractible chucks 500*a*, 500*b* are capable of holding the inner circumferential surface of the 3-inch first flanged member 18*b*. The radially expandable and contractible chucks 498*a*, 498*b* and 500*a*, 500*b* have tapered surfaces 502*a*, 502*b* and 504*a*, 504*b*, respectively, on their tip ends.

Figure 32:
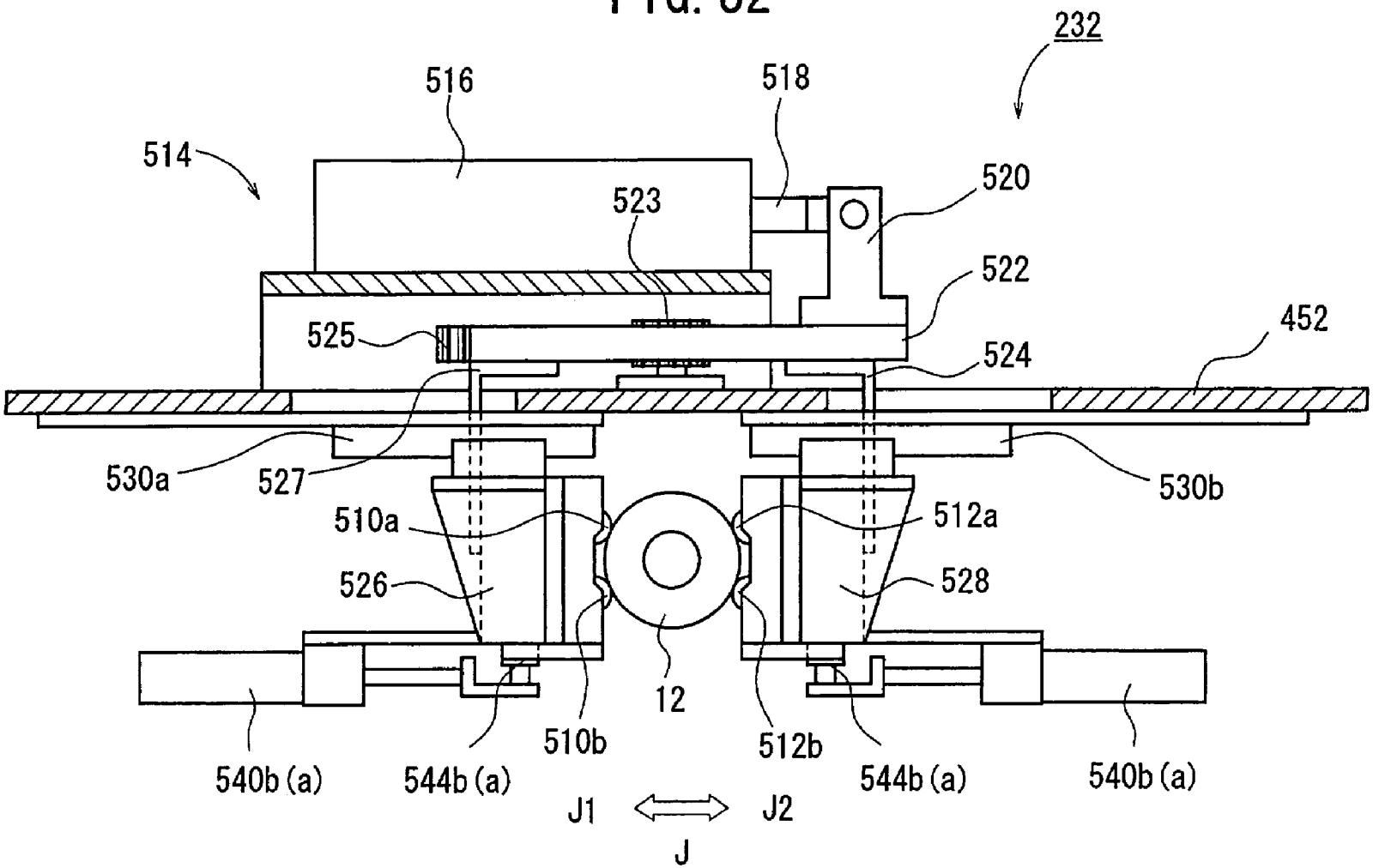
FIG. 32 is a front elevational view, partly in cross section, of a centering mechanism.
Figure 33:
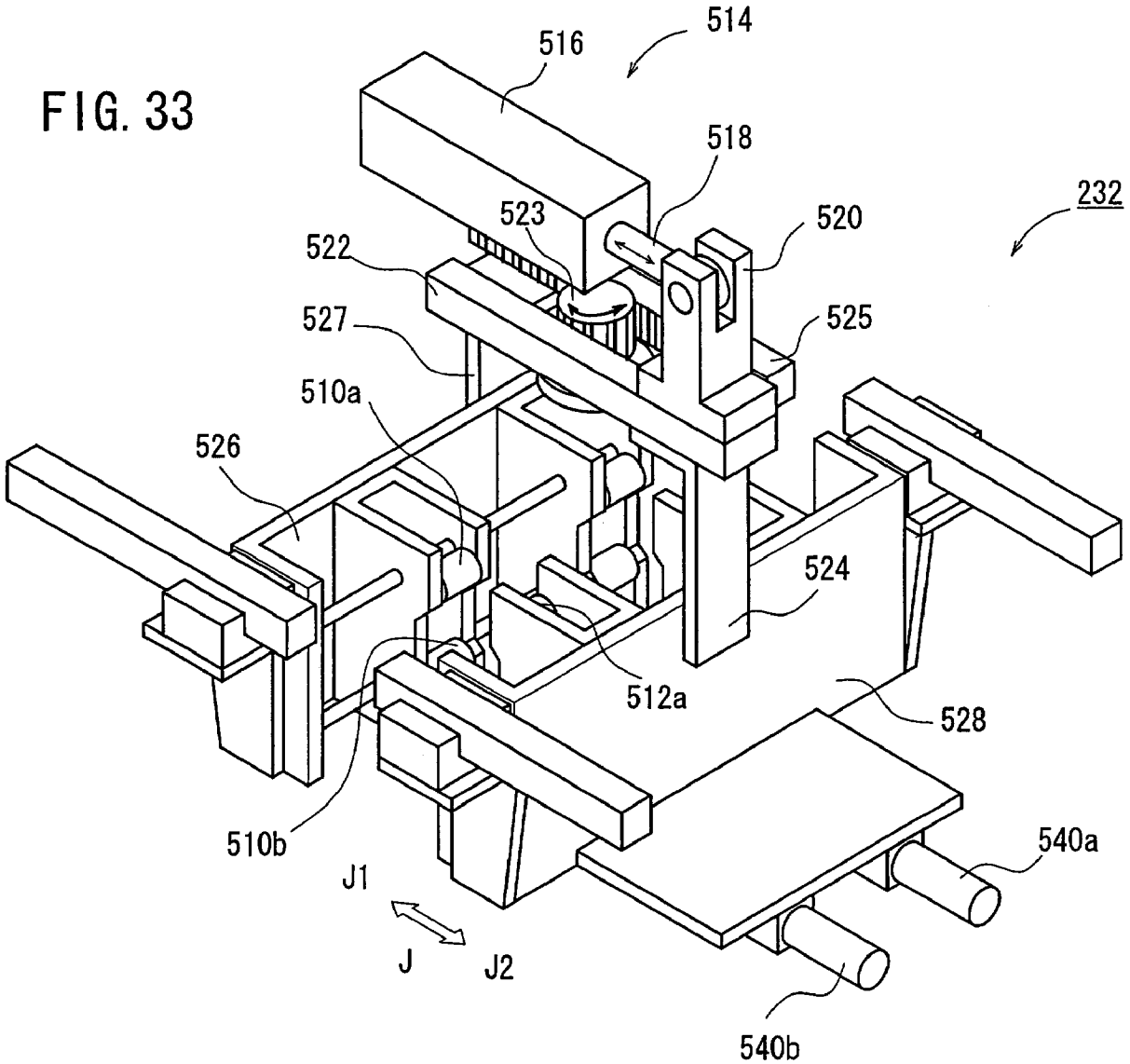
FIG. 33 is a fragmentary perspective view of the centering mechanism.
Figure 34:
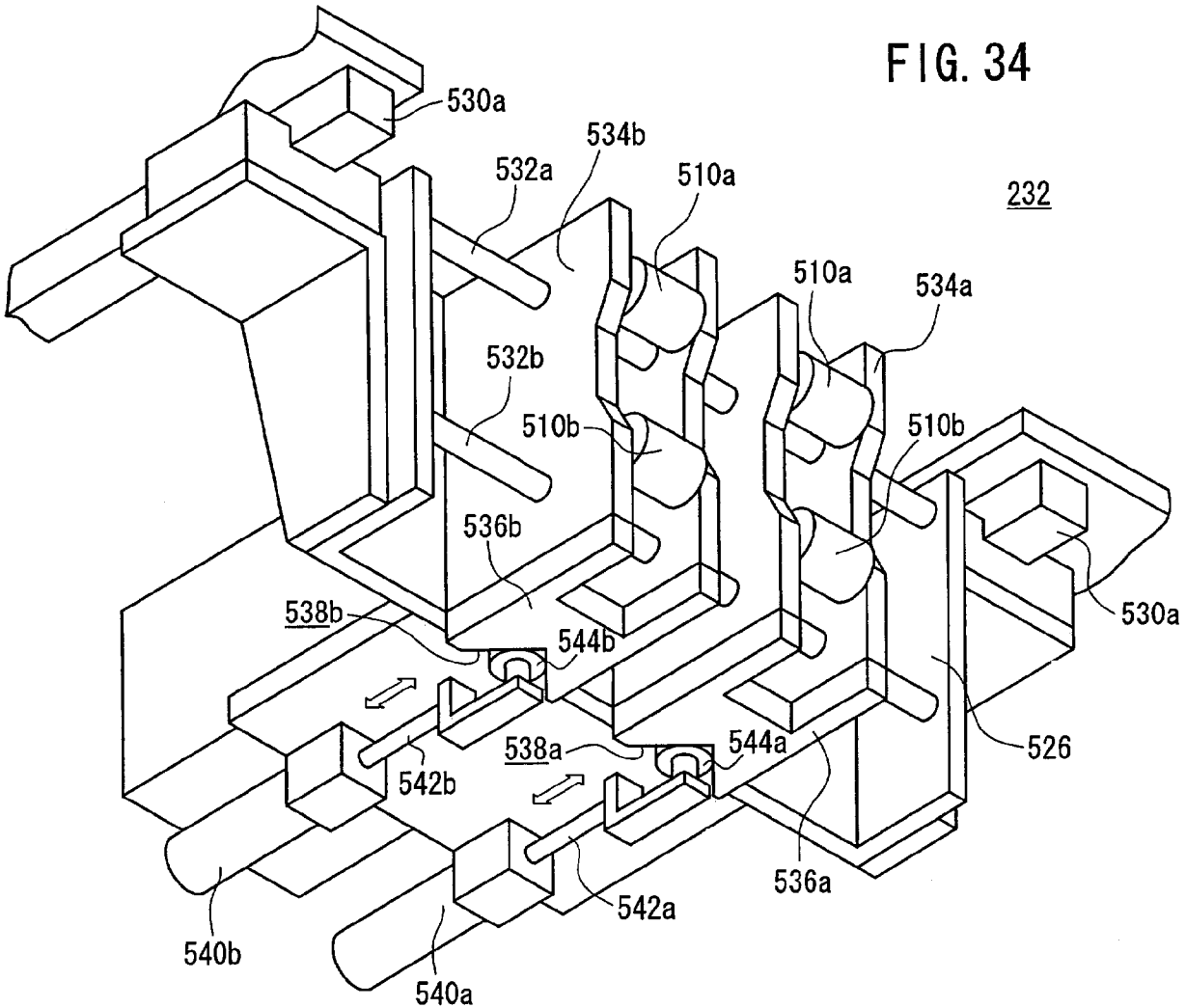
FIG. 34 is a fragmentary perspective view showing the bottom side of the centering mechanism.

As shown in FIGS. 32 through 34, the centering mechanism 232 comprises first centering rollers 510*a*, 510*b* and second centering rollers 512*a*, 512*b* disposed diametrically across the photosensitive roll 12 in confronting relation to each other in the direction indicated by the arrow J, and an actuating means 514 for moving the first centering rollers 510*a*, 510*b* and second centering rollers 512*a*, 512*b* toward and away from each other.

The actuating means 514 has a cylinder 516 mounted on the frame 452 and having a rod 518 that is connected to a first rack 522 by a coupling 520. A second movable base 528 is fixed to the first rack 522 by a first attachment plate 524. The first rack 522 is elongate in the direction indicated by the arrow J, and a pinion 523 is held in mesh with an intermediate portion of the first rack 522. The pinion 523 is also held in mesh with a second rack 525 extending parallel to the first rack 522. A first movable base 526 is fixed to the second rack 525 by a second attachment plate 527. The first and second movable bases 526, 528 are guided by respective guide rails 530*a*, 530*b* mounted on the frame 452.

Figure 35:
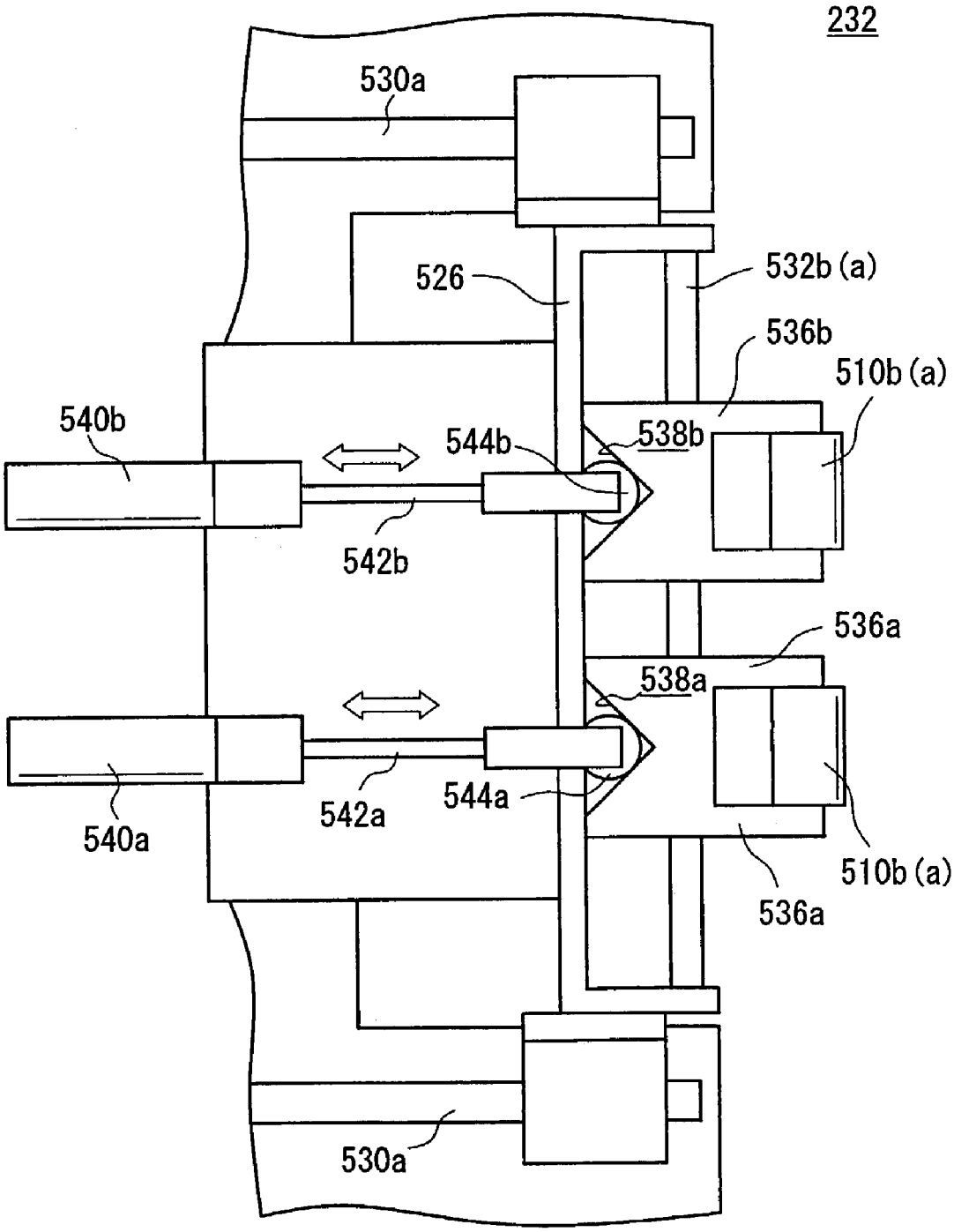
FIG. 35 is a bottom view of the centering mechanism.

As shown in FIG. 34, movable blocks 534*a*, 534*b* are movably supported on the first movable base 526 by upper and lower pairs of guide bars 532*a*, 532*b*. The first centering rollers 510*a*, 510*b* are rotatably mounted on the movable blocks 534*a*, 534*b*. As shown in FIGS. 34 and 35, plates 536*a*, 536*b* are secured to the movable blocks 534*a*, 534*b*, respectively, and have respective V-shaped notches 538*a*, 538*b* defined therein. Cylinders 540*a*, 540*b* are fixed to the first movable base 526, and have respective rods 542*a*, 542*b* projecting therefrom with positioning rollers 544*a*, 544*b* rotatably supported on respective tip ends thereof. The positioning rollers 544*a*, 544*b* can engage in the respective V-shaped notches 538*a*, 538*b* in the plates 536*a*, 536*b* (see FIGS. 34 and 35).

The movable base 528 is structurally identical to the movable base 526. Those parts of the movable base 528 which are identical to those of the movable base 526 are denoted by identical reference characters, and will not be described in detail below.

Figure 36:
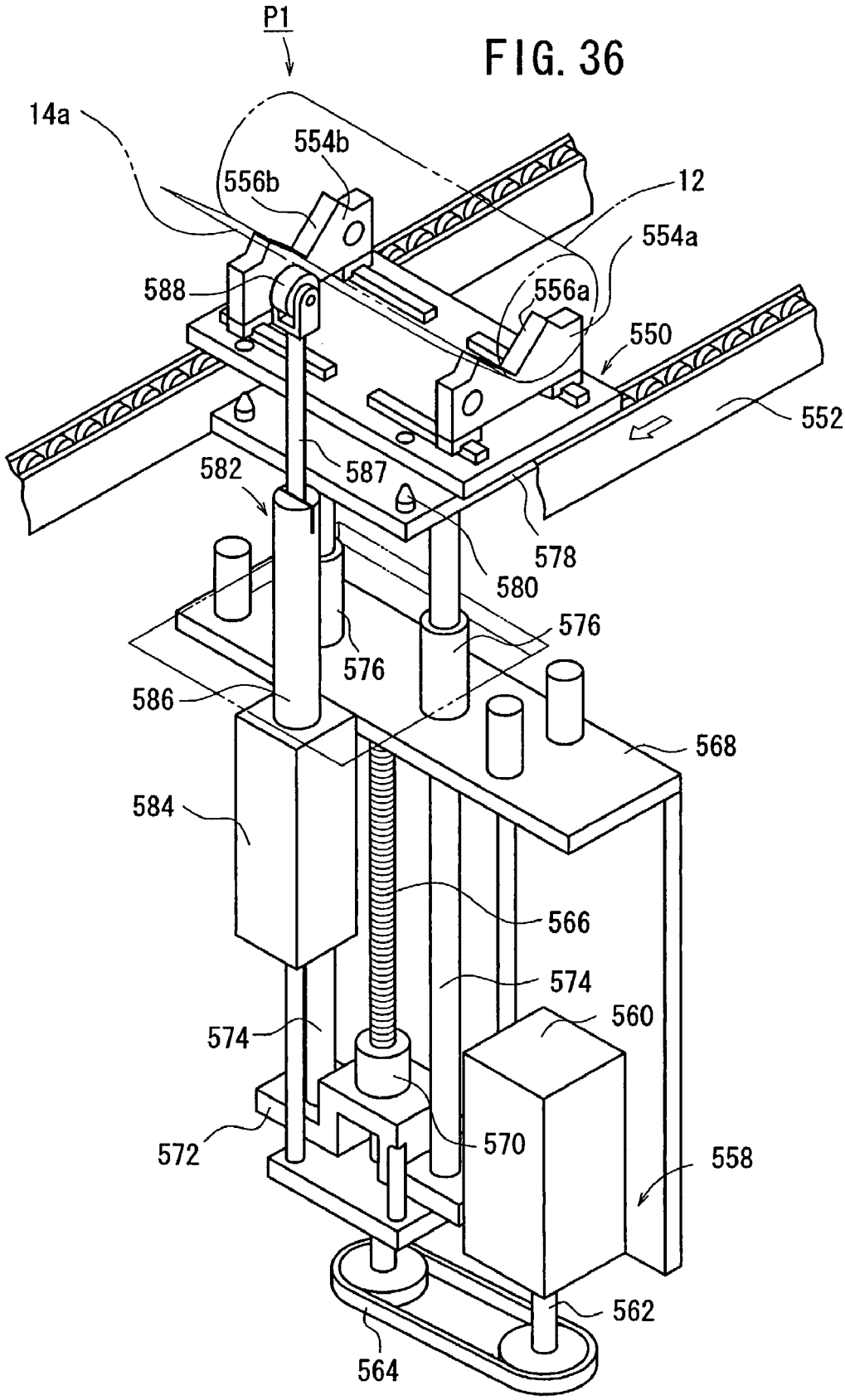
FIG. 36 is a perspective view of the pallet and a lifting and lowering mechanism.
Figure 37:
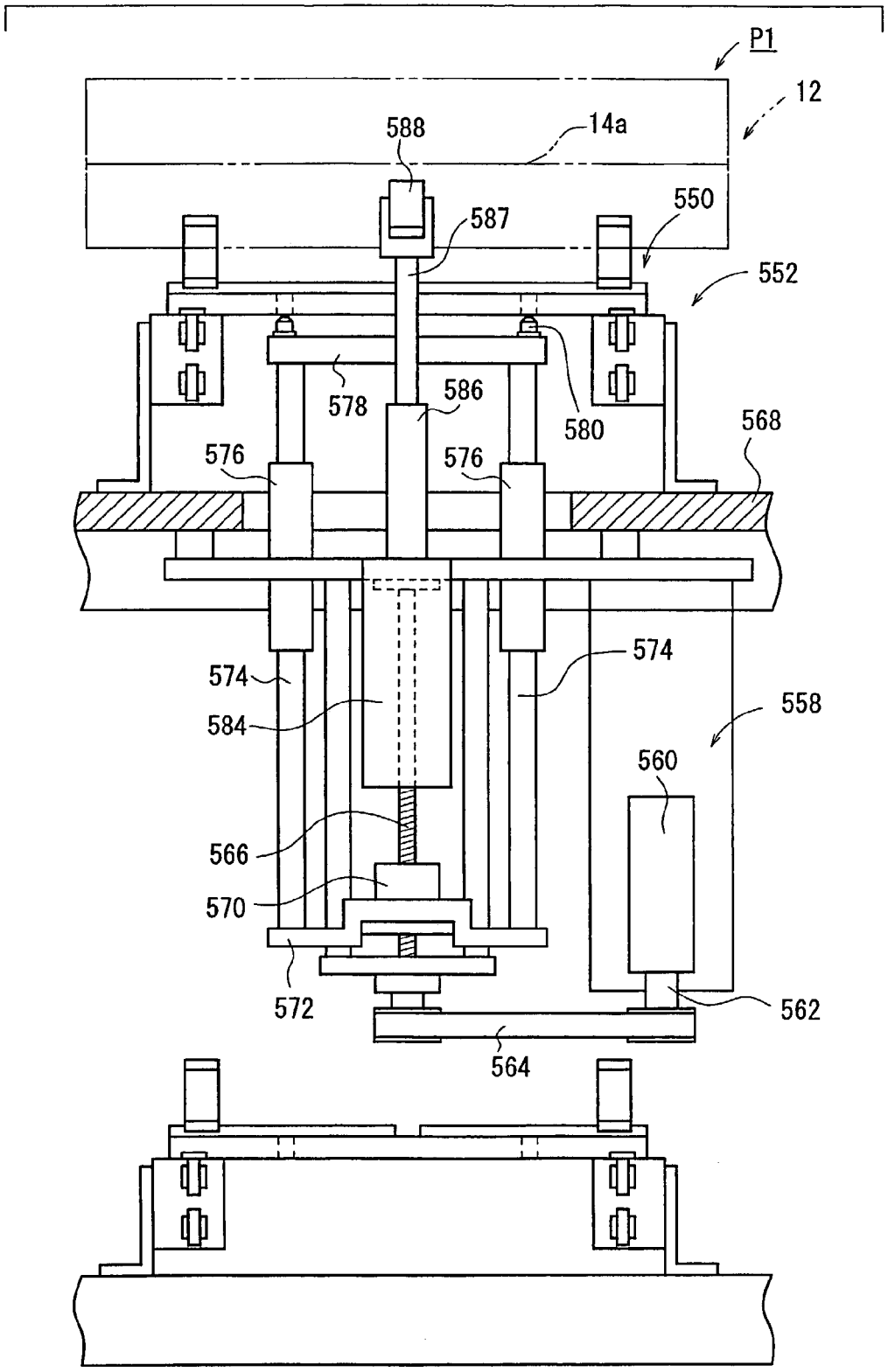
FIG. 37 is a front elevational view of the pallet and the lifting and lowering mechanism.

As shown in FIGS. 36 and 37, a photosensitive roll 12 is placed on a pallet 550 and fed to the light-shielding member installing position P1 by a conveyor 552. The photosensitive roll 12 is then fed from the light-shielding member installing position P1 to a next process. The pallet 550 has a pair of placement blocks 554*a*, 554*b* which are movable relatively to each other to adjust the distance therebetween to one of two values depending on a change in the axial length of the photosensitive roll 12. The placement blocks 554*a*, 554*b* have respective substantially V-shaped placement surfaces 556*a*, 556*b* for placing thereon photosensitive rolls 12 of various different diameters.

A lifting and lowering device 558 for lifting the pallet 550 with the photosensitive roll 12 placed thereon to a vertical light-shielding member installing position is disposed in the light-shielding member installing position P1. The lifting and lowering device 558 has a servomotor 560 with a brake as a rotary actuator which has a rotatable shaft 562 that is operatively coupled to a ball screw 566 by a belt and pulley means 564. The ball screw 566 extends vertically and has its upper end lower ends rotatably supported by a frame 568.

The ball screw 566 is threaded through a nut 570 mounted on a vertically movable base 572 affixed to the lower ends of a pair of guide bars 574 extending parallel to the ball screw 566. The guide bars 574 are supported on the frame 568 by respective linear bushings 576, and support on their upper ends a vertically movable plate 578 fixed thereto.

The vertically movable plate 578 supports a plurality of pins 580 for engaging the pallet 550. An end pressing mechanism 582 is provided for pressing the end 14*a* of the photosensitive sheet 14 against the outer circumferential surface of the photosensitive sheet 14. The end pressing mechanism 582 has a cylinder 584 having an upwardly extending rod 586 which supports on its upper end a leaf spring 587 with a pressing roller 588 mounted on its upper end.

Figure 38:
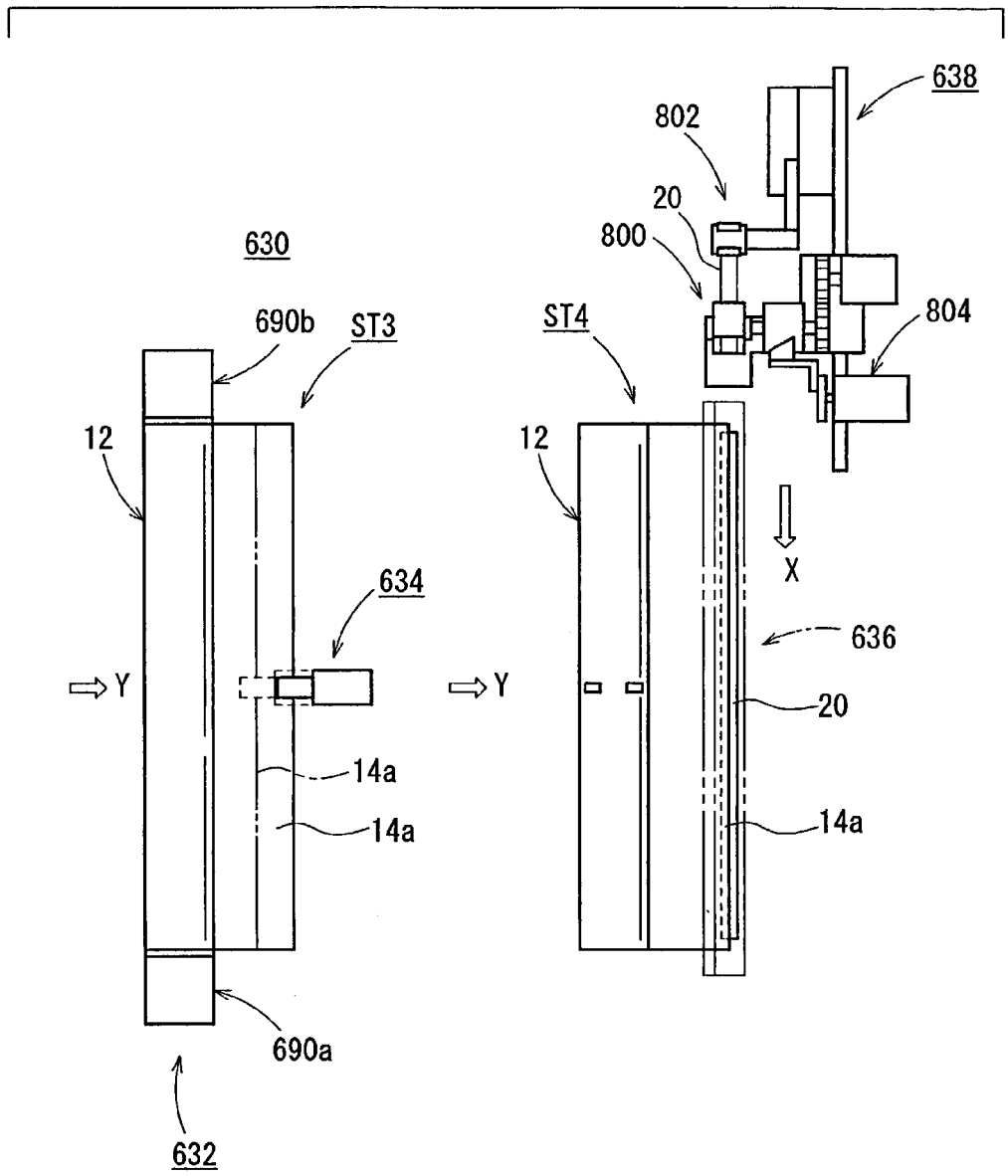
FIG. 38 is a plan view of an end drawing station and an applying station.

As shown in FIG. 38, the automatic packaging system 10 has a tape member applying device 630 for automatically applying the joint tape 20 to the end 14*a* of the photosensitive sheet 14. The tape member applying device 630 comprises a rotary support mechanism 632 disposed in the end drawing station ST3 for rotatably supporting the opposite ends of the photosensitive roll 12 and applying a predetermined tension to the photosensitive roll 12 when the end 14*a* of the photosensitive sheet 14 is drawn, an end drawing mechanism 634 disposed in the end drawing station ST3 for gripping and drawing the end 14*a* to a prescribed length, a pressing mechanism 636 disposed in the applying station ST4 for supporting the end 14*a* drawn to the prescribed length from its opposite surfaces, and an applying mechanism 638 disposed in the applying station ST4 for applying the joint tape 20 to the end 14*a* supported by the pressing mechanism 636 in the transverse direction indicated by the arrow X of the photosensitive roll 12.

Figure 39:
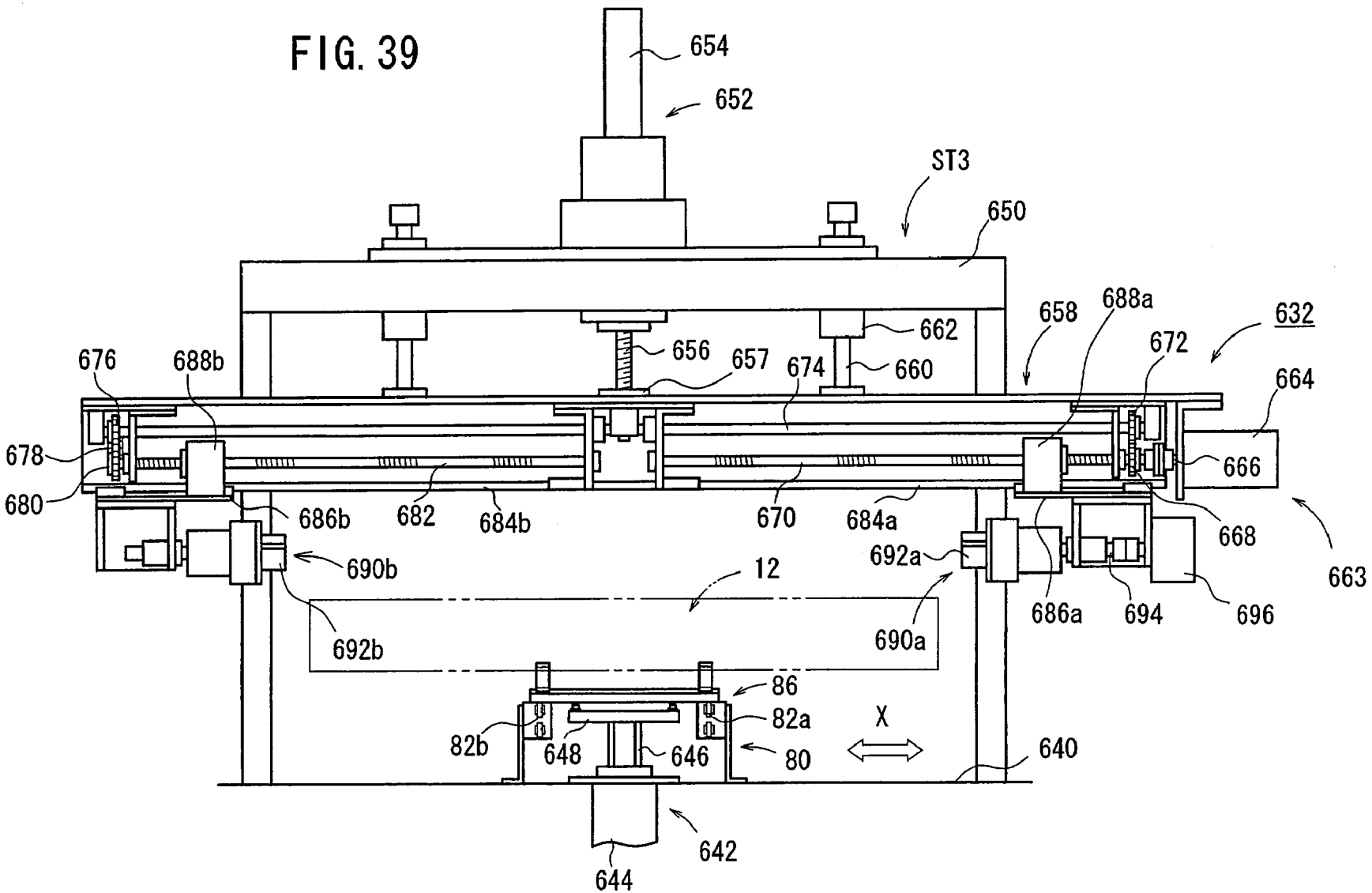
FIG. 39 is a front elevational view of a rotary support mechanism of an end processing device.
Figure 40:
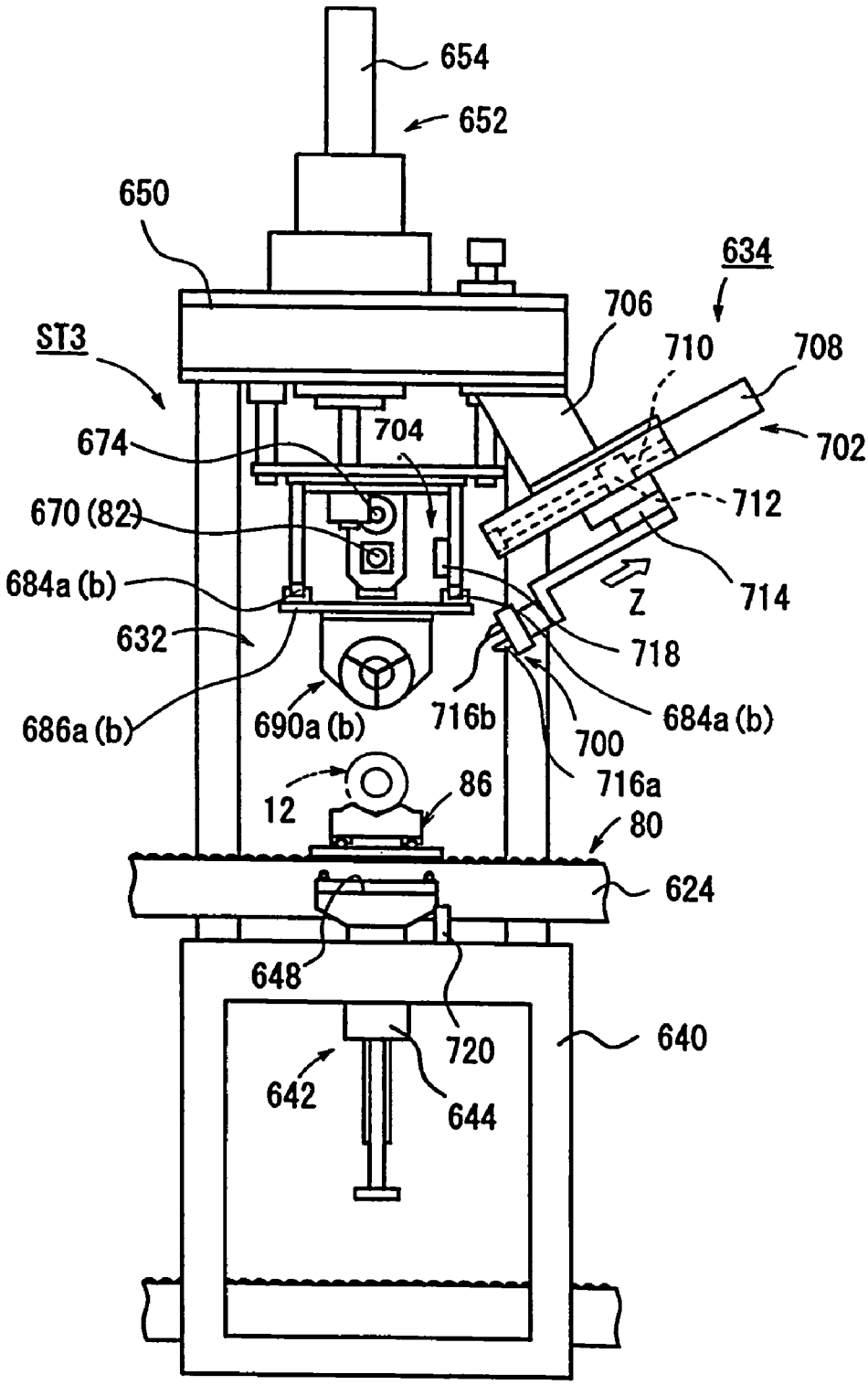
FIG. 40 is a side elevational view of the rotary support mechanism and an end drawing mechanism.

As shown in FIGS. 39 and 40, the end drawing station ST3 has a base 640 with a pallet lifting and lowering unit 642 mounted thereon. The pallet lifting and lowering unit 642 has a cylinder 644 fixed to the base 640 and having an upwardly extending rod 646 to which a vertically movable base 648 is secured. The vertically movable base 648 can engage a pallet 86 which has been fed by the upper feed conveyors 82*a*, 82*b* and feed the pallet 86 above the upper feed conveyors 82*a*, 82*b*.

Figure 41:
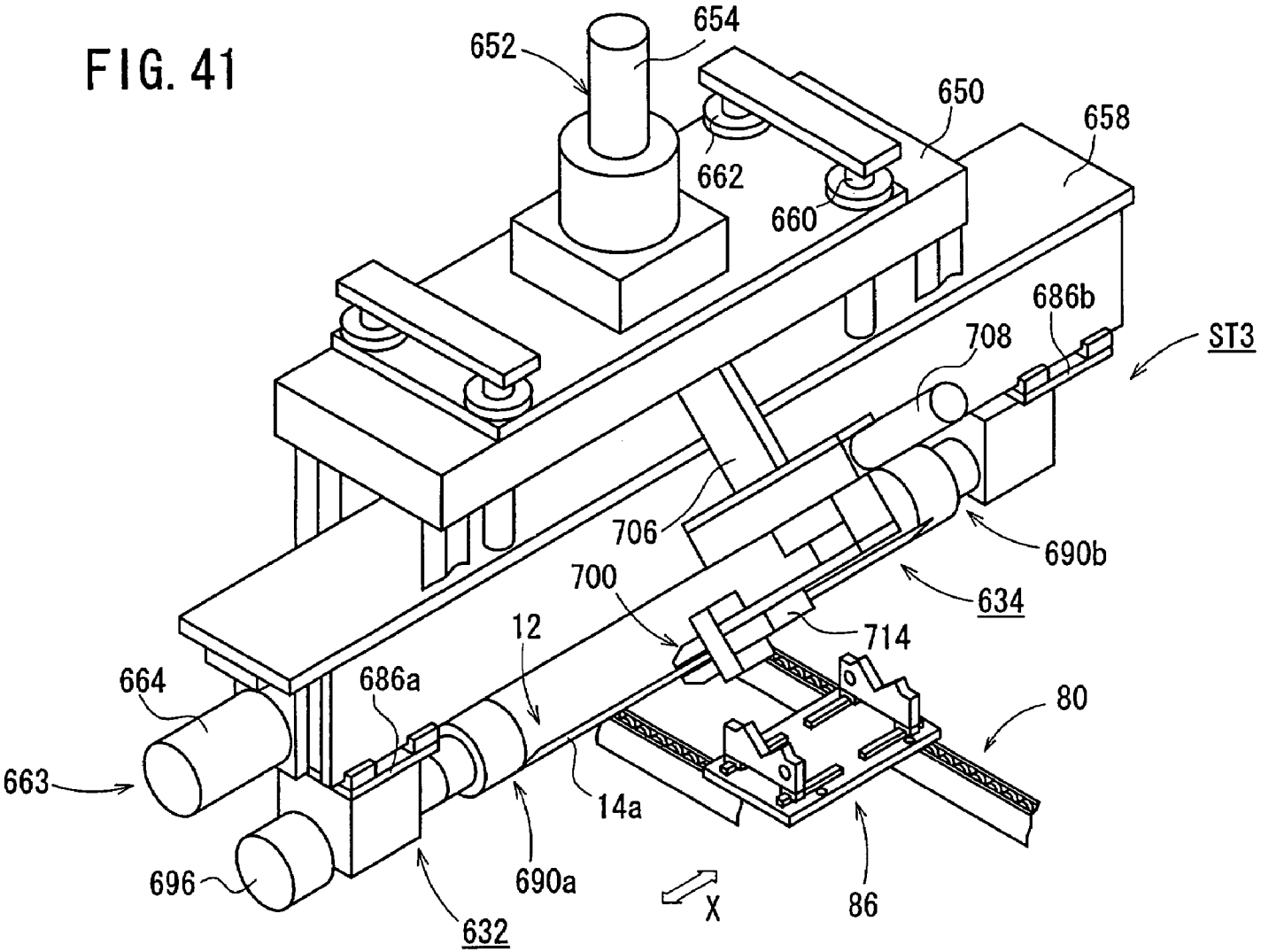
FIG. 41 is a perspective view of the rotary support mechanism and the end drawing mechanism.

A frame 650 is mounted on the base 640 and supports thereon a moving unit 652 of the rotary support mechanism 632. As shown in FIGS. 39 through 41, the moving unit 642 has a motor 654 fixedly mounted on the frame 650 and directed downwardly, and having a downwardly extending rotatable drive shaft (not shown) to which a ball screw 656 is coaxially connected. The ball screw 656 is threaded through a nut 657 fixed to a vertically movable frame 658 which extends transversely across the photosensitive roll 12 in the direction indicated by the arrow X. Four guide rods 660 have lower ends screwed to the vertically movable frame 658 and upper ends inserted slidably in respective guide rods 662 attached to the frame 650.

A drive unit 663 has a motor 664 mounted on a longitudinal end of the vertically movable frame 658 and having a rotatable drive shaft 666 to which there are coaxially fixed a drive gear 668 and a first ball screw 670. The drive gear 668 is held in mesh with a driven gear 672 fixedly mounted on an end of a rotatable shaft 674 whose opposite ends and central portion are rotatably supported on the vertically movable frame 658.

The rotatable shaft 674 has a first gear 676 mounted on an end thereof remote from the driven gear 672 and held in mesh with a second gear 678 meshing with a third gear 680. The third gear 680 is mounted on an end of a second ball screw 682 which is coaxial with the first ball screw 670 and is rotatably supported on the vertically movable frame 658.

The vertically movable frame 658 has a set of guide rails 684*a*, 684*b* extending parallel to the first and second ball screws 670, 682, and first and second slide bases 686*a*, 686*b* are slidably supported on the guide rails 684*a*, 684*b*. The first and second slide bases 686*a*, 686*b* support first and second nuts 688*a*, 688*b* fixed thereto which are threaded respectively over the first and second ball screws 670, 682. First and second chucks 690*a*, 690*b* are rotatably supported on lower surfaces of the first and second slide bases 686*a*, 686*b*, respectively.

The first and second chucks 690*a*, 690*b* have a plurality of openable and closable claws 692*a*, 692*b* which are insertable in the opposite ends of the photosensitive roll 12 and movable radially inwardly and outwardly in the photosensitive roll 12. A powder clutch (tension applying unit) 696 is connected to a shaft 694 of the first chuck 690*a*.

As shown in FIGS. 40 and 41, the end drawing mechanism 634 comprises a gripper 700 for gripping a substantially central area of the end 14*a* of the photosensitive sheet 14, an actuator 702 for moving the gripper 700 in the direction indicated by the arrow Z to draw the end 14*a*, and a detecting assembly 704 for detecting a drawn length of the end 14*a*.

The actuator 702 has a motor 708 fixed to the frame 650 by an attachment plate 706 and having a ball screw 710 connected to the drive shaft of the motor 708 and threaded through a nut 712. The nut 712 is mounted on a movable base 714 with the gripper 700 being mounted on a distal end of the movable base 714. The gripper 700 has a pair of gripping fingers 716*a*, 716*b* movable toward and away from each other for gripping and releasing the end 14*a* of the photosensitive sheet 14.

The detecting assembly 704 has an infrared emitter 718 and an infrared detector 720 for detecting the end 14*a* of the photosensitive sheet 14. The infrared emitter 718 is mounted on the vertically movable frame 658, and the infrared detector 720 is mounted on the base 640.

Figure 42:
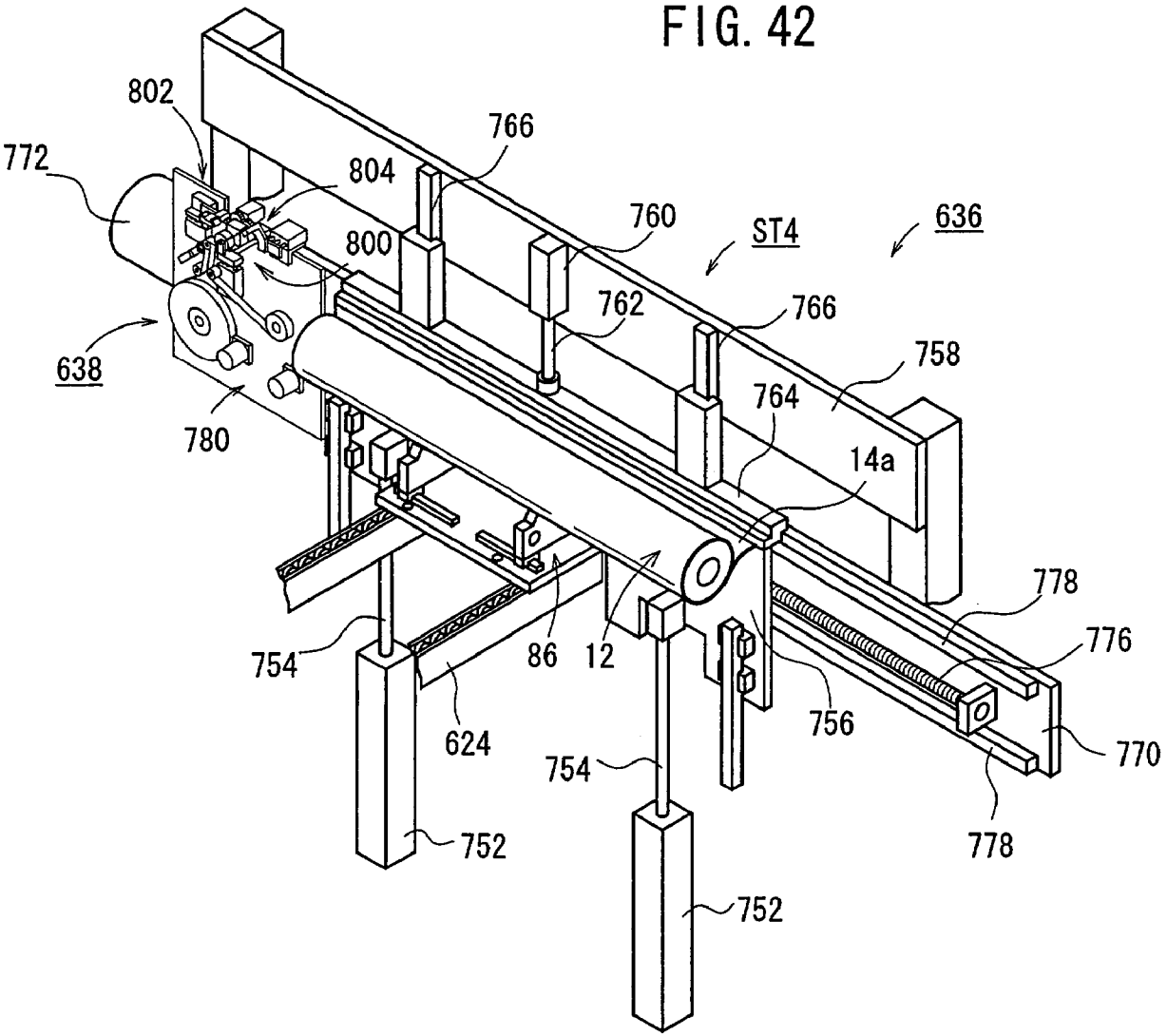
FIG. 42 is a perspective view of a pressing mechanism and an applying mechanism of the end processing device.
Figure 43:
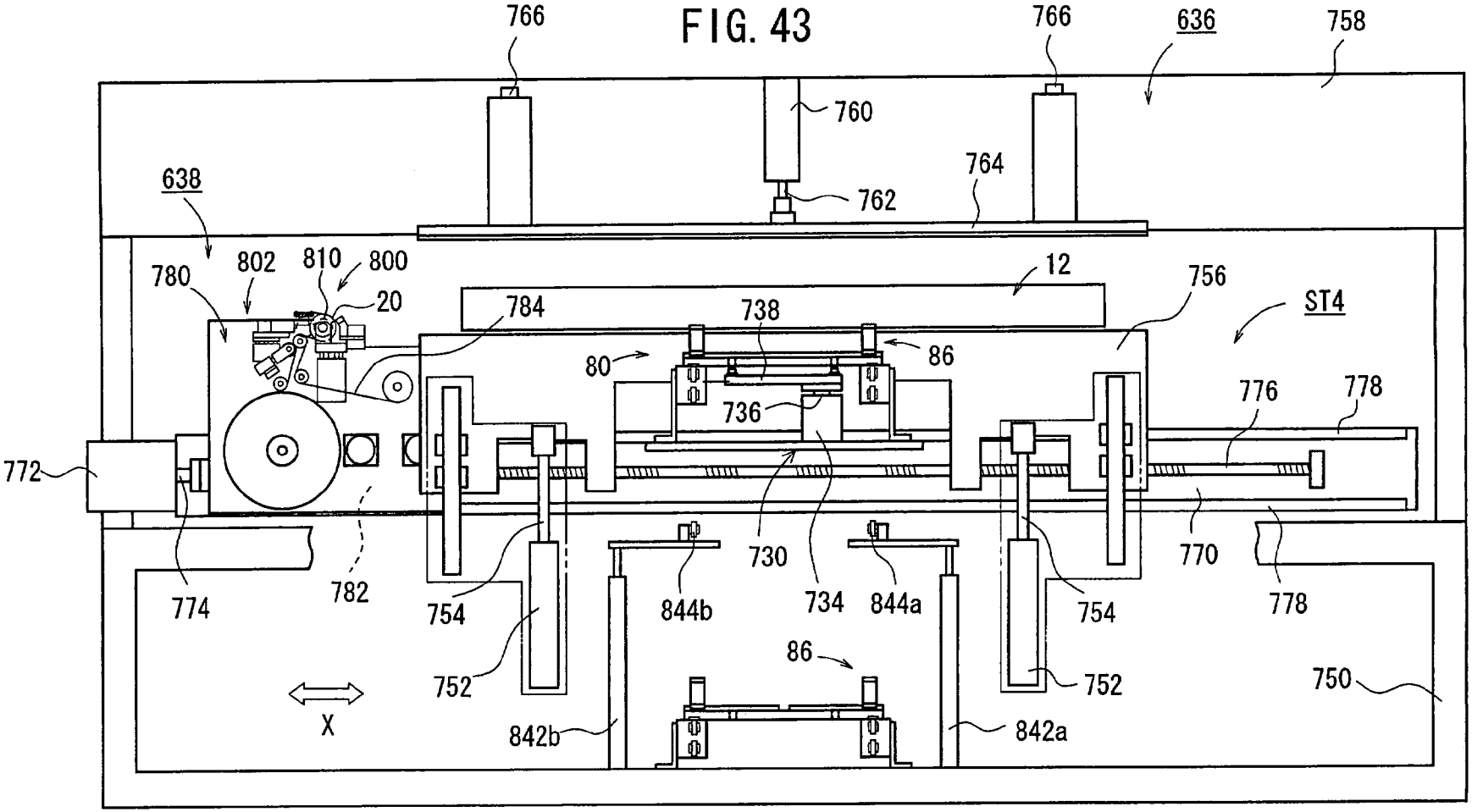
FIG. 43 is a front elevational view of the pressing mechanism and the applying mechanism.
Figure 44:
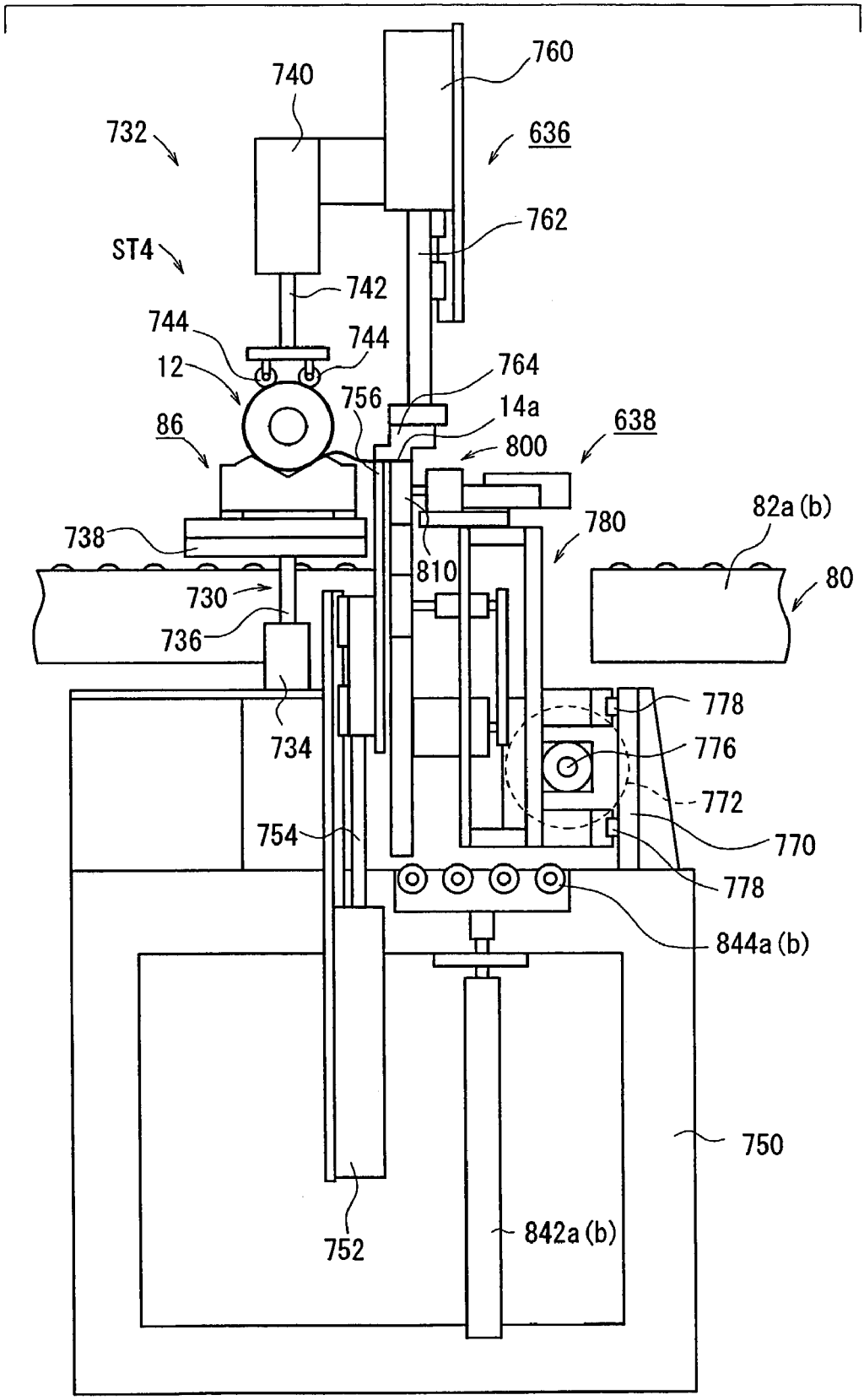
FIG. 44 is a side elevational view of the pressing mechanism and the applying mechanism.

As shown in FIGS. 42 through 44, the applying station ST4 has a pallet lifting and lowering unit 730 for lifting and lowering the pallet 86, and a roller presser 732 for holding an upper surface of the photosensitive roll 12 which is lifted by the pallet lifting and lowering unit 730.

The pallet lifting and lowering unit 730 has a cylinder 734 having an upwardly extending rod 736 on which a vertically movable base 738 is supported. The roll presser 732 has a cylinder 740 having a downwardly extending rod 742 on which there are supported a plurality of rollers 744 (see FIG. 44) for holding an upper outer circumferential surface of the photosensitive roll 12.

As shown in FIGS. 42 through 44, the pressing mechanism 636 has a pair of laterally spaced cylinders 752 fixed to a base 750 and having respective upwardly extending rods 754 to which there is fixed a first pressing member 756 disposed below one surface (lower surface) of the end 14*a* of the photosensitive sheet 14 and extending transversely across the end 14*a*. A cylinder 760 is mounted on the base 750 by a frame 758 and has a downwardly extending rod 762 to which there is fixed a second pressing member 764 disposed above the other surface (upper surface) of the end 14*a* and extending transversely across the end 14*a*. The second pressing member 764 is guided for its vertical movement by a pair of laterally spaced linear guides 766.

The applying mechanism 638 has a support member 770 fixedly mounted on the base 750 and having a length greater than the width of the photosensitive roll 12. A motor 772 is mounted on an end of the support member 770. The motor 772 has a rotatable drive shaft 774 to which there is coaxially connected a ball screw 776 that is rotatably supported on the support member 770. A pair of vertically spaced guide rails 778 with the ball screw 776 disposed therebetween is mounted on a vertical surface of the support member 770. A slide unit 780 is supported on the guide rails 778 for movement in the direction indicated by the arrow X. The slide unit 780 has a nut 782 threaded over the ball screw 776.

Figure 45:
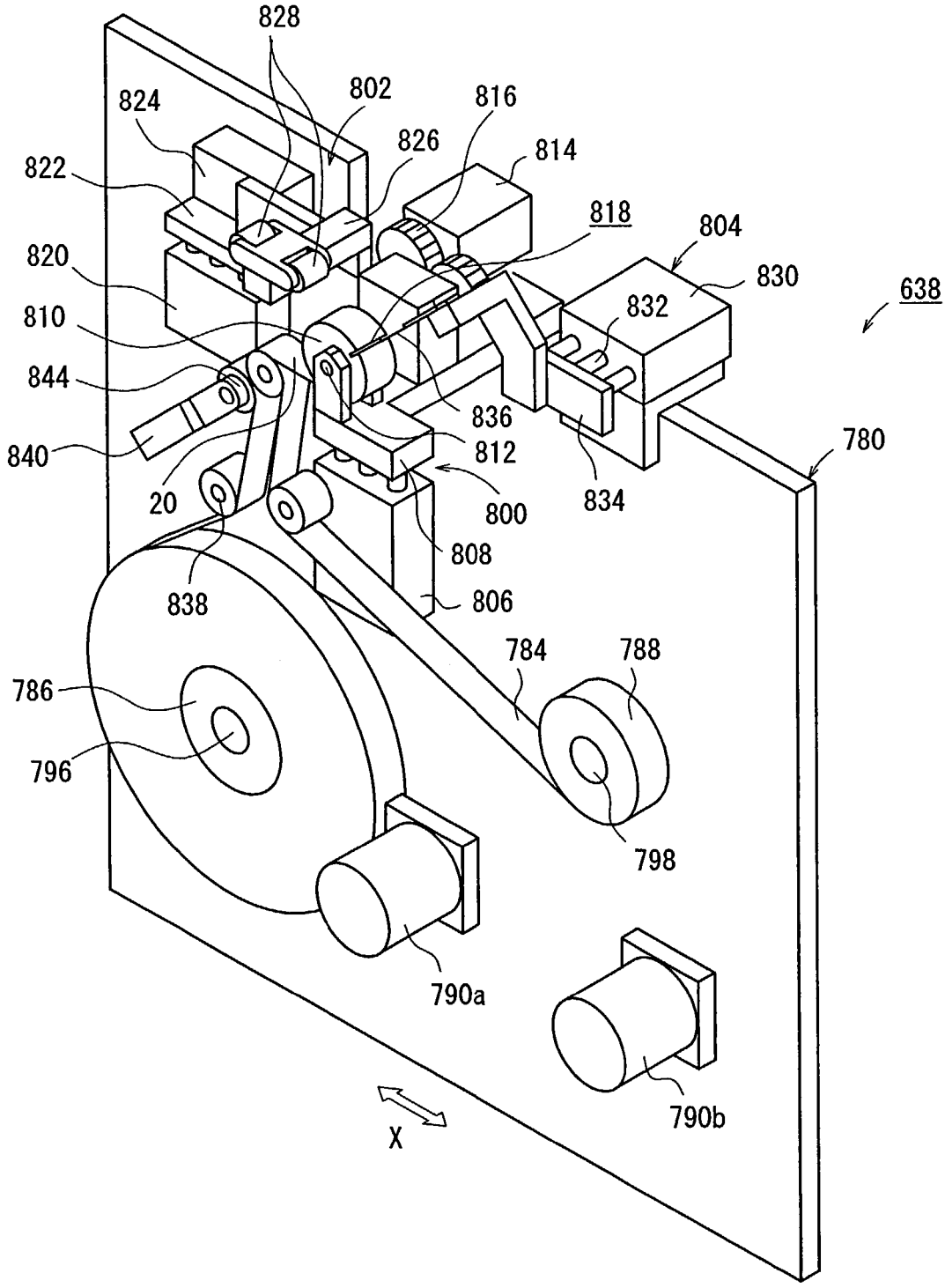
FIG. 45 is a perspective view of a slide unit of the applying mechanism.
Figure 46:
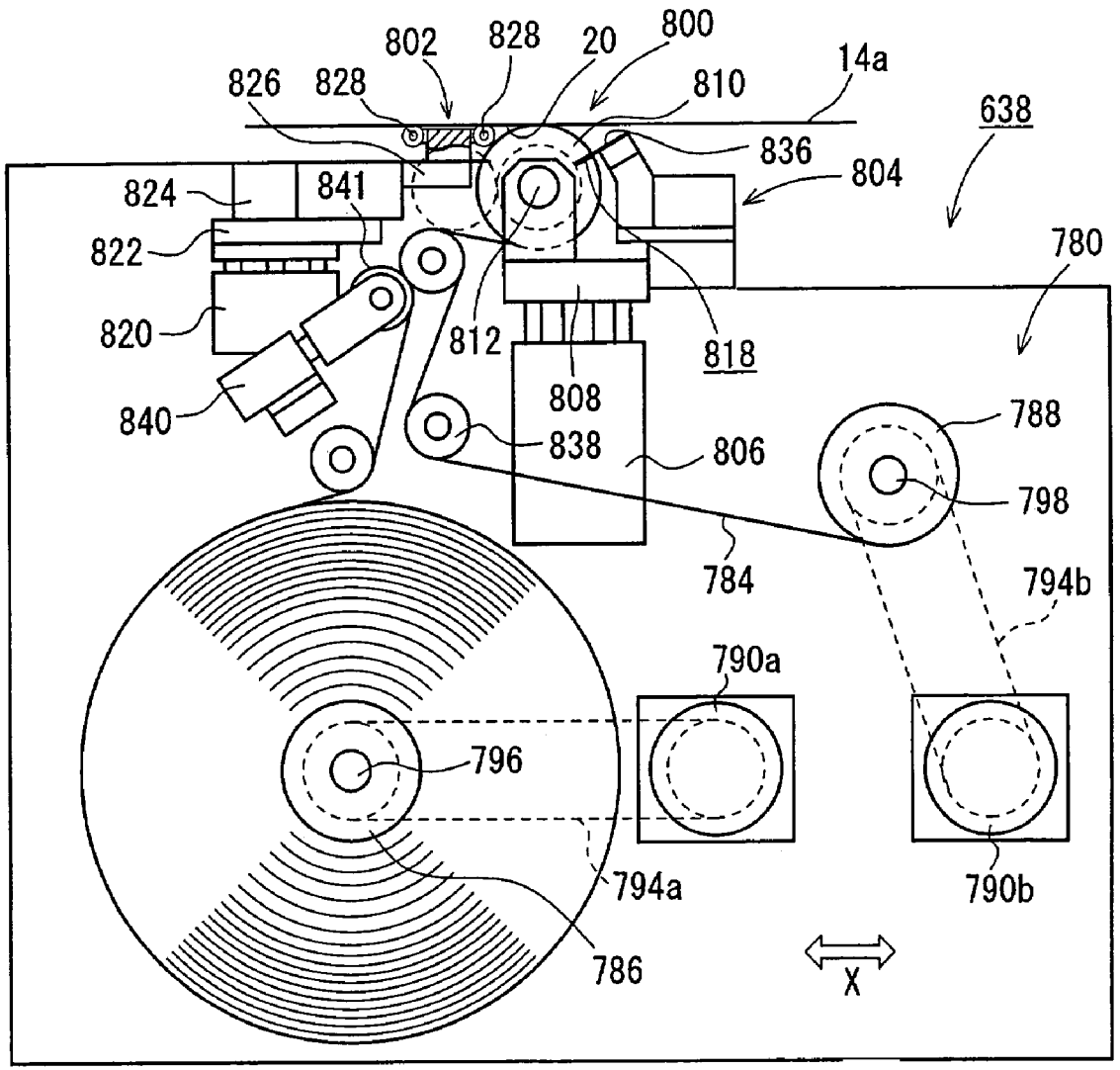
FIG. 46 is a front elevational view of the slide unit.

As shown in FIGS. 45 and 46, the slide unit 780 supports thereon a tape payout reel 786 for supporting and paying out a separable sheet 784 with joint tapes 20 thereon, and a separable sheet takeup reel 788 for winding the separable sheet 784 free of joint tapes 20. The slide unit 780 also supports thereon torque motors 790*a*, 790*b* positioned near the tape payout reel 786 and the separable sheet takeup reel 788. Rotatable shafts 796, 798 rotatably supported on the slide unit 780 have ends connected to the torque motors 790*a*, 790*b* by respective belt and pulley means 794*a*, 794*b* and opposite ends fixed to the tape payout reel 786 and the separable sheet takeup reel 788, respectively.

The slide unit 780 supports thereon an applying means 800 for applying the joint tape 20 to the end 14*a*, the applying means 800 being movable toward and away from the end 14*a*, a squeezing means 802 disposed behind the applying means 800 in the direction in which the joint tape 20 is applied to the end 14*a*, for pressing the joint tape 20 to the end 14*a*, the squeezing means 802 being movable toward and away from the end 14*a*, and a cutter 804 for cutting off the joint tape 20.

The applying means 800 has a cylinder 806 fixed to the slide unit 780, a movable base 808 movable back and forth by the cylinder 806, and a suction roller 810 rotatably supported on the movable base 808. The suction roller 810 has a rotatable shaft 812 which receives rotational drive power from a rotary actuator 814 through a gear train 816. The suction roller 810 has a cutter guide slot 818 defined in an outer circumferential surface thereof and extending axially of the suction roller 810.

The squeezing means 802 has a cylinder 820 fixed to the slide unit 780, a vertically movable base 822 vertically movable by the cylinder 820, and a cylinder 824 extending horizontally and fixedly mounted on the vertically movable base 822. A pair of squeezing rollers 828 is rotatably mounted on an arm 826 which is horizontally movable by the cylinder 824.

The cutter 804 has a cylinder 830 fixed to the slide unit 780, rods 832 extending from the cylinder 830 parallel to the axis of the suction roller 810, and a movable plate 834 fixed to the rods 832. A disk-shaped cutting blade 836 is fixedly mounted on the movable plate 834.

The slide unit 780 also has a plurality of fixed guide rollers 838, and a guide roller 841 movable toward and away from one of the fixed guide rollers 838 by a cylinder 840.

As shown in FIG. 44, a plurality of feed rollers 844*a*, 844*b* vertically movable by a pair of laterally spaced cylinders 842*a*, 842*b* are disposed below the slide unit 780 for transferring the pallet 86 to the upper feed conveyors 82*a*, 82*b*.

Figure 47:
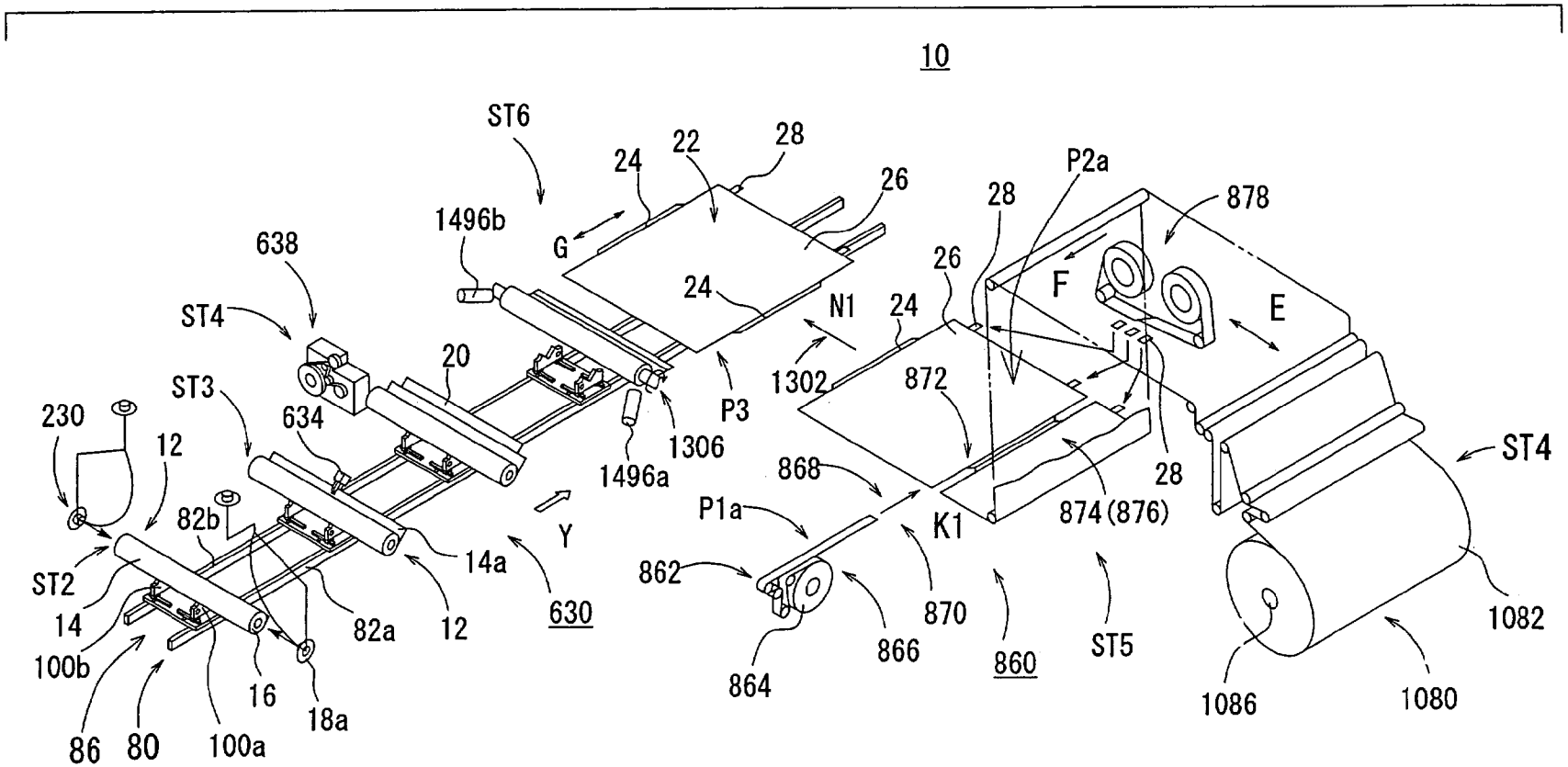
FIG. 47 is a perspective view of an upstream portion of the automatic packaging system.
Figure 48:
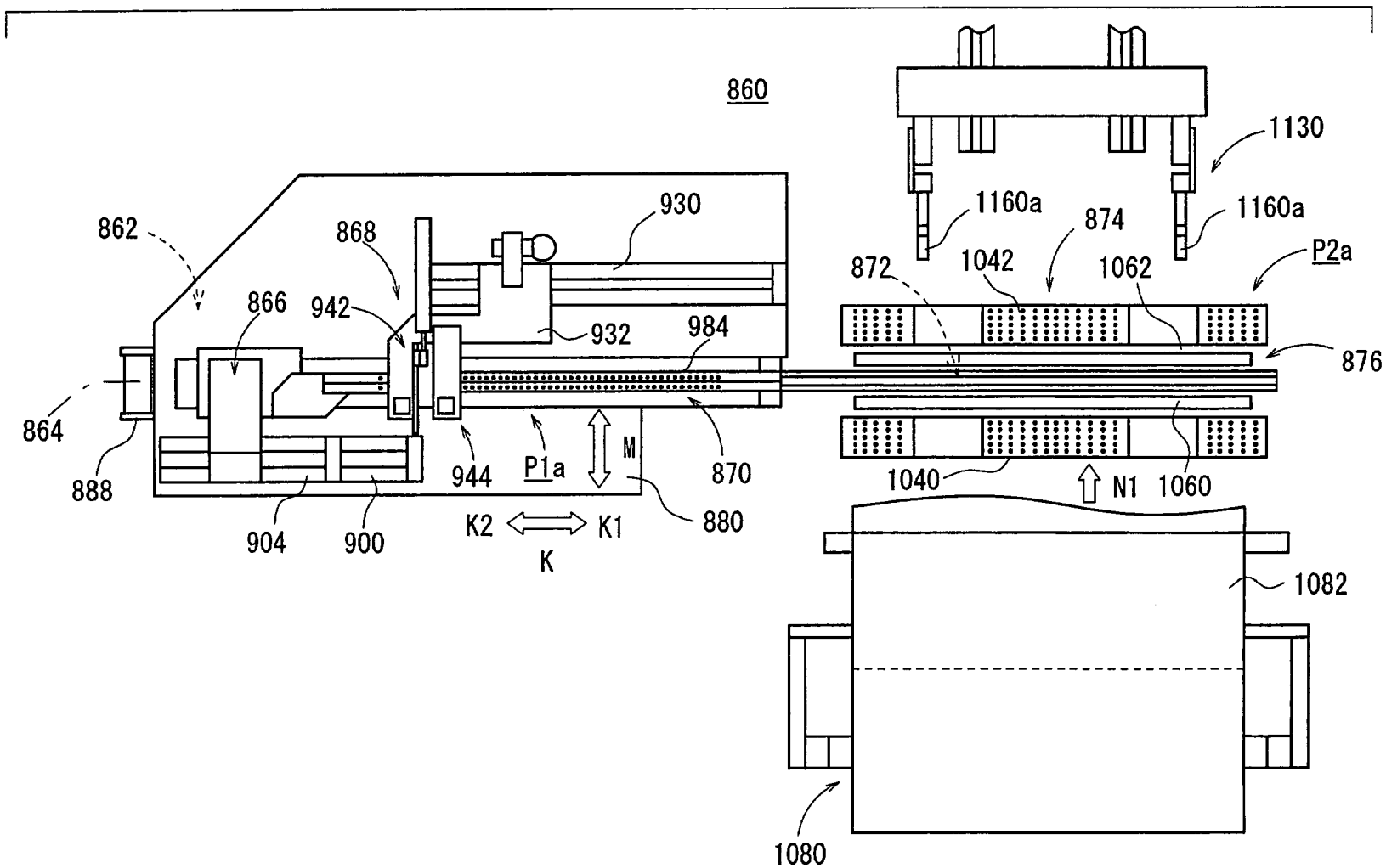
FIG. 48 is a plan view of a working device.

The light-shielding leader assembling station ST5 has a packaging sheet working device 860. As shown in FIGS. 47 and 48, the packaging sheet working device 860 has a working mechanism 866 for at least blanking a strip-like skirt member 864 delivered from a skirt member supply unit 862, a skirt member cutting mechanism 868 for transversely cutting the strip-like skirt member 864 in the blanked region into light-shielding shrink films 24, a skirt member feeding mechanism 870 for feeding the light-shielding shrink films 24 to a cutting region and a joining region for joining them to a light-shielding sheet 26, a cutting mechanism 872 for cutting the light-shielding sheet 26 in a longitudinal direction of the light-shielding shrink films 24, a sheet member spacing mechanism 874 for spacing cut ends of the light-shielding sheet 26 apart from each other by a given distance, a joining mechanism 876 for joining the light-shielding shrink films 24 to the confronting cut ends of the light-shielding sheet 26 with the light-shielding shrink films 24 having exposed transverse portions, and an end tape supplying and applying mechanism 878 for supplying end fastening tapes 28 to the leading end of the light-shielding sheet 26.

Figure 49:
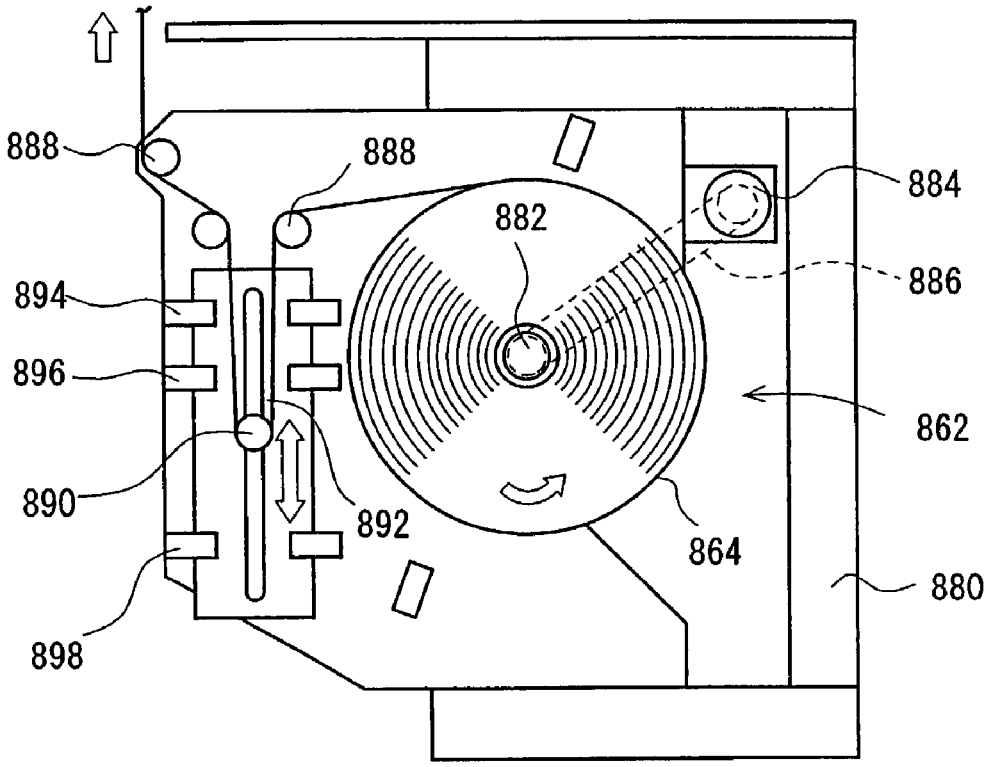
FIG. 49 is a front elevational view of a skirt member supply of the working device.

As shown in FIG. 49, the skirt member supply unit 862 has a payout shaft 882 rotatably supported on a base 880. The payout shaft 882 is rotatable about a horizontal axis by a motor 884 through a belt and pulley means 886 which is connected to the motor 884. The skirt member supply unit 862 also has a plurality of guide rollers 888 rotatably supported on the base 880 and arranged in a direction in which the strip-like skirt member 864 is paid out from the payout shaft 882. A dancer roller 890 is vertically movably disposed between two of the guide rollers 888 which are disposed parallel to each other.

The strip-like skirt member 864 includes a loop 892 formed around the dancer roller 890 between the two guide rollers 888. Positions of the loop 892 are detected by a first upper position detecting sensor 894, a second upper position detecting sensor 896, and a second lower position detecting sensor 898 which are disposed in vertically spaced positions.

Figure 50:
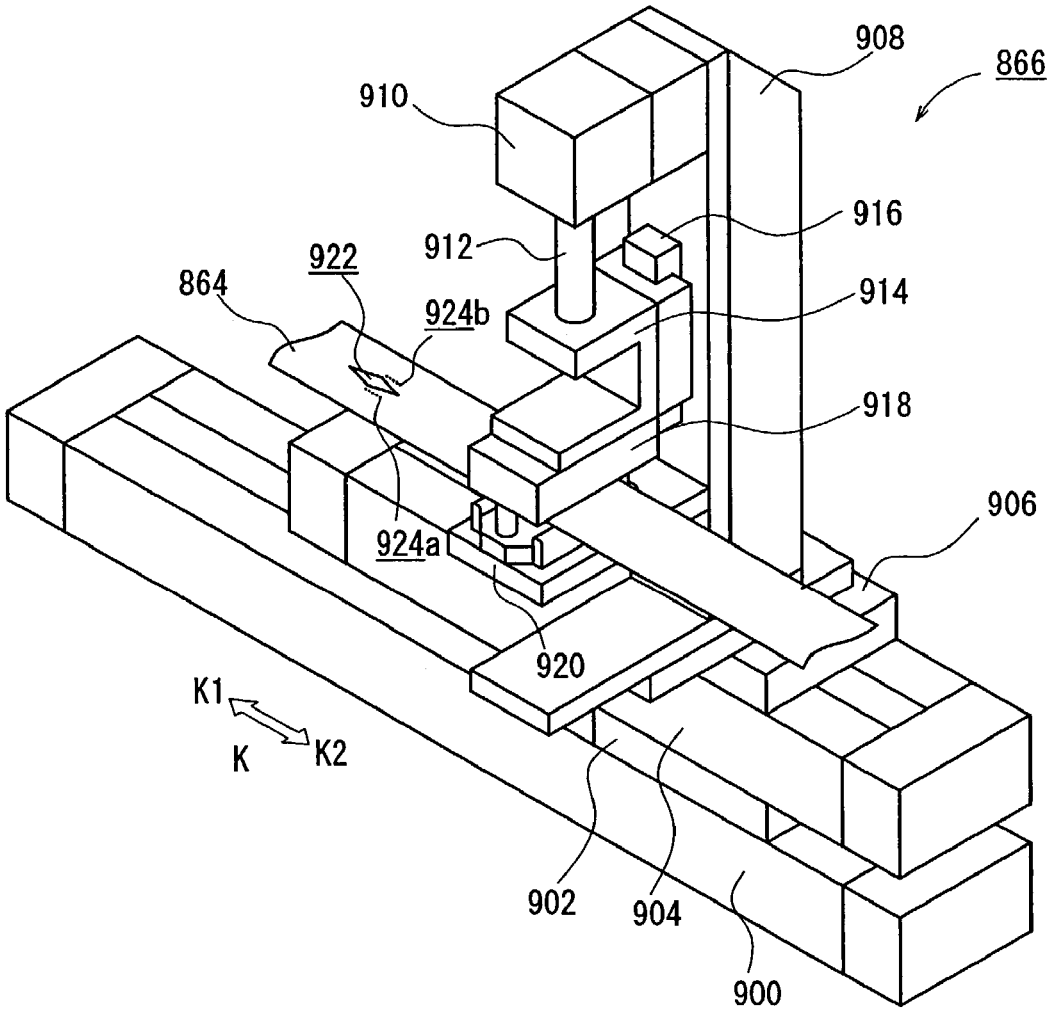
FIG. 50 is a perspective view of a working mechanism of the working device.

As shown in FIGS. 48 and 50, the working mechanism 866 has a lower rodless cylinder 900 mounted on the base 880 and extending parallel to a strip-like skirt member feed path defined by the guide rollers 888. The lower rodless cylinder 900 has a first movable base 902 movable back and forth in the longitudinal direction indicated by the arrow K of the lower rodless cylinder 900. An upper rodless cylinder 904, which is shorter than the lower rodless cylinder 900, is fixedly mounted on the first movable base 902. The upper rodless cylinder 904 has a second movable base 906 movable back and forth in the longitudinal direction of the upper rodless cylinder 904.

Figure 51:
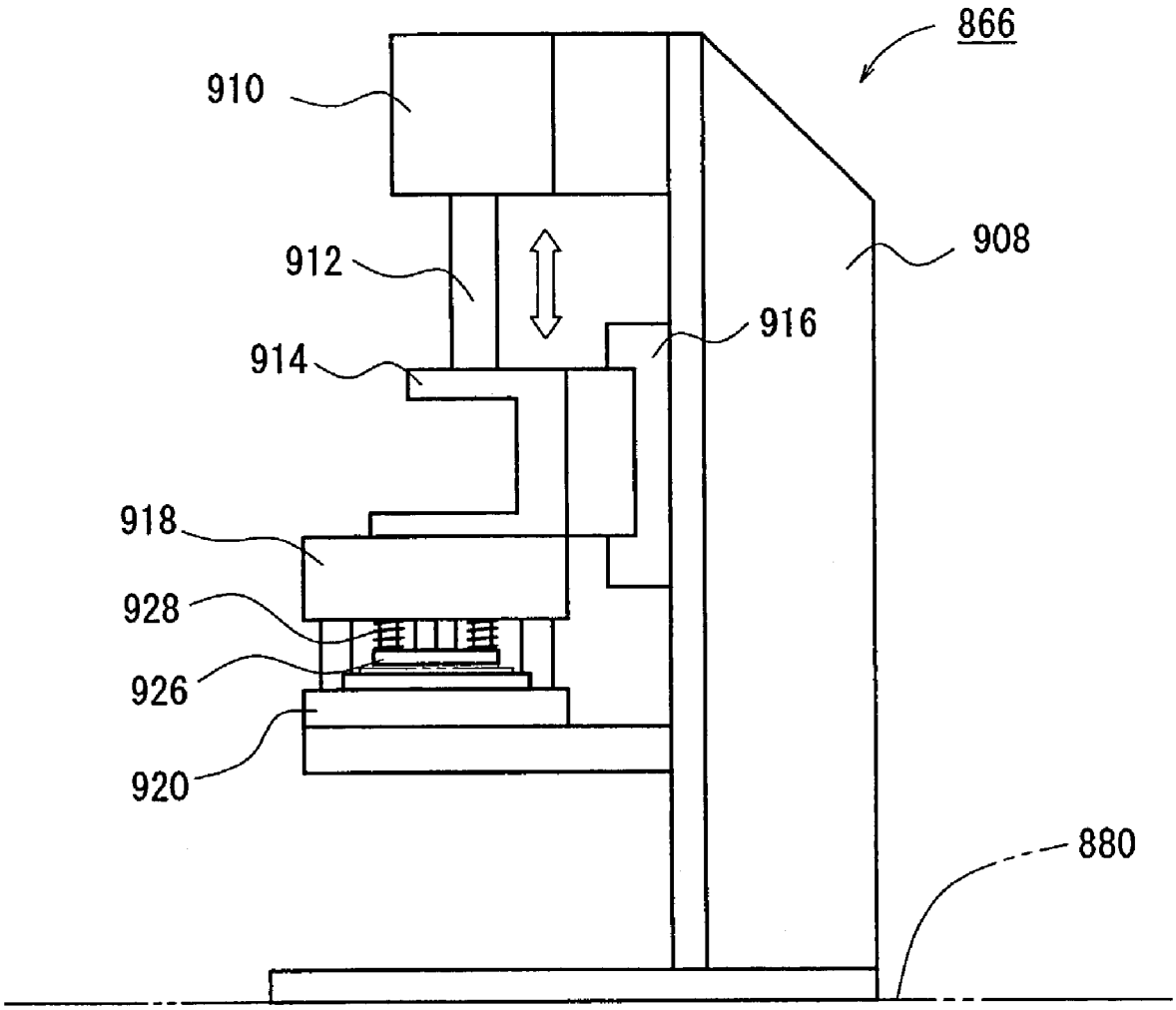
FIG. 51 is a side elevational view of the working mechanism.

A support frame 908 extending vertically upwardly is screwed to the second movable base 906, and a pressurizing cylinder 910 is fixed to an upper end of the support frame 908. As shown in FIGS. 50 and 51, the pressurizing cylinder 910 has a downwardly extending rod 912 positioned above and aligned with the strip-like skirt member feed path defined by the guide rollers 888. A vertically movable base 914 is coupled to a lower end of the rod 912. The vertically movable base 914 is guided along a vertical surface of the support frame 908 by a linear guide 916, and supports a punch 918 on its lower end. A die plate 920 disposed below the punch 918 is fixedly mounted on the support frame 908.

As shown in FIG. 50, the punch 918 and the die plate 920 jointly operate to form a diamond-shaped opening 922 and tear-off perforations 924*a*, 924*b* in the strip-like skirt member 864. The punch 918 and the die plate 920 have their punch and die structures shaped complementarily to the diamond-shaped opening 922 and the tear-off perforations 924*a*, 924*b*. As shown in FIG. 51, the punch 918 has a stripper 926 vertically movably supported on a plurality of stripper bolts 928.

Figure 52:
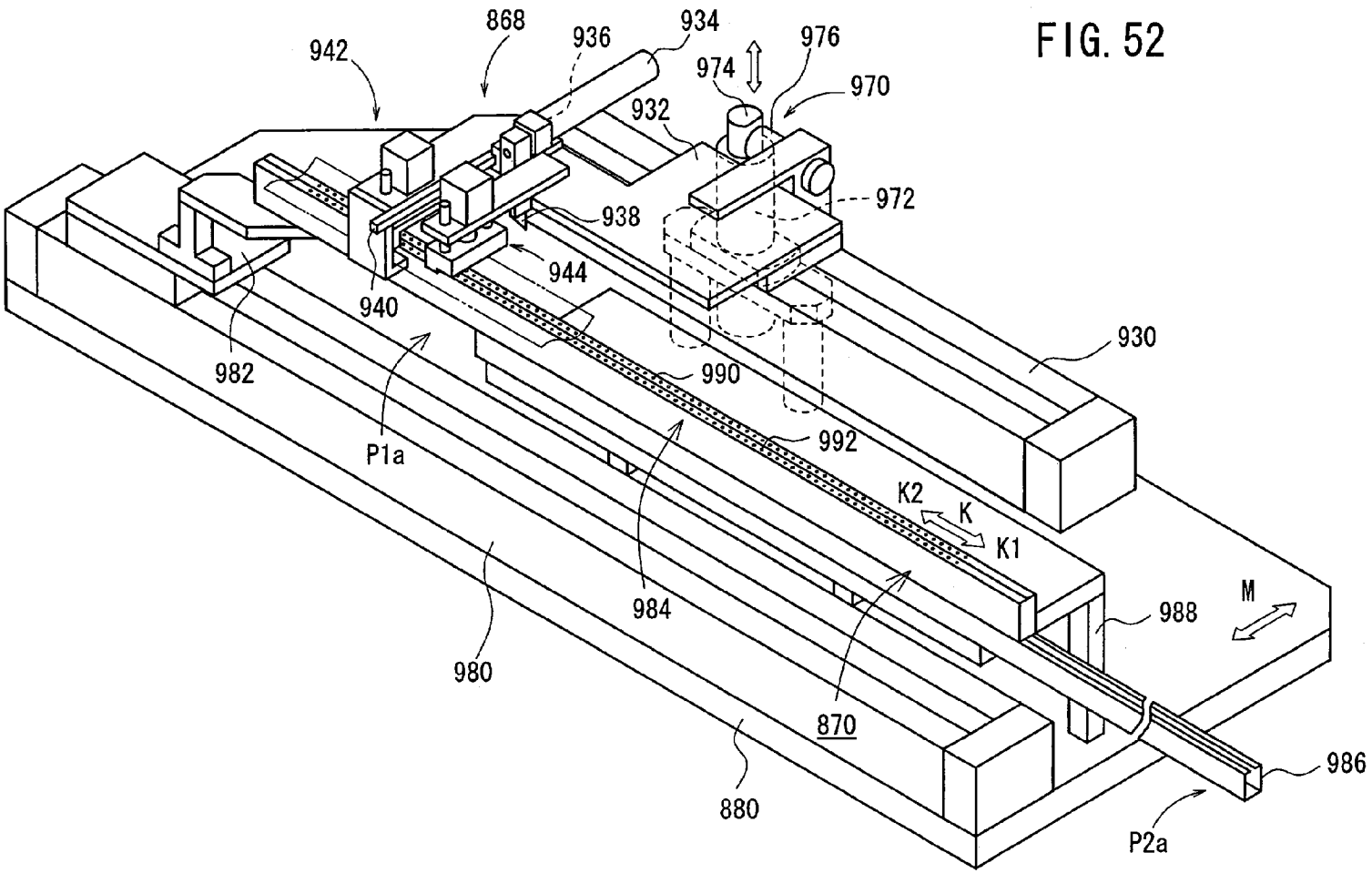
FIG. 52 is a perspective view of a skirt member cutting mechanism and a skirt member feeding mechanism of the working device.

As shown in FIGS. 48 and 52, a rodless cylinder 930 is mounted on the base 880 parallel to the lower rodless cylinder 900 of the working mechanism 866, the rodless cylinder 930 being positioned on one side of the strip-like skirt member feed path remotely from the lower rodless cylinder 900. The rodless cylinder 930 has a length in the direction indicated by the arrow K so as to correspond to the drawn length of the strip-like skirt member 864. The rodless cylinder 930 has a movable base 932 on which the skirt member cutting mechanism 868 is mounted. The skirt member cutting mechanism 868 has a horizontal cylinder 934 having a rod 936 with a cutter blade 938 fixed thereto. The cutter blade 938 is guided by a slide guide 940 for movement in the transverse direction indicated by the arrow M of the strip-like skirt member 864.

The movable base 932 has a function as a skirt member holding mechanism for holding the strip-like skirt member 864 when the strip-like skirt member 864 is transversely cut off by the skirt member cutting mechanism 868. The movable base 932 has a gripping means 942 disposed upstream of the cutter blade 938 with respect to the direction in which the strip-like skirt member 864 is fed, and a holding means 944 disposed downstream of the cutter blade 938 with respect to the same direction.

Figure 53:
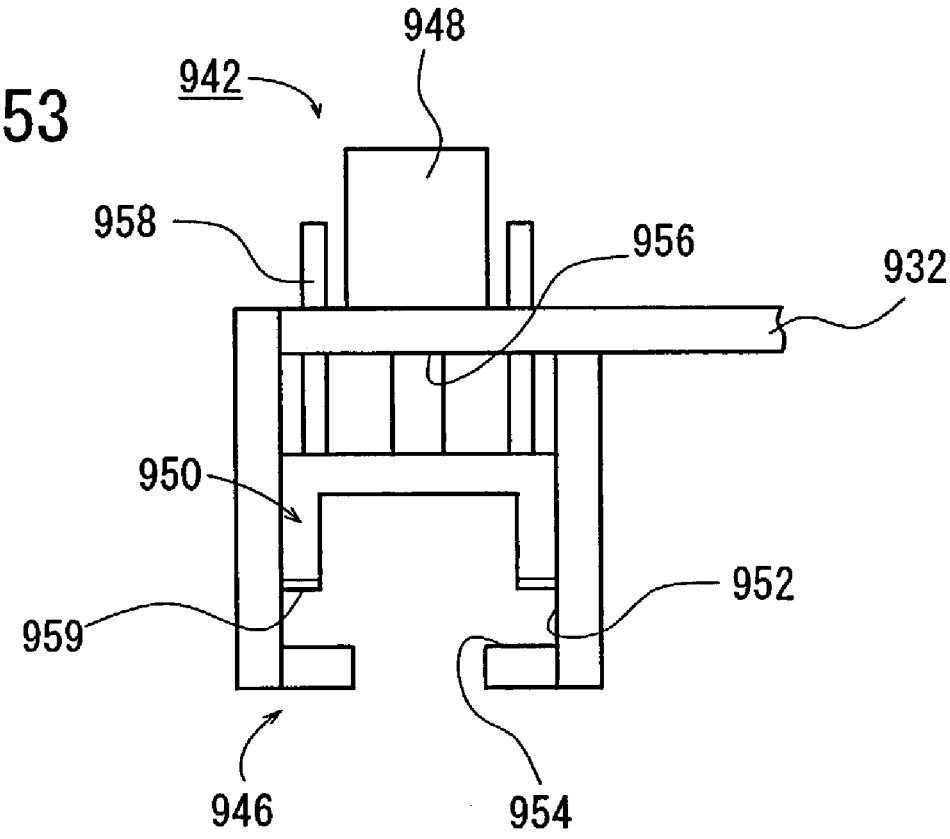
FIG. 53 is a front elevational view of a gripping means of the working device.

As shown in FIG. 53, the gripping means 942 has a fixed guide 946 fixed to the movable base 932 and a movable base 950 movable toward and away from the fixed guide 946 by a cylinder 948. The fixed guide 946 has a pair of vertical guide surfaces 952 spaced from each other by a distance corresponding to the width of the strip-like skirt member 864, and a pair of horizontal guide surfaces 954 spaced from each other by a given distance for supporting the lower surface of the strip-like skirt member 864.

The movable guide 950 is coupled to a distal end of a rod 956 extending downwardly from the cylinder 948 and is movably guided on the movable base 932 by a plurality of guide bars 958. The movable guide 950 has a pair of pressing surfaces 959 for pressing and holding transversely spaced opposite edges of the strip-like skirt member 864 against the respective horizontal guide surfaces 954.

Figure 54:
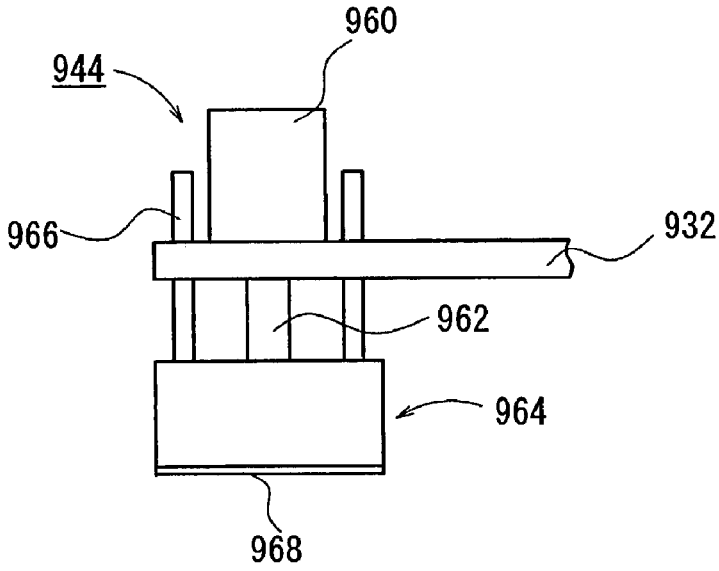
FIG. 54 is a front elevational view of a holding means of the working device.

As shown in FIG. 54, the holding means 944 has a cylinder 960 fixed to the movable base 932 and a pressing guide 964 coupled to a rod 962 which extends downwardly from the cylinder 960. The pressing guide 964 is vertically movably supported on the movable base 932 by a plurality of guide bars 966 and has a lower pressing surface 968 for pressing and holding the strip-like skirt member 864 against the skirt member feeding mechanism 870. The lower pressing surface 968 extends the full transverse width of the strip-like skirt member 864.

As shown in FIG. 52, a stopper means 970 for positioning and holding the movable base 932 is disposed in a retracted position of the movable base 932, i.e., a position for cutting the strip-like skirt member 864. The stopper means 970 has a cylinder 972 disposed on the base 880 and having an engaging rod 974 which extends upwardly. When the engaging rod 974 is brought into an upper end position by the cylinder 972, the engaging rod 974 abuts against an engaging member 976 on the movable base 932. When the engaging rod 974 is retracted into the cylinder 972, the engaging rod 974 is spaced from the movable base 932, allowing the movable base 932 to move to a retracted limit position of the rodless cylinder 930.

As shown in FIGS. 48 and 52, the skirt member feeding mechanism 870 has an elongate rodless cylinder 980 extending in the direction indicated by the arrow K over the strip-like skirt member feed path. The rodless cylinder 980 has a movable base 982 to which an end of a skirt member suction box 984 is coupled. The skirt member suction box 984 is supported on an elongate guide member 986 extending from a cutting region P1*a* to a joining region P2*a*. The guide member 986 is disposed on the base 880 by a plurality of support columns 988.

The skirt member suction box 984 has its dimension in the direction indicated by the arrow K so as to correspond to the cut length of the strip-like skirt member 864. The skirt member suction box 984 has a plurality of suction holes 990 defined in its upper surface. The skirt member suction box 984 also has a cutting guide slit 992 defined in its upper surface at a transversely central region thereof and extending longitudinally.

Figure 55:
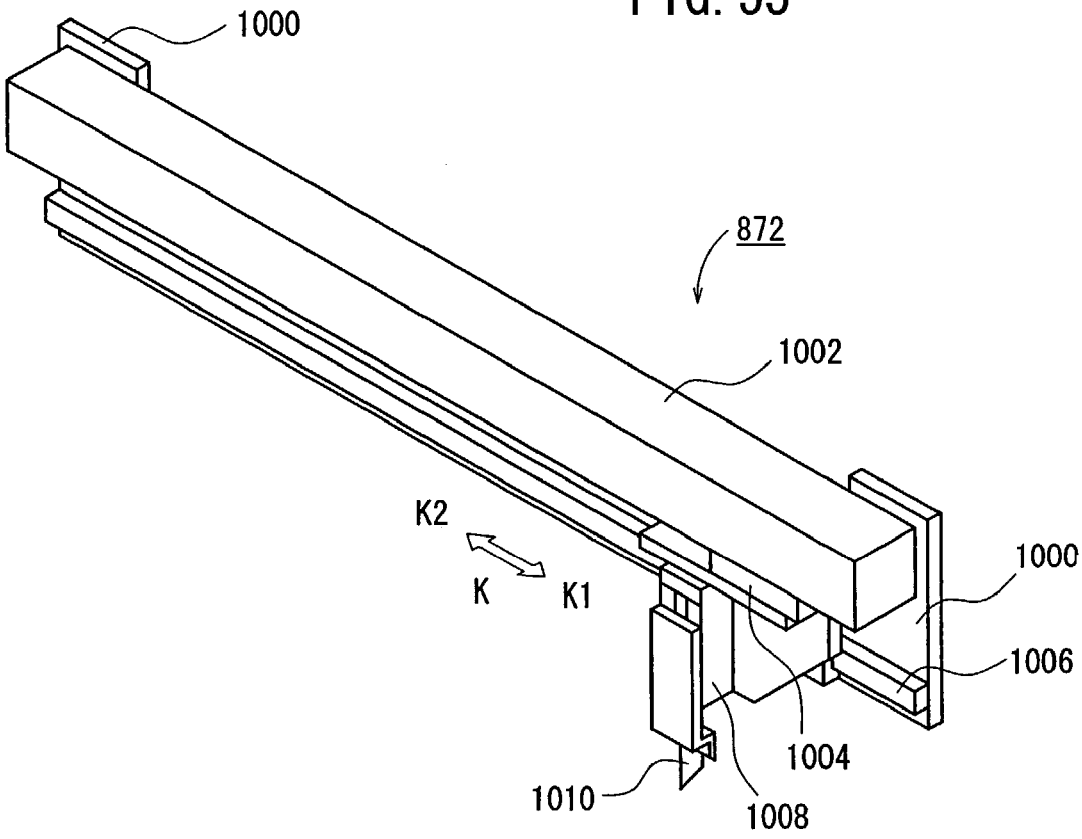
FIG. 55 is a perspective view of a cutting mechanism of the working device.

As shown in FIGS. 48 and 55, the cutting mechanism 872 has a support frame 1000 disposed above the joining region P2*a*, and a horizontally extending rodless cylinder 1002 is mounted on a vertical surface of the support frame 1000. The rodless cylinder 1002 has a movable base 1004 which is movable back and forth in the direction indicated by the arrow K along a linear guide 1006 fixed to the support frame 1000. A cylinder 1008 is fixedly mounted on the movable base 1004, and a cutter blade 1010 is vertically movably supported on the cylinder 1008.

Figure 56:
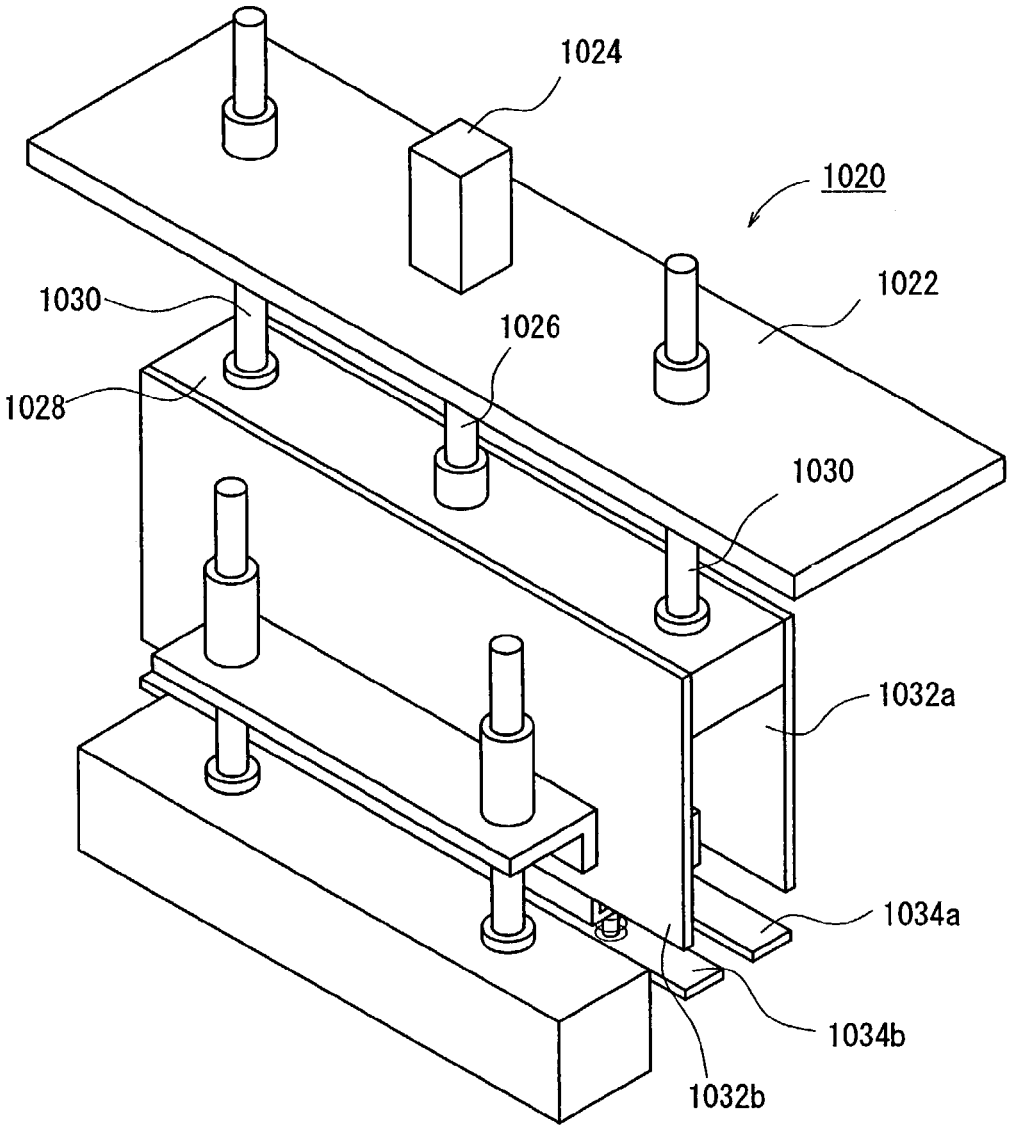
FIG. 56 is a perspective view of a sheet member holding mechanism of the working device.

As shown in FIG. 56, a sheet member holding mechanism 1020 is disposed near the cutting mechanism 872. The sheet member holding mechanism 1020 has a lifting and lowering cylinder 1024 fixedly mounted on a horizontal upper frame 1022 and having a downwardly extending rod 1026 to which a vertically movable base 1028 is fixed. The vertically movable base 1028 is movably supported on the upper frame 1022 by guide bars 1030. Presser plates 1034*a*, 1034*b* are mounted on the vertically movable base 1028 by attachment plates 1032*a*, 1032*b*. The presser plates 1034*a*, 1034*b* extend in the direction in which the light-shielding sheet 26 is cut, and are disposed one on each side of the cutter blade 1010.

Figure 57:
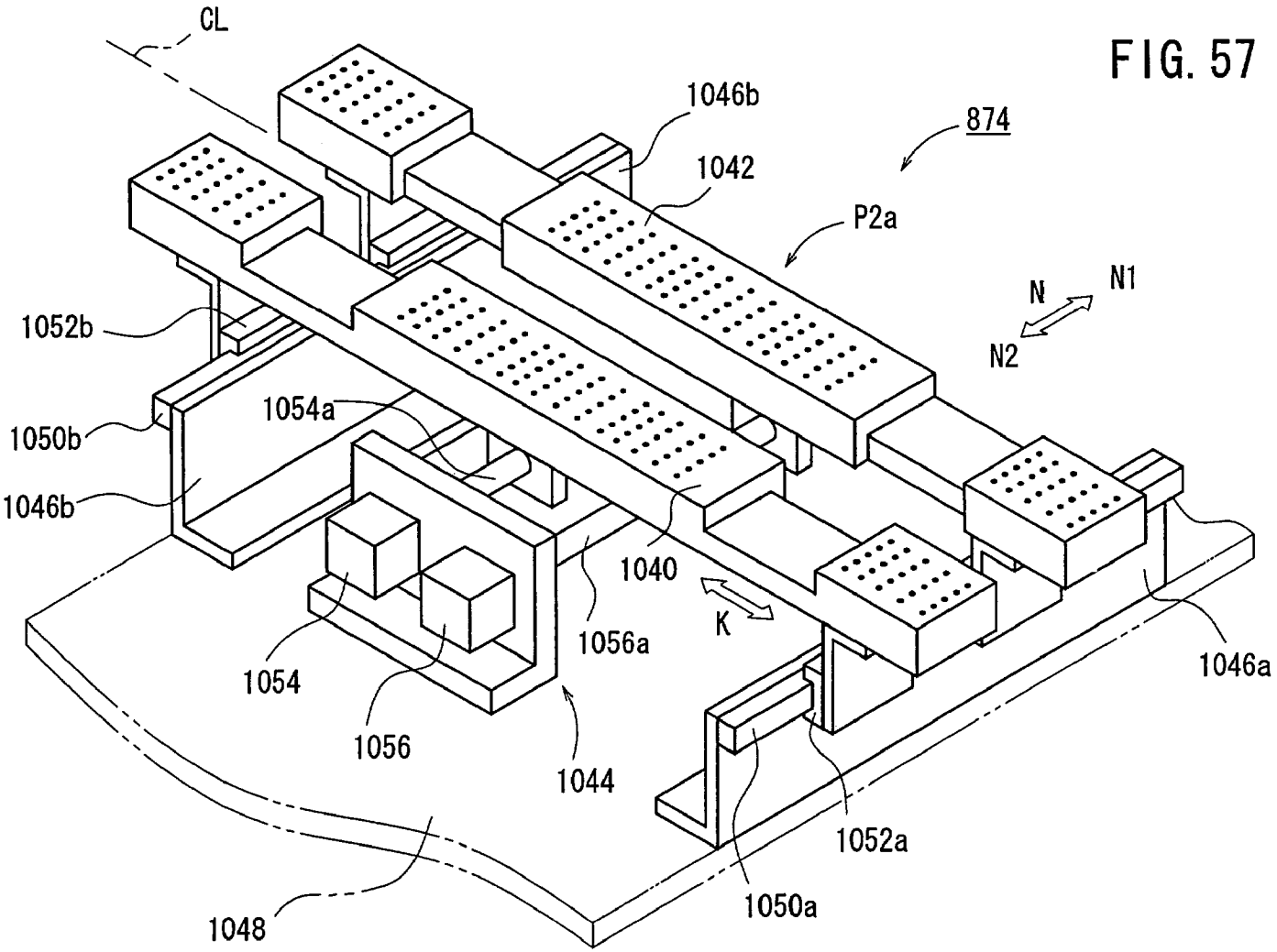
FIG. 57 is a perspective view of a sheet member spacing mechanism of the working device.

As shown in FIG. 57, the sheet member spacing mechanism 874 has first and second sheet member suction boxes 1040, 1042 disposed one on each side of a cutting line CL for the light-shielding sheet 26, for attracting the light-shielding sheet 26 under suction, and a moving unit 1044 for moving the first and second sheet member suction boxes 1040, 1042 toward and away from each other in the direction indicated by the arrow N.

In the joining region P2*a*, a pair of support members 1046*a*, 1046*b* is fixedly mounted on a base 1048. The support members 1046*a*, 1046*b* are spaced a distance from each other in the direction indicated by the arrow K and extend parallel to each other in the direction indicated by the arrow N. Guide rails 1050*a*, 1050*b* extending in the direction indicated by the arrow N are mounted on the respective support members 1046*a*, 1046*b*. The guide rails 1050*a*, 1050*b* are slidably engaged by respective linear guides

1052*a,* 1052*b* that are fixed to opposite ends of the first and second sheet member suction boxes 1040, 1042.

The moving unit 1044 has first and second cylinders 1054, 1056 fixedly mounted on a base 1048. The first and second cylinders 1054, 1056 have respective shorter and longer rods 1054*a,* 1056*a* extending parallel to each other in the direction indicated by the arrow N1. The shorter rod 1054*a* is coupled to a lower surface of the first sheet member suction box 1040, and the longer rod 1056*a* extends below the first sheet member suction box 1040 and is coupled to a lower surface of the second sheet member suction box 1042.

Figure 58:
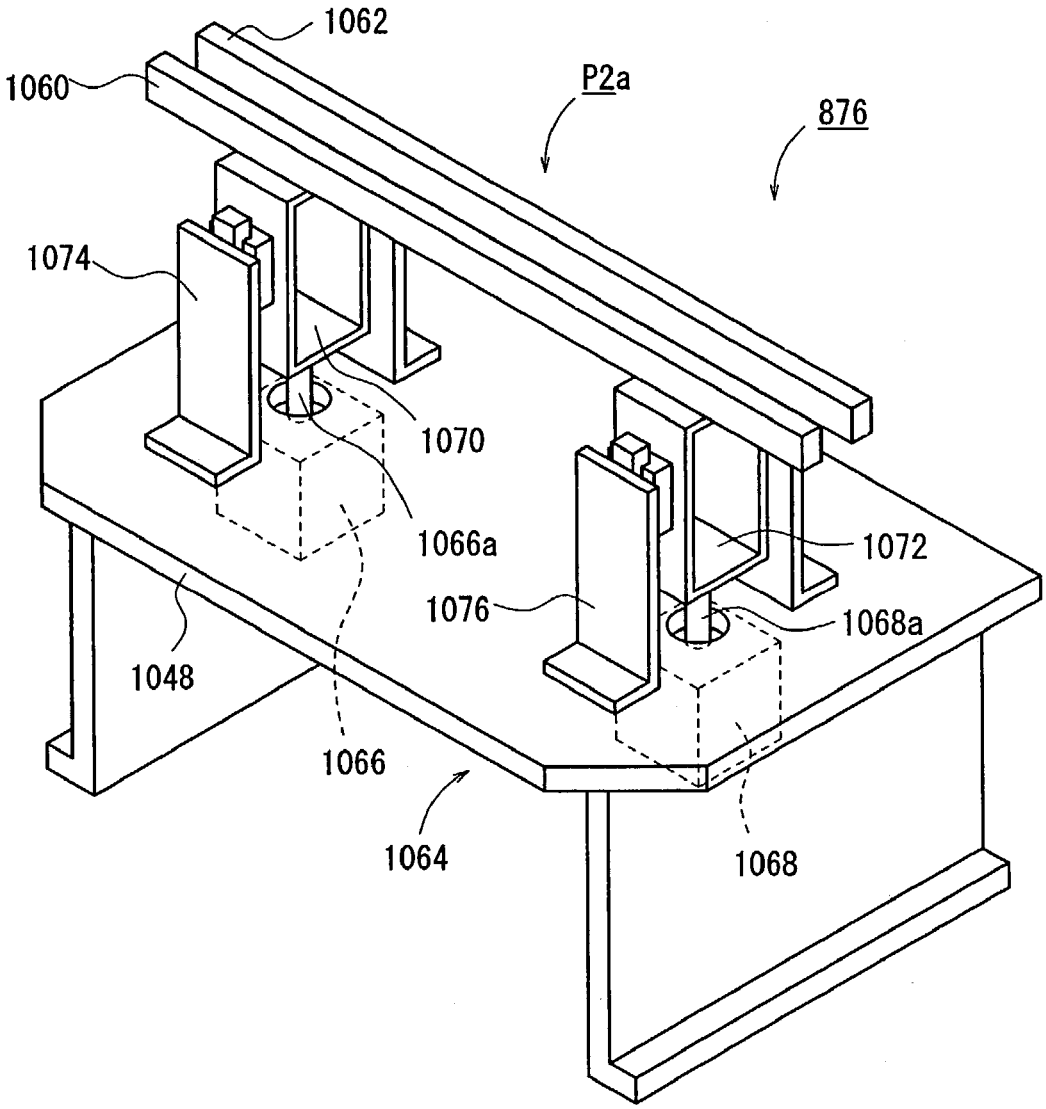
FIG. 58 is a perspective view of a joining mechanism of the working device.

As shown in FIG. 58, the joining mechanism 876 has first and second heater blocks 1060, 1062 disposed between the first and second sheet member suction boxes 1040, 1042 in the joining region P2*a,* the first and second heater blocks 1060, 1062 being spaced from each other such that the skirt member suction box 984 can enter centrally therebetween, and a lifting and lowering unit 1064 for lifting and lowering the first and second heater blocks 1060, 1062.

The lifting and lowering unit 1064 has a pair of laterally spaced lifting and lowering cylinders 1066, 1068 mounted on the base 1048 outside of the moving unit 1044 and having upwardly extending rods 1066*a,* 1068*a,* respectively, to which vertically movable bases 1070, 1072 are coupled. The vertically movable bases 1070, 1072 are vertically supported by respective pairs of guide plates 1074, 1076. The first and second heater blocks 1060, 1062 are integrally fixed to the vertically movable bases 1070, 1072.

Figure 59:
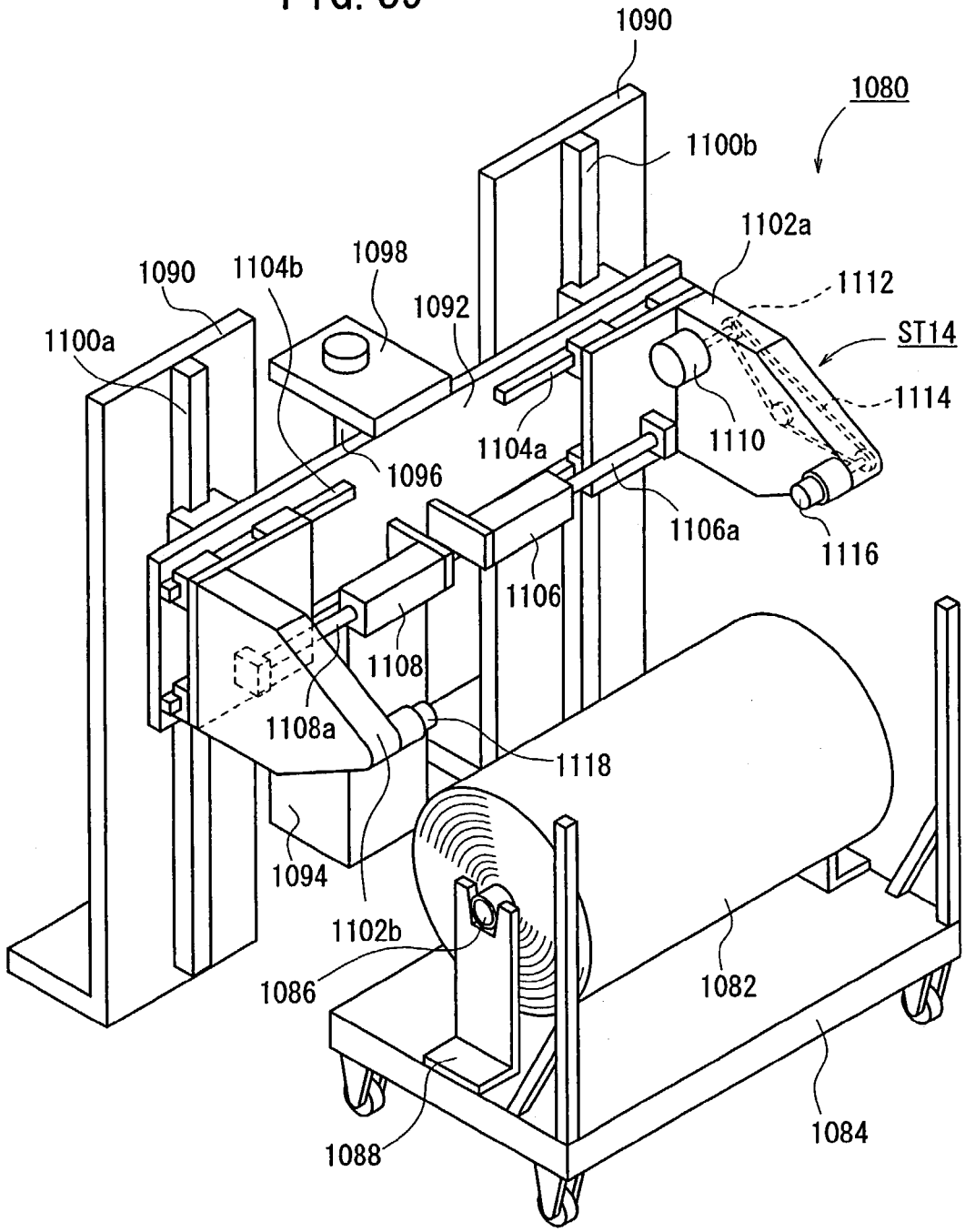
FIG. 59 is a perspective view of a light-shielding sheet supply.
Figure 60:
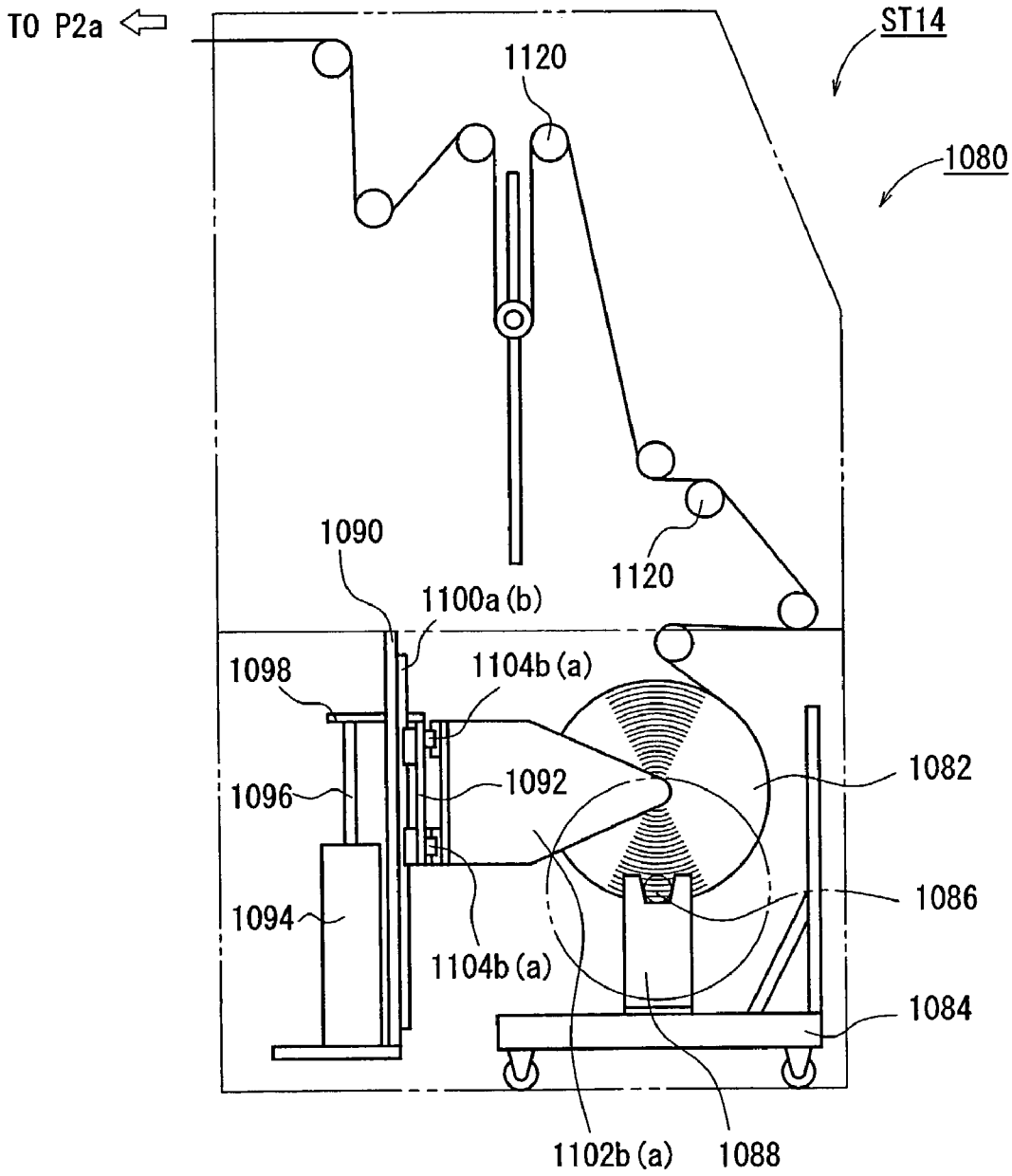
FIG. 60 is a side elevational view of the light-shielding sheet supply.

As shown in FIG. 47, a light-shielding sheet 26 is produced by cutting off a strip-like light-shielding sheet 1082 unwound from its roll in a light-shielding sheet supply 1080, to a predetermined width in the joining region P2*a.* In the light-shielding sheet supply 1080, as shown in FIGS. 59 and 60, the strip-like light-shielding sheet 1082 is placed as a roll on a carriage 1084 and supplied therefrom. A pair of support blocks 1088 supporting a core 1086 of the rolled strip-like light-shielding sheet 1082 is mounted on the carriage 1084.

The light-shielding sheet supply 1080 has a pair of vertically extending walls 1090 in a position where the carriage 1084 is placed. A support plate 1092 which is vertically movable by a lifting and lowering cylinder 1094 is supported on the walls 1090. The lifting and lowering cylinder 1094 is directed vertically and has an upwardly extending rod 1096 which is connected to a support plate 1092 by a joint 1098. Laterally spaced rails 1100*a,* 1100*b* are vertically mounted on vertical surfaces of the respective walls 1090, with the support plate 1092 being slidably supported on the rails 1100*a,* 1100*b.*

A pair of laterally spaced movable arms 1102*a,* 1102*b* is horizontally movably supported on the support plate 1092 by respective pairs of upper and lower guide rails 1104*a,* 1104*b.* The support plate 1092 supports cylinders 1106, 1108 fixed thereto which extend horizontally in alignment with each other. The cylinders 1106, 1108 have respective rods 1106*a,* 1108*a* projecting in different directions therefrom and coupled to the movable arms 1102*a,* 1102*b,* respectively.

A motor 1110 is mounted on the movable arm 1102*a* and has a rotatable shaft 1112 operatively coupled to a drive shaft 1116 on the movable arm 1102*a* by a chain and sprocket mechanism 1114. A driven shaft 1118 is rotatably supported on the movable arm 1102*b* in alignment with the drive shaft 1116. The drive shaft 1116 and the driven shaft 1118 can be fitted in the respective opposite ends of the core 1086 of the rolled strip-like light-shielding sheet 1082. The light-shielding sheet supply 1080 has a plurality of guide rollers 1120 for feeding the strip-like light-shielding sheet 1082 to the joining region P2*a* (see FIG. 60).

Figure 61:
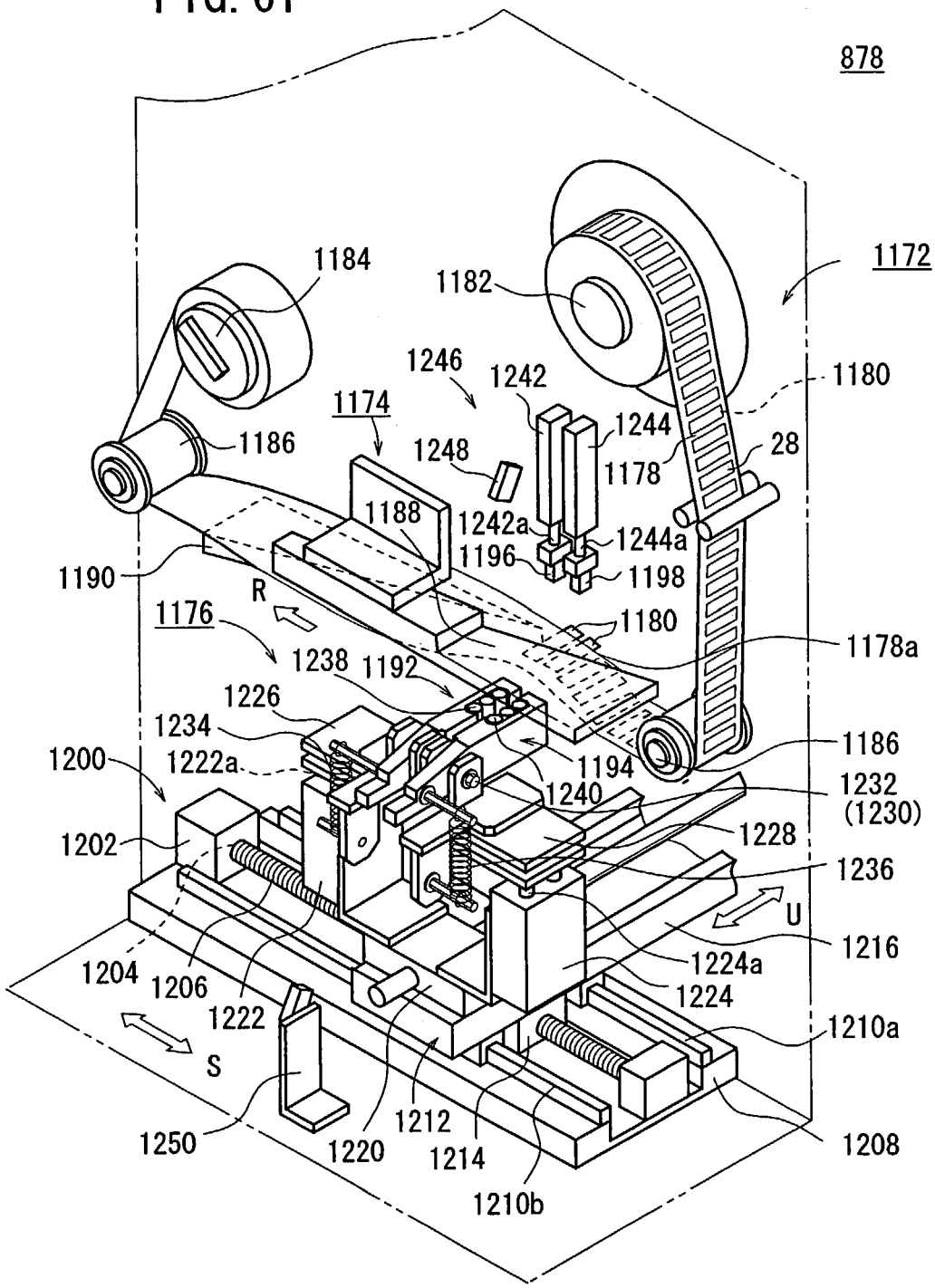
FIG. 61 is a perspective view of an end tape supplying and applying mechanism of the automatic packaging system.
Figure 62:
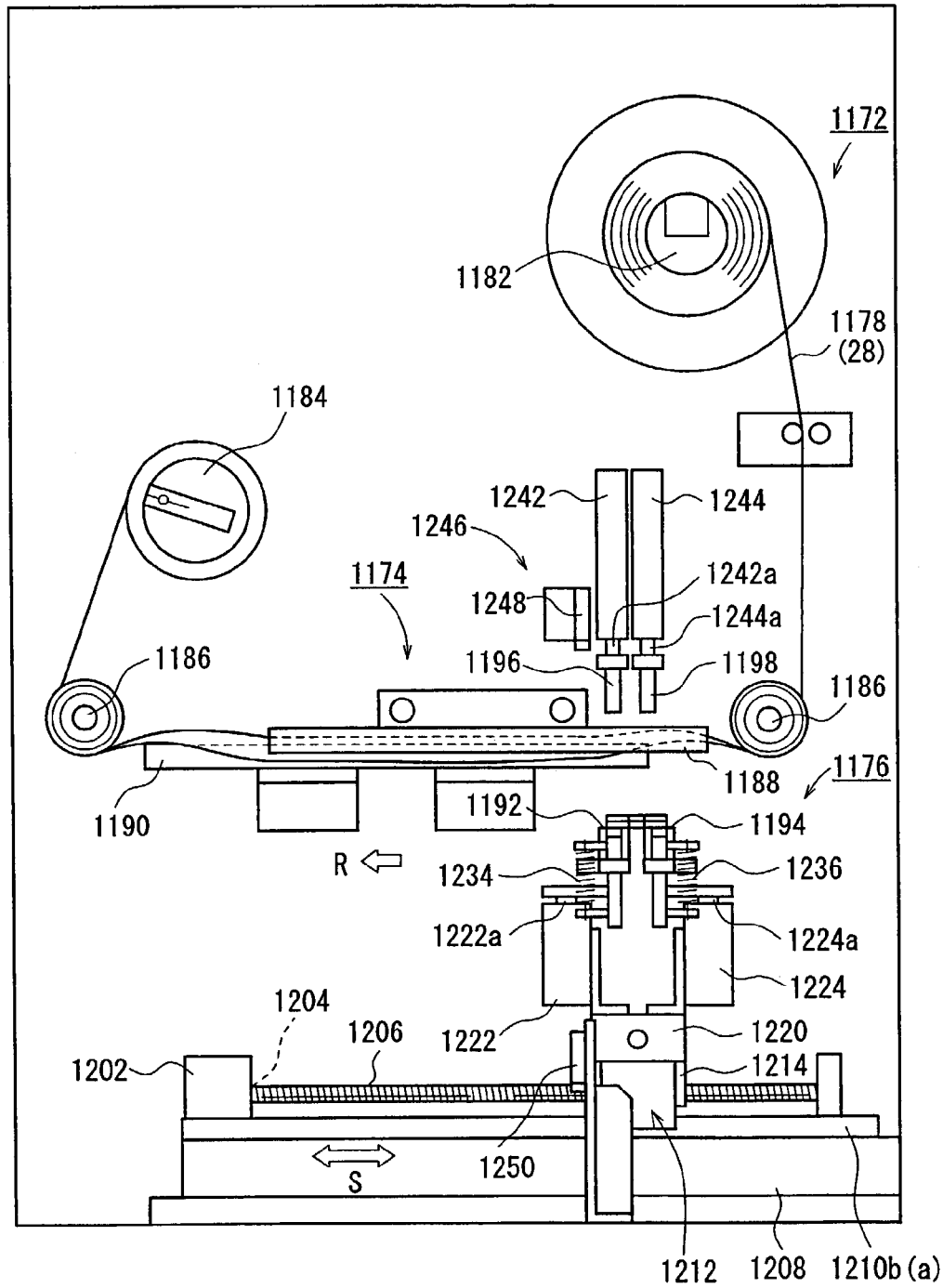
FIG. 62 is a front elevational view of the end tape supplying and applying mechanism.

As shown in FIGS. 61 and 62, the end tape supplying and applying mechanism 878 has a separable sheet payout mechanism 1172, a separable sheet bending mechanism 1174, and an end tape removing mechanism 1176. End fastening tapes 28 are applied in an array to a strip-like separable sheet 1178. Each of the end fastening tapes 28 has its longitudinal direction extending transversely across the strip-like separable sheet 1178, and has an adhesive-free area 1180 positioned at a side edge 1178*a* of the strip-like separable sheet 1178.

The separable sheet payout mechanism 1172 has a tape payout shaft 1182 for paying out the separable sheet 1178 with end fastening tapes 28 applied thereto from a roll thereof on the tape payout shaft 1182, and a separable sheet takeup shaft 1184 for winding the separable sheet 1178 free of the end fastening tapes 28. A pair of guide rollers 1186 whose axes extend substantially horizontally parallel to each other is disposed between the tape payout shaft 1182 and the separable sheet takeup shaft 1184.

Figure 63:
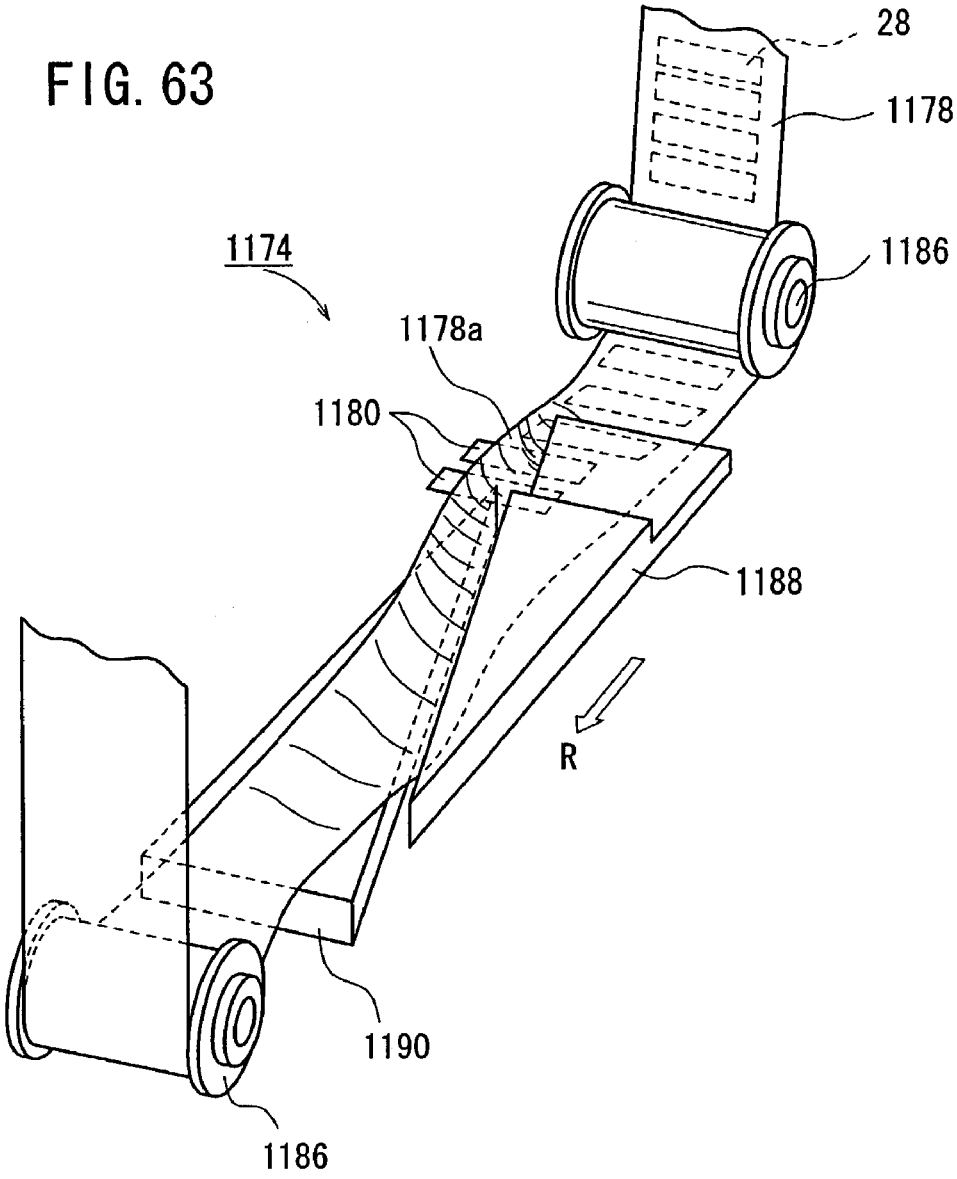
FIG. 63 is a perspective view of a separable sheet bending mechanism of the end tape supplying and applying mechanism.
Figure 64:
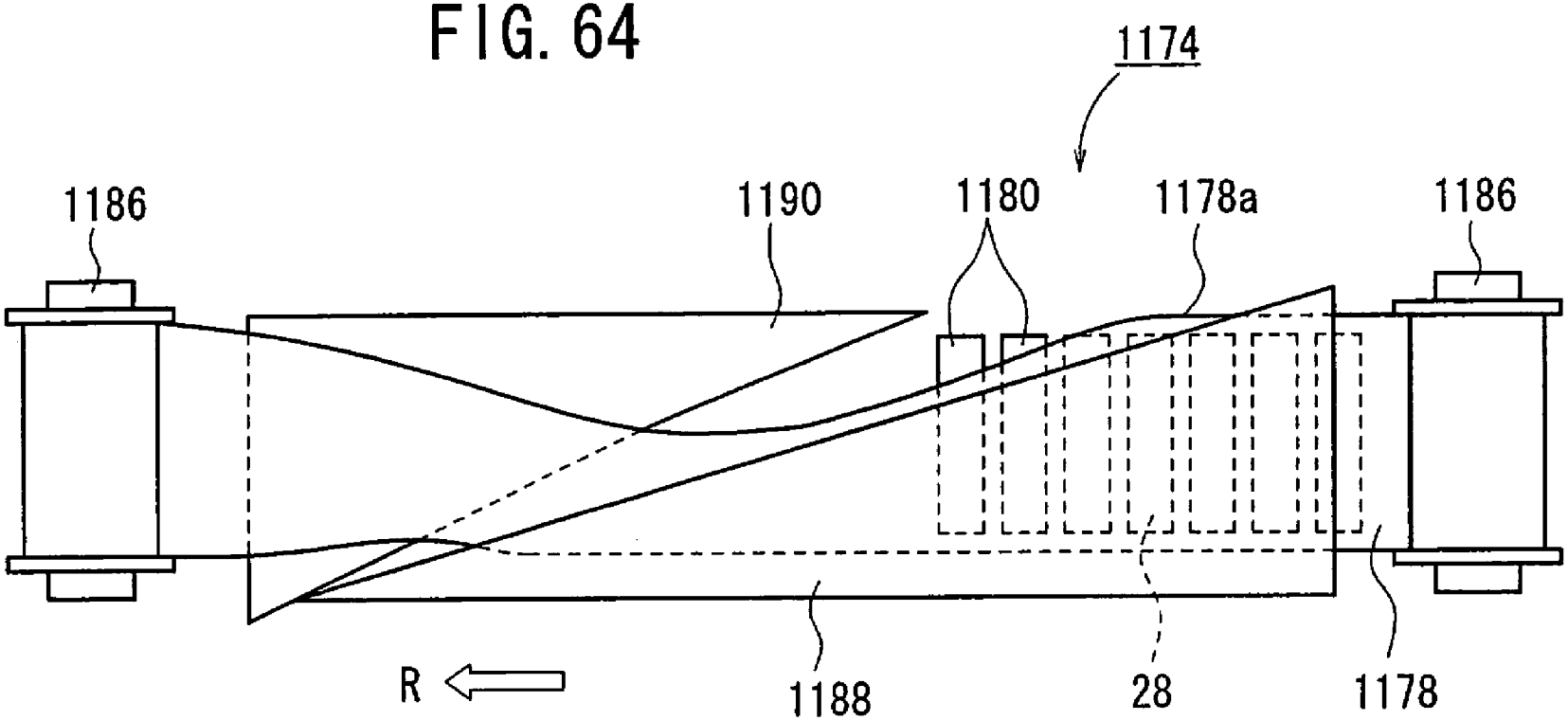
FIG. 64 is a plan view of the separable sheet bending mechanism.

As shown in FIGS. 63 and 64, the separable sheet bending mechanism 1174 has first and second feed guides 1188, 1190 disposed one on each side of the separable sheet 1178, for guiding the side edge 1178*a* of the strip-like separable sheet 1178 so as to forcibly bend the side edge 1178*a* upwardly. The first feed guide 1188 serves to guide a reverse side of the strip-like separable sheet 1178 opposite to the surface thereof on which the end fastening tapes 28 are disposed. The first feed guide 1188 has a substantially triangular shape having an edge inclined progressively away from the side edge 1178*a* of the strip-like separable sheet 1178 in the direction indicated by the arrow R in which the strip-like separable sheet 1178 is fed.

The second feed guide 1190 serves to guide the surface of the strip-like separable sheet 1178 on which the end fastening tapes 28 are disposed. The second feed guide 1190 has a substantially triangular shape having an edge inclined progressively away from the side edge 1178*a* of the strip-like separable sheet 1178 in the direction indicated by the arrow R in which the strip-like separable sheet 1178 is fed. When the strip-like separable sheet 1178 is guided by the first and second feed guides 1188, 1190, the side edge 1178*a* thereof is bent upwardly, exposing the adhesive-free areas 1180 of the end fastening tapes 28 out of the side edge 1178*a.*

As shown in FIGS. 61 and 62, the end tape removing mechanism 1176 has first and second suction heads 1192, 1194 positioned in facing relation to the surface of the strip-like separable sheet 1178 on which the end fastening tapes 28 are disposed, and first and second pressing members 1196, 1198 positioned in facing relation to the reverse side of the strip-like separable sheet 1178, with the end fastening tapes 28 being interposed between the first and second suction heads 1192, 1194 and the first and second pressing members 1196, 1198.

The end tape removing mechanism 1176 has a moving means 1200 for moving the first and second suction heads 1192, 1194 together in the direction indicated by the arrow S. The moving means 1200 has a servomotor 1202 having a rotatable drive shaft 1204 to which there is coupled an end of a ball screw 1206 that is rotatably supported on a base 1208. Two parallel guide rails 1210*a,* 1210*b* disposed one on each side of the ball screw 1206 and extending parallel to each other are mounted on the base 1208. A movable base 1212 is movably mounted on the guide rails 1210*a,* 1210*b.* The movable base 1212 has a nut 1214 threaded over the ball screw 1206.

The movable base 1212 supports thereon a guide member 1216 which is elongate in the direction indicated by the arrow U which is perpendicular to the direction indicated by the arrow S. A slide member 1220 of a rodless cylinder is mounted on the guide member 1216 for movement in the direction indicated by the arrow U.

First and second lifting and lowering cylinders 1222, 1224 are vertically mounted on the slide member 1220 and have respective upwardly extending rods 1222*a*, 1224*a* to which first and second vertically movable bases 1226, 1228 are fixed.

Figure 65:
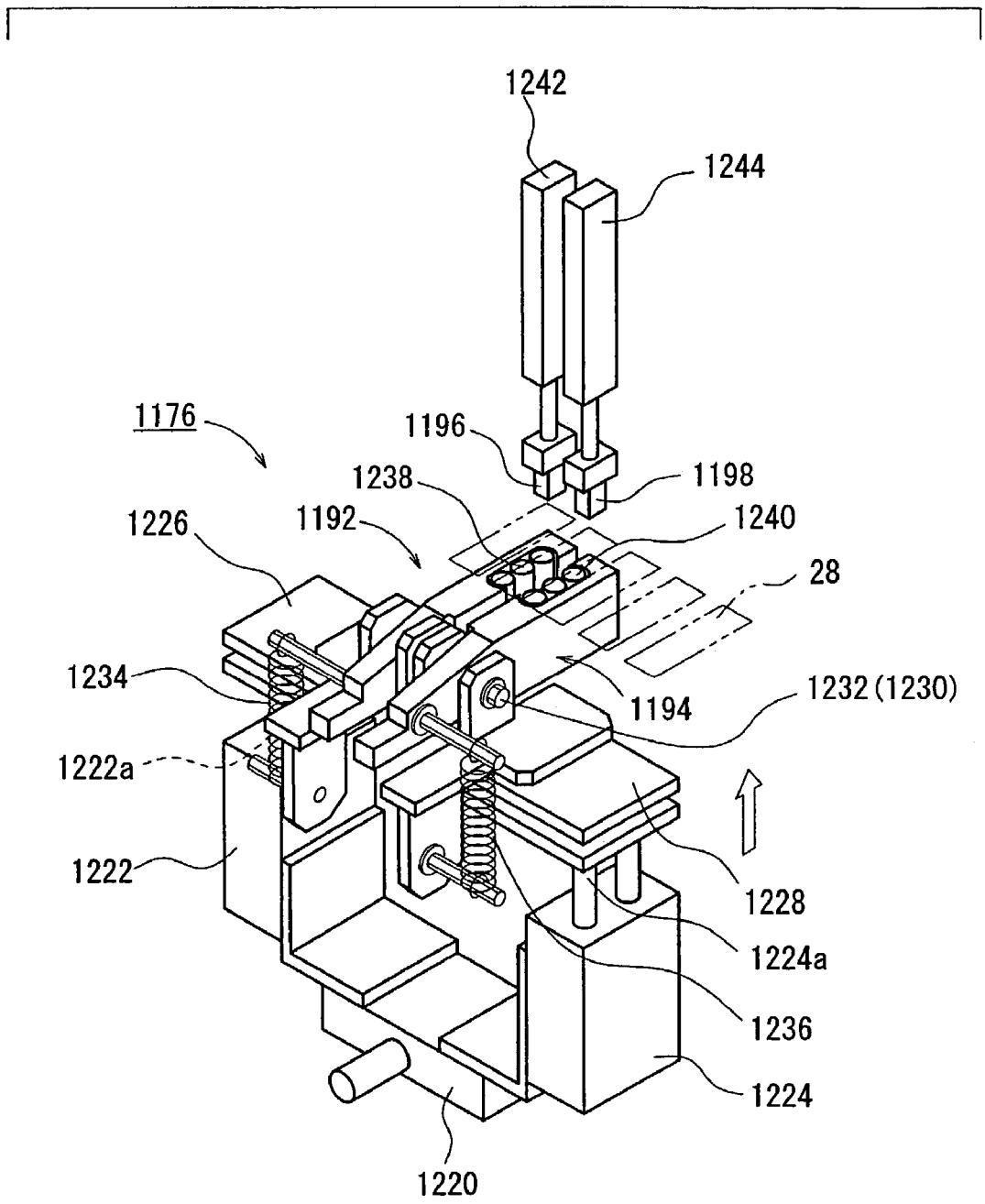
FIG. 65 is a perspective view showing the manner in which first and second suction heads of an end tape removing mechanism are lifted.

As shown in FIGS. 61 and 65, the first and second suction heads 1192, 1194 are mounted on the respective first and second vertically movable bases 1226, 1228 for swinging movement about respective pivot shafts 1230, 1232. The first and second suction heads 1192, 1194 are normally urged by respective springs 1234, 1236 to cause their distal ends to swing upwardly. A plurality of (e.g., three) suction pads 1238, 1240 are arrayed on each of the first and second suction heads 1192, 1194 in the longitudinal direction of the end fastening tapes 28. The suction pads 1238, 1240 are connected to a vacuum source (not shown).

As shown in FIGS. 61 and 62, the first and second pressing members 1196, 1198 are fixed to respective tip ends of rods 1242*a*, 1244*a* which project downwardly from respective first and second cylinders 1242, 1244, and positioned in alignment with the adhesive-free areas 1180 of the end fastening tapes 28 applied to the separable sheet 1178. An end tape detecting means 1246 for automatically detecting the adhesive-free areas 1180 of the end fastening tapes 28 is disposed near the first cylinder 1242. The end tape detecting means 1246 comprises a light emitter 1248 and a light detector 1250 which are vertically spaced a certain distance from each other.

Figure 66:
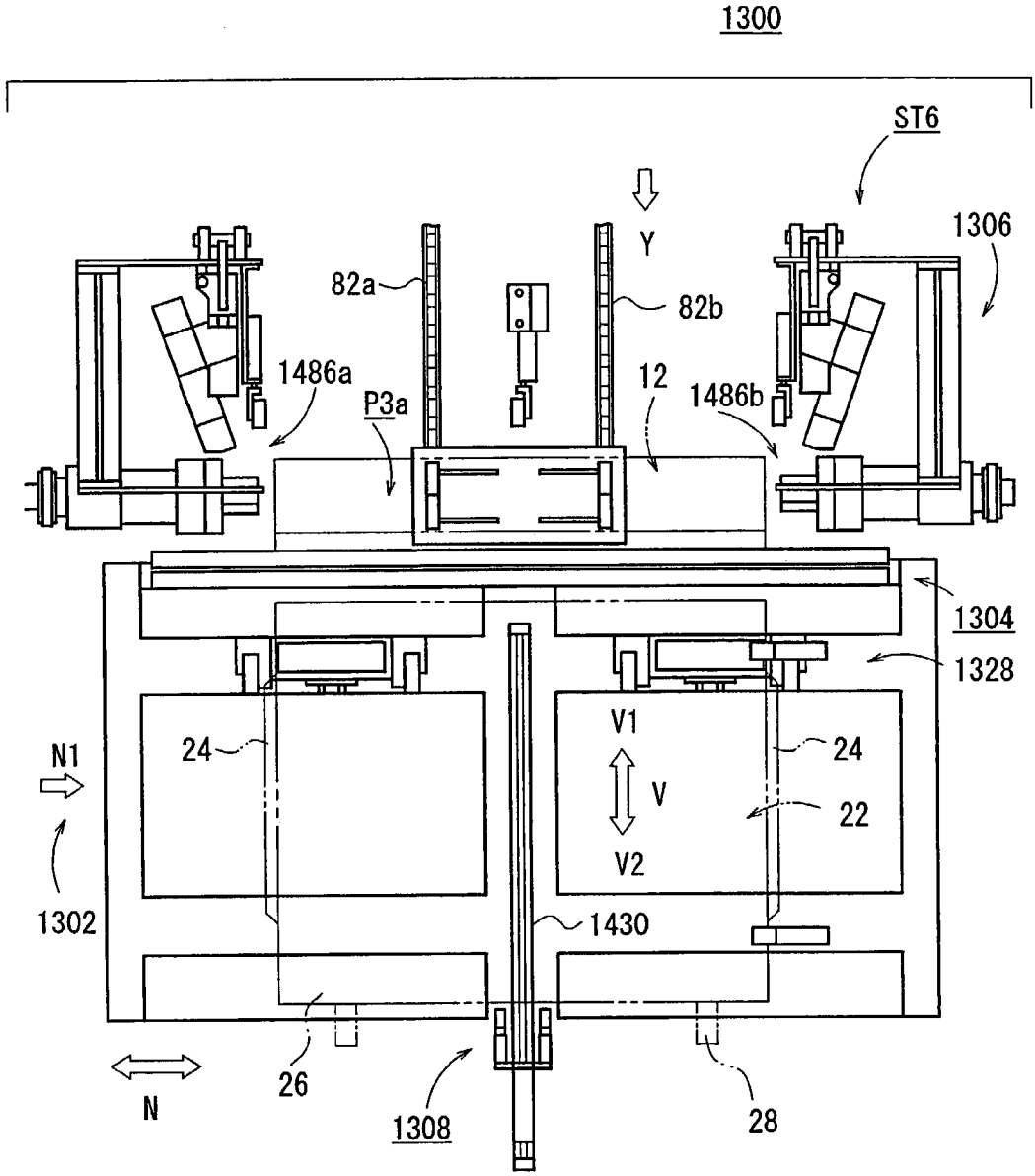
FIG. 66 is a plan view of a light-shielding leader winding station.

The light-shielding leader winding station ST6 has a packaging sheet takeup device 1300. As shown in FIG. 66, the packaging sheet takeup device 1300 comprises a light-shielding leader feed mechanism (packaging sheet feeding mechanism) 1302 for gripping the end of the light-shielding leader 22 and feeding and positioning the end of the light-shielding leader 22 in a winding position P3*a*, an applying mechanism (packaging sheet applying mechanism) 1304 for applying the light-shielding leader 22 to the end 14*a* of the photosensitive sheet 14, a rotating mechanism 1306 for rotating the photosensitive roll 12 with the light-shielding leader 22 applied thereto, and a light-shielding leader holding mechanism (packaging sheet holding mechanism) 1308 for gripping and moving the winding terminal end of the light-shielding leader 22 to the photosensitive roll 12 when the photosensitive roll 12 is rotated.

Figure 67:
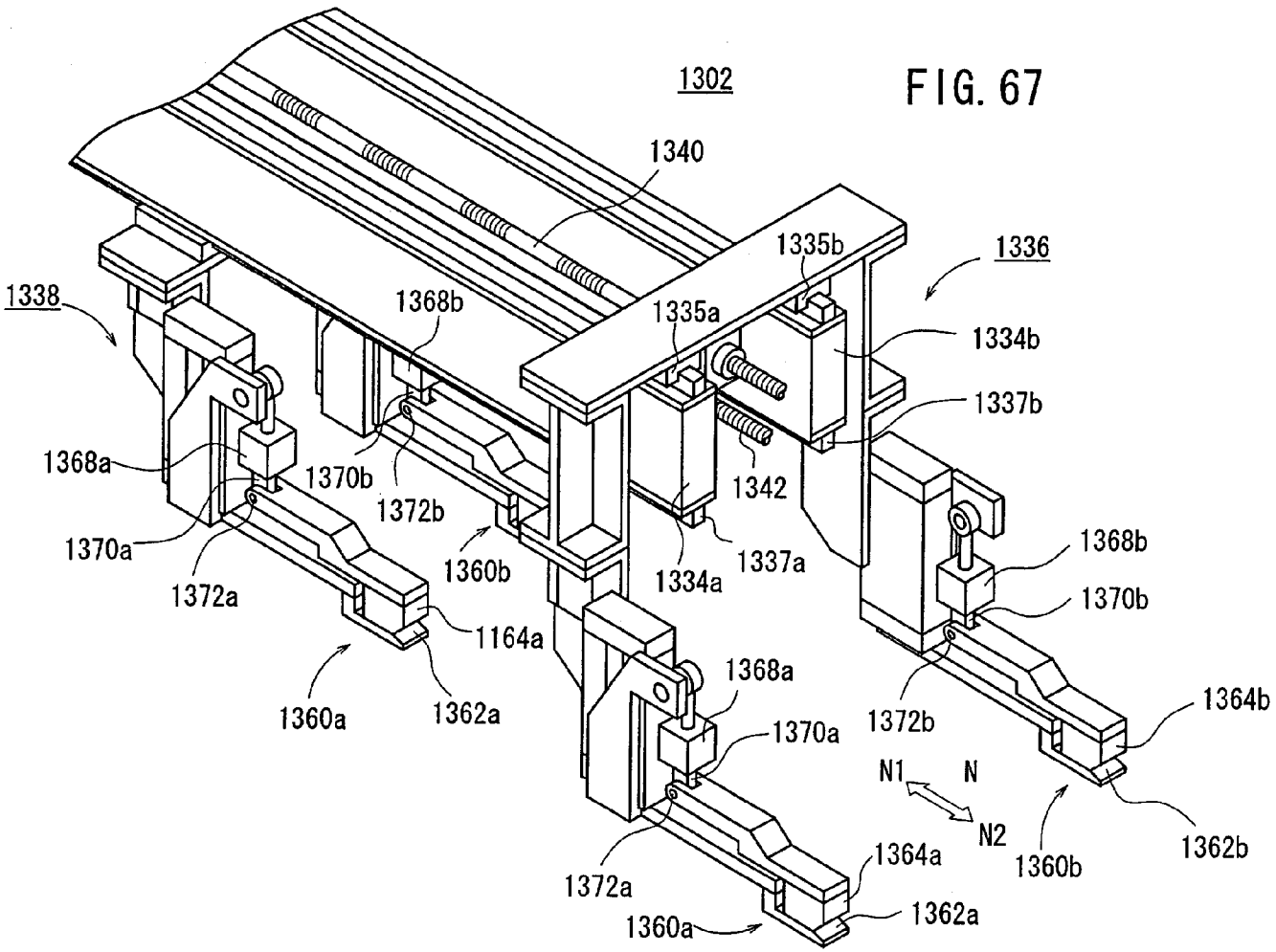
FIG. 67 is a perspective view of a light-shielding leader feeding mechanism of the automatic packaging system.
Figure 68:
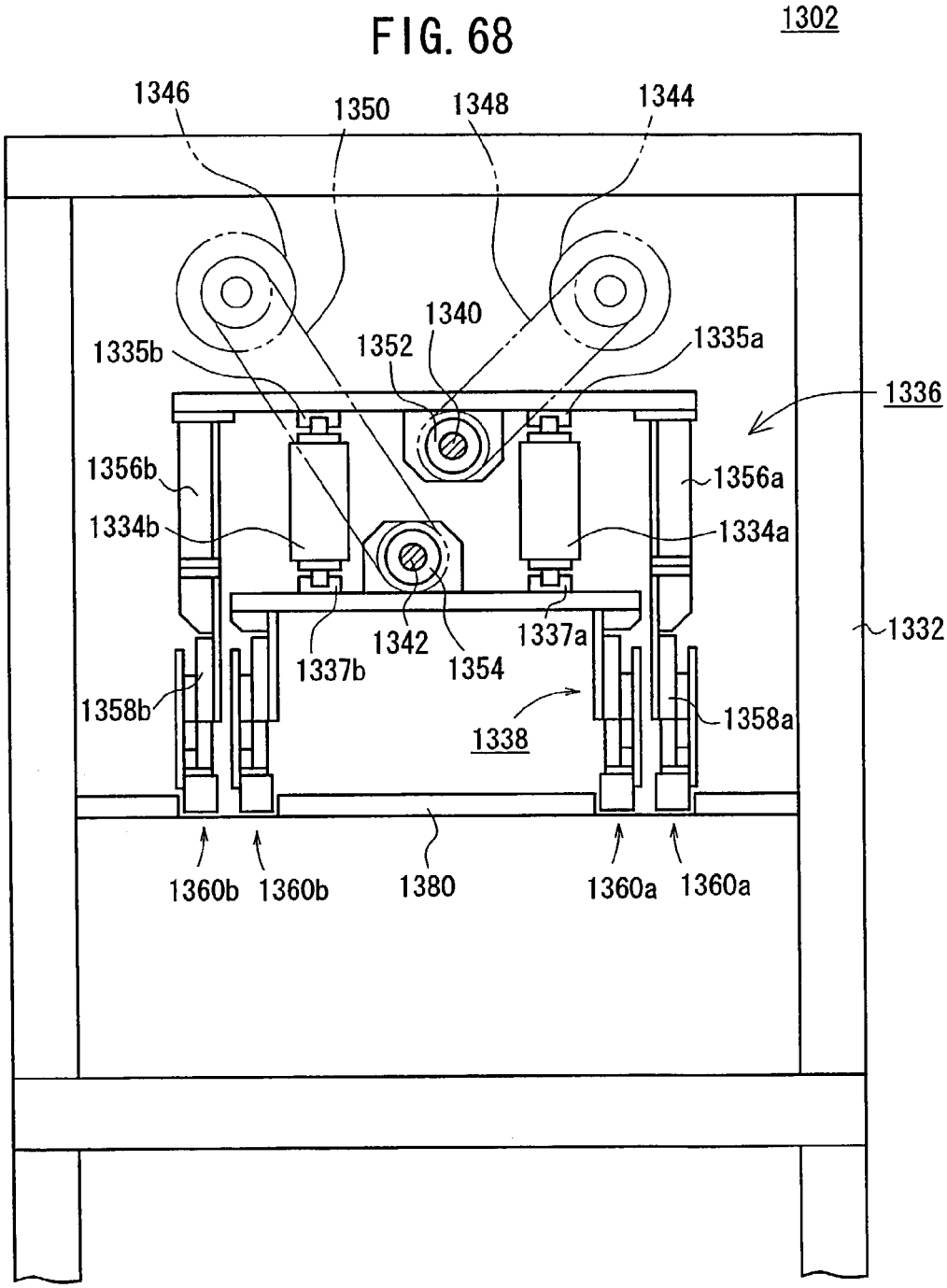
FIG. 68 is a front elevational view of the light-shielding leader feeding mechanism.

As shown in FIGS. 67 and 68, the light-shielding leader feed mechanism 1302 has a pair of horizontally extending rails 1334*a*, 1334*b* supported on an upper portion of a frame 1332 which extends from the light-shielding leader assembling station ST5 to the light-shielding leader winding station ST6. On the rails 1334*a*, 1334*b*, there are movably mounted first and second feed units 1336, 1338, respectively, for selectively feeding light-shielding leaders 22 having different lengths.

Upper linear guides 1335*a*, 1335*b* and lower linear guides 1337*a*, 1337*b* are mounted on the rails 1334*a*, 334*b*, between which there are rotatably supported first and second ball screws 1340, 1342. The first and second ball screws 1340, 1342 can individually be rotated by belt and pulley means 1348, 1350 which are coupled to respective motors 1344, 1346 fixed to an end of the frame 1332.

The first feed unit 1336 has a nut 1352 threaded over the first ball screw 1340, and is supported by the upper linear guides 1335*a*, 1335*b* for movement in the direction indicated by the arrow N. The second feed unit 1338 has a nut 1354 threaded over the second ball screw 1342, and is supported by the lower linear guides 1337*a*, 1337*b* for movement in the direction indicated by the arrow N.

Figure 69:
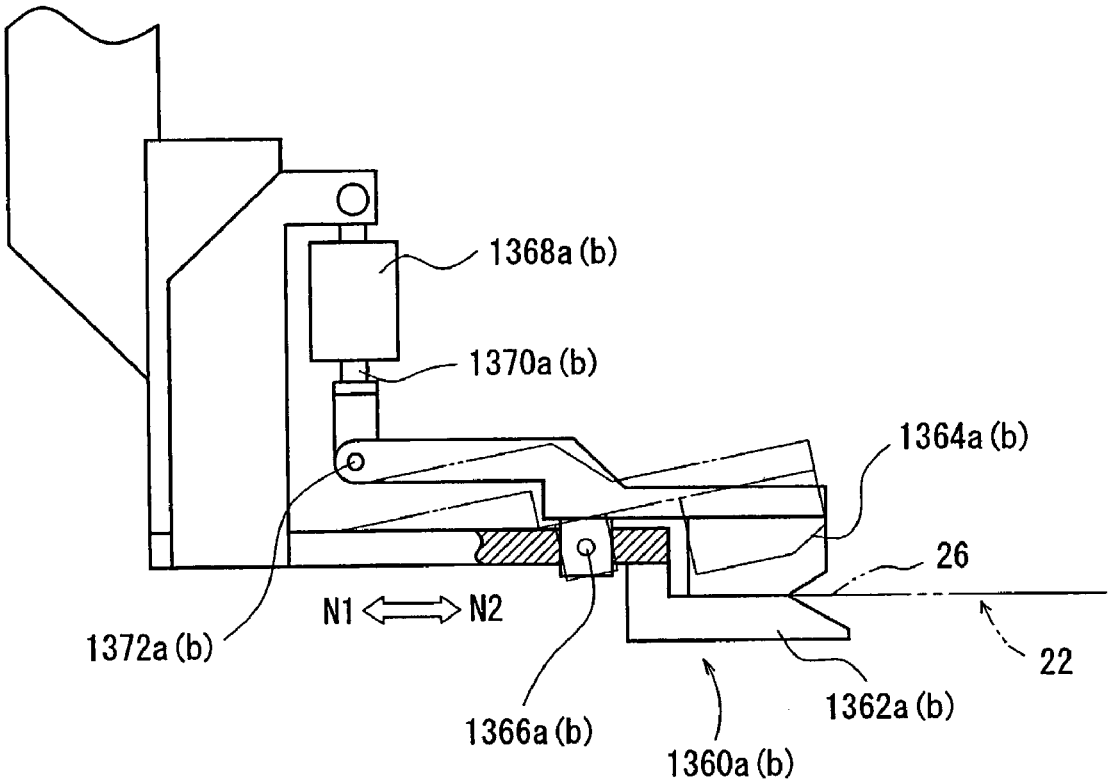
FIG. 69 is a view of a clamp means of the light-shielding leader feeding mechanism.

Arms 1356*a*, 1356*b* extend downwardly from the first feed unit 1336, and support on their lower ends clamp means 1360*a*, 1360*b* through vertically movable tables 1358*a*, 1358*b* which are actuatable under air pressure. As shown in FIGS. 67 and 69, the clamp means 1360*a*, 1360*b* have fixed fingers 1362*a*, 1362*b* and swing fingers 1364*a*, 1364*b*. The swing fingers 1364*a*, 1364*b* are swingable about respective pivot shafts 1366*a*, 1366*b* and have rear ends connected by respective hinge pins 1372*a*, 1372*b* to respective rods 1370*a*, 1370*b* extending downwardly from cylinders 1368*a*, 1368*b*.

The second feed unit 1338 is identical in structure to the first feed unit 1336. Therefore, the components of the second feed unit 1338 which are identical to those of the first feed unit 1336 are denoted by identical reference characters, and will not be described in detail below.

Figure 70:
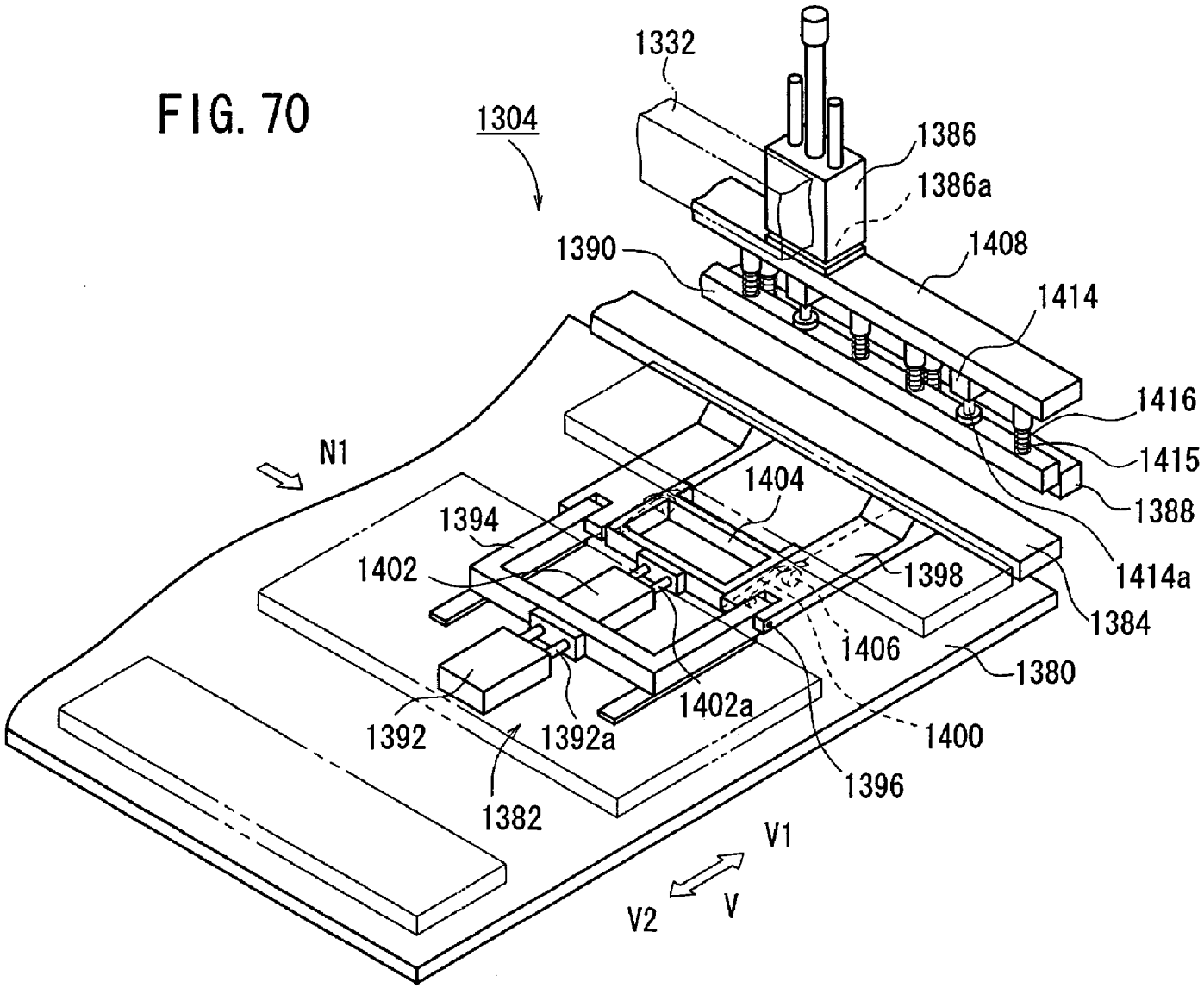
FIG. 70 is a perspective view of an applying mechanism of the automatic packaging system.
Figure 71:
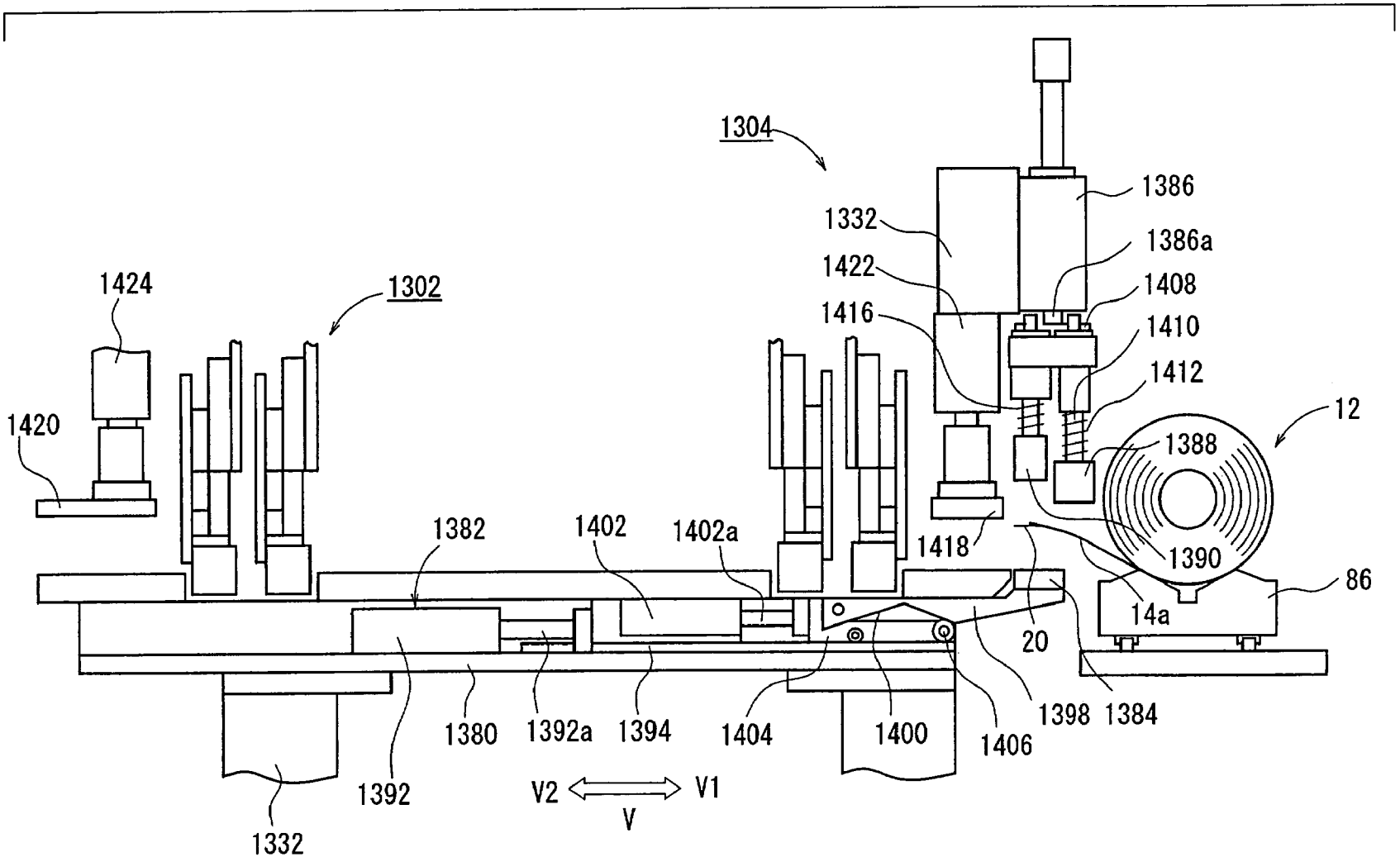
FIG. 71 is a side elevational view of the applying mechanism.

As shown in FIGS. 70 and 71, the applying mechanism 1304 has a movable base plate 1384 which is movable by an actuator 1382 mounted on a base 1380 of the frame 1332, and first and second presser members 1388, 1390 disposed above the movable base plate 1384 and vertically movable by a lifting and lowering cylinder 1386.

The actuator 1382 has a pair of laterally spaced first cylinders 1392 mounted on the base 1380 and having rods 1392*a* which extend therefrom in the direction indicated by the arrow V1 and are connected to a movable base 1394. Arms 1398 are swingably supported by a pair of pivot shafts 1396 on a distal end of the movable base 1394 in the direction indicated by the arrow V1. The movable base plate 1384 is integrally fixed to distal ends of the arms 1398. The arms 1398 have respective angularly concave cam surfaces 1400 on their lower surfaces.

A second cylinder 1402 is mounted centrally on the movable base 1394 and has rods 1402*a* which extend therefrom in the direction indicated by the arrow V1 and are connected to a cam plate 1404. Cam rollers 1406 engaging the cam surfaces 1400 of the arms 1398 are mounted on opposite ends of the cam plate 1404.

The lifting and lowering cylinder 1386 is fixed to the frame 1332 and has a downwardly extending rod 1386*a* to which an attachment plate 1408 is fixed. The first presser member 1388, which is positioned closely to the photosensitive roll 12, is connected to the attachment plate 1408 by a plurality of guide bars 1410, with springs 1412 disposed around the respective guide bars 1410. The attachment plate 1408 supports thereon a plurality cylinders 1414 spaced from the guide bars 1410 in the direction indicated by the arrow V2 and having respective downwardly extending rods 1414*a* to which the second presser member 1390 is fixed. The second presser member 1390 is movable toward and away from the attachment plate 1408 by the cylinders 1414 while being guided by rods 1415 and springs 1416 disposed therearound.

As shown in FIG. 71, light-shielding leader pressers 1418, 1420 are disposed on the base 1380 at its opposite ends spaced in the direction indicated by the arrow V. The light-shielding leader pressers 1418, 1420 extend in the direction indicated by the arrow N, and are vertically movable by respective lifting and lowering cylinders 1422, 1424. The light-shielding leader holding mechanism 1308 is disposed on the base 1380 at a substantially central position in the direction indicated by the arrow N (see FIG. 66).

Figure 72:
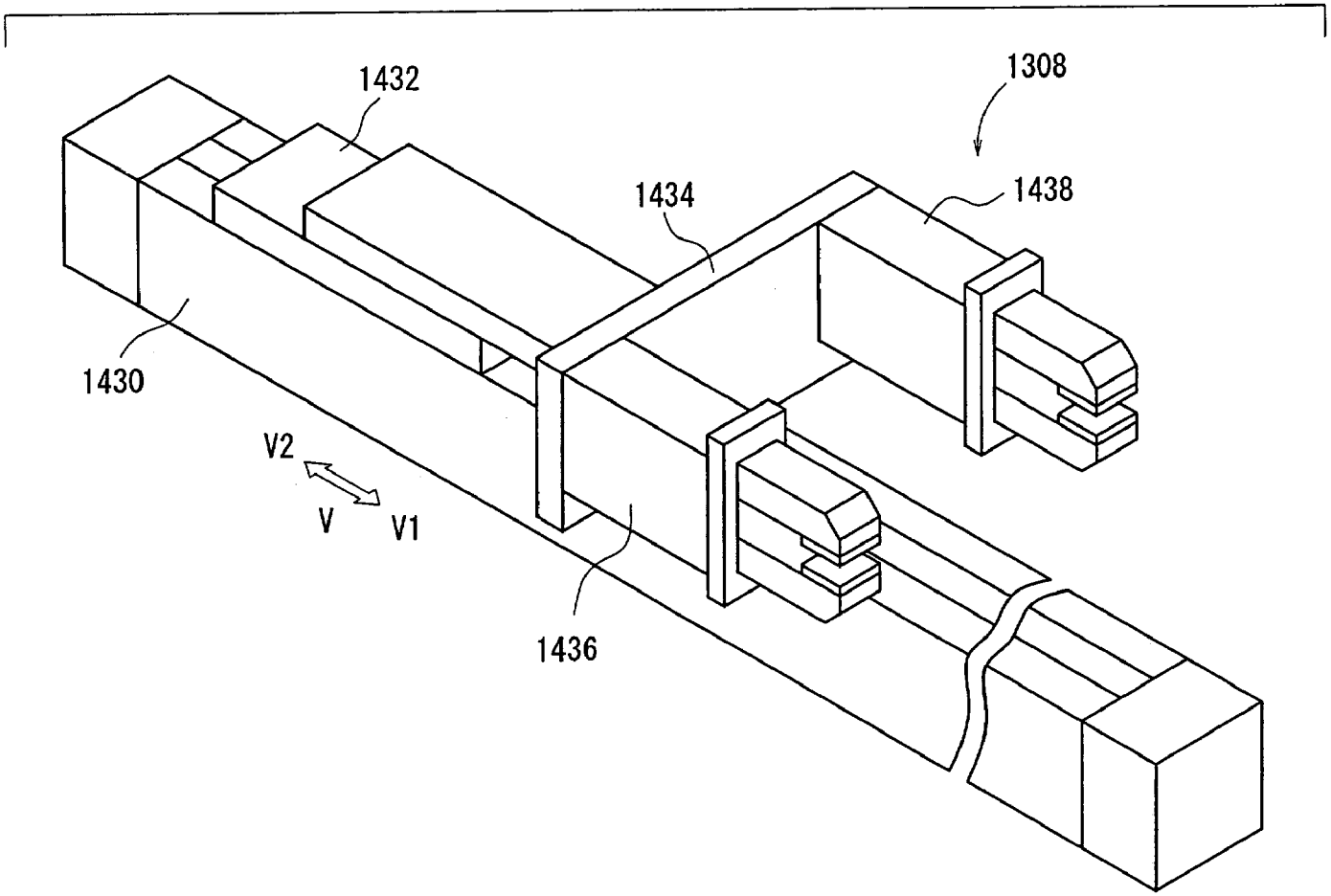
FIG. 72 is a perspective view of a light-shielding leader holding mechanism of the automatic packaging system.

The light-shielding leader holding mechanism 1308 has a rodless cylinder 1340 mounted on the base 1380 and extending in the direction indicated by the arrow V. As shown in FIG. 72, a support plate 1434 is fixed to a movable base 1432 which is movable in the direction indicated by the arrow V by the rodless cylinder 1430. Air chucks 1436, 1438 are mounted on the support plate 1434 in respective positions which are equally spaced laterally from a transversely central line of the light-shielding leader 22.

Figure 73:
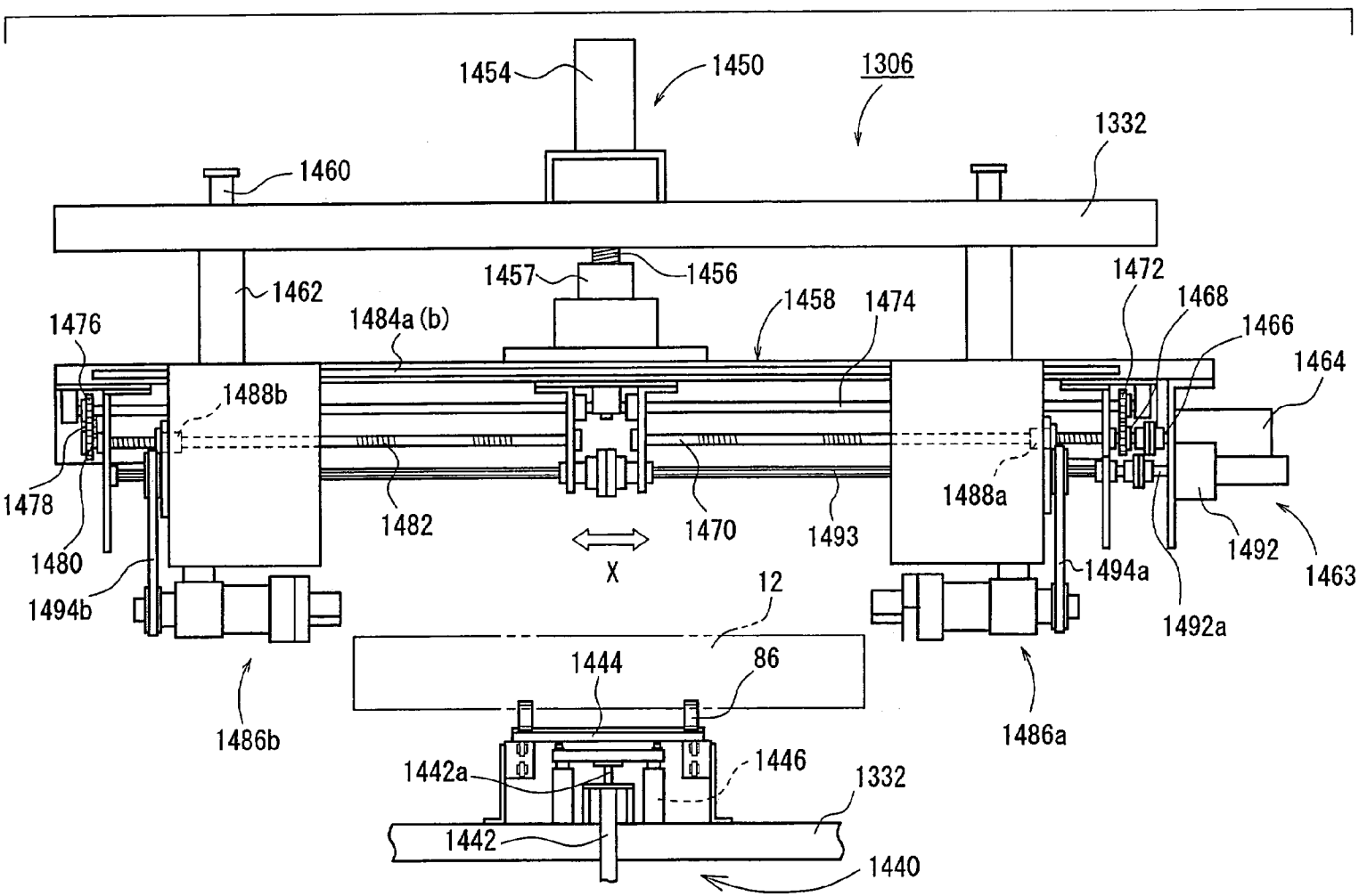
FIG. 73 is a front elevational view of a rotating mechanism and a pallet lifting and lowering device of the automatic packaging system.

As shown in FIG. 73, the photosensitive roll 12 is supported on a pallet lifting and lowering device 1440 in a position below the rotating mechanism 1306. The pallet lifting and lowering device 1440 has a cylinder 1442 fixed to the frame 1332. The cylinder 1442 has an upwardly extending rod 1442*a* to which a vertically movable base 1444 is secured. Guide bars 1446 mounted on the vertically movable base 1444 are vertically movably supported by the frame 1332. The pallet 86 can be placed on the vertically movable base 1444.

Figure 74:
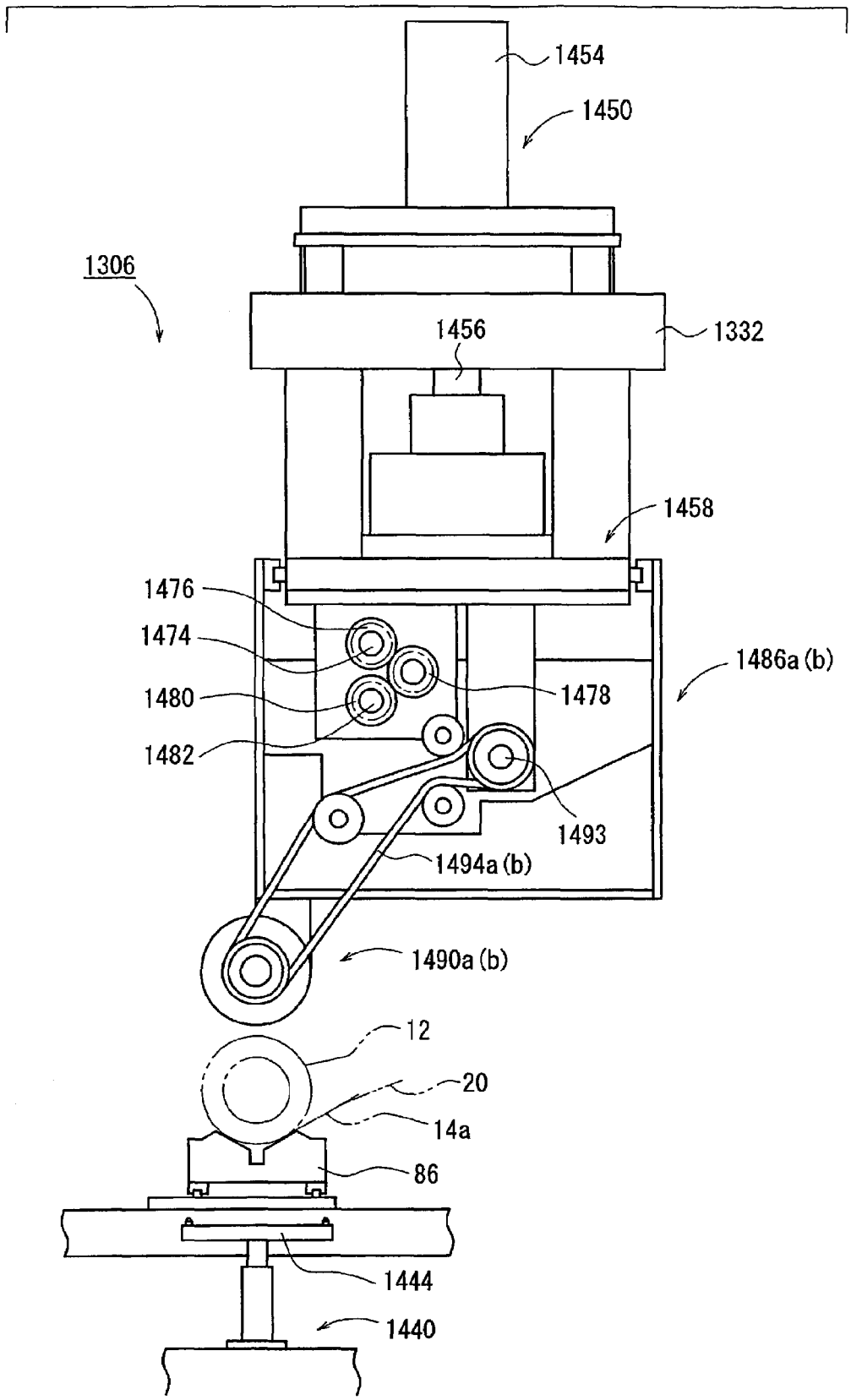
FIG. 74 is a side elevational view of the rotating mechanism and the pallet lifting and lowering device.

The rotating mechanism 1306 has a moving unit 1450 mounted on the frame 1332. As shown in FIGS. 73 and 74, the moving unit 1450 has a motor 1454 fixedly mounted on the frame 1332 and directed downwardly, and having a downwardly extending rotatable drive shaft (not shown) to which a ball screw 1456 is coaxially connected. The ball screw 1456 is threaded through a nut 1457 fixed to a vertically movable frame 1458 which extends transversely across the photosensitive roll 12 in the direction indicated by the arrow X. a plurality of guide rods 1460 have lower ends screwed to the vertically movable frame 1458 and are inserted in respective guide bushings 1462 attached to the frame 1332.

A drive unit 1463 has a motor 1464 mounted on a longitudinal end of the vertically movable frame 1458 and having a rotatable drive shaft 1466 to which there are coaxially fixed a drive gear 1468 and a first ball screw 1470. The drive gear 1468 is held in mesh with a driven gear 1472 fixedly mounted on an end of a rotatable shaft 1474 whose opposite ends and central portion are rotatably supported on the vertically movable frame 1458.

The rotatable shaft 1474 has a first gear 1476 mounted on an end thereof remote from the driven gear 1472 and held in mesh with a second gear 1478 meshing with a third gear 1480. The third gear 1480 is mounted on an end of a second ball screw 1482 which is coaxial with the first ball screw 1470 and is rotatably supported on the vertically movable frame 1458.

The vertically movable frame 1458 has a set of guide rails 1484*a*, 1484*b* extending parallel to the first and second ball screws 1470, 1482, and first and second slide units 1486*a*, 1486*b* are slidably supported on the guide rails 1484*a*, 1484*b*. The first and second slide units 1486*a*, 1486*b* support first and second nuts 1488*a*, 1488*b* fixed thereto which are threaded respectively over the first and second ball screws 1470, 1482. First and second chucks 1490*a*, 1490*b* are rotatably supported on lower surfaces of the first and second slide units 1486*a*, 1486*b*, respectively. The first and second chucks 1490*a*, 1490*b* are insertable in the opposite ends of the photosensitive roll 12 and movable radially inwardly and outwardly in the photosensitive roll 12.

A motor 1492 is mounted on the longitudinal end of the vertically movable frame 1458 in juxtaposed relation to the motor 1464, and has a rotatable drive shaft 1492*a* to which a splined shaft 1493 is coaxially connected. The splined shaft 1493 extends in the direction indicated by the arrow X and is rotatably supported on the vertically movable frame 1458. The first and second chucks 1490*a*, 1490*b* are operatively coupled to the opposite ends of the splined shaft 1493 respectively by belt and pulley means 1494*a*, 1494*b*.

Figure 75:
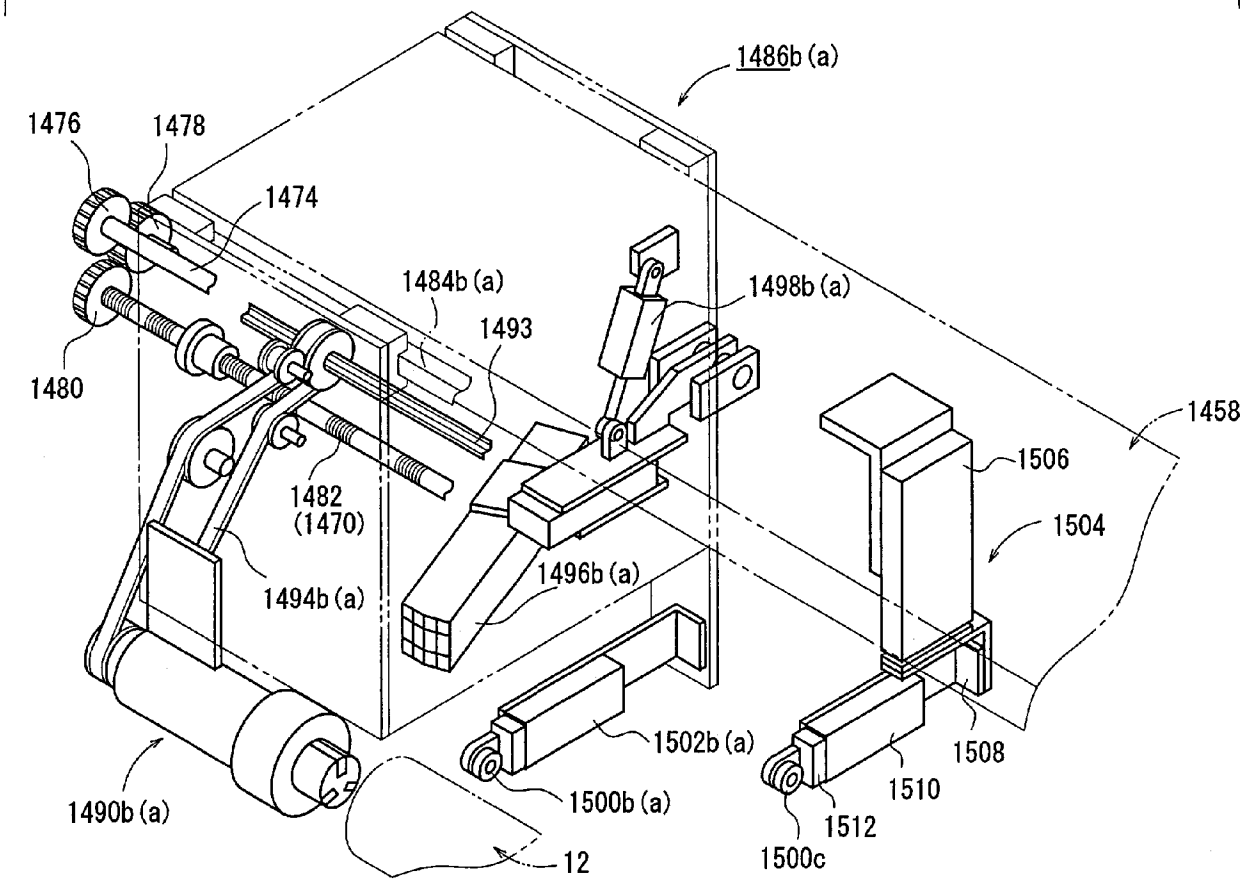
FIG. 75 is a perspective view of a slide unit of the rotating mechanism.
Figure 76:
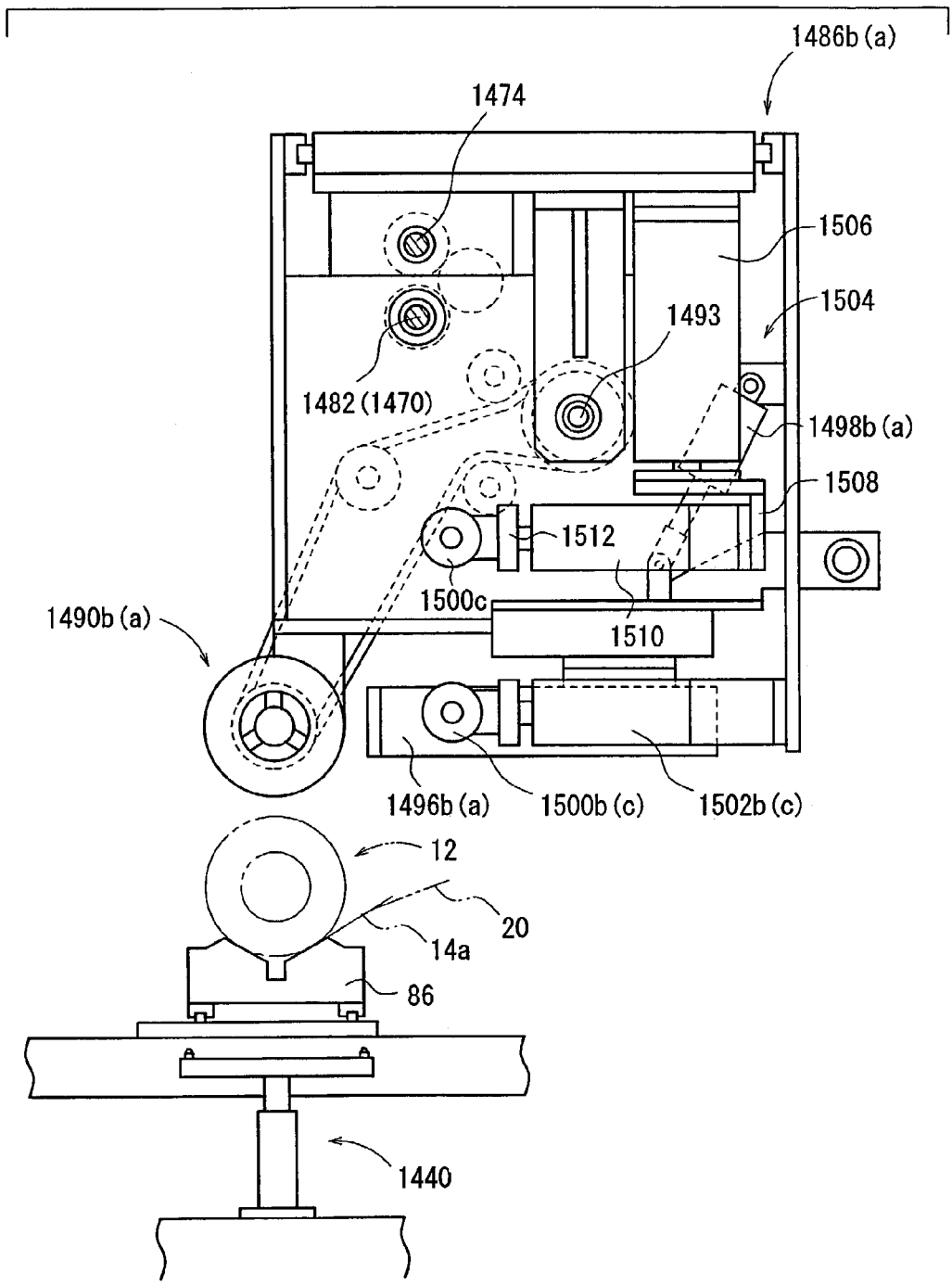
FIG. 76 is a side elevational view of the slide unit.

As shown in FIGS. 75 and 76, hot air blowers 1496*a*, 1496*b* for continuously supplying hot air at a constant temperature and a constant rate to the light-shielding shrink films 24 upon rotation of the photosensitive roll 12 are swingably mounted on the respective first and second slide units 1486*a*, 1486*b* by cylinders 1498*a*, 1498*b*.

Rollers 1500*a*, 1500*b* for pressing the light-shielding leader 22 against the photosensitive roll 12 while the winding terminal end of the light-shielding leader 22 is being released from the light-shielding leader holding mechanism 1308 when the light-shielding leader 22 is wound are mounted on the respective first and second slide units 1486*a*, 1486*b*. The rollers 1500*a*, 1500*b* are horizontally movable by horizontal cylinders 1502*a*, 1502*b*, respectively.

A roller 1500*c* which is movable by an actuator 1504 is mounted on the vertically movable frame 1458. The actuator 1504 has a vertical first cylinder 1506 which lifts and lowers an attachment plate 1508 having a vertical surface on which a horizontal second cylinder 1510 is fixedly mounted. The second cylinder 1510 horizontally moves a plate 1512 with the roller 1500*c* being rotatably supported thereon.

Figure 77:
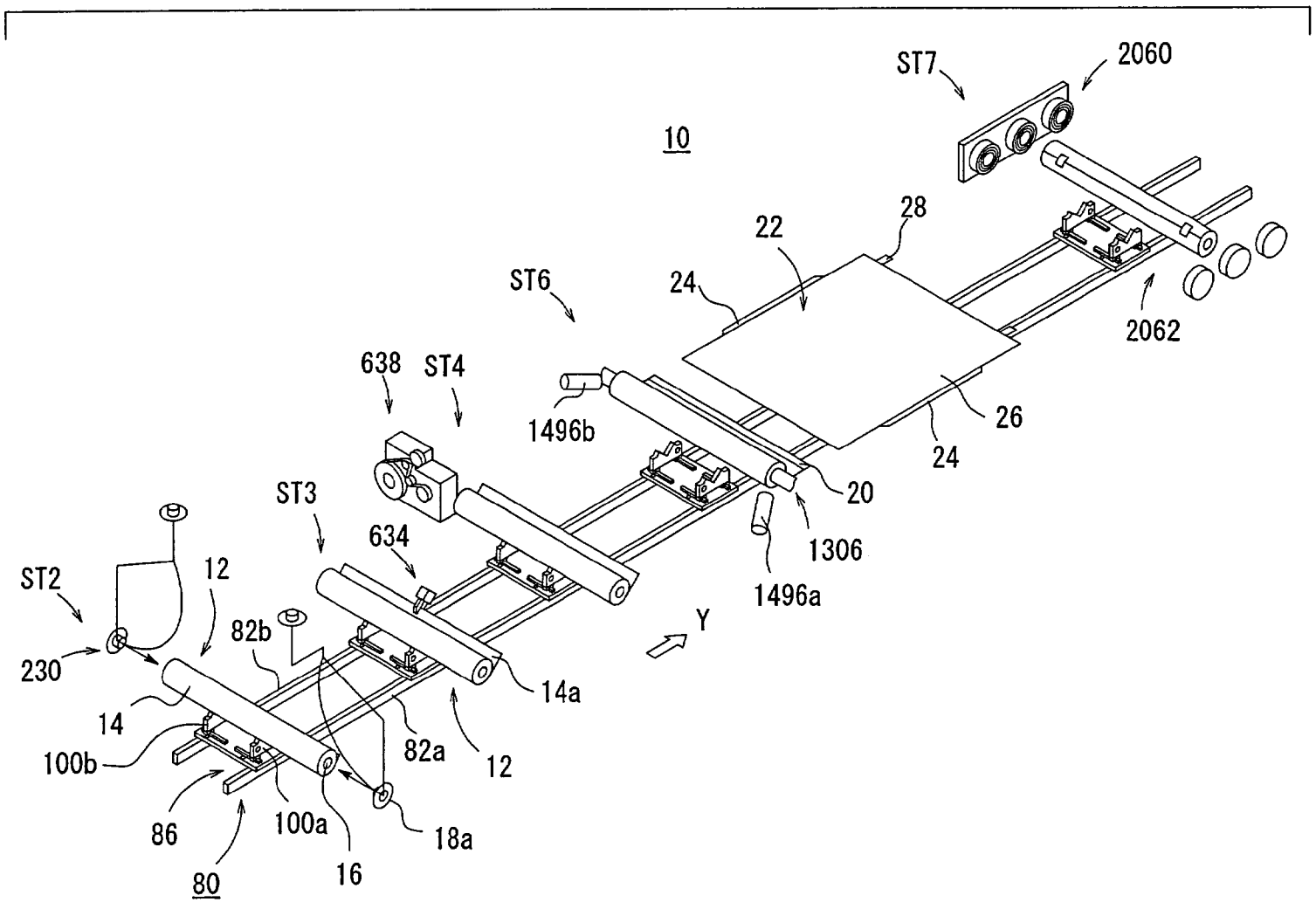
FIG. 77 is a perspective view of a downstream portion of the automatic packaging system.

As shown in FIG. 77, the thermally fusing station ST7 has a packaging sheet bonding device 2060 and a lifting and lowering device 2062 for lifting the photosensitive roll 12 in unison with the pallet 86 to a thermally fusing position.

Figure 78:
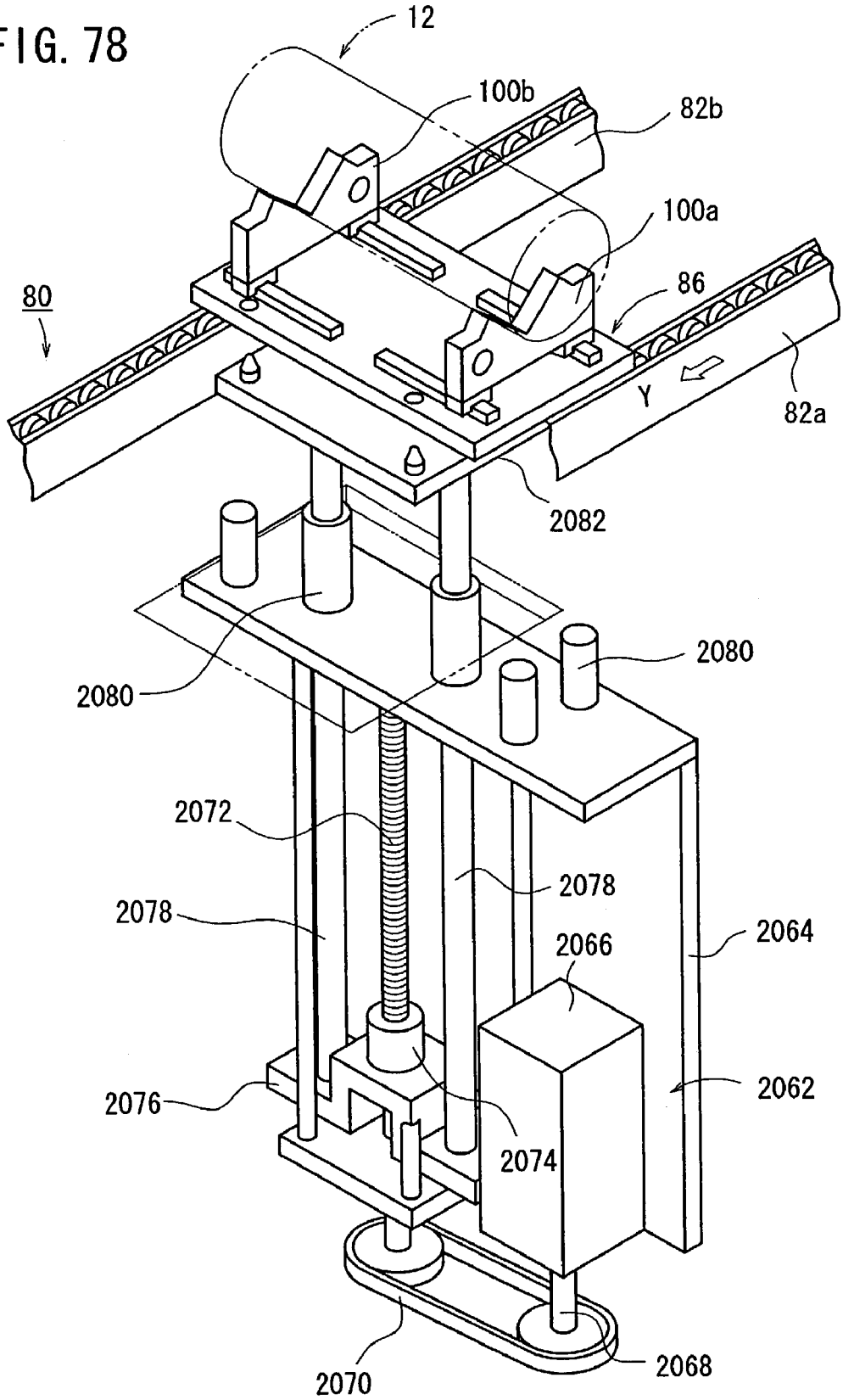
FIG. 78 is a perspective view of a lifting and lowering device of a thermally fusing mechanism.

As shown in FIG. 78, the lifting and lowering device 2062 has a servomotor 2066 with a brake as a rotary actuator fixed to a frame 2064. The servomotor 2066 has a rotatable drive shaft 2068 operatively coupled to a ball screw 2072 by a belt and pulley means 2070. The ball screw 2072 extends vertically and have upper and lower ends rotatably supported on the frame 2064.

The ball screw 2072 is threaded through a nut 2074 mounted on a vertically movable base 2076 to which there are fixed the lower ends of a pair of guide bars 2078 parallel to the ball screw 2072. The guide bars 2078 are supported on the frame 2064 by linear bushings 2080 and have respective upper ends to which a vertically movable plate 2082 is fixed.

Figure 79:
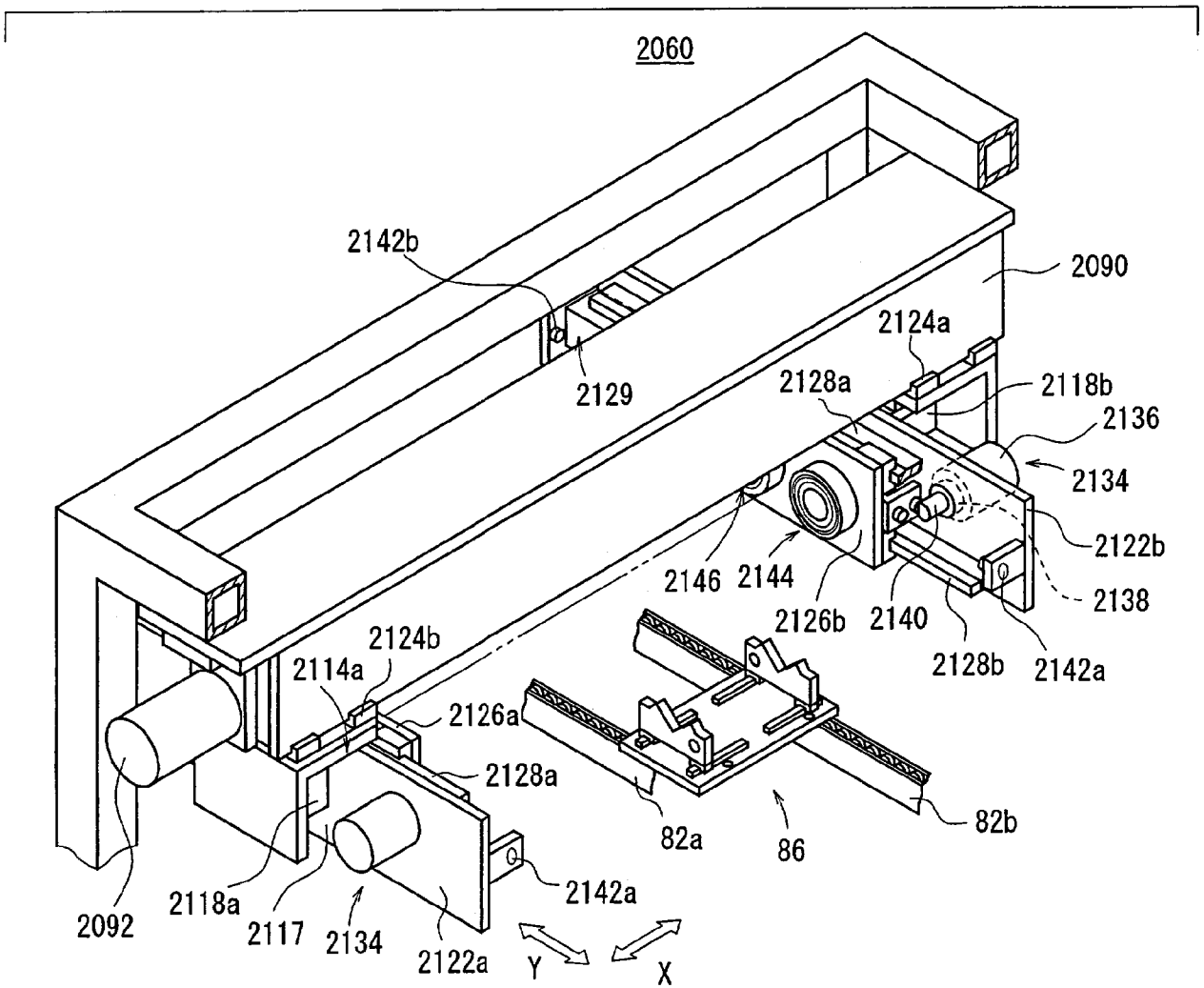
FIG. 79 is a perspective view of the thermally fusing mechanism.
Figure 80:
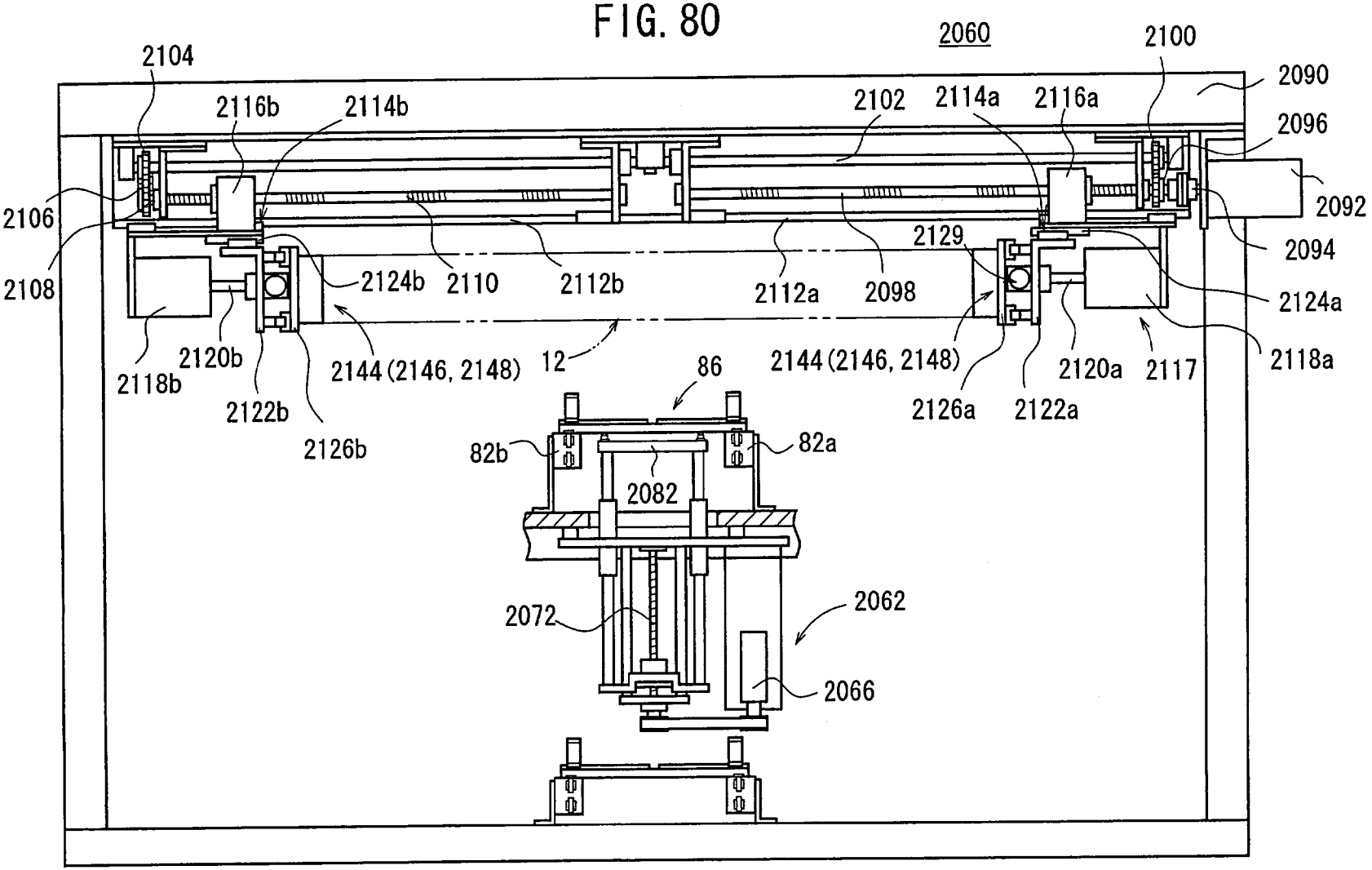
FIG. 80 is a front elevational view of the thermally fusing mechanism.
Figure 81:
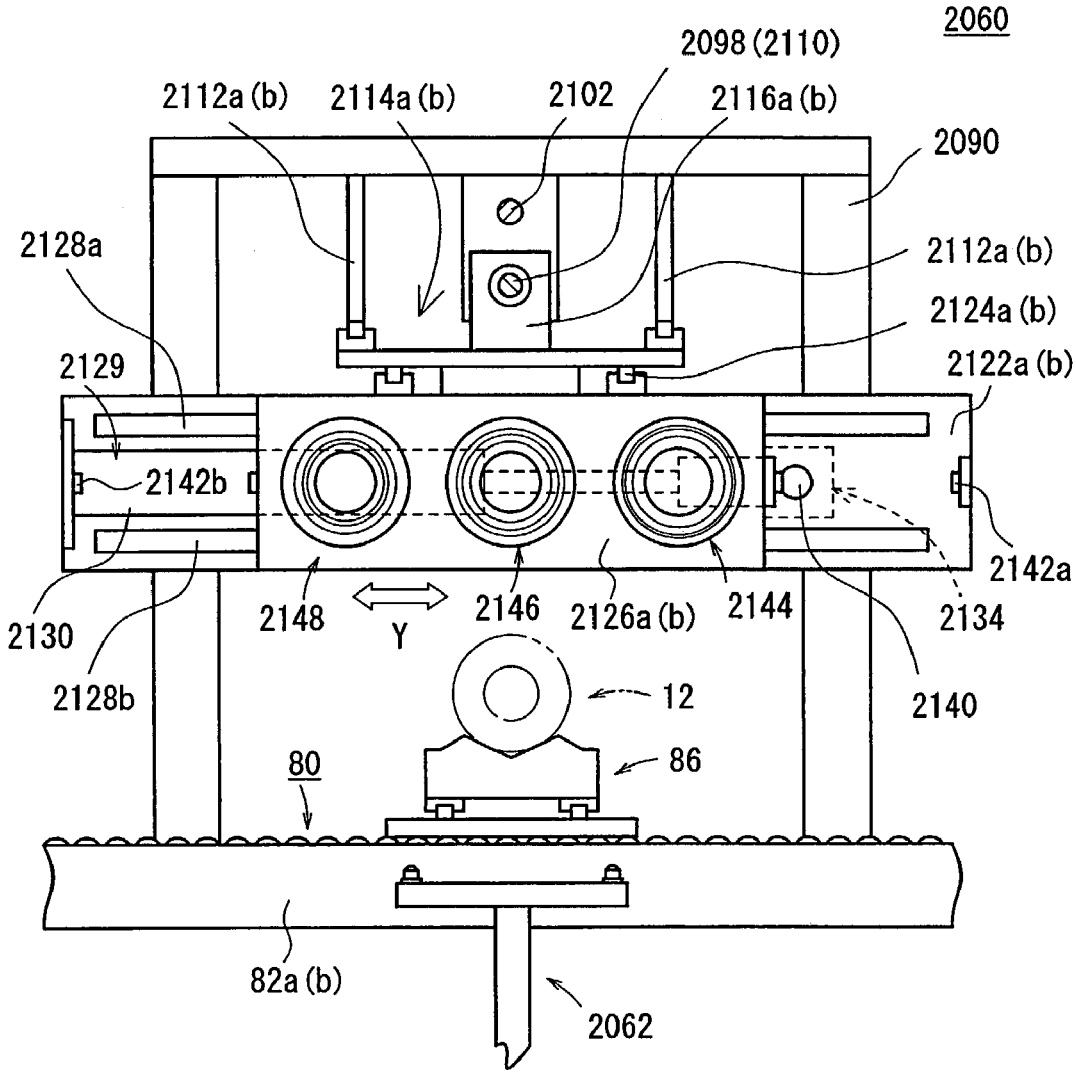
FIG. 81 is a side elevational view of the thermally fusing mechanism.

As shown in FIGS. 79 through 81, the packaging sheet bonding device 2060 has an upper frame 2090 fixedly mounted on the frame 2064. A horizontal servomotor 2092 with a brake is mounted on an end of the upper frame 2090 and has a rotatable drive shaft 2094 to which there are coaxially fixed a drive gear 2096 and a first ball screw 2098. The drive gear 2096 is held in mesh with a driven gear 2100 fixedly mounted on an end of a rotatable shaft 2102 whose opposite ends and central portion are rotatably supported on the upper frame 2090.

The rotatable shaft 2102 has a first gear 2104 mounted on an end thereof remote from the driven gear 2100 and held in mesh with a second gear 2106 meshing with a third gear 2108. The third gear 2108 is mounted on an end of a second ball screw 2110 which is coaxial with the first ball screw 2098 and is rotatably supported on the upper frame 2090. The upper frame 2090 has a set of guide rails 2112*a*, 2112*b* extending parallel to the first and second ball screws 2098, 2110, and first and second slide bases 2114*a*, 2114*b* are slidably supported on the guide rails 2112*a*, 2112*b*.

The first and second bases 2114*a*, 2114*b* support first and second nuts 2116*a*, 2116*b* fixed thereto which are threaded respectively over the first and second ball screws 2098, 2100. A pressing mechanism 2117 has first and second cylinders 2118*a*, 2118*b* fixed to lower surfaces of the first and second bases 2114*a*, 2114*b* in confronting relation to each other. The first and second cylinders 2118*a*, 2118*b* have respective horizontally projecting rods 2120*a*, 2120*b* coupled to respective first and second movable support bases 2122*a*, 2122*b*. The first and second movable support bases 2122*a*, 2122*b* are movably supported on the respective first and second bases 2114*a*, 2114*b* by respective linear guides 2124*a*, 2124*b*.

Figure 82:
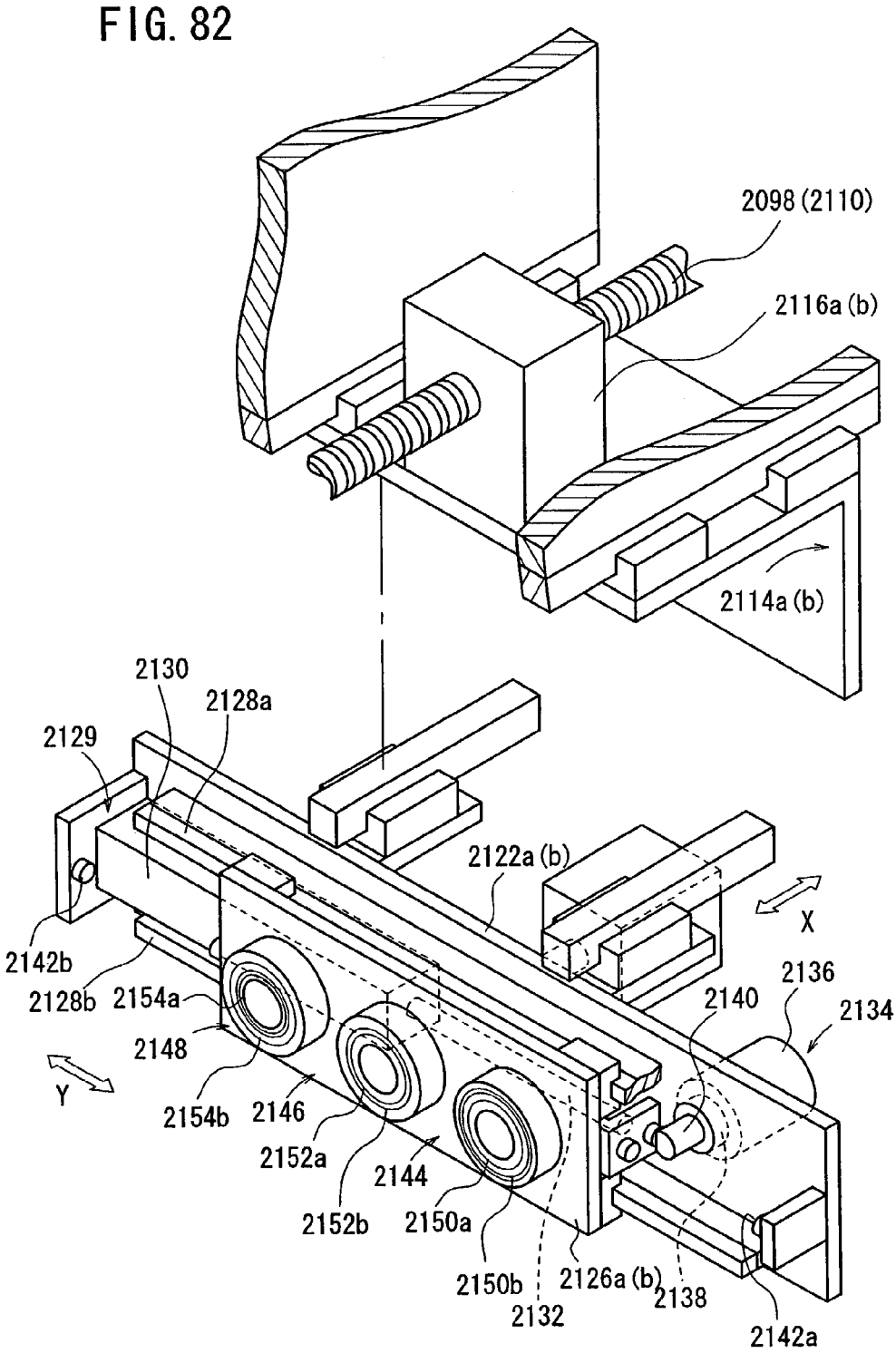
FIG. 82 is a perspective view of heating heads of the thermally fusing mechanism.

As shown in FIG. 82, slide plates 2126*a*, 2126*b* are mounted respectively on the first and second movable support bases 2122*a*, 2122*b* for movement in the direction indicated by the arrow Y (diametrically across the photosensitive roll 12) which is perpendicular to the direction indicated by the arrow X in which the first and second movable support bases 2122*a*, 2122*b* are movable. The first and second movable support bases 2122*a*, 2122*b* have respective vertical surfaces to which there are fixed upper and lower guide rails 2128*a*, 2128*b* extending parallel to each other in the direction indicated by the arrow Y. A moving mechanism 2129 has a cylinder 2130 disposed between the upper and lower guide rails 2128*a*, 2128*b*. The cylinder 2130 has a horizontally extending rod 2132 connected to the slide plate 2126*a*, 2126*b* which is supported on the guide rails 2128*a*, 2128*b*.

The first and second movable support bases 2122*a*, 2122*b* have a stopper means 2134 for forcibly stopping the slide plate 2126*a*, 2126*b* in a substantially intermediate position between the opposite ends of its stroke of movement caused by the cylinder 2130. The stopper means 2134 has a cylinder 2136 having a rod 2138 with an engaging member 2140 coupled thereto. Engaging screws 2142*a*, 2142*b* for engaging the opposite ends of the slide plate 2126*a*, 2126*b* to position the slide plate 2126*a*, 2126*b* are adjustably mounted on the respective opposite ends of the first and second movable support bases 2122*a*, 2122*b* in the direction indicated by the arrow Y.

A first heating head 2144, a second heating head 2146, and a third heating head 2148 are mounted on a front surface of the slide plate 2126*a*, 2126*b*. Each of the first through third heating heads 2144, 2146, 2148 is substantially disk-shaped, and houses a cartridge heater, not shown, therein.

Figure 83:
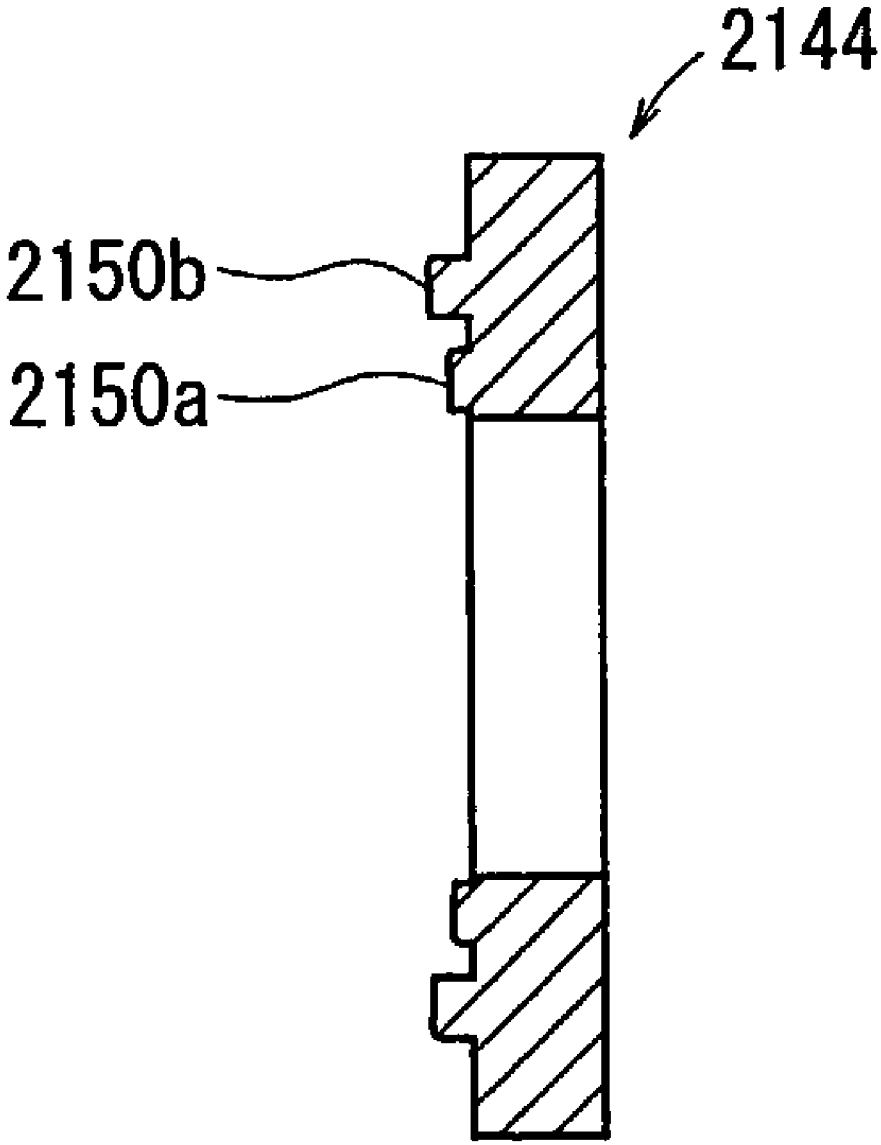
FIG. 83 is a cross-sectional view of a first heating head.
Figure 84:
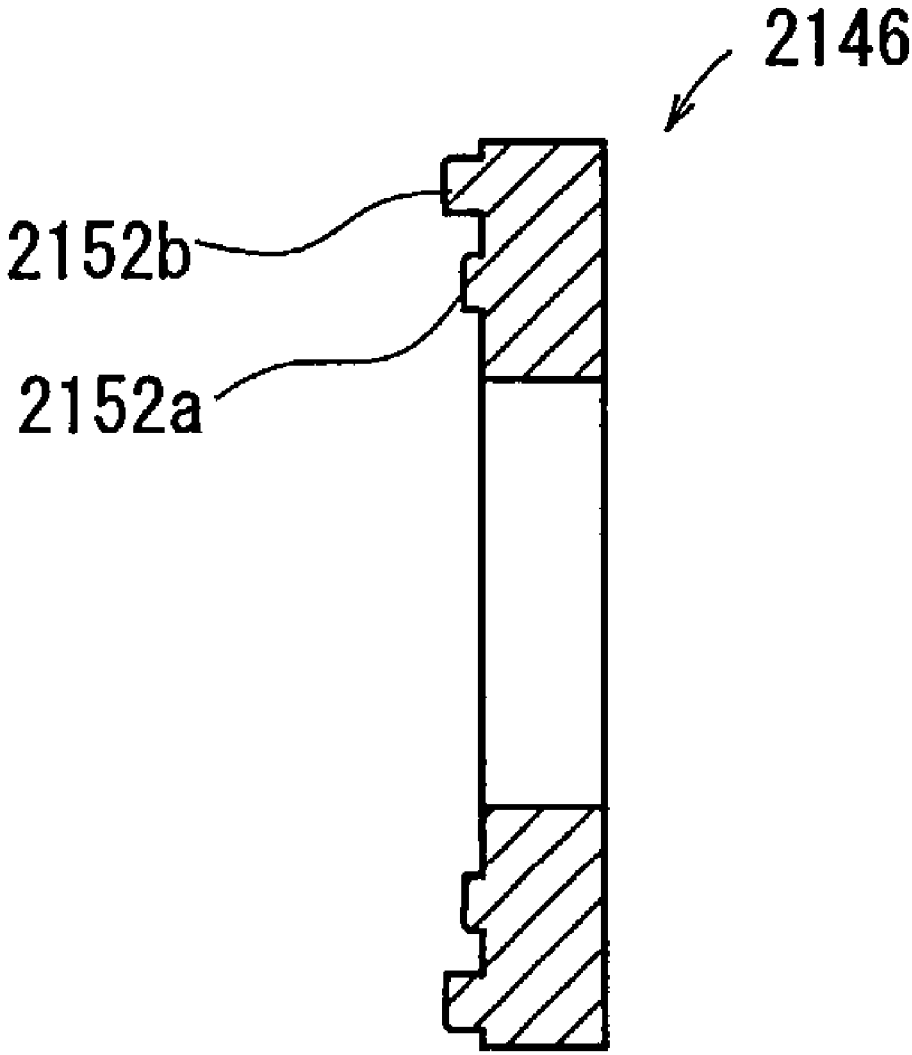
FIG. 84 is a cross-sectional view of a second heating head.
Figure 85:
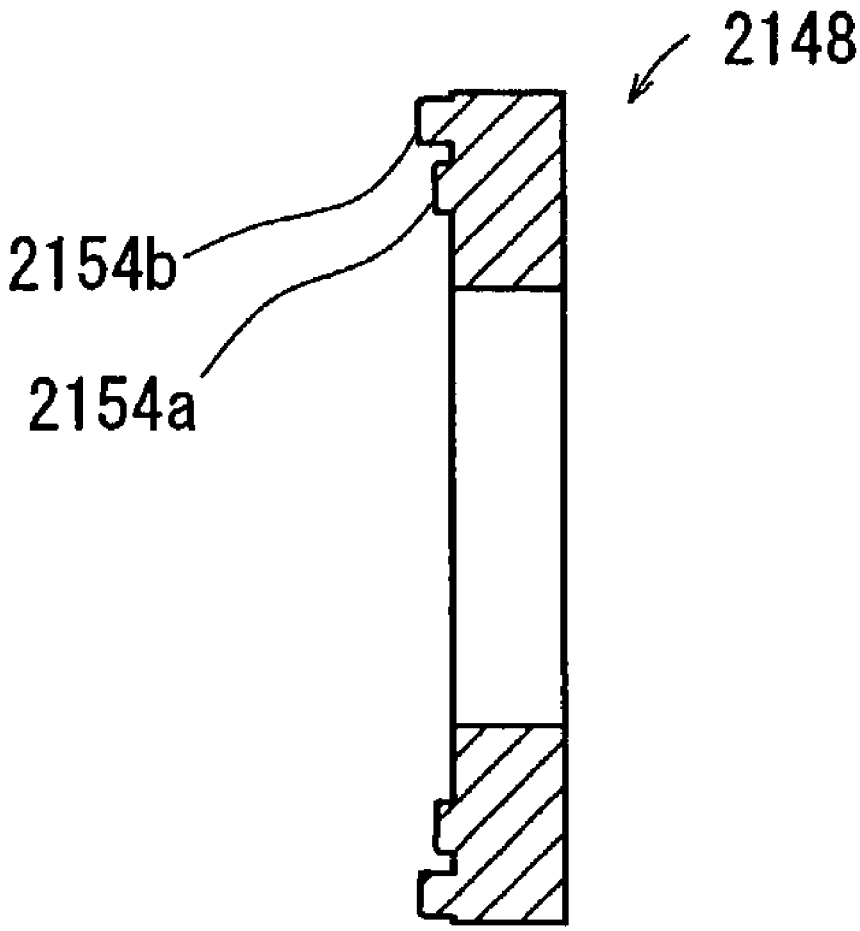
FIG. 85 is a cross-sectional view of a third heating head.

As shown in FIGS. 82 and 83, the first heating head 2144 has a first annular protrusion 2150*a* and a second annular protrusion 2150*b* disposed coaxially around the first annular protrusion 2150*a*. The outer second annular protrusion 2150*b* projects outwardly more than the inner first annular protrusion 2150*a*. The second and third heating heads 2146, 2148 also have inner first annular protrusions 2152*a*, 2154*a*, respectively, and outer second annular protrusions 2152*b*, 2154*b* disposed coaxially around the first annular protrusions 2152*a*, 2154*a*. The outer second annular protrusions 2152*b*, 2154*b* project outwardly more than the inner first annular protrusions 2152*a*, 2154*a* (see FIGS. 84 and 85).

The first annular protrusions 2150*a*, 2152*a*, 2154*a* and the second annular protrusions 2150*b*, 2152*b*, 2154*b* having different diameters are formed on the first, second, and third heating heads 2144, 2146, 2148. Therefore, the packaging sheet bonding device 2060 may deal with six types of photosensitive rolls 12 having different outside diameters.

Figure 86:
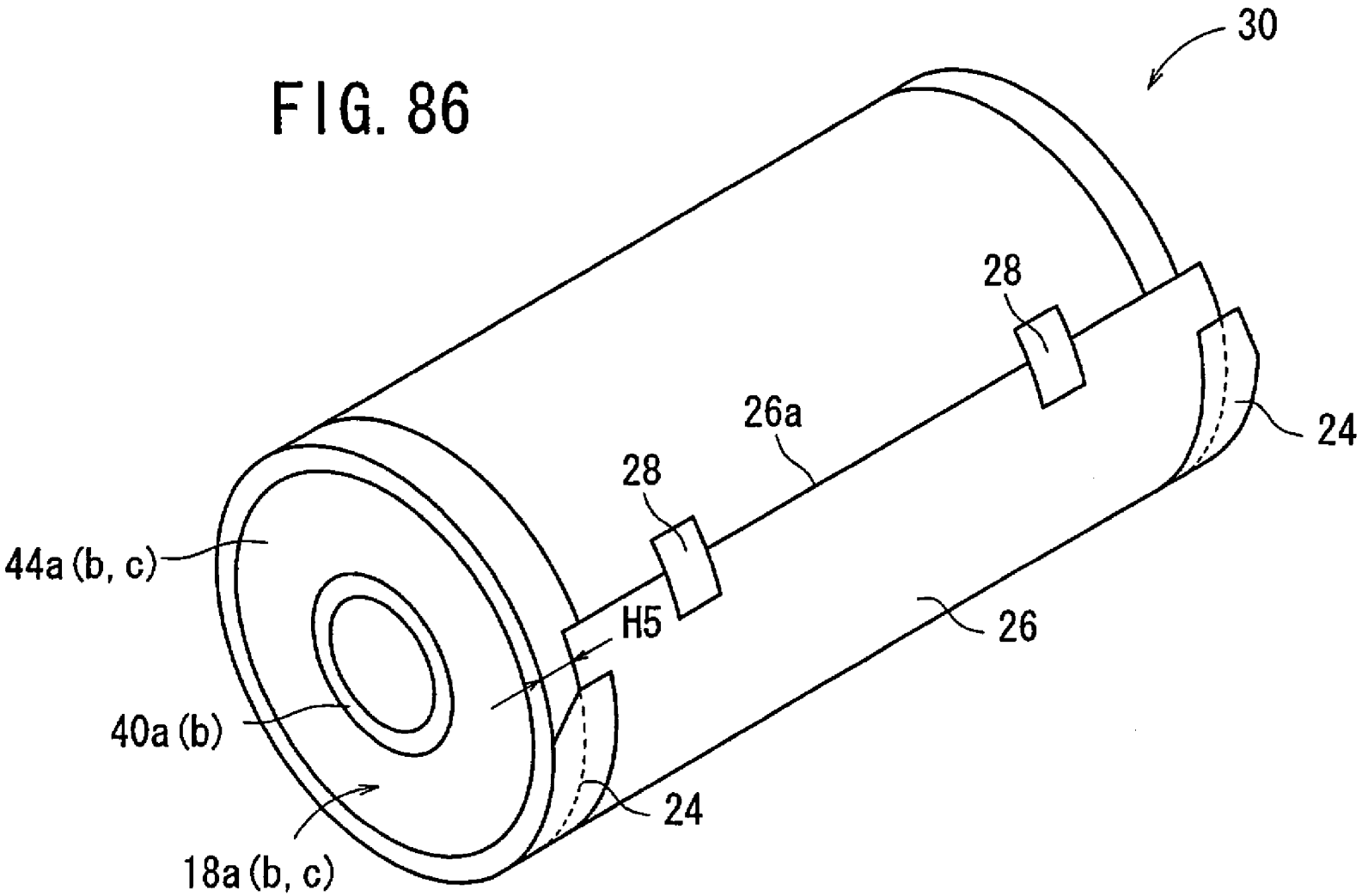
FIG. 86 is a perspective view of a packaged photosensitive roll.
Figure 87:
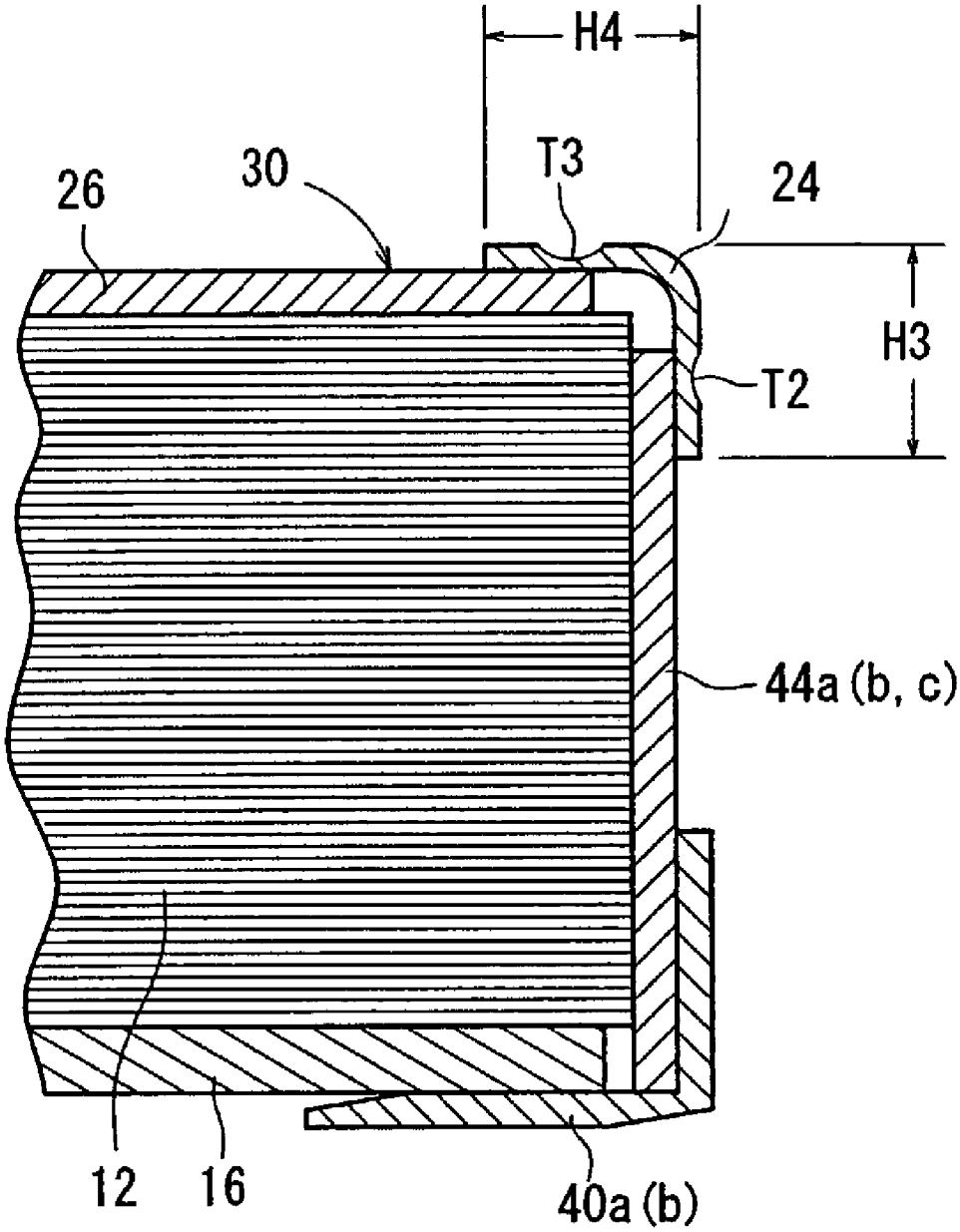
FIG. 87 is a fragmentary cross-sectional view of the packaged photosensitive roll.

The inspecting station ST9 has a packaged state inspecting device 3040. The packaged state inspecting device 3040 inspects a skewed state of the light-shielding sheet 26 and an attached state of the light-shielding shrink films 24 in the photosensitive roll 30 which is packaged as shown in FIGS. 86 and 87. Specifically, as shown in FIG. 87, the packaged state inspecting device 3040 inspects a width H3 of each of the light-shielding shrink films 24 on the opposite ends of the photosensitive roll 30, a fusion mark T2 of each of the light-shielding shrink films 24 fused to the ring 44*a*, 44*b*, 44*c*, a width H4 of each of the light-shielding shrink films 24 disposed on the outer circumferential surface of the photosensitive roll 30, a fusion mark T3 of each of the light-shielding shrink films 24 fused to the light-shielding sheet 26, and a skewed distance H5 (see FIG. 86) of the light-shielding sheet 26 at its end 26*a*.

Figure 88:
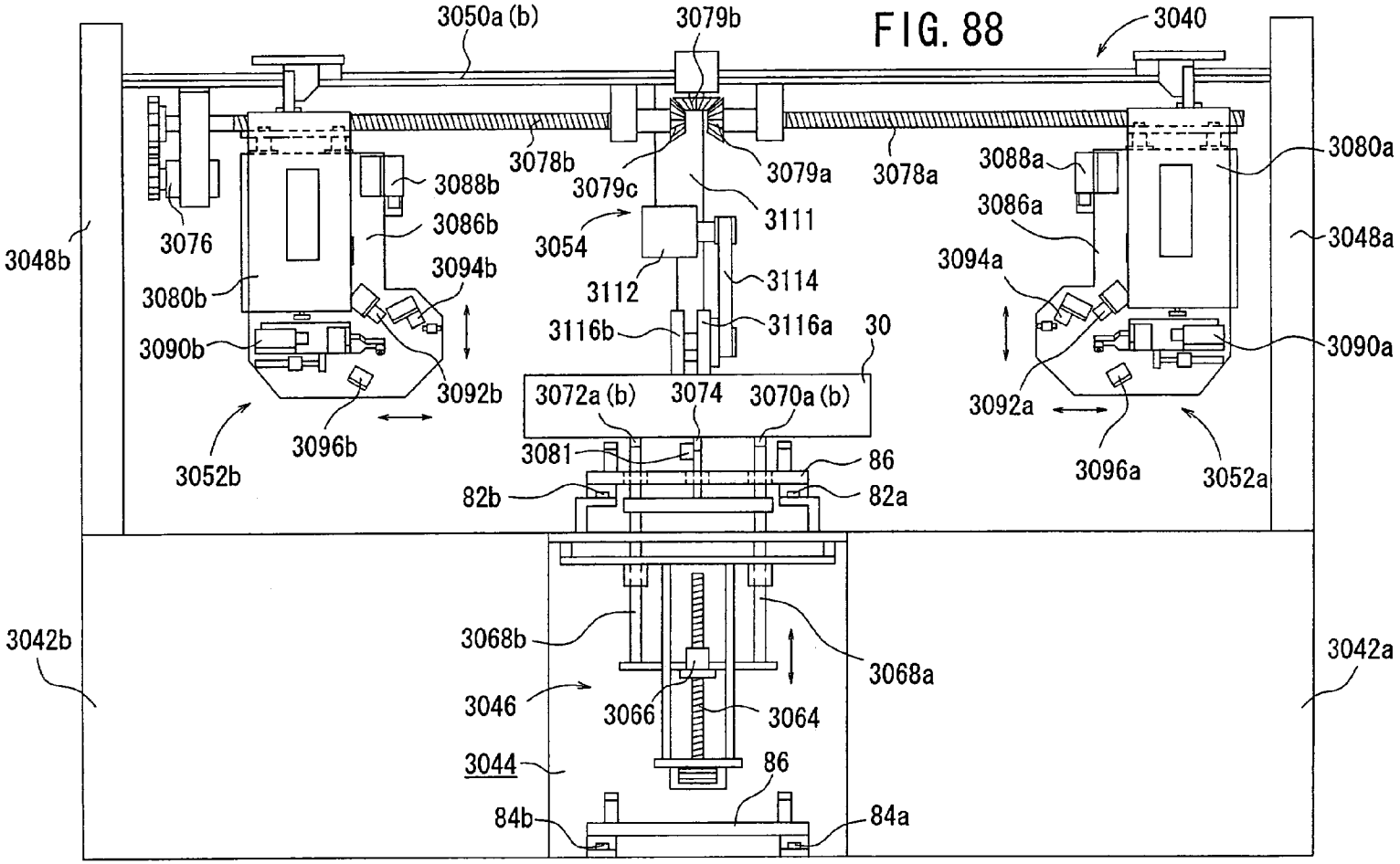
FIG. 88 is a front elevational view of a packaged state inspecting device.
Figure 89:
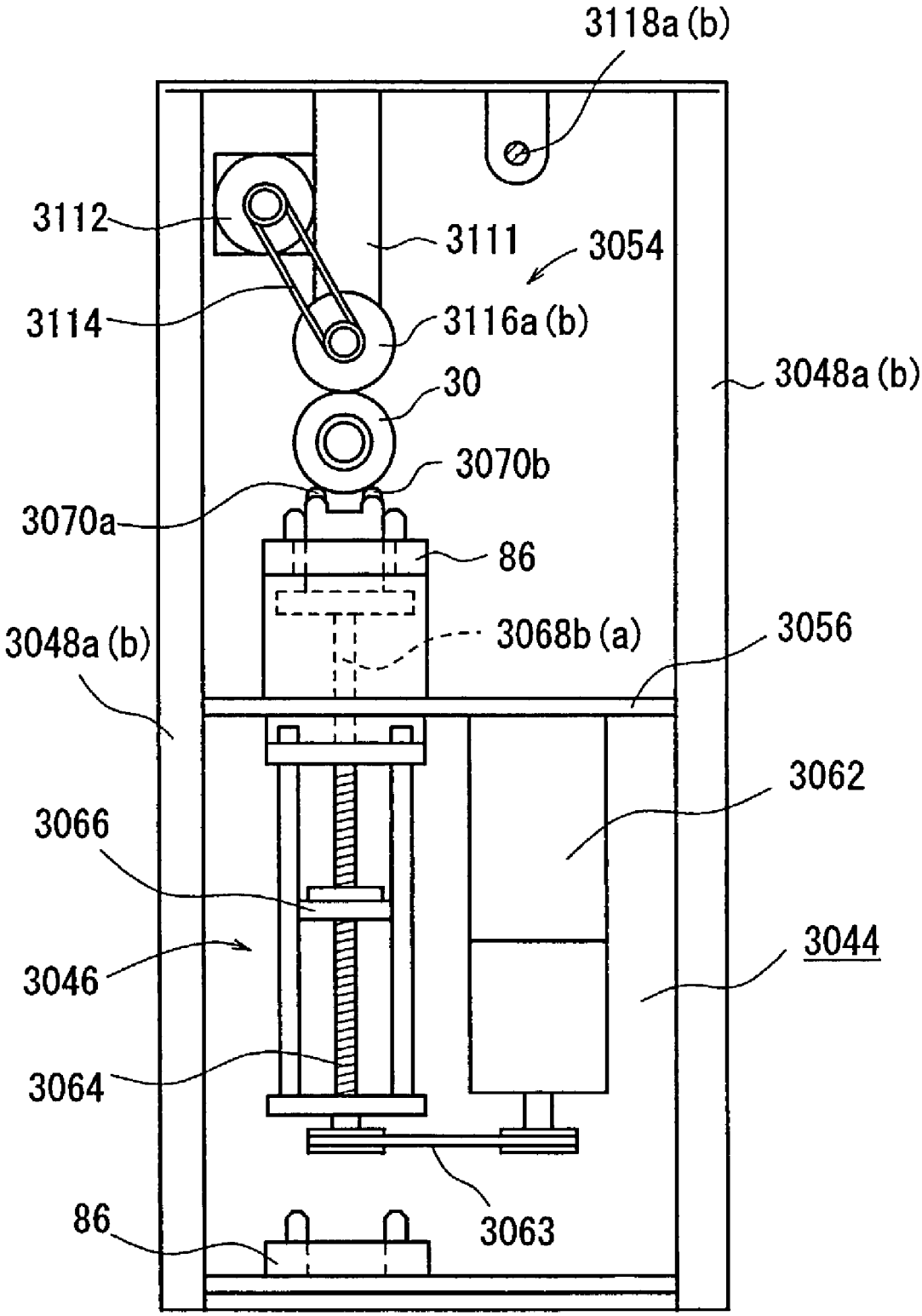
FIG. 89 is a side elevational view of the packaged state inspecting device.

FIGS. 88 and 89 show structural details of the packaged state inspecting device 3040. The packaged state inspecting device 3040 basically comprises a lifting and lowering mechanism 3046 (second displacing means) disposed in a pit 3044 defined between bases 3042*a*, 3042*b*, for vertically displacing a light-shielded photosensitive roll 30, a pair of imaging units 3052*a*, 3052*b* displaceable axially of the light-shielded photosensitive roll 30 along guide rails 3050*a*, 3050*b* extending between the upper ends of support posts 3048*a*, 3048*b* mounted vertically on the bases 3042*a*, 3042*b*, and a rotating mechanism 3054 disposed at a central region of the guide rails 3050*a*, 3050*b* for rotating the light-shielded photosensitive roll 30 about its own axis.

Figure 90:
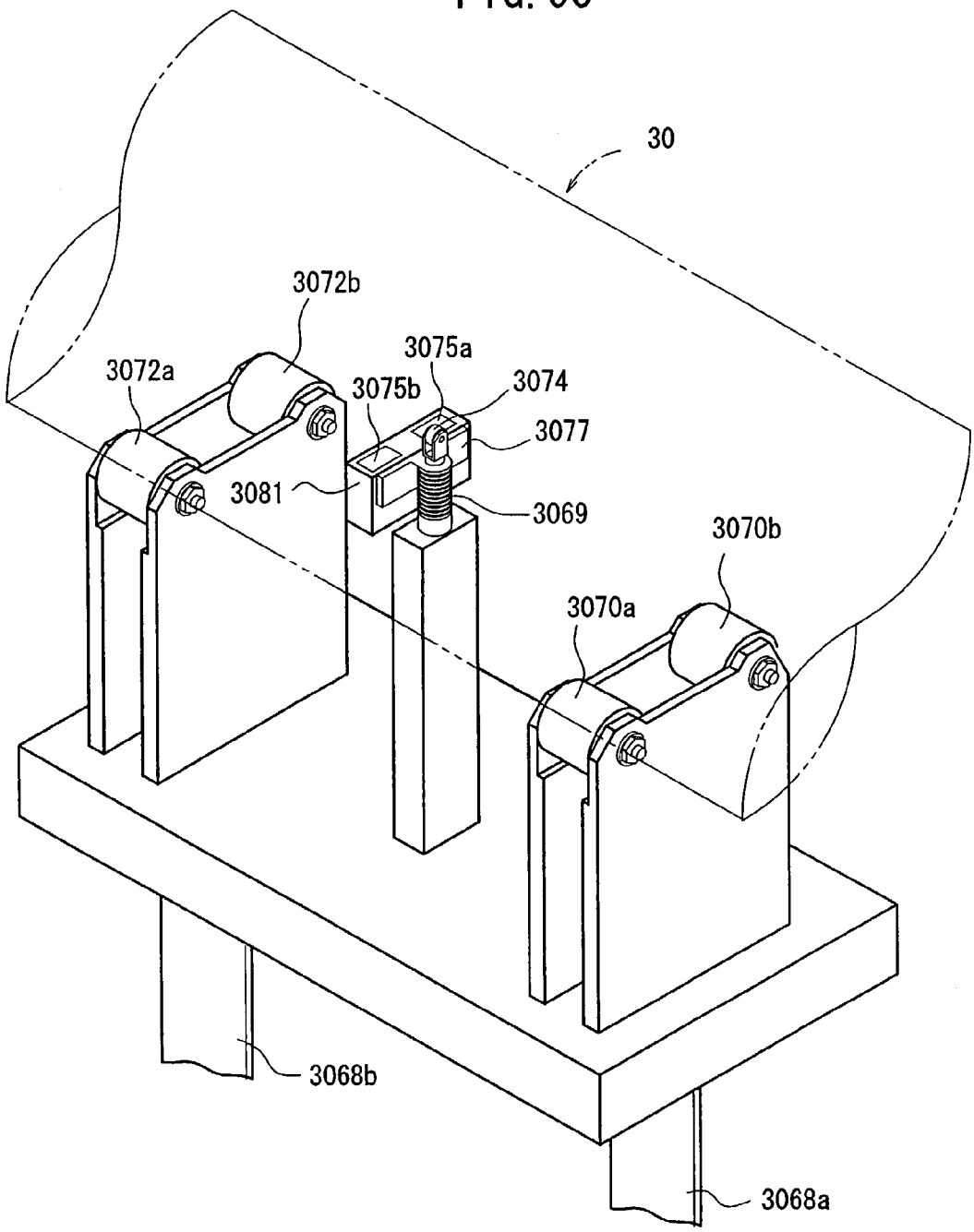
FIG. 90 is a view showing the relationship between a lifting and lowering mechanism and a photosensitive roll supported thereby in the packaged state inspecting device.

The lifting and lowering mechanism 3046 has a motor 3062 fixed to a lower surface of a support base 3056, a ball screw 3064 operatively coupled to the motor 3062 by a belt 3063, and a nut 3066 threaded over the ball screw 3064. The ball screw 3064 has an upper end rotatably supported on the support base 3056. To the nut 3066, there are connected two guide rods 3068*a*, 3068*b* extending upwardly through the support base 3056. The guide rods 3068*a*, 3068*b* extend through gaps in the pallet 86 toward the outer circumferential surface of the light-shielded photosensitive roll 30, and have respective upper ends supporting two pairs of rollers 3070*a*, 3070*b* and 3072*a*, 3072*b* which support the light-shielded photosensitive roll 30, as shown in FIG. 90. A tracing roller 3074 held in rolling contact with the outer circumferential surface of the light-shielded photosensitive roll 30 is supported by a spring 3069 and disposed between the pairs of rollers 3070*a*, 3070*b* and 3072*a*, 3072*b*. A reflective displacement detector 3081 serving as an end sensor for detecting the end 26*a* of the light-shielded photosensitive roll 30 is secured to a side of the tracing roller 3074 by a bracket 3077. The reflective displacement detector 3081 comprises a light emitter 3075*a* and a light detector 3075*b*. The light emitter 3075*a* emits a light beam, and the light detector 3075*b* detects a reflection of the light beam from the end 26*a* of the light-shielded photosensitive roll 30.

The imaging units 3052*a*, 3052*b* are displaceable in the axial direction of the light-shielded photosensitive roll 30 by ball screws 3078*a*, 3078*b* which are rotated about their own axes by a motor 3076 (first displacing means) disposed adjacent to the support post 3048*b*. The ball screws 3078*a*, 3078*b* are coupled to each other by bevel gears 3079*a*, 3079*b*, 3079*c* disposed between confronting ends of the ball screws 3078*a*, 3078*b*. The bevel gears 3079*a*, 3079*b*, 3079*c* transmit rotation of the ball screw 3078*b* to the ball screw 3078*a* and rotate the ball screws 3078*a*, 3078*b* in respective opposite directions.

Figure 91:
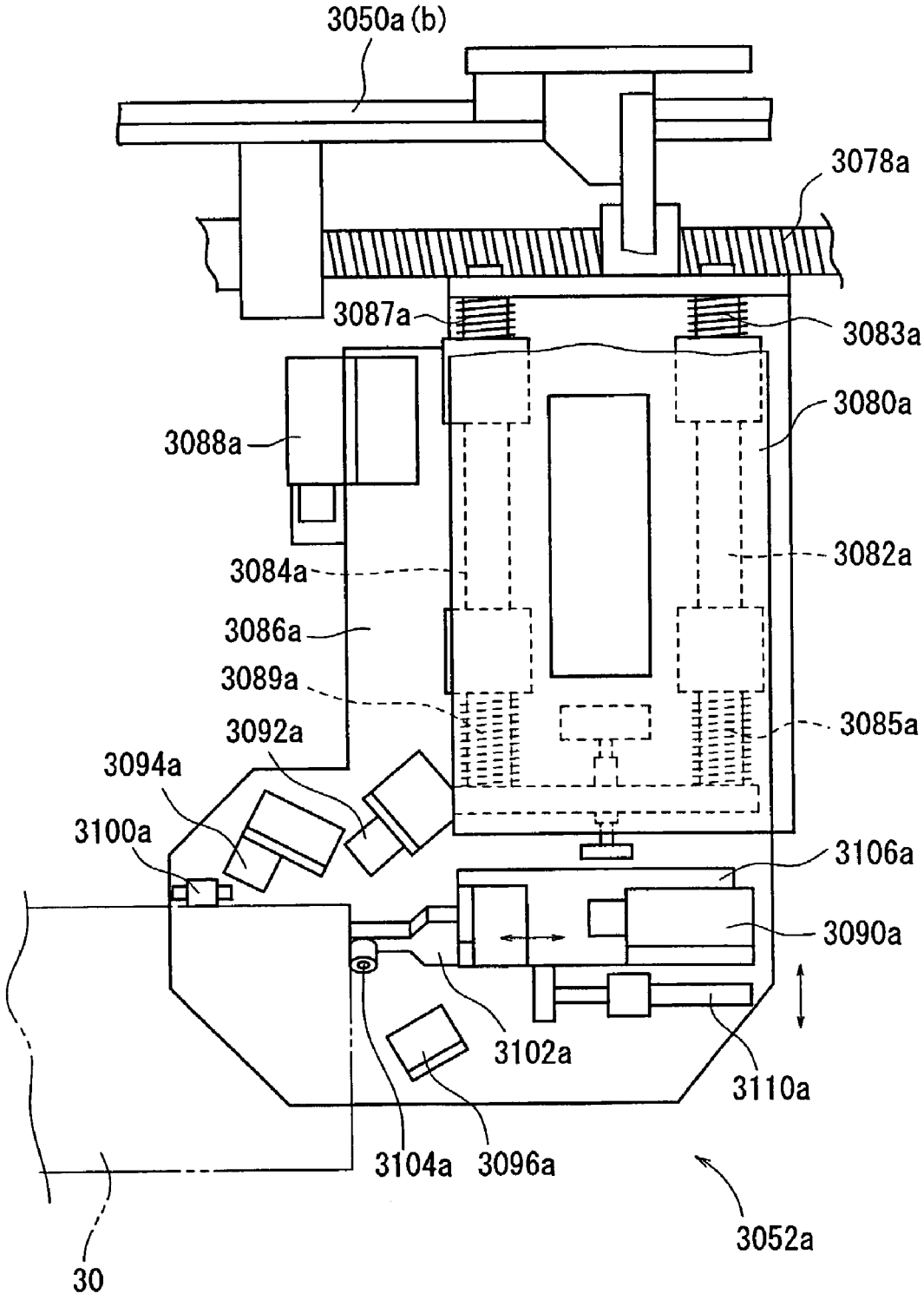
FIG. 91 is a front elevational view of an imaging unit in the packaged state inspecting device.
Figure 92:
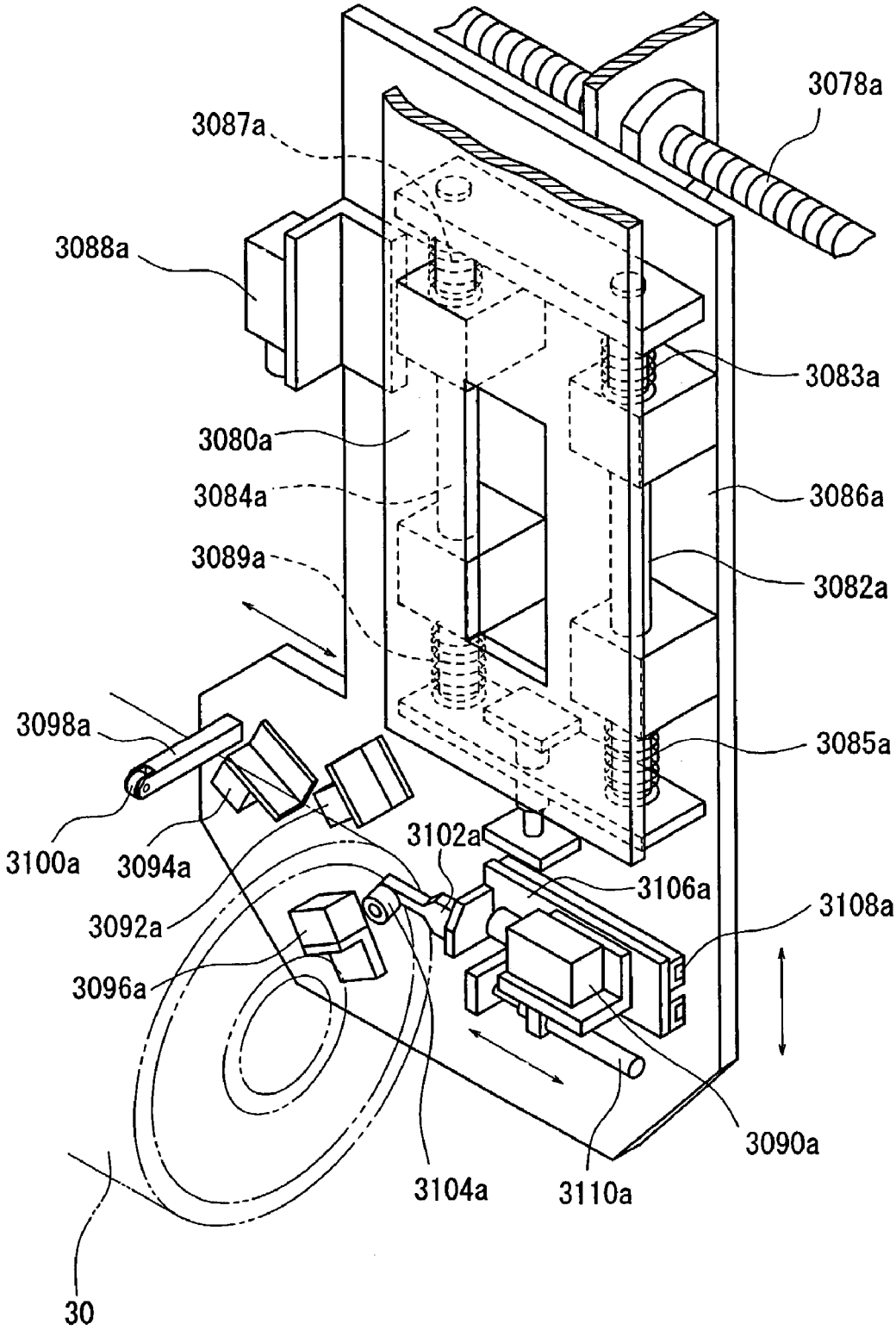
FIG. 92 is a perspective view of the imaging unit in the packaged state inspecting device.

FIGS. 91 and 92 show one of the imaging units 3052*a*. The other imaging unit 3052*b* is identical in structure to the imaging unit 3052*a*. Those parts of the imaging unit 3052*b* which are identical to those of the imaging unit 3052*a* are denoted by identical reference characters a suffix "b" instead of "a", and will not be described in detail below.

The imaging unit 3052*a* comprises a first bracket 3080*a* connected to the ball screw 3078*a* for displacement in the axial direction of the light-shielded photosensitive roll 30, a second bracket 3086*a* connected to the first bracket 3080*a* by guide bars 3082*a*, 3082*b* and vertically movable with respect to the first bracket 3080*a* with springs 3083*a*, 3085*a*, 3087*a*, 3089*a* acting therebetween which are disposed on upper and lower ends of the guide bars 3082*a*, 3082*b*, a first imaging element 3088*a* fixed to the second bracket 3086*a* for capturing an image of the outer circumferential surface of the light-shielded photosensitive roll 30 near a corner thereof, a second imaging element 3090*a* mounted on the second bracket 3086*a* for capturing an image of an end face of the light-shielded photosensitive roll 30 near a corner thereof, a first illuminating element 3092*a*, a second illuminating element 3094*a*, and a third illuminating element 3096*a* which are fixed to the second bracket 3086*a*, an outer circumferential position variation correcting roller (outer circumferential position variation correcting means) 3100*a* fixed to the second bracket 3086*a* by a bracket 3098*a* for engaging the outer circumferential surface of the light-shielded photosensitive roll 30 to correct the outer circumferential surface out of positional variations, and an end position variation correcting roller (end position variation correcting means) 3104*a* fixed to the second bracket 3086*a* by a bracket 3102*a* for engaging the end face of the light-shielded photosensitive roll 30 to correct the end face out of positional variations.

The first illuminating element 3092*a*, the second illuminating element 3094*a*, and the third illuminating element 3096*a*, and the corresponding illuminating element 3092*b*, 3094*b*, 3096*b* on the imaging unit 3052*b* may comprise a two-dimensional array of LEDs for emitting red light which is not detrimental to the photosensitive roll 30.

As shown in FIG. 92, the second imaging element 3090*a* and the end position variation correcting roller 3104*a* are fixedly mounted on a common support base 3106*a*. The support base 3106*a* is mounted on the second bracket 3086*a* by guide rails 3108*a*. A cylinder 3110*a* is connected to the support base 3106*a* for moving the second imaging element 3090*a* and the bracket 3102*a* toward and away from the end face of the light-shielded photosensitive roll 30.

Figure 93:
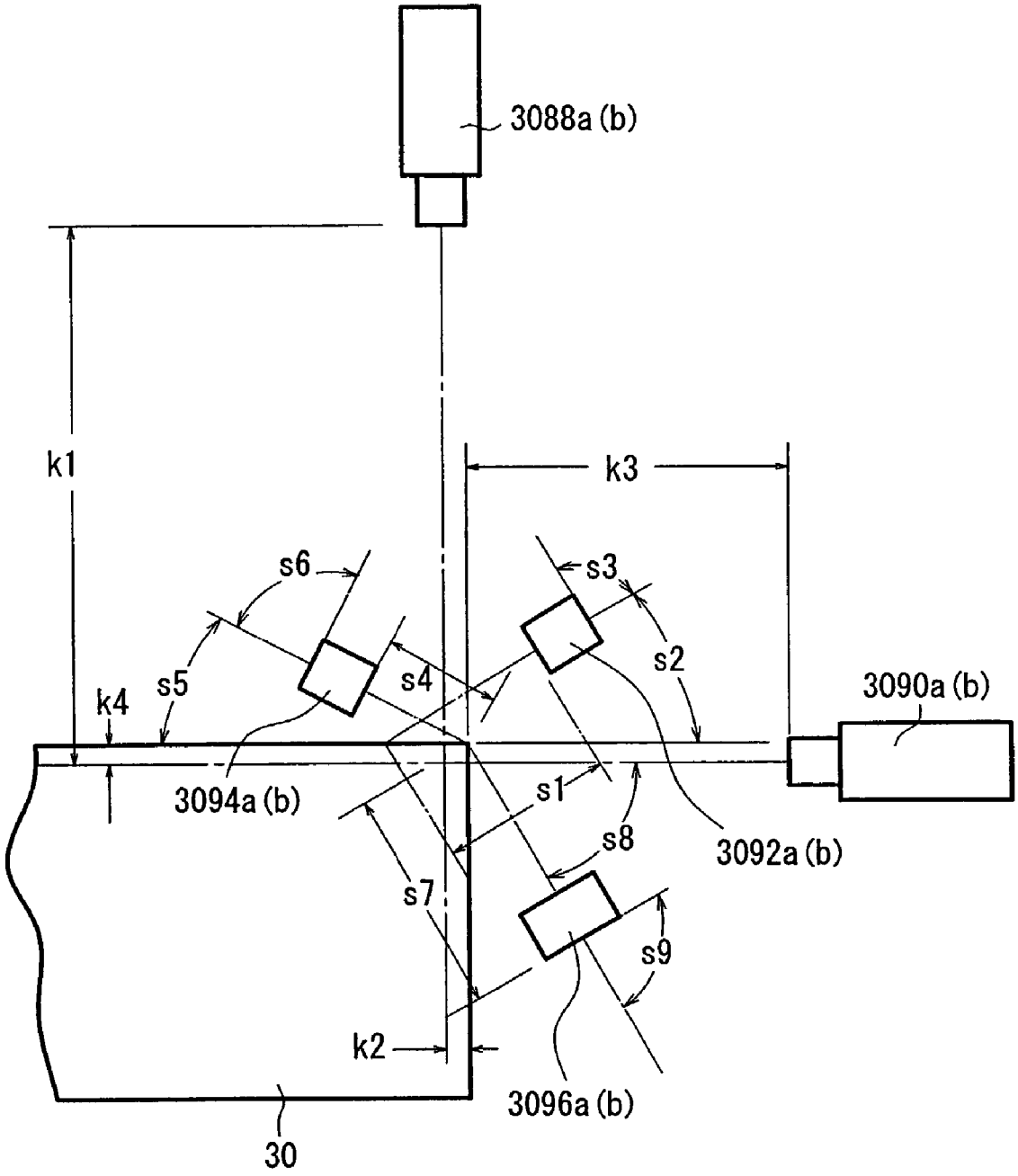
FIG. 93 is an elevational view showing the layout of elements of the imaging unit in the packaged state inspecting device.

FIG. 93 shows the layout of the first imaging element 3088*a*, the second imaging element 3090*a*, the first illuminating element 3902*a*, the second illuminating element 3904*a*, and the third illuminating element 3096*a* of the imaging unit 3052*a*. Table 1 shown below distances and illuminating angles of these elements of the imaging unit 3052*a*. The elements of the imaging unit 3052*b* are similarly positioned.

TABLE 1

| | Symbols | Distances and illuminating angles |
|---|---|---|
| 1st imaging | k1 | 208 ± 25 mm |
| element 3088a(b) | k2 | 7.5 ± 10 mm |
| 2nd imaging | k3 | 125 ± 25 mm |
| element 3090a(b) | k4 | 10 ± 10 mm |
| 1st illuminating | s1 | 45 ± 10 mm |
| element 3092a(b) | s2 | 37 ± 10° |
| | s3 | 90 ± 20° |
| 2nd illuminating | s4 | 40 ± 20 mm |
| element 3094a(b) | s5 | 25 ± 10° |
| | s6 | 90 ± 20° |
| 3rd illuminating | s7 | 85 ± 30 mm |
| element 3096a(b) | s8 | 60 ± 10° |
| | s9 | 90 ± 20° |

As shown in FIGS. 88 and 89, the rotating mechanism 3054 comprises a motor 3112 fixed to a bracket 3111 extending downwardly from the central region of the guide rails 3050*a*, 3050*b*, and rollers (rotating means) 3116*a*, 3116*b* rotatably supported on the lower end of the bracket 3111 and operatively coupled to the motor 3112 by a belt 3114. The rollers 3116*a*, 3116*b* are rotated by the motor 3112 in rolling contact with the outer circumferential surface of the light-shielded photosensitive roll 30, thereby rotating the light-shielded photosensitive roll 30 about its own axis. The two rollers 3116*a*, 3116*b* are effective to stably rotate light-shielded photosensitive rolls 30 of different dimensions ranging from narrow to wide light-shielded photosensitive rolls 30.

Figure 94:
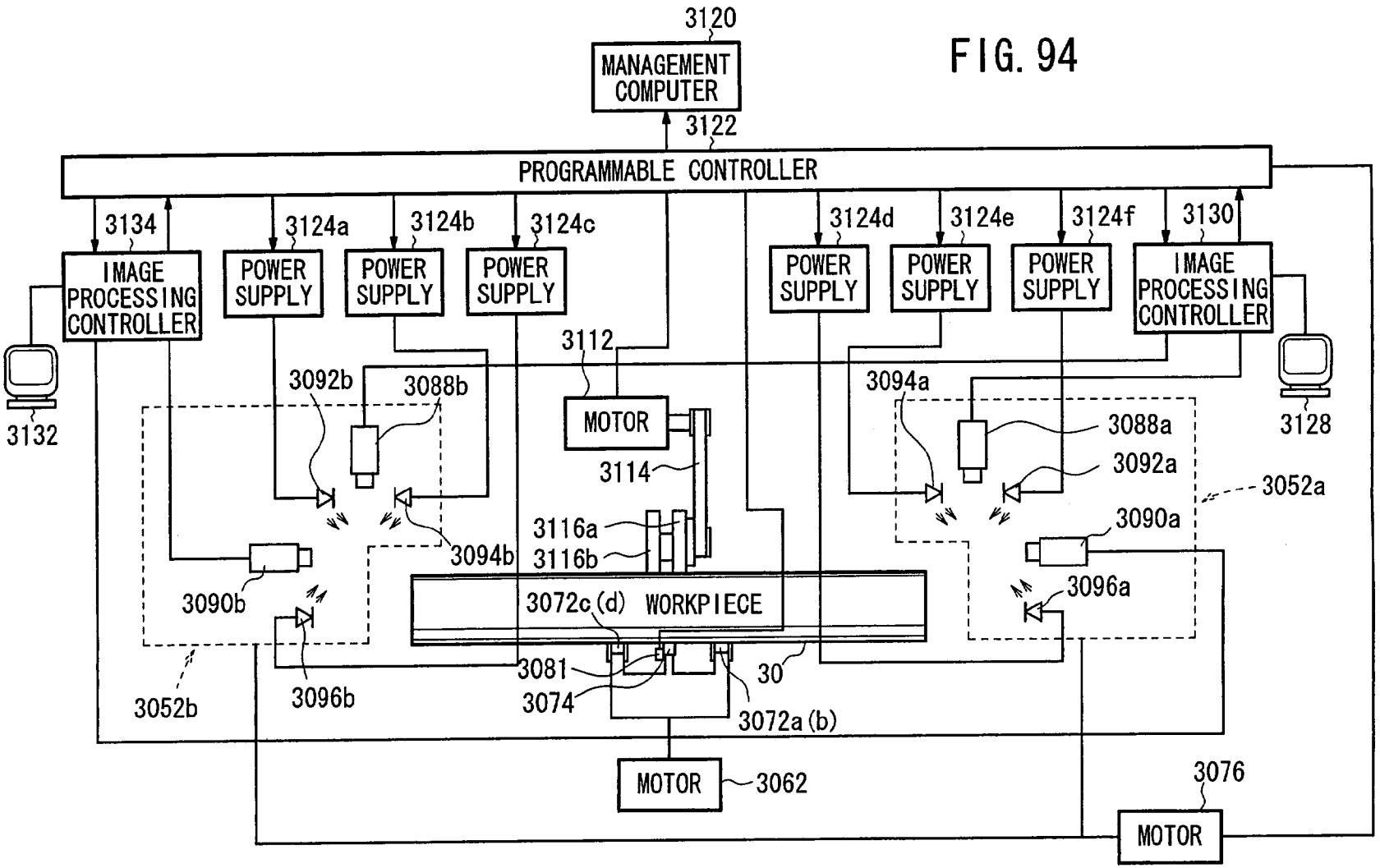
FIG. 94 is a block diagram of a control circuit of the packaged state inspecting device.

FIG. 94 is a block diagram of a control circuit of the packaged state inspecting device 3040 thus constructed. As shown in FIG. 94, the control circuit has a programmable controller 3122 for controlling operation of the packaged state inspecting device 3040 according to data supplied from a management computer 3120, the data representing the diameter and width of the light-shielded photosensitive roll 30. Specifically, the programmable controller 3122 controls the motor 3062 to vertically move the light-shielded photosensitive roll 30, the motor 3076 to displace the imaging units 3052*a*, 3052*b*, and the motor 3112 to rotate the light-shielded photosensitive roll 30, and also carries out a control process based on a signal from the reflective displacement detector 3081 fixed to the tracing roller 3074. The programmable controller 3122 also selectively turns on and off power supplies 3124*a* through 3124*f* of the first illuminating elements 3092*a*, 3092*b*, the second illuminating elements 3094*a*, 3094*b*, and the third illuminating elements 3096*a*, 3096*b*. The programmable controller 3122 has-an image processing controller (inspecting means) 3130 for processing image data captured by the first imaging elements 3088*a*, 3088*b* and displaying processed image data on a display monitor 3128, and an image processing controller (inspecting means) 3134 for processing image data captured by the second imaging elements 3090*a*, 3090*b* and displaying processed image data on a display monitor 3132.

Figure 95:
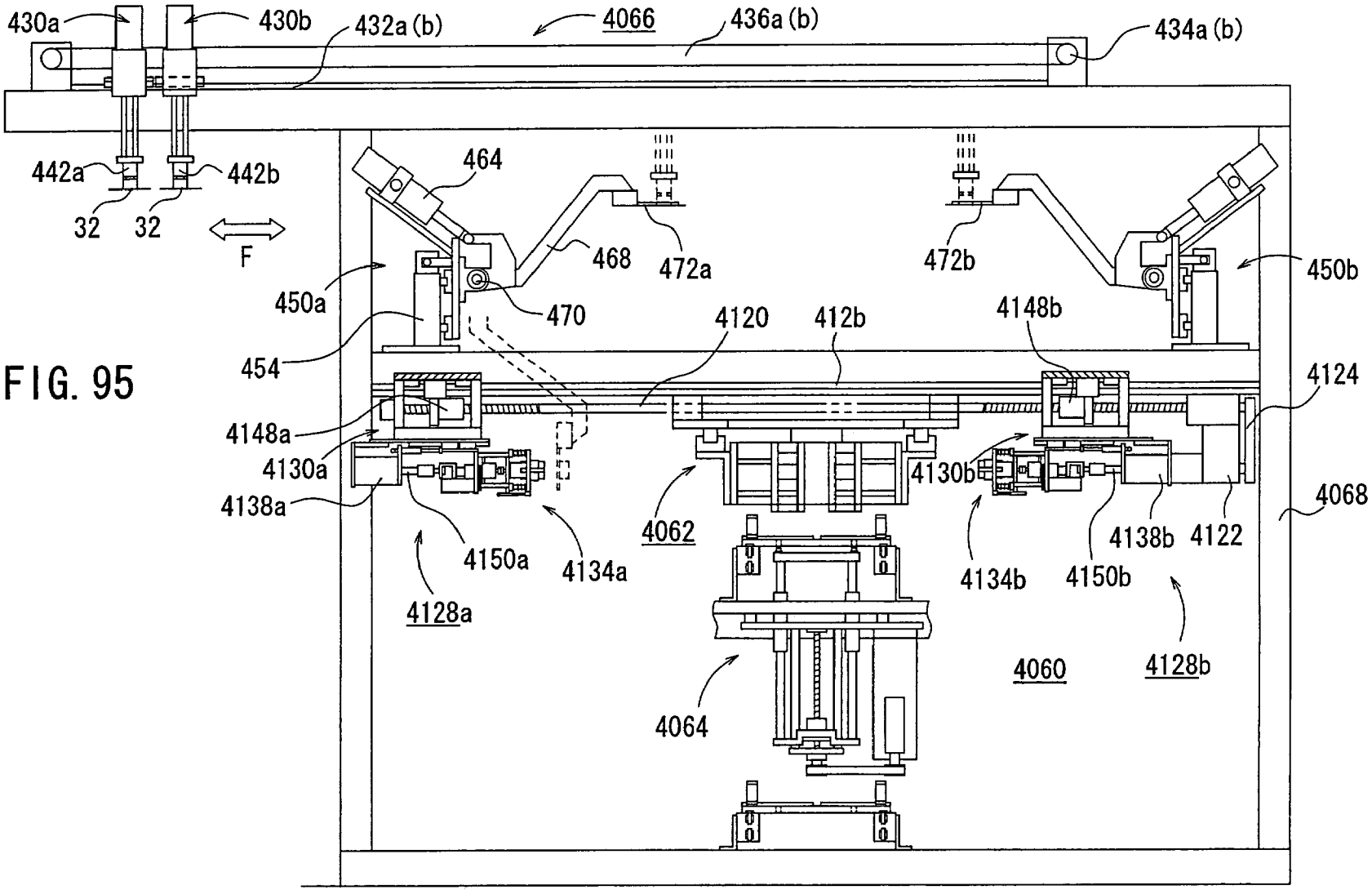
FIG. 95 is a side elevational view of a hard flanged member inserting device, a centering device, a lifting and lowering device, and a flanged member feeding device.

The second flanged member inserting station ST10 has a hard flanged member inserting device 4060. FIG. 95 shows the hard flanged member inserting device 4060, a centering device 4062 for positioning and holding the outer circumference of the light-shielded photosensitive roll 30, a lifting and lowering device 4064 for lifting and lowering the light-shielded photosensitive roll 30, and a flanged member feeding device 4066 for feeding the second flanged members 32 to the hard flanged member inserting device 4060. Those parts of the second flanged member inserting station ST10 which are identical to those of the first flanged member inserting station ST2 shown in FIG. 26 are denoted by identical reference characters, and will not be described in detail below.

As shown in FIG. 95, the hard flanged member inserting device 4060 has a ball screw 4120 rotatably supported on the frame 4068 and extending in the axial direction (transverse direction) of the photosensitive roll 30. The ball screw 4120 can be rotated by a motor 4122 through a gear train 4124. The ball screw 4120 is paralleled by a pair of guide rods 4126 which support first and second inserting units 4128*a*, 4128*b* thereon.

Figure 96:
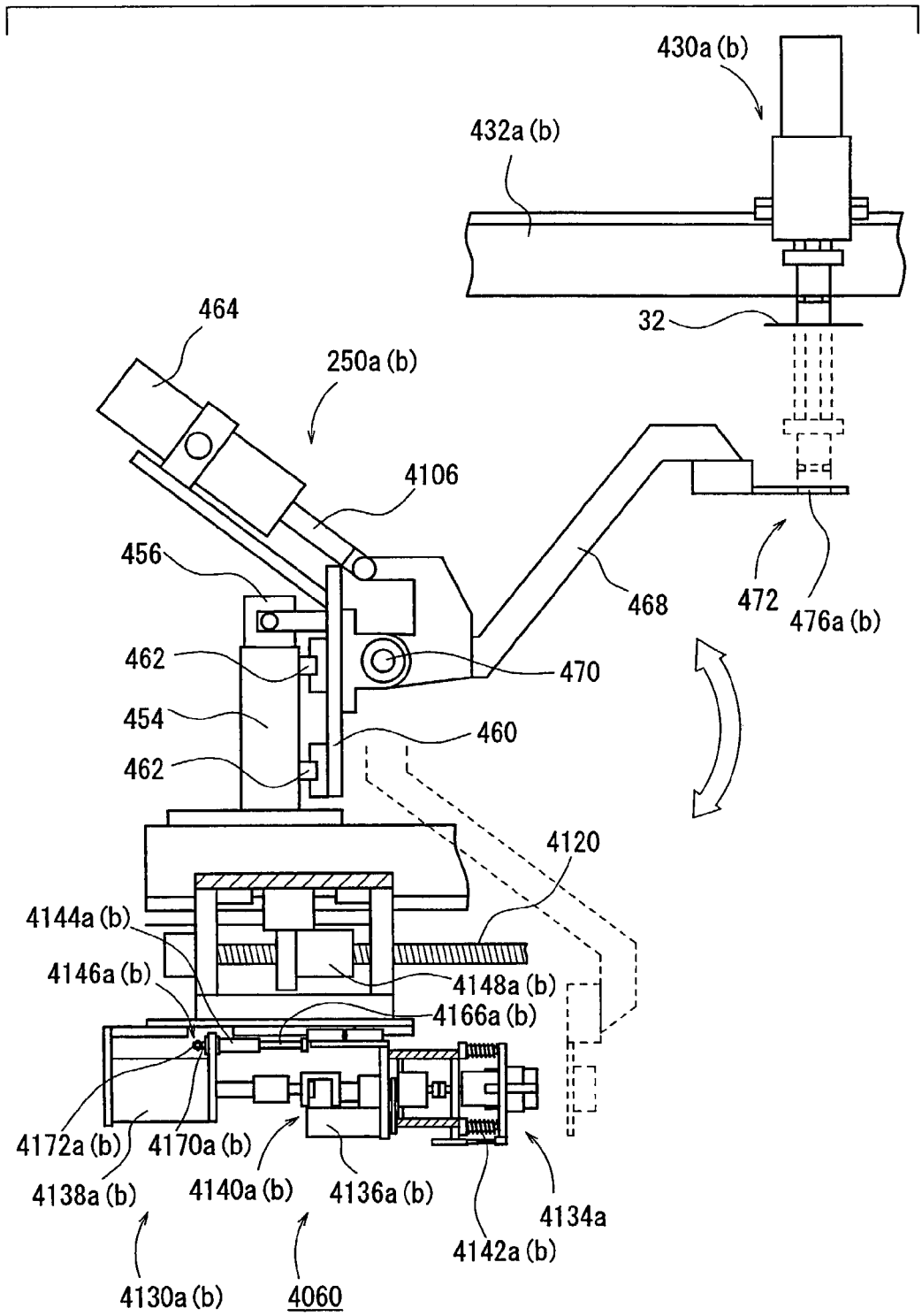
FIG. 96 is a perspective view of a first transferring means.
Figure 97:
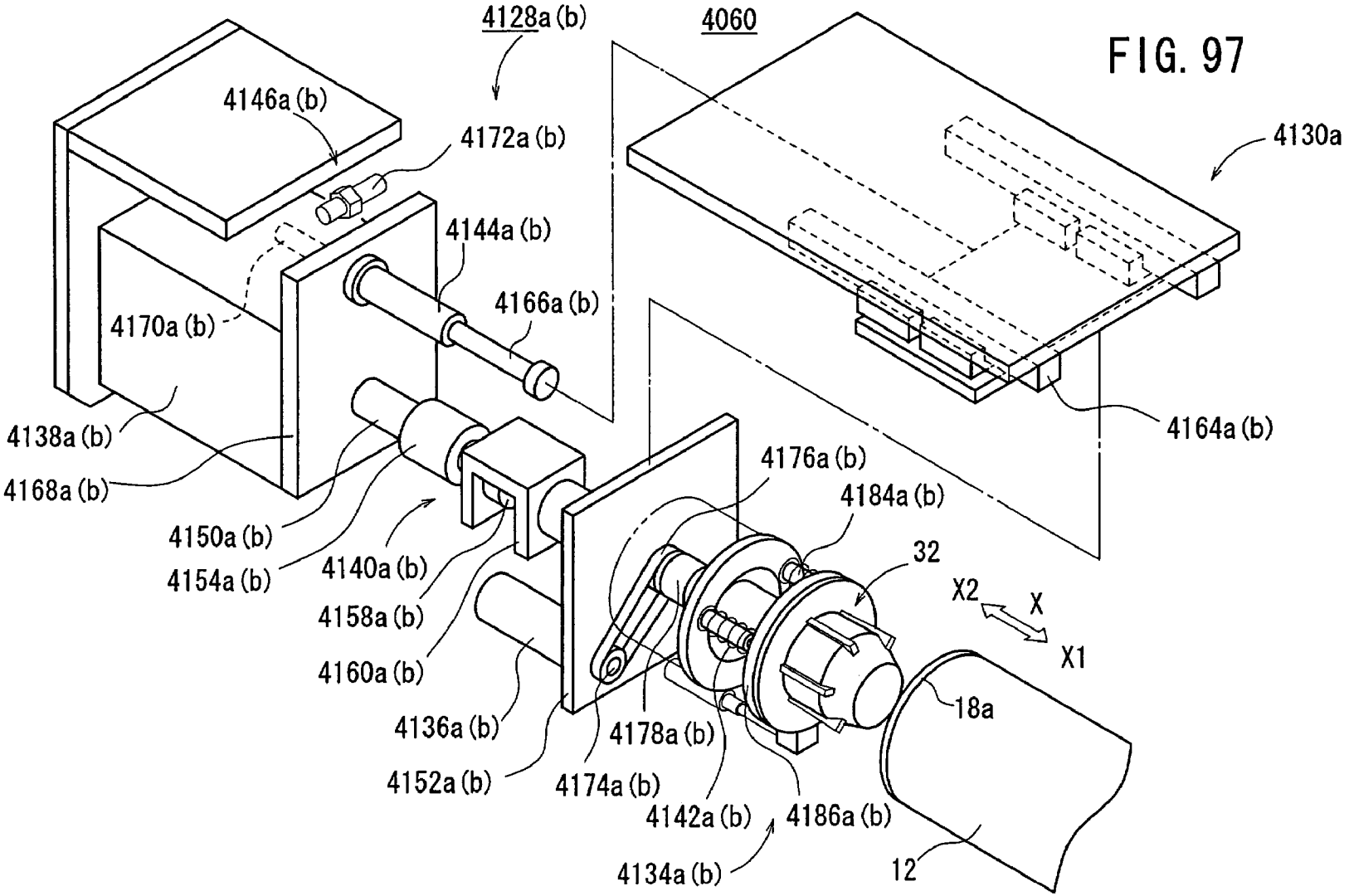
FIG. 97 is a perspective view of first and second inserting units of the hard flanged member inserting device.
Figure 98:
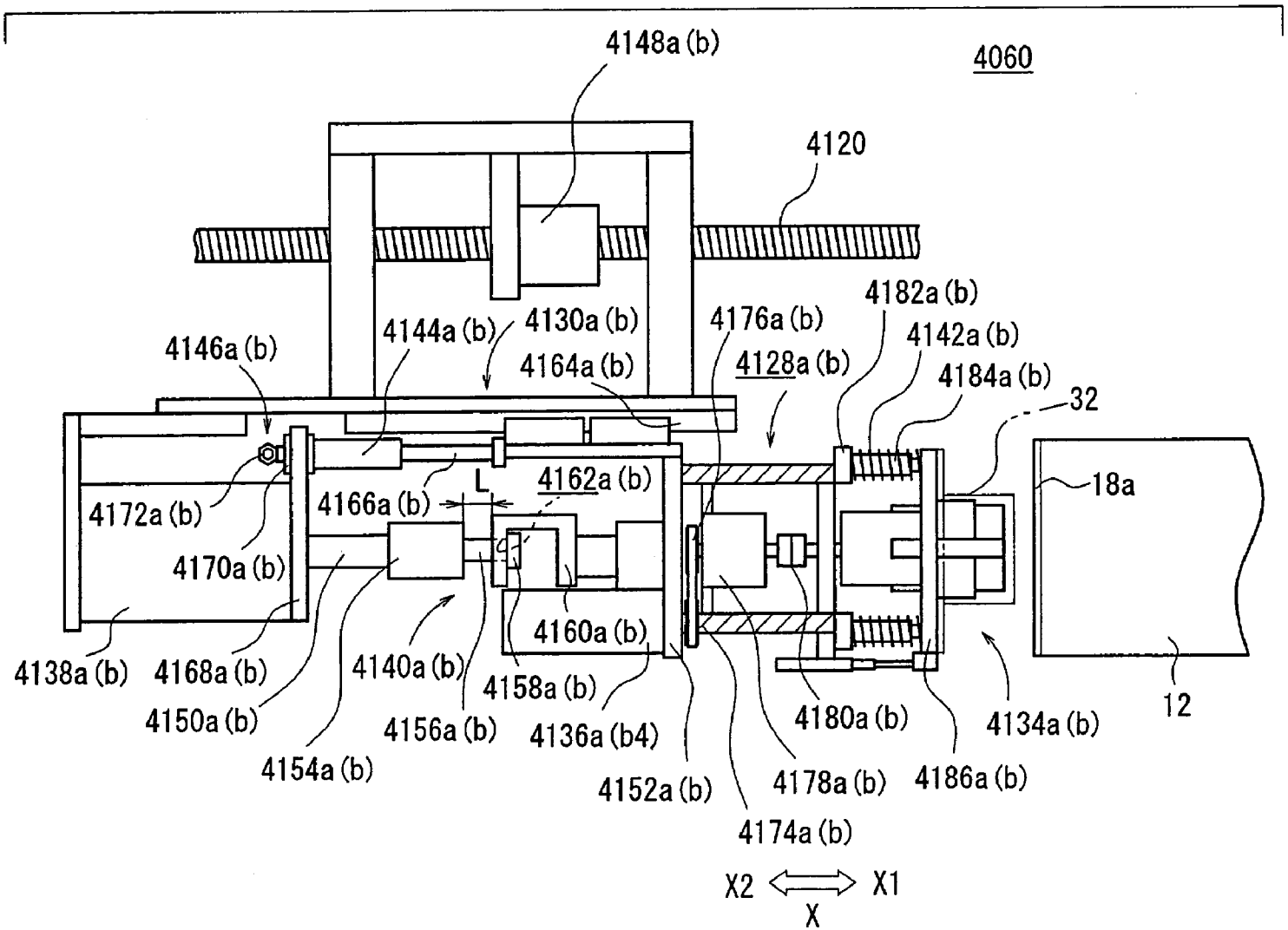
FIG. 98 is a side elevational view, partly in cross section, of the first and second inserting units.

As shown in FIGS. 96 through 98, the first and second inserting units 4128*a*, 4128*b* have respective inserting heads 4134*a*, 4134*b* movable toward and away from unit assemblies 4130*a*, 4130*b* while gripping second flanged members 32, respective motors (rotary actuators) 4136*a*, 4136*b* for rotating the inserting heads 4134*a*, 4134*b*, respective inserting cylinders (inserting actuators) 4138*a*, 4138*b* fixed to the unit assemblies 4130*a*, 4130*b* for moving the inserting heads

4134*a*, 4134*b* in order to insert the second flanged members 32 into first flanged members 18*a*, respective floating couplers 4140*a*, 4140*b* for moving the inserting heads 4134*a*, 4134*b* by a distance L with respect to the inserting cylinders 4138*a*, 4138*b*, respective cylinders (urging means) 4144*a*, 4144*b* for pressing the second flanged members 32 against the first flanged members 18*a* while allowing the second flanged members 32 to move with respect to the inserting heads 4134*a*, 4134*b*, and respective detectors 4146*a*, 4146*b* for detecting when the grooves 56 of the first flanged members 18*a* are aligned with the ridges 68 of the second flanged members 32 by the motors 4136*a*, 4136*b* and the second flanged members 32 are moved into the first flanged members 18*a*.

The unit assemblies 4130*a*, 4130*b* have nuts 4148*a*, 4148*b* threaded over the ball screw 4120. The ball screw 4120 has reversely threaded structures one on each side of its center, so that the unit assemblies 4130*a*, 4130*b* can move in unison in directions toward and away from each other. The inserting cylinders 4138*a*, 4138*b* of the unit assemblies 4132*a*, 4132*b* have respective horizontal rods 4150*a*, 4150*b* engaged by respective movable bases 4152*a*, 4152*b* of the inserting heads 4134*a*, 4134*b* through the floating couplers 4140*a*, 4140*b*.

Tubular pressers 4154*a*, 4154*b* are mounted on the respective distal ends of the rods 4150*a*, 4150*b*. Rods 4156*a*, 4156*b* inserted in the respective tubular pressers 4154*a*, 4154*b* have larger-diameter members 4158*a*, 4158*b* integrally formed with distal ends thereof. Angles 4160*a*, 4160*b* are fixed to the respective movable bases 4152*a*, 4152*b* and have respective holes 4162*a*, 4162*b* defined in distal ends thereof.

The rods 4156*a*, 4156*b* are fitted respectively in the holes 4162*a*, 4162*b*. The tubular pressers 4154*a*, 4154*b* can press the outer surfaces of the distal ends of the angles 4160*a*, 4160*b*, whereas the larger-diameter members 4158*a*, 4158*b* can press inner surfaces of the angles 4160*a*, 4160*b*. The movable bases 4152*a*, 4152*b* are independently movable the distance L between the tubular pressers 4154*a*, 4154*b* and the larger-diameter members 4158*a*, 4158*b*.

The movable bases 4152*a*, 4152*b* are supported on respective guide rails 4164*a*, 4164*b* mounted on the unit assemblies 4130*a*, 4130*b* for movement in the direction indicated by the arrow X. The cylinders 4144*a*, 4144*b* have respective presser rods 4166*a*, 4166*b* whose distal ends can abut against ends of the movable bases 4152*a*, 4152*b*. The presser rods 4166*a*, 4166*b* are movably supported on respective attachment plates 4168*a*, 4168*b* fixed to the inserting cylinders 4138*a*, 4138*b* and normally urged toward the movable base 4152*a* in the direction indicated by the arrow X1 by the cylinders 4144*a*, 4144*b*.

The detectors 4146*a*, 4146*b* have respective dogs 4170*a*, 4170*b* fixed to the ends of the presser rods 4166*a*, 4166*b*. The dogs 4170*a*, 4170*b* are engageable with the attachment plates 4168*a*, 4168*b* to prevent the presser rods 4166*a*, 4166*b* from being detached from the attachment plates 4168*a*, 4168*b*. The detectors 4146*a*, 4146*b* also have respective sensors 4172*a*, 4172*b* which are turned on by the dogs 4170*a*, 4170*b* when the grooves 56 of the first flanged members 18*a* are not aligned with the ridges 68 of the second flanged members 32, and turned off when the grooves 56 are aligned with the ridges 68 and the second flanged members 32 move toward the first flanged members 18*a*.

The motors 4136*a*, 4136*b* are fixed to the movable bases 4152*a*, 4152*b*, respectively, and have respective rotatable drive shafts 4174*a*, 4174*b* to which rotatable shafts 4178*a*, 4178*b* are operatively coupled by belt and pulley means 4176*a*, 4176*b*. The inserting heads 4134*a*, 4134*b* are connected to the respective rotatable shafts 4178*a*, 4178*b* by respective couplings 4180*a*, 4180*b*.

Support tubes 4182*a*, 4182*b* have ends fixed to the distal ends of the movable bases 4152*a*, 4152*b*, and support rods 4184*a*, 4184*b* are movably disposed in the respective support tubes 4182*a*, 4182*b*, with springs 4142*a*, 4142*b* disposed around the support tubes 4182*a*, 4182*b* and the support rods 4184*a*, 4184*b*. Presser plates 4186*a*, 4186*b* are fixed to distal ends of the support rods 4184*a*, 4184*b*.

Operation of the automatic packaging system 10 thus constructed will be described below with respect to a method of automatically packaging a roll according to the present invention.

The flanged member installing device 230 is capable of selectively manufacturing three types of photosensitive rolls 12, i.e., two 2-inch types of photosensitive rolls 12 using 2-inch cores 16*a* and having different wound diameters, and a 3-inch type of photosensitive rolls 12 using a 3-inch core 16*b*.

The first cap supply 234*a* is supplied with caps 40*a* on the tray 240*a* which correspond to 2-inch photosensitive rolls 12, and the second cap supply 234*b* is supplied with caps 40*b* on the tray 240*b* which correspond to 3-inch photosensitive rolls 12. In the first ring supply 236*a*, 2-inch rings 44*a*, 44*c* are stacked around the respective support posts 302. In the second ring supply 236*b*, 3-inch rings 44*b* are stacked around the respective support posts 302.

A process of installing first flanged members 18*a*, each comprising a cap 40*a* and a ring 44*a*, on the respective opposite ends of a photosensitive roll 12 which comprises a photosensitive sheet 14 wound around a 2-inch core 16*a* will be described below.

As shown in FIGS. 13 and 14, a stack of trays 240*a* is introduced into the tray loading region 244 of the first cap supply 234*a*. Each of the trays 240*a* carries a predetermined number of caps 40*a* fitted over bosses 242*a*. The trays 240*a* are fed from the tray loading region 244 to the cap removing region 250 by the belt 248 actuated by the motor 246. In the cap removing region 250, the uppermost tray 240*a* has its four sides held by the tray holding means 263, and the cap removing means 268 is actuated.

In the cap removing means 268, the cap removing chuck 282 is positioned over a cap 40*a* on the uppermost tray 240*a*, and then the vertically movable base 280 is lowered by the cylinder 278 to insert the cap removing chuck 282 into the cap 40*a*.

At this time, as shown in FIG. 16, the air cylinder 288 of the floating structure 286 has been inactivated, allowing the cap removing chuck 282 to float by being guided by the flange 296 and the steel balls 298.

Therefore, the cap removing chuck 282 can smoothly and reliably be inserted into the cap 40*a*. After the cap removing chuck 282 is inserted into the cap 40*a*, the cylinder 284 is actuated to radially expand the cap removing chuck 282 to hold the inner circumferential surface of the cap 40*a*.

Figure 99:
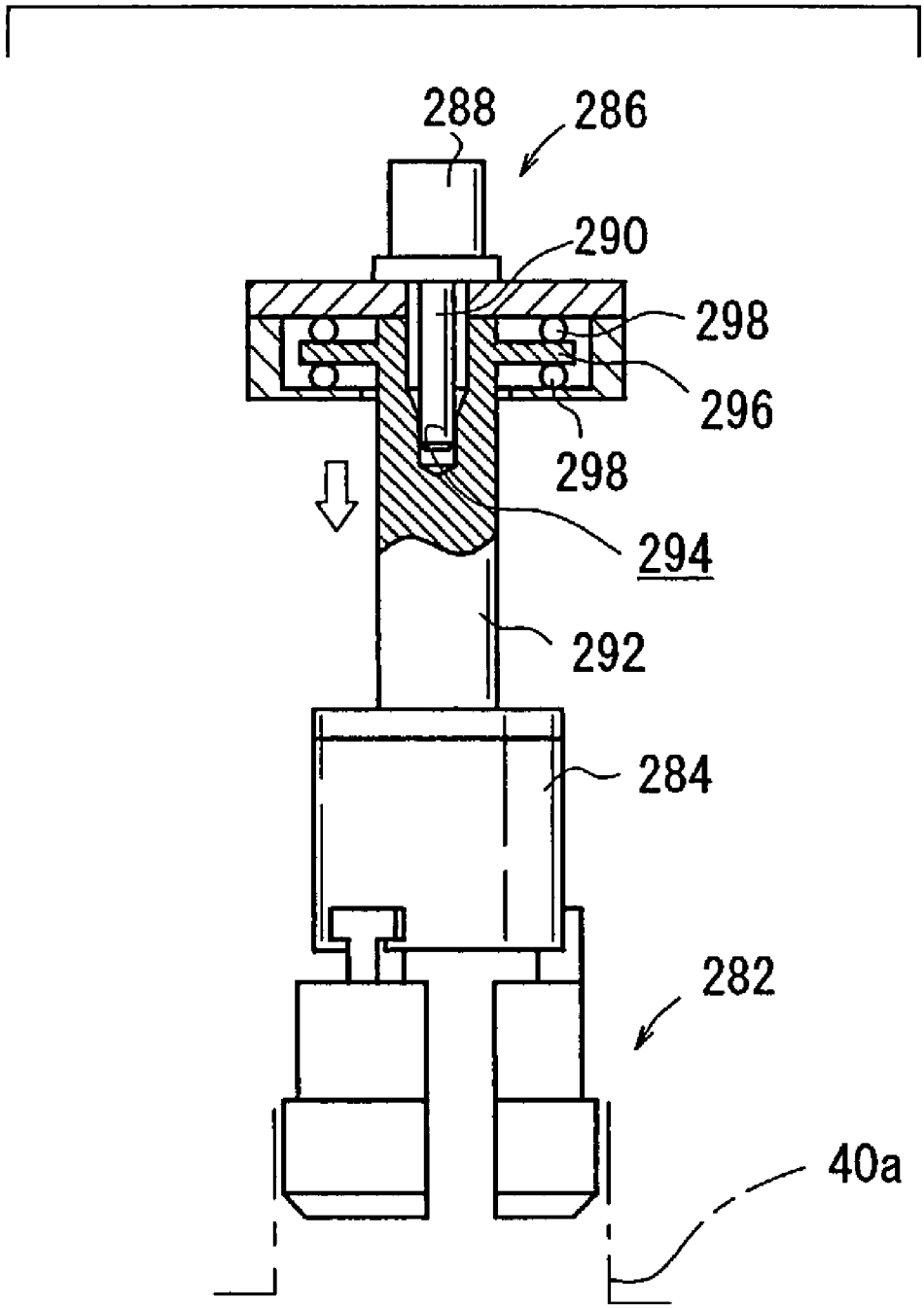
FIG. 99 is an elevational view, partly in cross section, showing the manner in which the cap removing chuck operates.

Then, the cylinder 278 is actuated to elevate the cap removing chuck 282 in unison with the vertically movable base 280, removing the cap 40*a* held by the cap removing chuck 282 from the tray 240*a*. The air cylinder 288 of the floating structure 286 is activated to lower the position pin 290 into the hole 294 defined in the shank 292, as shown in FIG. 99. The cap removing chuck 282 is thus fixed in position.

As shown in FIGS. 13 through 15, the self-propelled carriage 272 is displaced along the rails 270 toward the first index table 238*a*, and the movable base 276 is moved along the guide rail 274. The cap 40*a* held by the cap removing chuck 282 is thus delivered to a position over the cap placing station ST1*a* on the first index table 238*a*. The cylinder 278 is actuated to lower the cap removing chuck 282, placing the cap 40*a* held by the cap removing chuck 282 over the first index table 238*a*.

Figure 100:
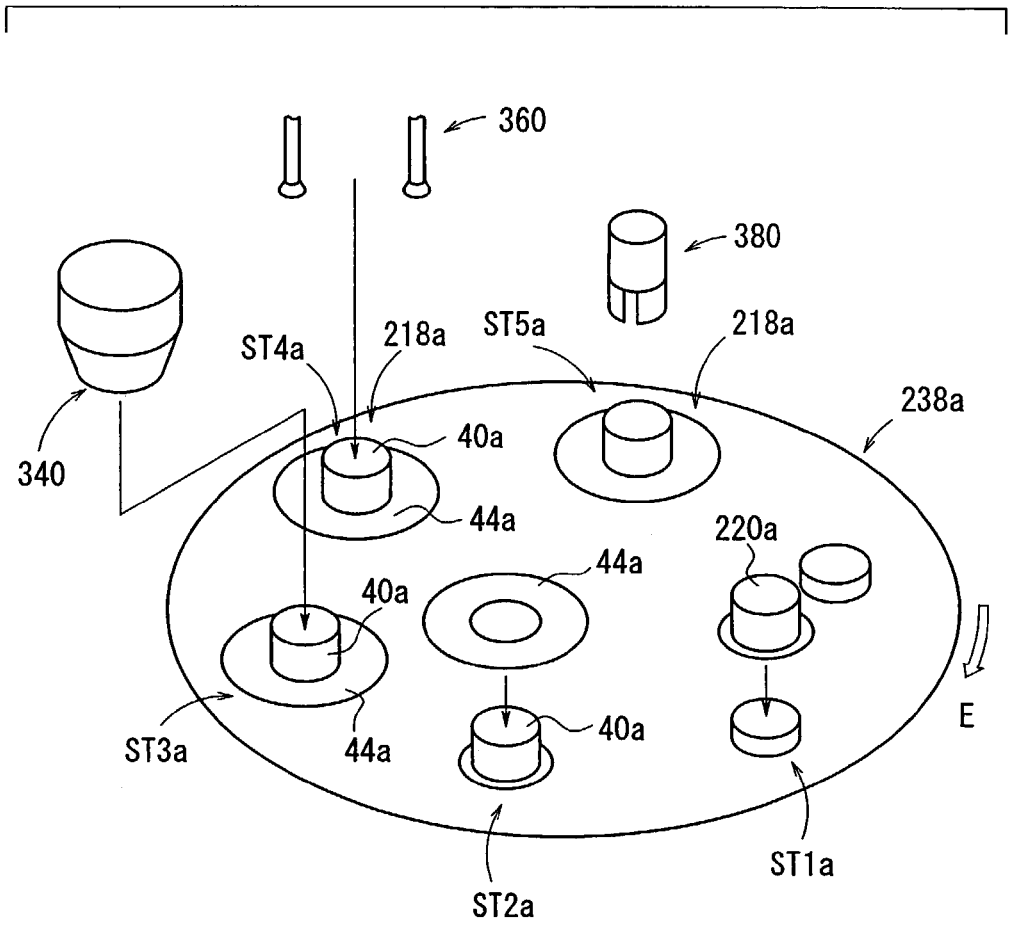
FIG. 100 is a perspective view showing the manner in which the fist index table operates.

Then, the cylinder 284 is actuated to radially contract the cap removing chuck 282, putting the cap 40*a* on the first index table 238*a* (see FIG. 99). The first index table 238*a* is turned a predetermined angle in the direction indicated by the arrow E, bringing the cap 40*a* into the ring placing station ST2*a* (see FIG. 100).

In the first ring supply 236*a*, the rings 44*a* have been positioned in alignment with a removing position by the turntable 300, with the suction means 308 placed over the rings 44*a*. As shown in FIGS. 17 and 18, air is ejected from the ejection ports 304 defined in the support post 302 around which the rings 44*a* are stacked, toward the rings 44*a*, separating the rings 44*a*. The cylinder 316 of the suction means 308 is actuated to lower the vertically movable base 320, bringing the suction pads 328 into engagement with the uppermost ring 44*a*, whereupon the suction pads 328 attract the uppermost ring 44*a*.

The cylinder 330 is actuated to cause the squeezing member 332 to engage the surface of the uppermost ring 44*a* obliquely, squeezing the uppermost ring 44*a* toward its center. The uppermost ring 44*a* attracted by the suction pads 328 is now reliably separated from the other rings 44*a*, and removed together with the suction pads 328 by the cylinder 316. The squeezing member 332 may comprise a spherical member, or may comprise at least one of the suction pads 328.

When the ring 44*a* is lifted by the suction pads 328, air is ejected from the air nozzle 306 toward the ring 44*a*. The ring 44*a* attracted by the suction pads 328 is separated from the other rings 44*a* by the applied air, and hence can reliably be removed from the other rings 44*a*.

After the vertically movable base 320 is lifted by the cylinder 316, the rotary actuator 312 is actuated to move the swing arm 314 from the position over the support post 302 to the position over the ring placing station ST2*a* on the first index table 238*a*. Since the cap 40*a* has been delivered to the ring placing station ST2*a*, when the vertically movable base 320 is lowered by the cylinder 316, the ring 44*a* attracted by the suction pads 328 is placed on the cap 40*a* in partly overlapping relation to the flange 42*a* of the cap 40*a* (see FIG. 20). The ring 44*a* is then released from the suction pads 328, which are then elevated by the cylinder 316 and moved to the first ring supply 236*a* by the rotary actuator 312.

The cap 40*a* and the ring 44*a* which is partly overlapping the cap 40*a* are delivered to the joining station ST3*a* upon rotation of the first index table 238*a*. In the joining station ST3*a*, the cylinder 344 of the heat sealer 340 is actuated to lower the vertically movable base 348 with the rod 346. The heater head 352 mounted on the vertically movable base 348 and surrounded by the band heater 354 is brought into engagement of the overlapping portions of the cap 40*a* and the ring 44*a*, joining (heat-sealing) them. The cap 40*a* and the ring 44*a* are joined to each other, thus assembling a first flanged member 18*a*.

Figure 101:
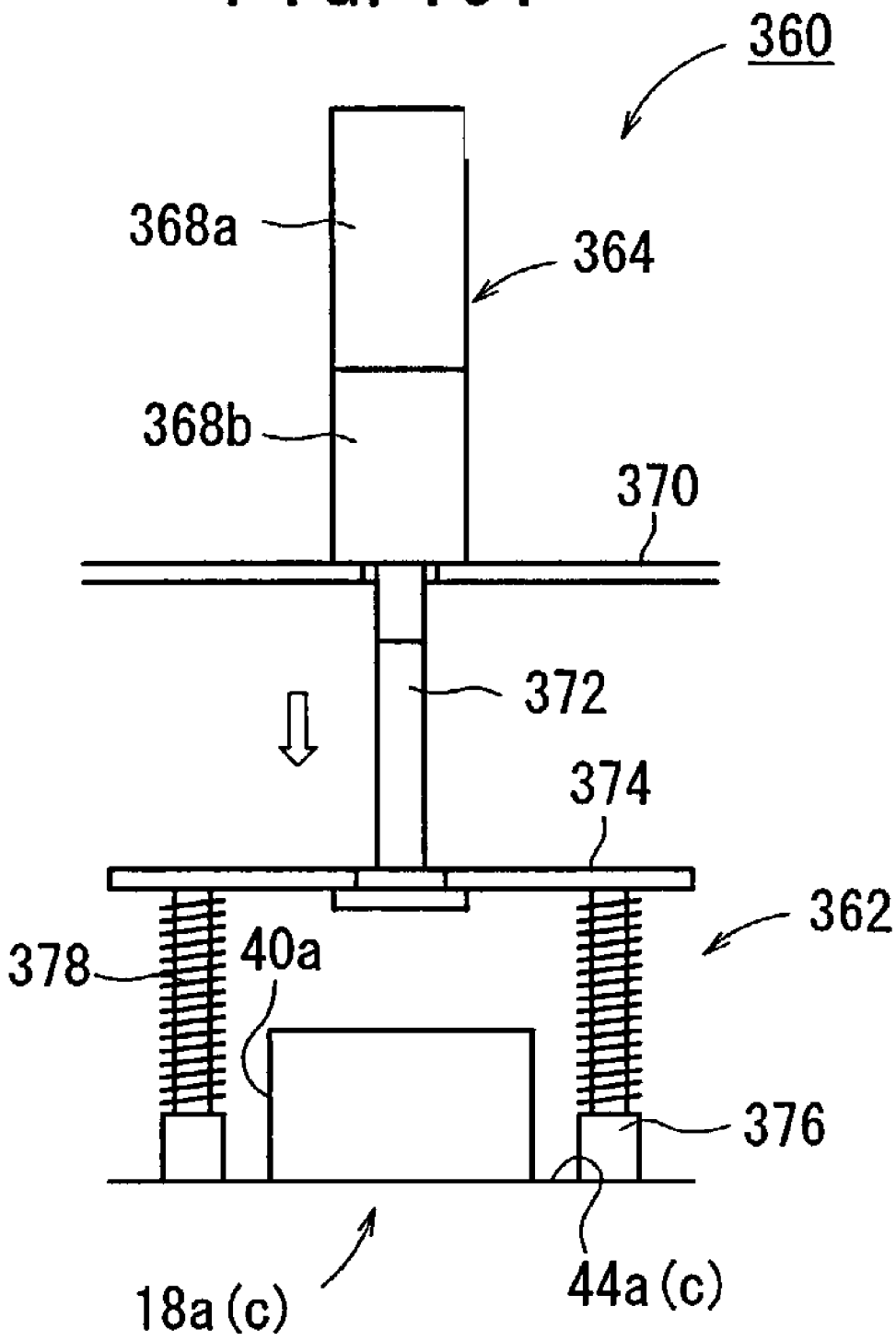
FIG. 101 is an elevational view showing the manner in which the ring is attracted by suction pads of the inspecting device.

When the first index table 238*a* is further turned a given angle in the direction indicated by the arrow E, the first flanged member 18*a* is brought into the inspecting station ST4*a* in which the inspecting mechanism 360 determines the face and reverse sides of the ring 44*a*. In the inspecting mechanism 360, as shown in FIG. 101, the first and second cylinders 368*a*, 368*b* are actuated to lower the vertically movable base 374 to bring the suction pads 376 into engagement with the ring 44*a*, and the negative pressure pump 379 (see FIG. 22) is actuated to cause the suction pads 376 to attract the surface of the ring 44*a*. At this time, the cap 40*a* is held by a holding means (not shown) in the inspecting station ST4*a* on the first index table 238*a*. The second cylinder 368*b*, for example, is actuated to lift the vertically movable base 374 a relatively short distance into the inspecting position KP, and a change in the vacuum is detected by the pressure meter 366 which is connected between the suction pads 376 and the negative pressure pump 379.

Figure 102:
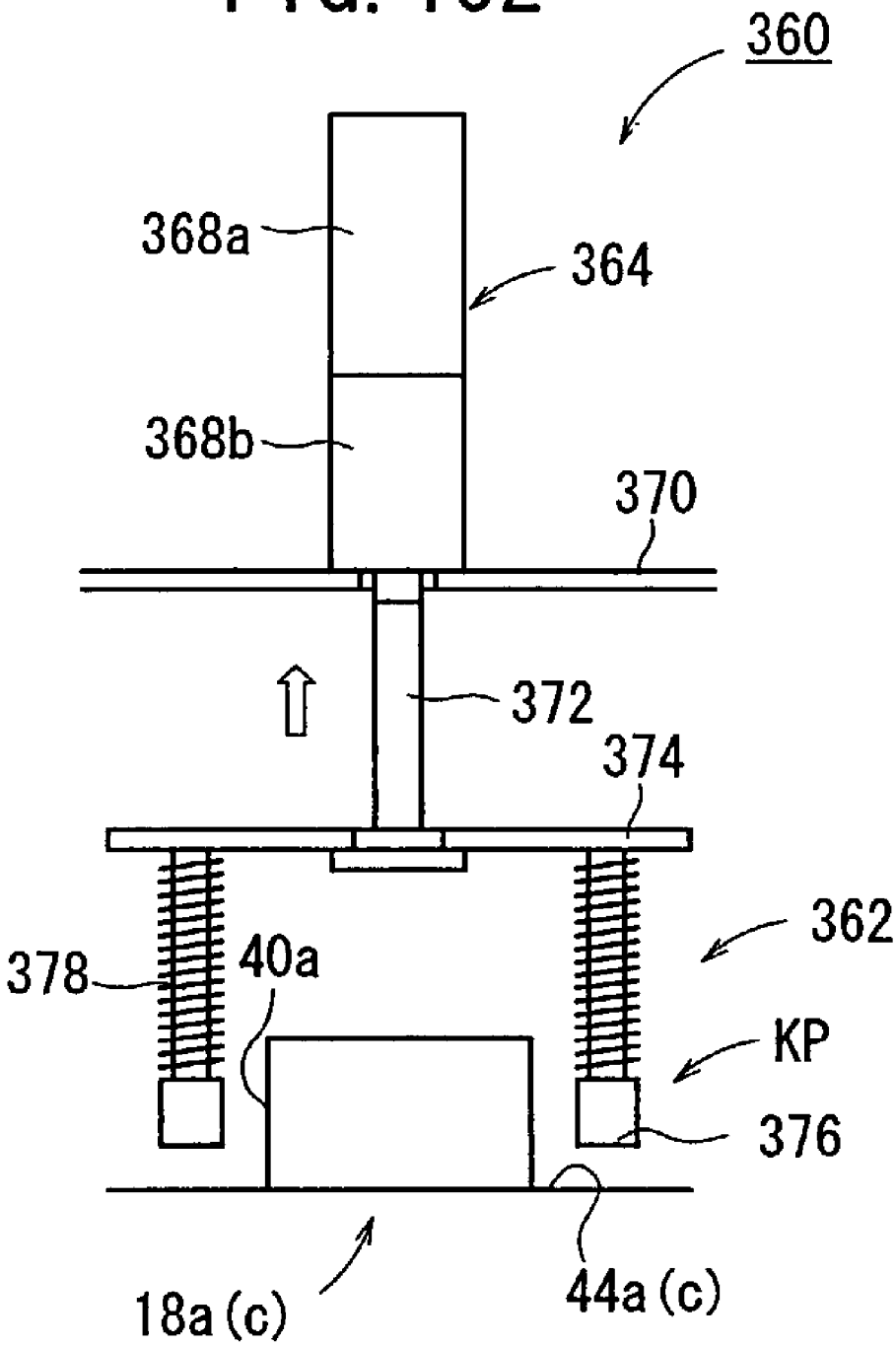
FIG. 102 is an elevational view showing the manner in which only the suction pads are lifted to an inspecting position.

If the suction pads 376 are released from the ring 44*a*, as shown in FIG. 102, then the pressure meter 366 displays a pressure value as it changes from the vacuum pressure to the atmospheric pressure, indicating that the ring 44*a* and the cap 40*a* are well joined to each other. Therefore, the adhesive layer 190 of the ring 44*a* is detected as being thermally fused to the flange 42*a* of the cap 40*a*, indicating that the face and reverse sides of the ring 44*a* are properly oriented.

Figure 103:
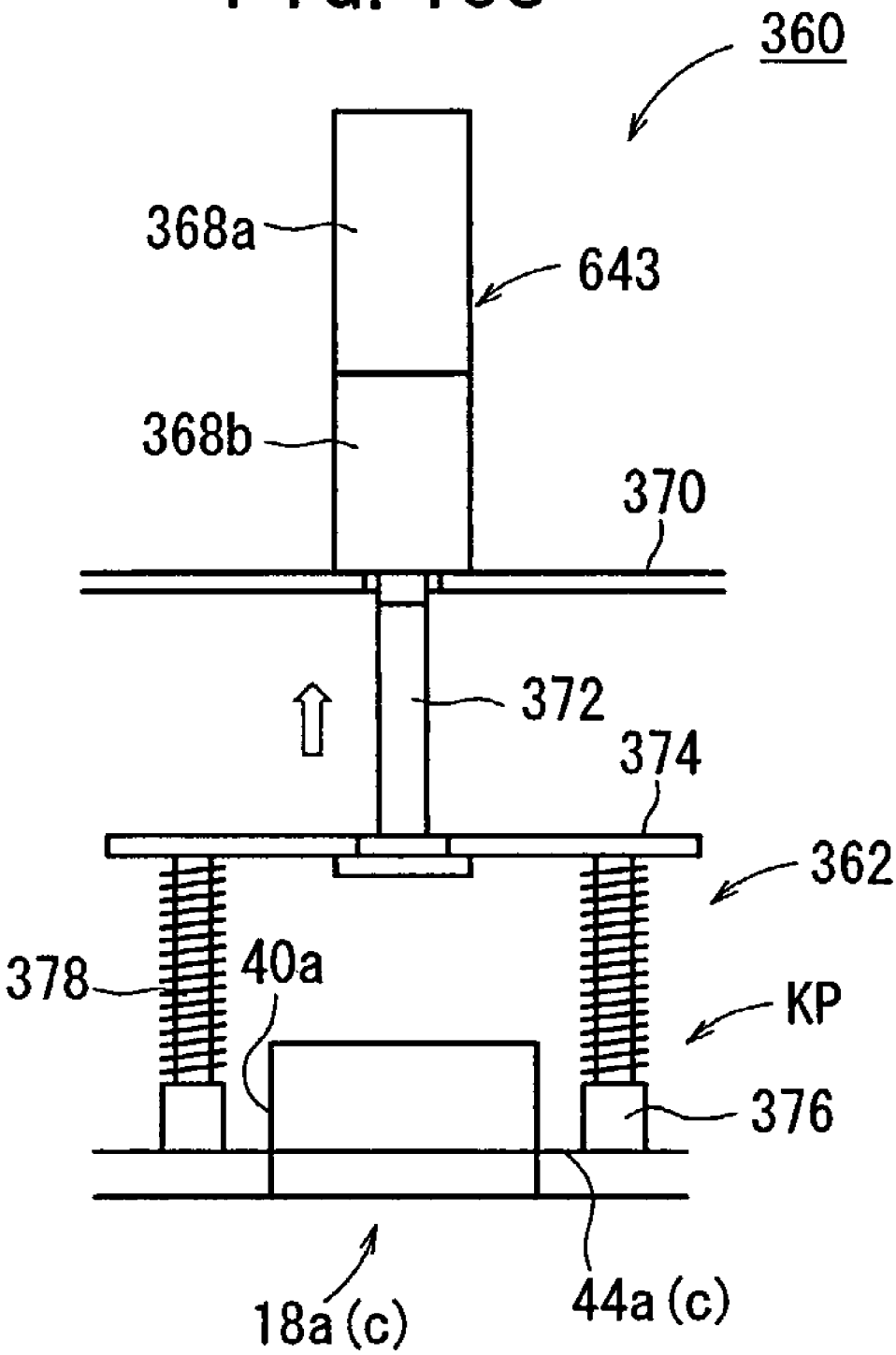
FIG. 103 is an elevational view showing the manner in which the ring is lifted together with the suction pads to an inspecting position.

If the suction pads 376 keep attracting the ring 44*a* in the inspecting position KP, as shown in FIG. 103, then the vacuum pressure as detected by the pressure meter 366 remains unchanged, indicating that the ring 44*a* is detached from the cap 40*a*. It is determined that the surface layer 196*a* of the ring 44*a* is placed over the flange 42*a* of the cap 40*a*, indicating that the face and reverse sides of the ring 44*a* are reversed.

According to the first embodiment, after the ring 44*a* and the cap 40*a* are joined to each other, the ring 44*a* is attracted by the suction pads 376 in the inspecting station ST4*a*, and then the suction pads 376 are lifted to the inspecting position KP. At this time, if the adhesive layer 190 of the ring 44*a* has been thermally fused to the cap 40*a*, then since the ring 44*a* is firmly joined to the cap 40*a* with a desired bonding strength, the ring 44*a* is released from the suction pads 376 against the attractive forces of the suction pads 376 (see FIG. 102).

If the surface layer 196 of the ring 44*a* has been joined to the cap 40*a*, then since no adhesive layer is present on the surface layer 196, the bonding strength between the ring 44*a* and the cap 40 is considerably low. When the suction pads 376 are lifted to the inspecting position KP while attracting the ring 44*a*, the ring 44*a* is disengaged from the cap 40*a*, and lifted together with the suction pads 376 to the inspecting position KP.

In the first embodiment, therefore, it can be determined, reliably with a simple arrangement and process, whether the ring 44*a* is peeled off the cap 40*a* or not, i.e., whether the face and reverse sides of the ring 44*a* are properly oriented or not, simply by detecting the pressure exerted by the suction pads 376 in the inspecting position KP with the pressure meter 366.

Figure 104:
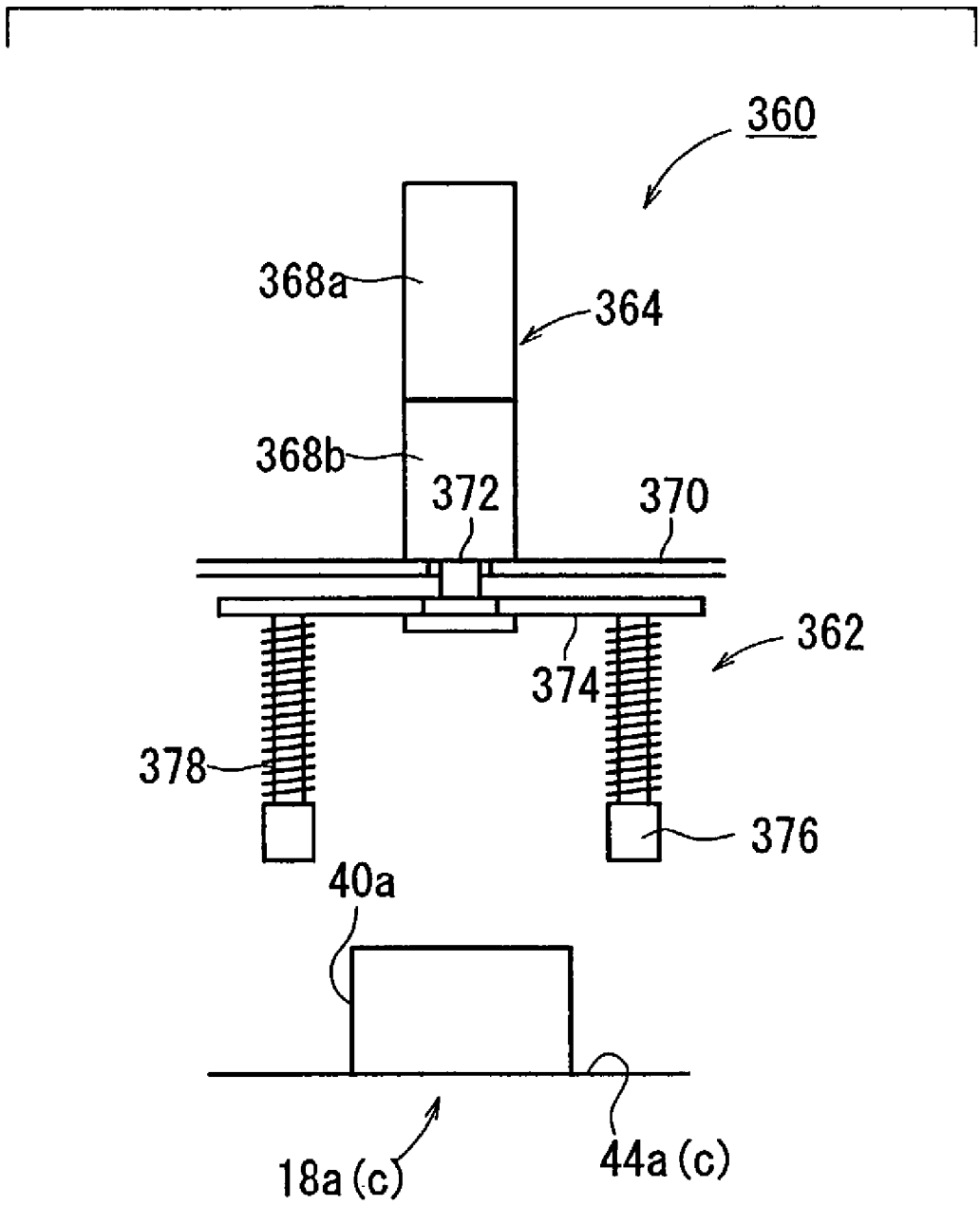
FIG. 104 is an elevational view showing the manner in which the suction pads are moved to a retracted position after the ring has been inspected.

After the face and reverse sides of the ring 44*a* have been determined by the inspecting device 360, the first cylinder 368*a* is actuated to retract the suction pads 376 to a predetermined vertical position (see FIG. 104).

Figure 105:
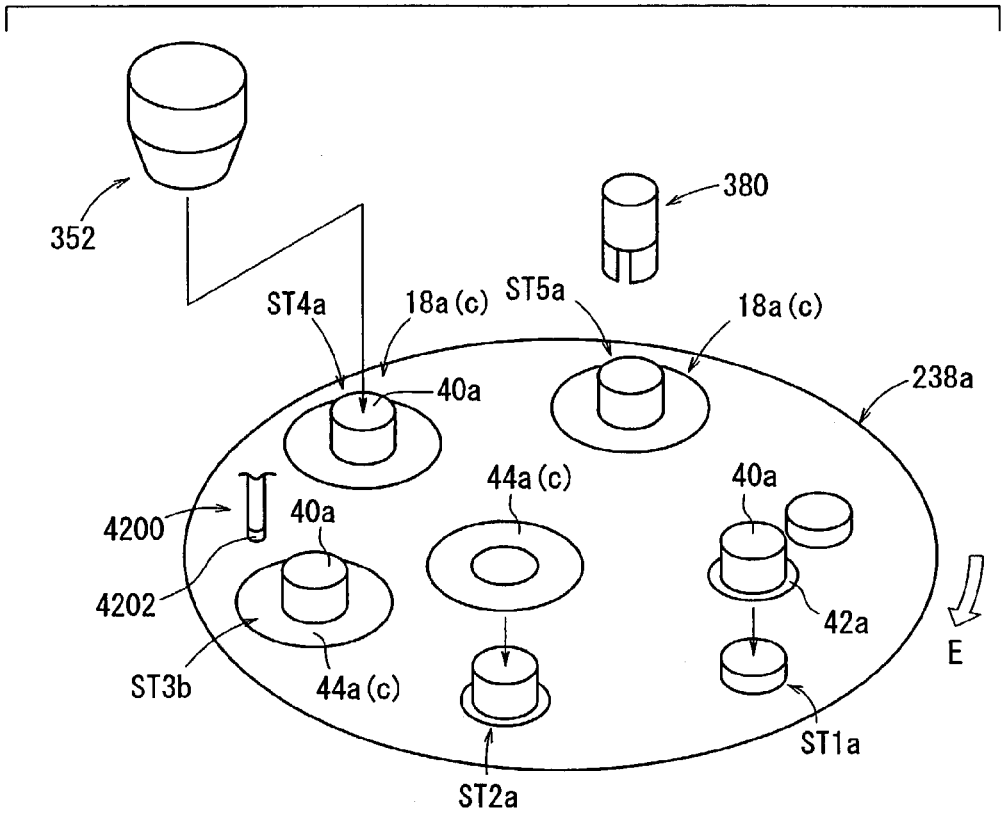
FIG. 105 is a perspective view of the first index table which incorporates another inspecting device.

As shown in FIG. 23, the ring 44*a* has its surface layer 196 constructed as a color layer whose color is different from the color of the adhesive layer 190. Specifically, the surface layer 196 is gray and the adhesive layer 190 is black. As shown in FIG. 105, therefore, the inspection station ST4*b* may have a movable color identification sensor 4202 of an inspecting mechanism 4200.

The color identification sensor 4202 is capable of determining the face and reverse sides of the ring 44*a*, i.e., the surface layer 196, based on the different colors of the surface layer 196 and the adhesive layer 190. The color identification sensor 4202 can accurately determine the face and reverse sides of the ring 44*a* before the cap 40*a* and the ring 44*a* are joined to each other. If the face and reverse sides of the ring 44*a* are inverted, then the ring 44*a* will not be joined to the cap 40*a*.

Therefore, the face and reverse sides of the ring 44*a* can accurately be determined with a simple arrangement and process, so that the first flanged member 18*a*, in particular, is prevented from being assembled if it is defective, and can be assembled efficiently.

If the face and reverse sides of the first flanged member 18*a* and its joined state are detected and judged as being acceptable, then the first flanged member 18*a* is delivered to the light-shielding member removing station ST5*a*, and thereafter fed to the lifter 400 by the light-shielding member removing means 380. Specifically, as shown in FIGS. 20 and 25, the light-shielding member chuck 396 is placed over the light-shielding member removing station ST5*a*, and the lifting and lowering cylinder 394 is actuated to insert the light-shielding member chuck 396 into the first flanged member 18*a*, after which the light-shielding member chuck 396 is radially expanded to hold the inner circumferential surface of the first flanged member 18*a*.

The lifting and lowering cylinder 394 is actuated to lift the first flanged member 18*a* which is held by the light-shielding member chuck 396. Thereafter, the movable base 392 is moved along the guide rail 384 in the direction indicated by the arrow C. At this time, as shown in FIG. 106, the first shutter 410 is moved downwardly by the cylinder 414 to open the first opening 424, and the second shutter 412 closes the second opening 426, keeping the dark chamber 11 shielded from light.

The first flanged member 18*a* which is held by the light-shielding member chuck 396 is moved through the first opening 424 to a position over the lifter 400, and stopped over the first rest 406*a* on the fixed placement base 402 of the lifter 400. The lifting and lowering cylinder 394 is actuated lower the light-shielding member chuck 396 to place the first flanged member 18*a* on the first rest 406*a*, after which the light-shielding member chuck 396 is radially contracted to release the first flanged member 18*a*.

The light-shielding member chuck 396 is lifted by the lifting and lowering cylinder 394, and thereafter the movable base 392 is moved in the direction opposite to the direction indicated by the arrow C, to a position over the light-shielding member removing station ST5*a* on the first index table 238*a*. Since a newly joined first flanged member 18*a* is placed in the light-shielding member removing station ST5*a*, the above process is repeated to hold the newly joined first flanged member 18*a* with the light-shielding member chuck 396 and deliver the newly joined first flanged member 18*a* to the lifter 400.

Figure 107:
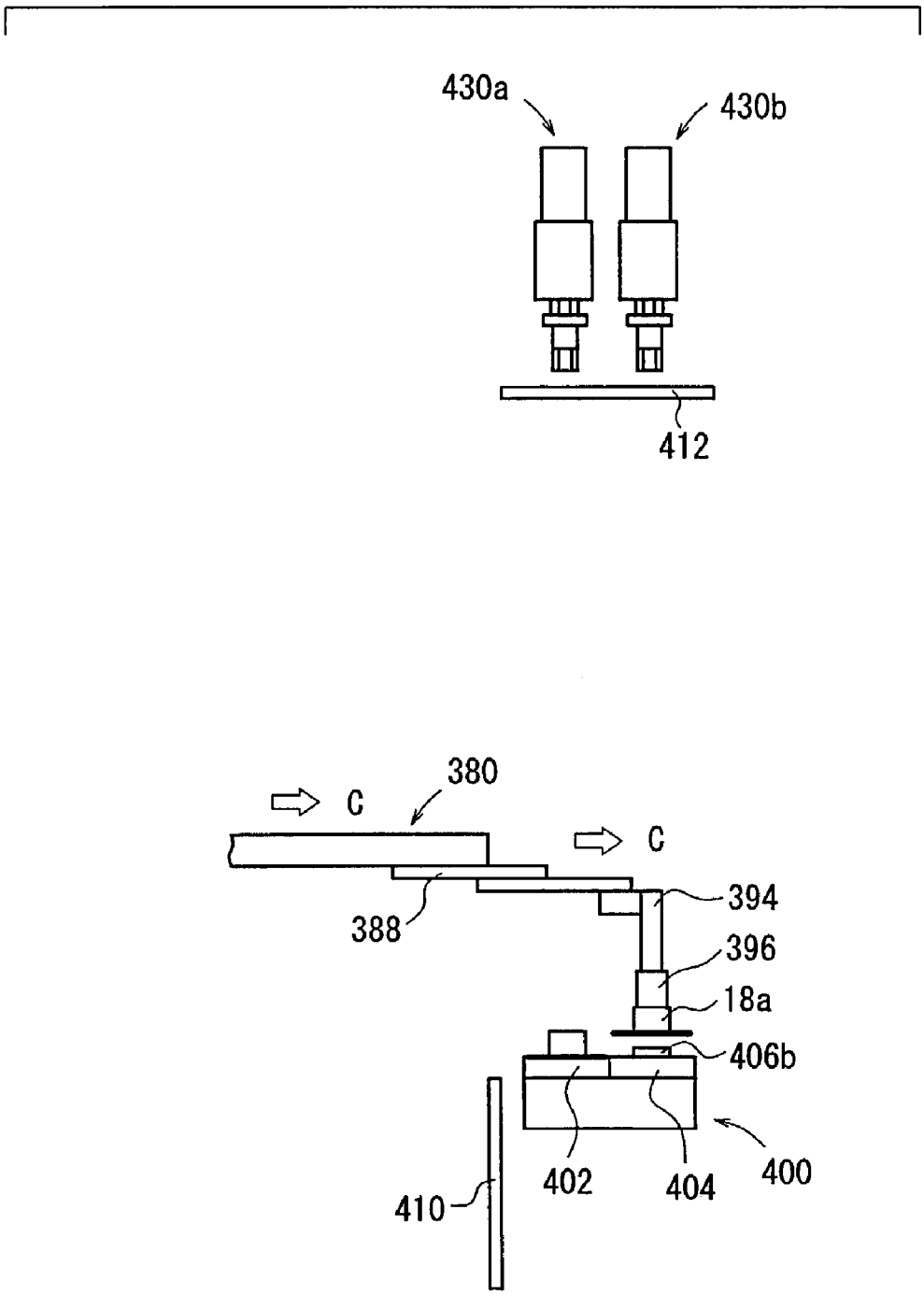
FIG. 107 is an elevational view showing the manner in which a second flanged member is fed to the lifter.

At this time, as shown in FIG. 107, the cylinder 388 of the light-shielding member removing means 380 is actuated to place the light-shielding member chuck 396 in a position over the first rest 406*b* on the movable placement base 404 of the lifter 400. The lifting and lowering cylinder 394 is actuated to lower the first flanged member 18*a* onto the first rest 406*b*.

Figure 108:
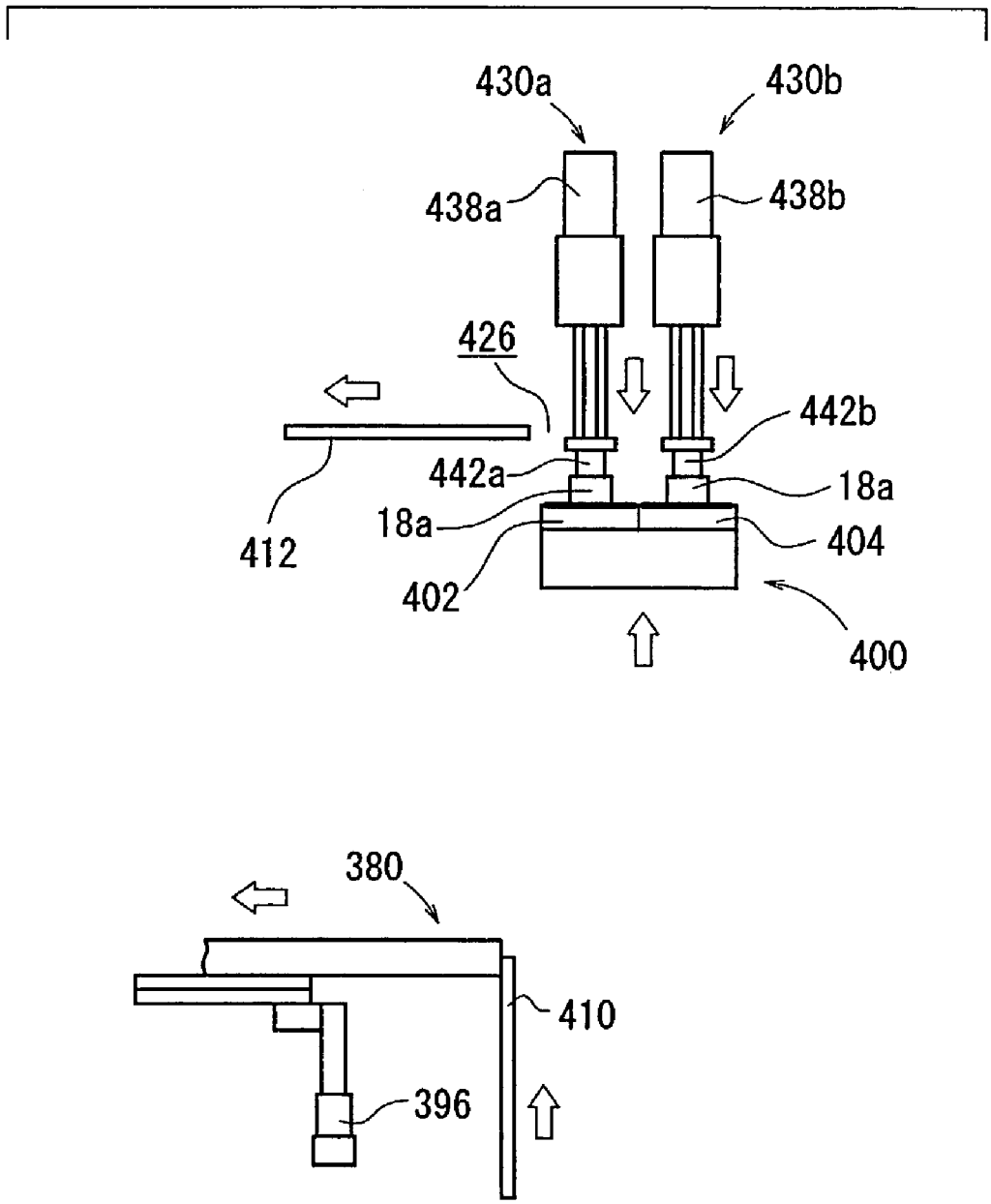
FIG. 108 is an elevational view showing the manner in which after a first shutter is closed, the lifter is lifted and a second shutter is opened.

Having placed the first flanged member 18*a* onto the first rest 406*b*, the light-shielding member chuck 396 is returned to the first index table 238*a*, and the first shutter 410 is lifted by the cylinder 414 to close the first opening 424 (see FIG. 108). The lifter 400 starts moving upwardly, and the movable placement base 404 is moved in the direction indicated by the arrow G1 in FIG. 109, positioning the first rest 406*b* in diagonally opposite relation to the first rest 406*a*.

When the lifter 400 is lifted, the second shutter 412 is moved by the cylinder 418, opening the second opening 426, as shown in FIG. 108. When the lifter 400 stops in its upper limit position, the cylinders 438*a*, 438*b* of the first and second horizontal feed means 430*a*, 430*b* are actuated. The chucks 442*a*, 442*b* are lowered, and the first flanged members 18*a* placed on the first rests 406*a*, 406*b* have their inner circumferential surfaces held by the chucks 442*a*, 442*b* and are removed from the lifter 400 by the cylinders 438*a*, 438*b*.

Figure 110:
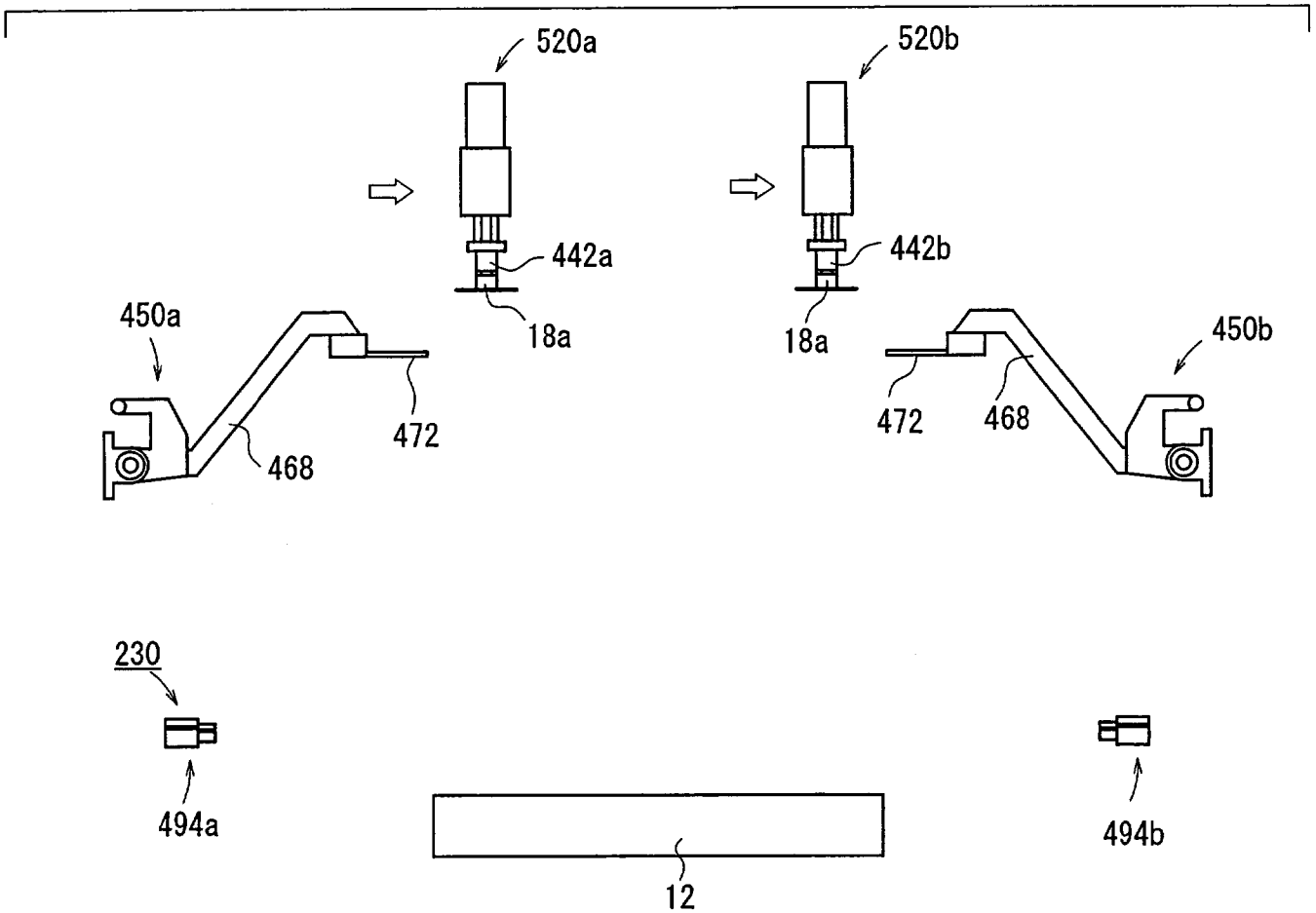
FIG. 110 is an elevational view showing the manner in which first flanged members are moved by first and second horizontal feed means.

The chucks 442*a*, 442*b* which are holding the first flanged members 18*a* are moved along the guide rails 432*a*, 432*b* by the belts 436*a*, 436*b* moved in circulation by the motors 434*a*, 434*b*, as shown in FIG. 28. The chucks 442*a*, 442*b* are temporarily placed between the swing arms 468 of the first and second light-shielding member transfer means 450*a*, 450*b* (see FIG. 110). The swing arms 468 have been angularly moved upwardly from their lower positions.

Figure 111:
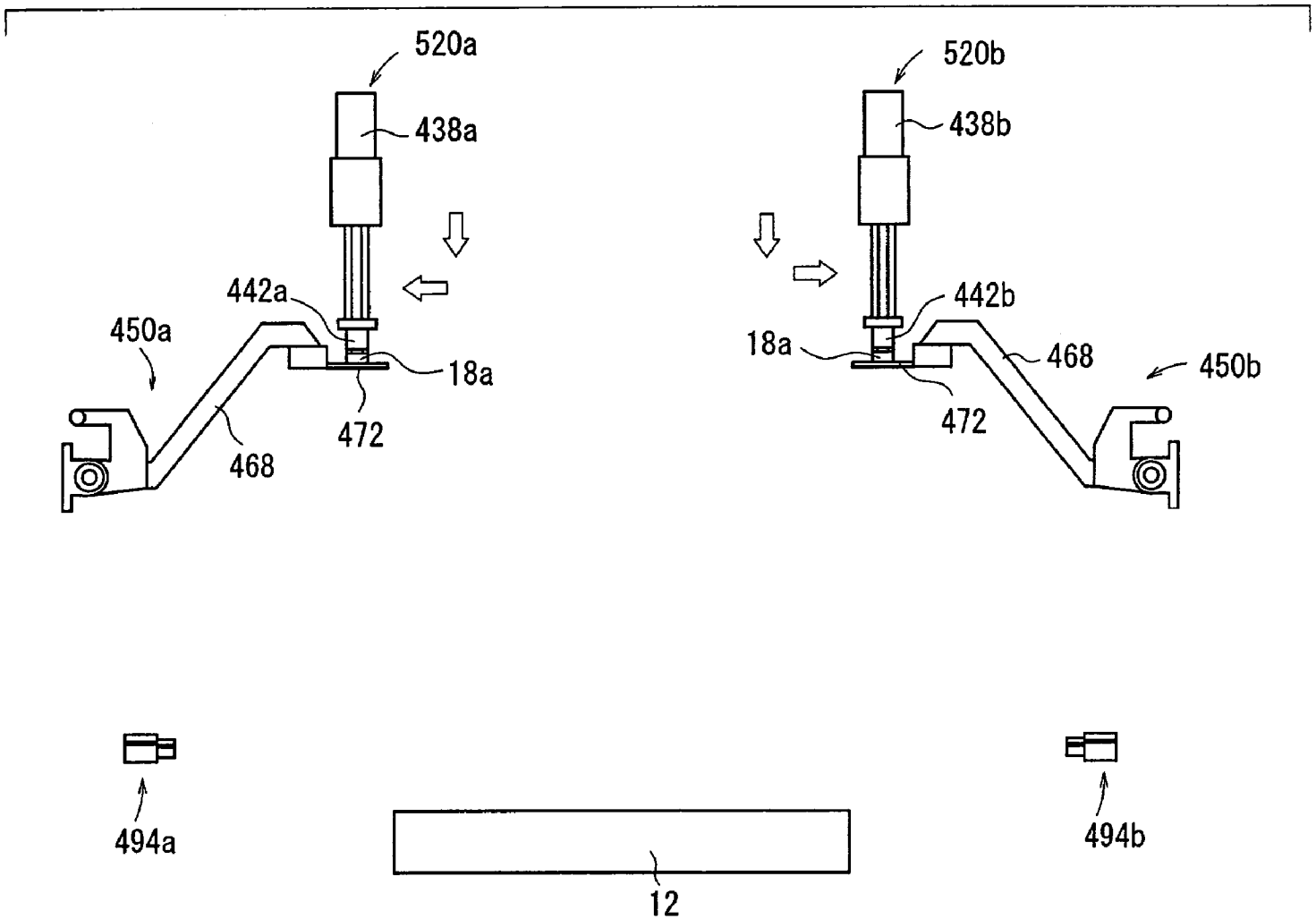
FIG. 111 is an elevational view showing the manner in which the first flanged members are transferred to swing arms from the first and second horizontal feed means.

After the chucks 442*a*, 442*b* are lowered by the cylinders 438*a*, 438*b*, the chuck 442*a* is moved toward the first light-shielding member transfer means 450*a*, and the chuck 442*b* is moved toward the second light-shielding member transfer means 450*b* (see FIG. 111). The first flanged members 18*a* held by the chucks 442*a*, 442*b* are transferred to the chucks 472 of the respective swing arms 468. After the first flanged members 18*a* are placed on the chucks 472, the fingers 476*a*, 476*b* thereof which have been spaced from each other are displaced toward each other, thus holding the first flanged members 18*a*.

Figure 112:
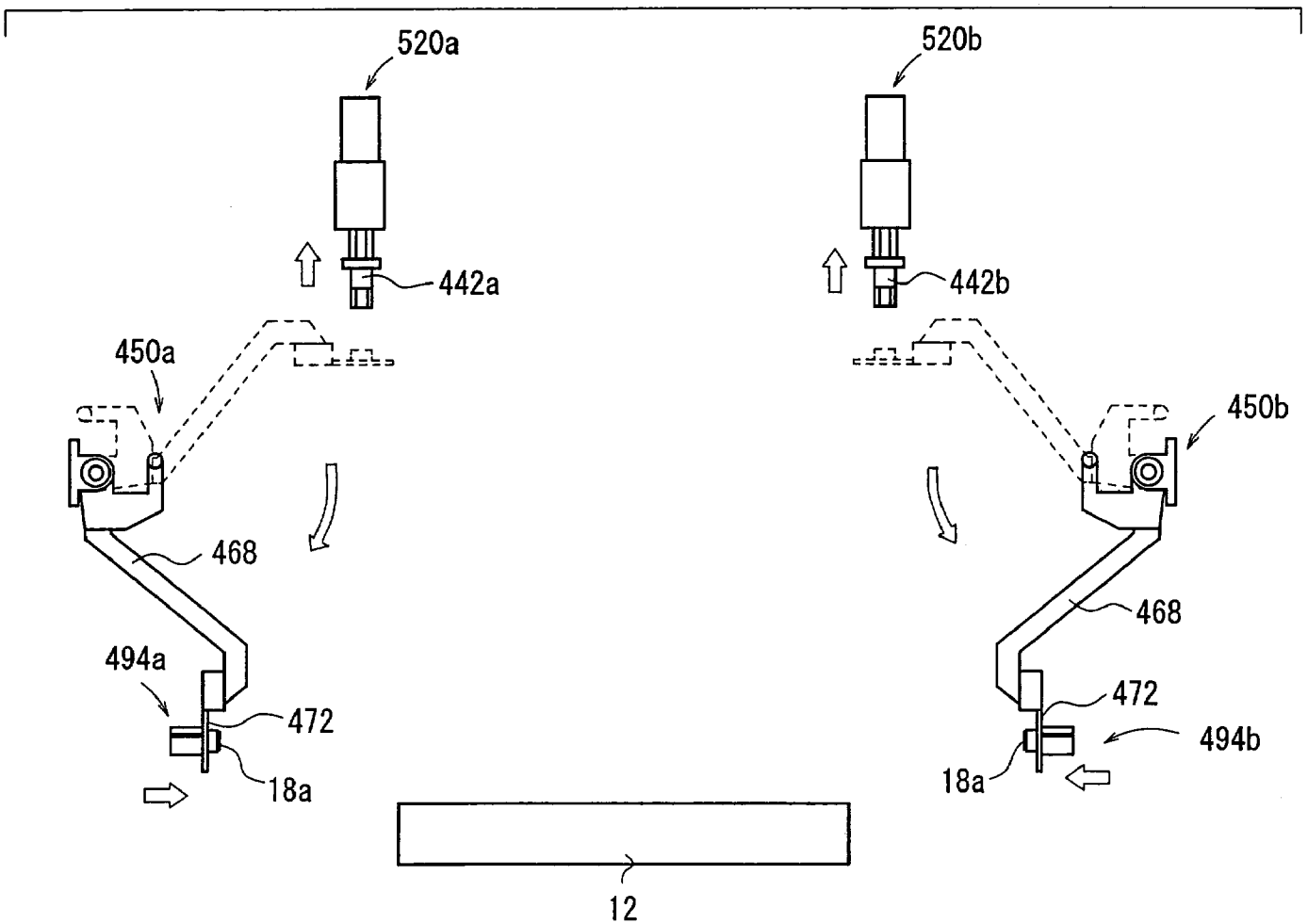
FIG. 112 is an elevational view showing the manner in which the swing arms are swung to transfer the first flanged members to insertion heads.

One of the swing arms 468 has been displaced out of alignment with the other swing arm 468 in the axial direction of the photosensitive roll 12 depending on the chucks 442*a*, 442*b*. Therefore, one of the swing arms 468 is positioned adjusted with respect to the other swing arm 468 by the cylinder 456. Then, the swing arms 468 are turned about 90° downwardly by the cylinders 464, directing the axes of the first flanged members 18*a* horizontally (see FIG. 112).

Figure 113:
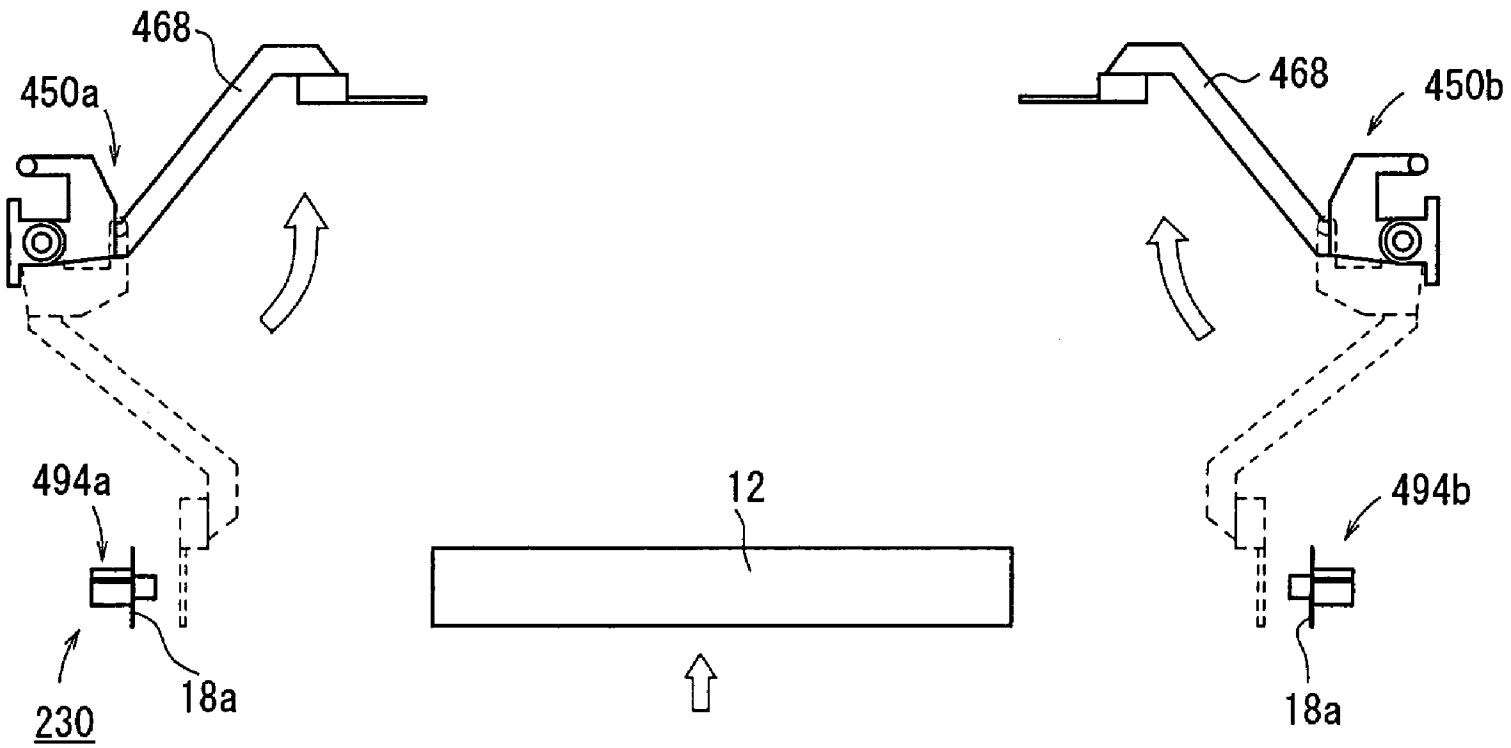
FIG. 113 is an elevational view showing the manner in which the first flanged members are held by the insertion heads.

The inserting mechanisms 231 are positioned outwardly of and coaxially with the respective first flanged members 18*a*. The cylinders 490*a*, 490*b* of the inserting mechanisms 231 are actuated to insert the inserters 494*a*, 494*b* into the first flanged members 18*a* held by the chucks 472 until the first flanged members 18*a* are positioned around the radially expandable and contractible chucks 498*a*, 498*b* of the inserters 494*a*, 494*b*. The radially expandable and contractible chucks 498*a*, 498*b* are radially expanded to hold the inner circumferential surfaces of the first flanged members 18*a*, and the fingers 476*a*, 476*b* of the chucks 472 are displaced away from each other, releasing the first flanged members 18*a*. The inserters 494*a*, 494*b* are retracted by the cylinders 490*a*, 490*b*, and the swing arms 468 are swung upwardly by the cylinders 464 (see FIG. 113).

A photosensitive roll 12 is placed by the centering mechanism 232 in coaxial alignment with the first flanged members 18*a* held by the inserters 494*a*, 494*b*. Specifically, the photosensitive roll 12 is placed by the pallet 86 on the upper feed conveyors 82*a*, 82*b* of the feed device 80, and the upper feed conveyors 82*a*, 82*b* are moved in circulation to feed the photosensitive roll 12 in the direction indicated by the arrow Y (see FIGS. 5 and 6).

The pallet 86 is fed in the direction indicated by the arrow Y by the upper feed conveyors 82*a*, 82*b*, and placed on the second base 96*b* of the second lifter 88*b*, whereupon the pallet 86 is lowered onto the lower feed conveyors 84*a*, 84*b* by the second cylinder 94*b*. When the lower feed conveyors 84*a*, 84*b* are moved in circulation, the pallet 86 is fed toward the first lifter 88*a*, and the cylinders 106*a*, 106*b* of the second base actuating mechanism 104*b* are actuated. The pressers 114*b*, 116*b* directly press the surfaces of the placement bases 100*a*, 100*b*, moving the placement bases 100*a*, 100*b* toward each other.

After the placement bases 100*a*, 100*b* are moved closely to each other, the pallet 86 is placed on and lifted by the first base 96*a* of the first lifter 88*a*, and transferred to the upper feed conveyors 82*a*, 82*b*. At this time, if the photosensitive roll 12 placed on the pallet 86 has a large roll width, then the first base actuating mechanism 104*a* is actuated. In the first base actuating mechanism 104*a*, the cylinders 106*a*, 108*a* are actuated to move the pressers 114*a*, 116*a* forward. The pressers 114*a*, 116*a* press the surfaces of the placement bases 100*b*, 100*a* through the holes 102*a*, 102*b*, moving the placement bases 100*b*, 100*a* away from each other.

Figure 114:
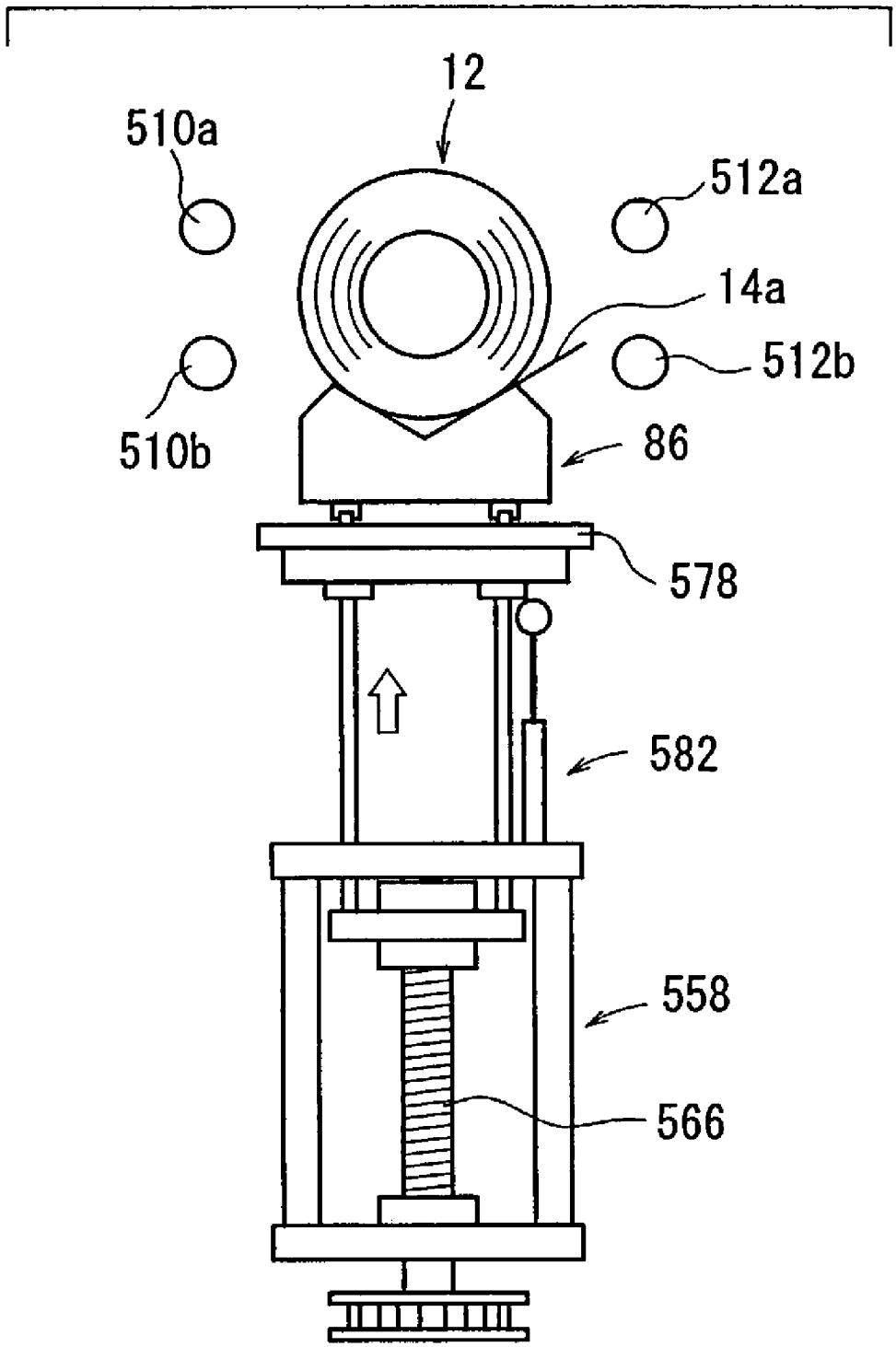
FIG. 114 is an elevational view showing the manner in which the pallet is lifted by the lifting and lowering device.

When the pallet 86 supporting the photosensitive roll 12 thereon is stopped in a given location at the light-shielding member installing position P1, the servomotor 560 of the lifting and lowering device 558 is energized. The belt and pulley means 564 associated with the rotatable shaft 562 of the servomotor 560 rotates the ball screw 566, which causes the nut 570 threaded thereover to lift the vertically movable base 572. The vertically movable plate 578 fixed to the vertically movable base 572 by the guide bars 574 brings the pins 580 into engagement with the pallet 86, elevating the pallet 86 to a position over the upper feed conveyors 82*a*, 82*b* (see FIG. 114).

Figure 115:
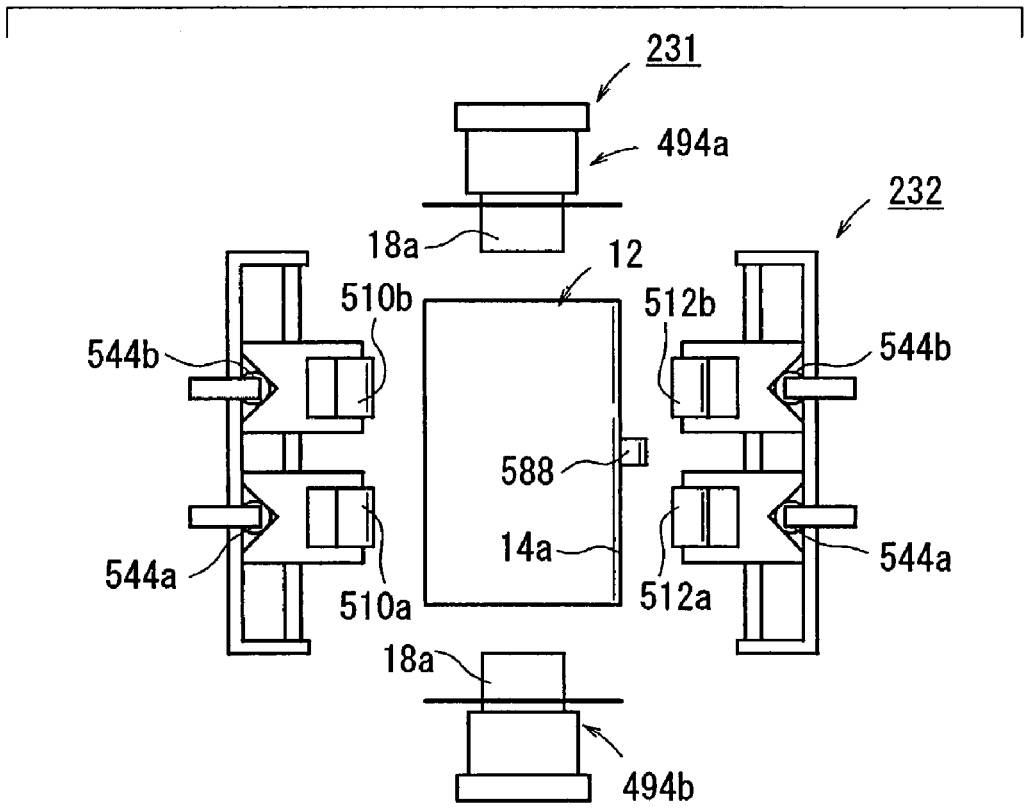
FIG. 115 is a plan view showing the manner in which an end pressing mechanism is actuated after the pallet has been lifted.

When the pallet 86 reaches a certain vertical position, the cylinder 584 of the end pressing mechanism 582 is actuated to lift the pressing roller 588 on the leaf spring 587. The pressing roller 588 now holds the end 14*a* of the photosensitive sheet 14 projecting from the photosensitive roll 12 against the outer circumferential surface of the photosensitive roll 12 (see FIG. 115). Then, as shown in FIGS. 32 and 33, the cylinder 516 of the actuating means 514 is actuated to move the rod 518 in the direction indicated by the arrow J1 (inwardly of the cylinder 516). The first rack 522 coupled to the rod 518 is moved in unison with the second movable base 528 in the direction indicated by the arrow J1. At this time, the pinion 523 meshing with the first rack 522 is rotated, moving the second rack 525 meshing with the pinion 523 in the direction indicated by the arrow J2. The first movable base 526 coupled to the second rack 525 is also moved in the direction indicated by the arrow J2.

Figure 116:
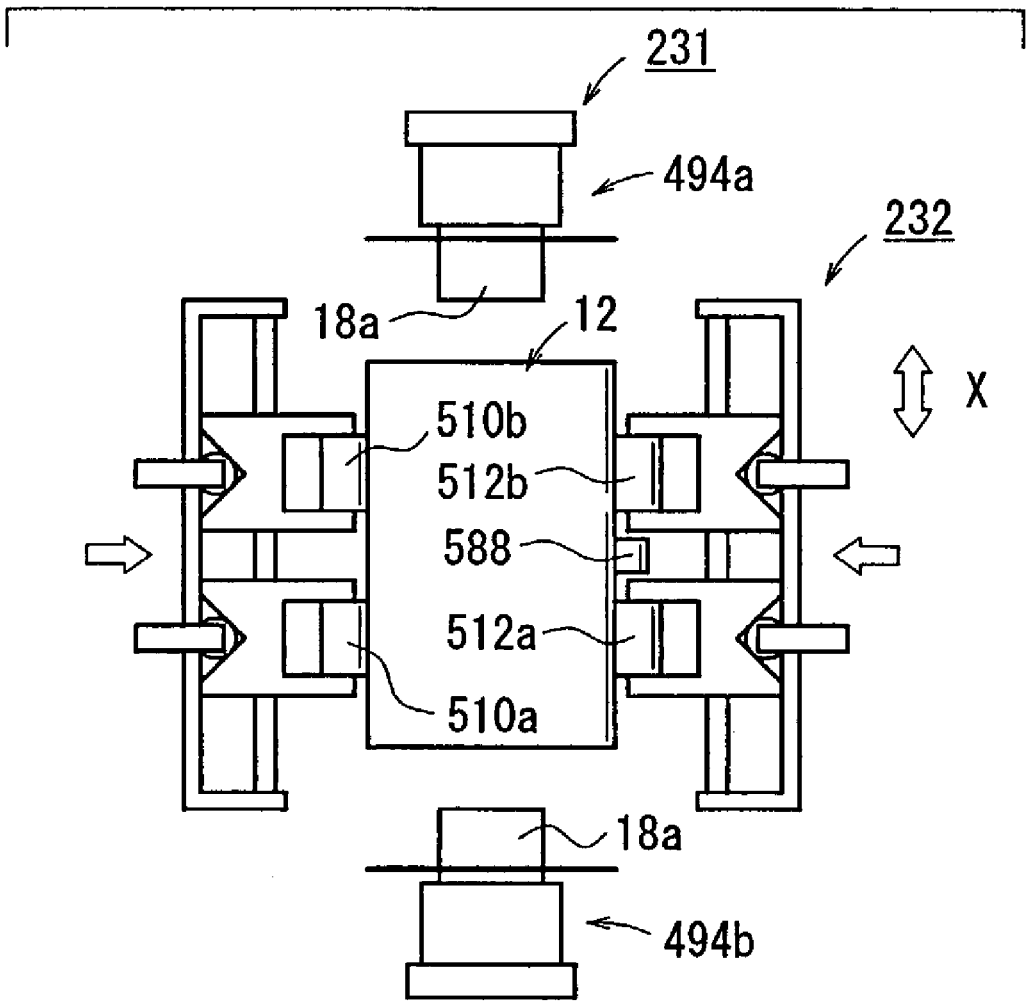
FIG. 116 is a plan view showing the manner in which the outer circumferential surface of the photosensitive roll is held by the centering mechanism.

The first and second movable bases 526, 528 are thus moved toward each other, moving the first centering rollers 510*a*, 510*b* and the second centering rollers 512*a*, 512*b* toward each other thereby to center and hold the outer circumferential surface of the photosensitive roll 12 (see FIG. 116).

As described above, the first and second movable bases 526, 528 are moved toward each other by the cylinder 516 as a single actuator through the first and second racks 522, 525 and the pinion 523. Therefore, the first and second movable bases 526, 528 can easily and reliably handle the photosensitive roll 12 even if its outside diameter is changed, and hence are highly versatile in use.

Figure 117:
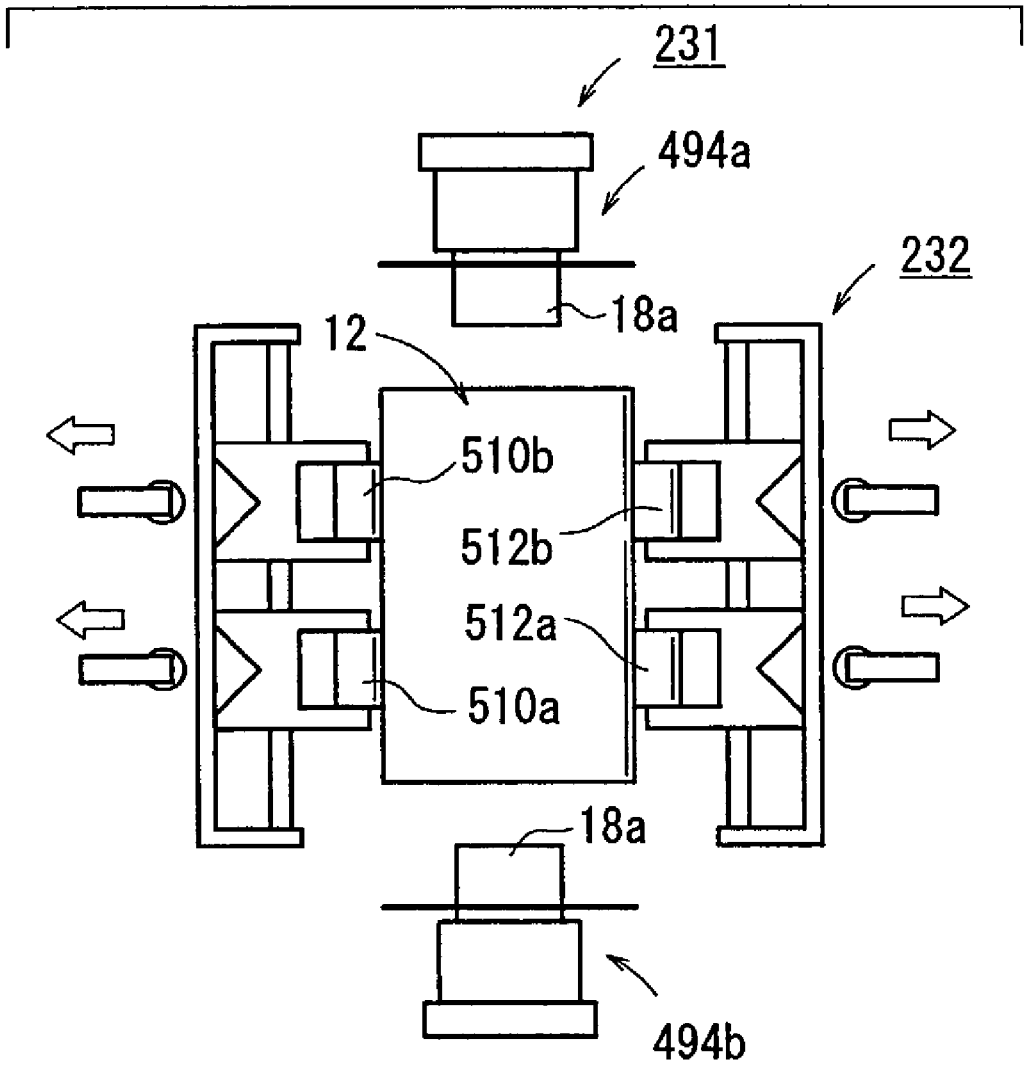
FIG. 117 is a plan view showing the manner in which the end pressing mechanism is lowered while the outer circumferential surface of the photosensitive roll is being held by the centering mechanism.

The positioning rollers 544*a*, 544*b* engage in the V-shaped notches 538*a*, 538*b* defined in the plates 536*a*, 536*b* that are secured to the movable blocks 534*a*, 534*b*, positioning the first centering rollers 510*a*, 510*b* and the second centering rollers 512*a*, 512*b* axially in the direction indicated by the arrow X. After the first centering rollers 510*a*, 510*b* and the second centering rollers 512*a*, 512*b* center and hold the outer circumferential surface of the photosensitive roll 12, the cylinder 584 of the end pressing mechanism 582 is actuated to move the pressing roller 588 downwardly off the photosensitive roll 12 (see FIG. 117) as the end 14*a* of the photosensitive sheet 14 is held against the outer circumferential surface of the photosensitive roll 12 by the first centering rollers 510*a*, 510*b*.

Then, the cylinders 540*a*, 540*b* are actuated to displace the positioning rollers 544*a*, 544*b* out of the V-shaped notches 538*a*, 538*b*, freeing the movable blocks 534*a*, 534*b*, whereupon the inserting mechanism 231 is actuated. In the inserting mechanism 231, the cylinders 490*a*, 490*b* are actuated to receive the first flanged members 18*a* from the first and second light-shielding member transfer means 450*a*, 450*b*. Thereafter, the motor 482 is energized to cause the gear train 484 to rotate the ball screw 480, whereupon the nuts 488*a*, 488*b* threaded over the reversely threaded structures of the ball screw 480 move the first and second slide bases 486*a*, 486*b* toward each other. the first and second slide bases 486*a*, 486*b* now move to the opposite ends of the photosensitive roll 12 which is centered and held by the centering mechanism 232.

Figure 118:
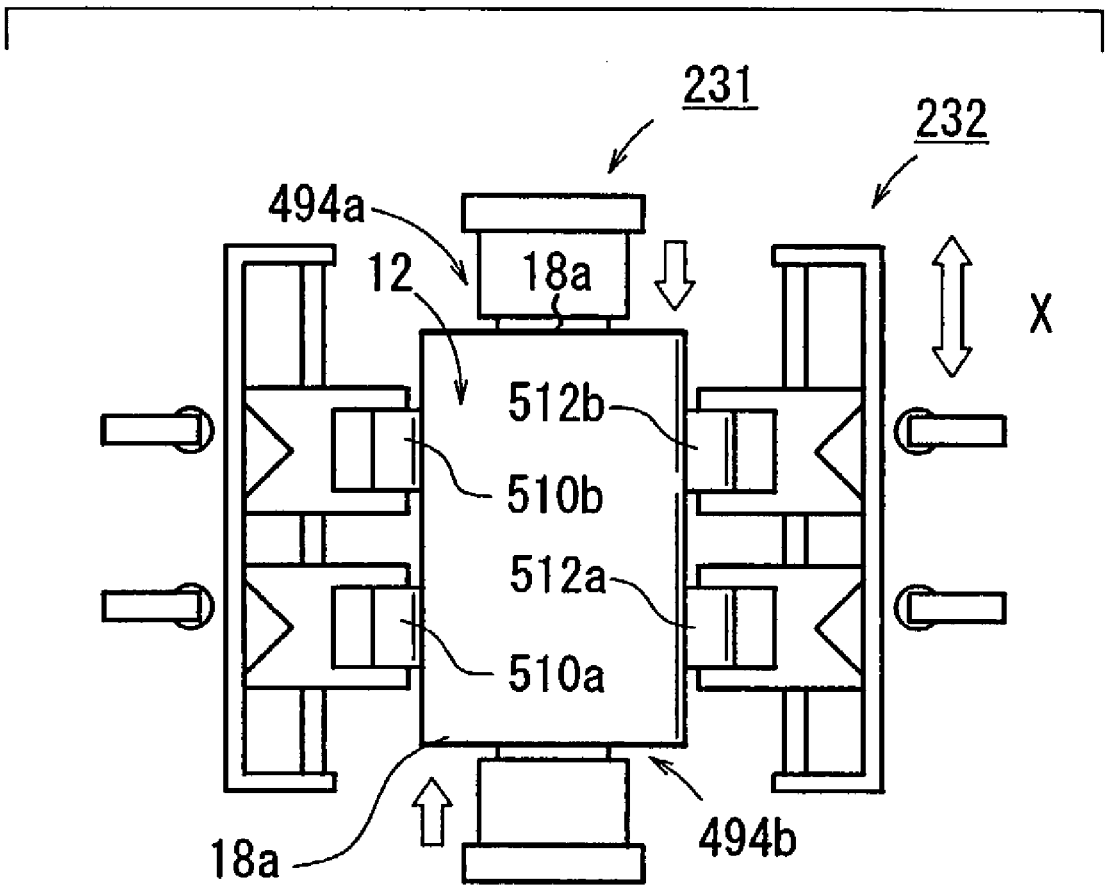
FIG. 118 is a plan view showing the manner in which the first flanged members are inserted into the respective opposite ends of the photosensitive roll.

The cylinders 490*a*, 490*b* are actuated to move the inserters 494*a*, 494*b* toward the opposite ends of the photosensitive roll 12 along the guides 496*a*, 496*b*, inserting the first flanged members 18*a* held by the radially expandable and contractible chucks 498*a*, 498*b* into the respective opposite ends of the photosensitive roll 12 (see FIG. 118). If the photosensitive roll 12 is positionally displaced axially in the direction indicated by the arrow X or if the left and right first flanged members 18*a* are inserted at different times, then the photosensitive roll 12 is axially moved when the first flanged members 18*a* are inserted.

According to the first embodiment, the first centering rollers 510*a*, 510*b* and the second centering rollers 512*a*, 512*b* which center and hold the outer circumferential surface of the photosensitive roll 12 are supported for movement with the movable blocks 534*a*, 534*b* along the guide bars 532*a*, 532*b*. Therefore, even if the photosensitive roll 12 is axially moved, the first centering rollers 510*a*, 510*b* and the second centering rollers 512*a*, 512*b* do not slide against the outer circumferential surface of the photosensitive roll 12, thereby effectively preventing the photosensitive roll 12 from being damaged.

Figure 119:
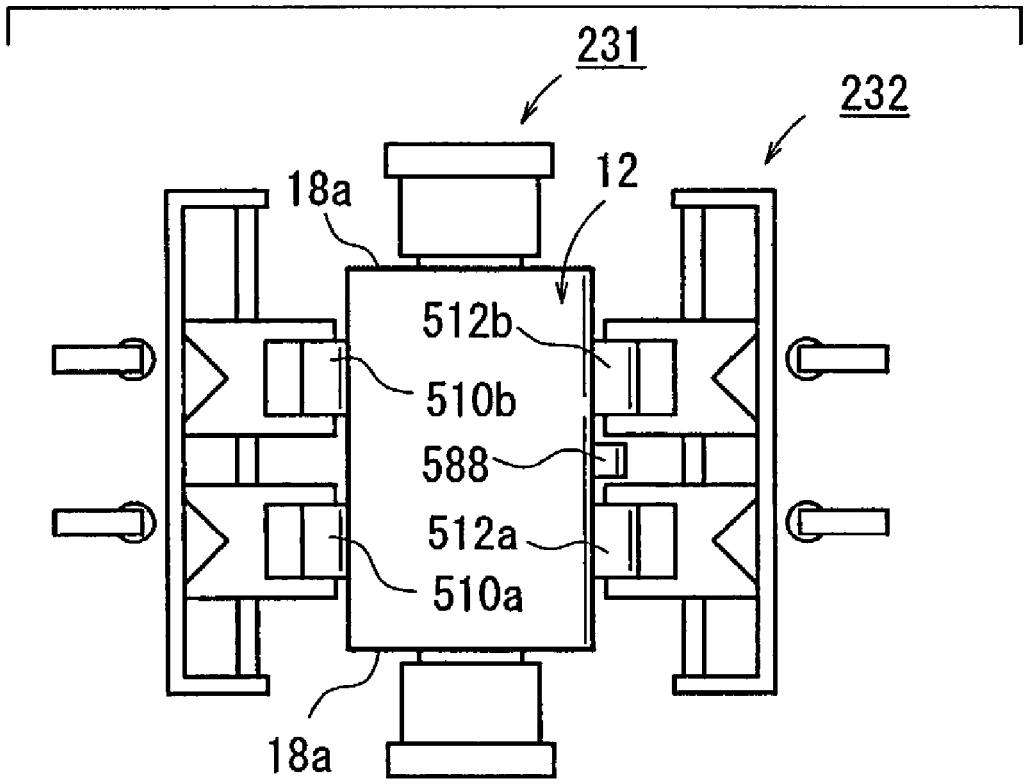
FIG. 119 is a plan view showing the manner in which the end pressing mechanism is actuated after the first flanged members have been inserted in position.
Figure 120:
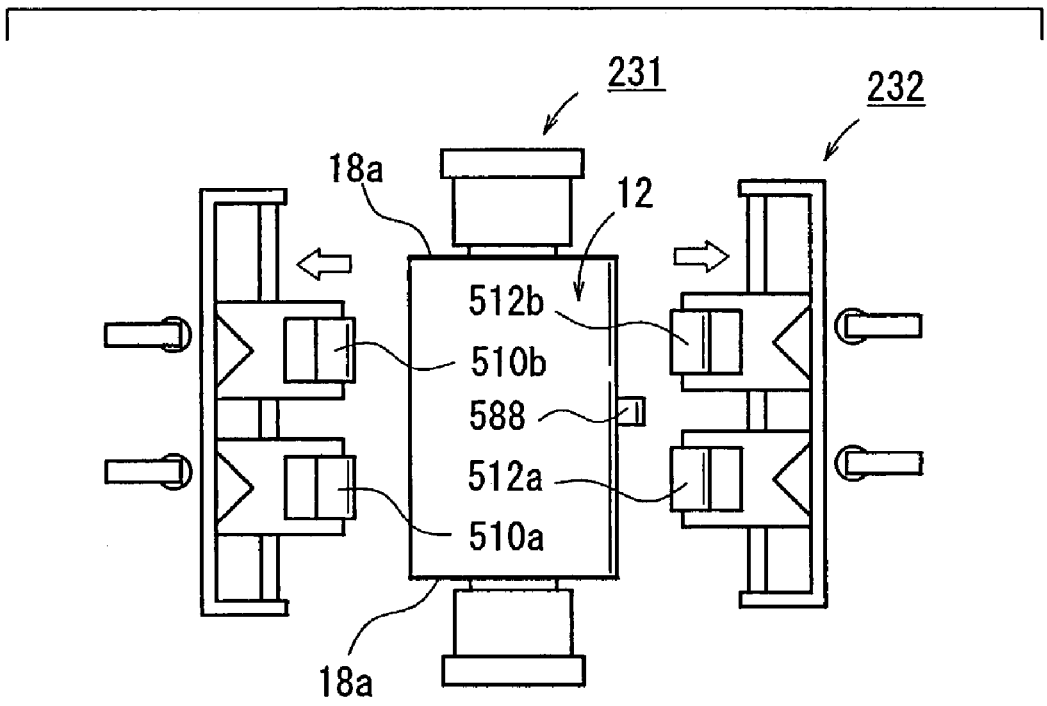

With the first flanged members 18*a* inserted in the respective opposite ends of the photosensitive roll 12 by the inserting mechanism 231, the cylinder 584 of the end pressing mechanism 582 is actuated to lift the pressing roller 588 to hold the end 14*a* of the photosensitive sheet 14 against the outer circumferential surface of the photosensitive roll 12 (see FIG. 119). The cylinder 516 of the actuating means 514 is actuated to displace the first centering rollers 510*a*, 510*b* and the second centering rollers 512*a*, 512*b* away from the outer circumferential surface of the photosensitive roll 12 (see FIG. 120).

Figure 121:
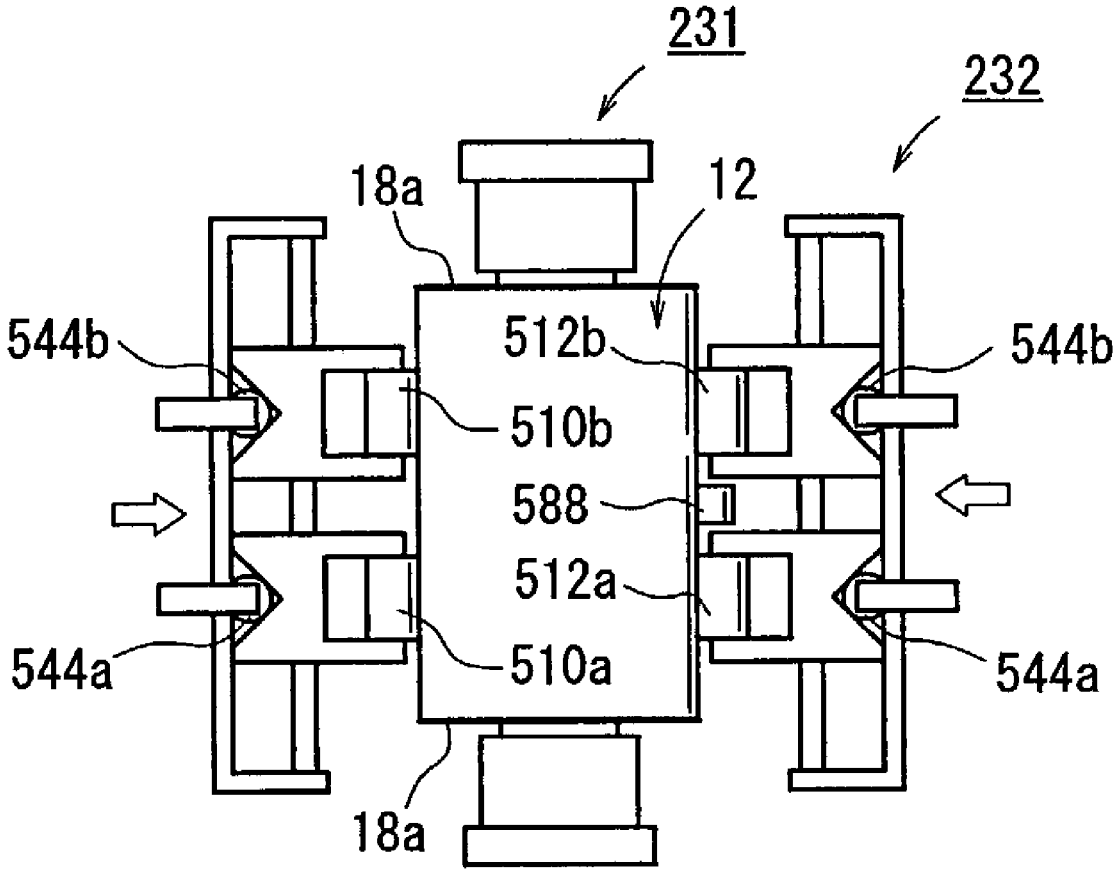
Figure 122:
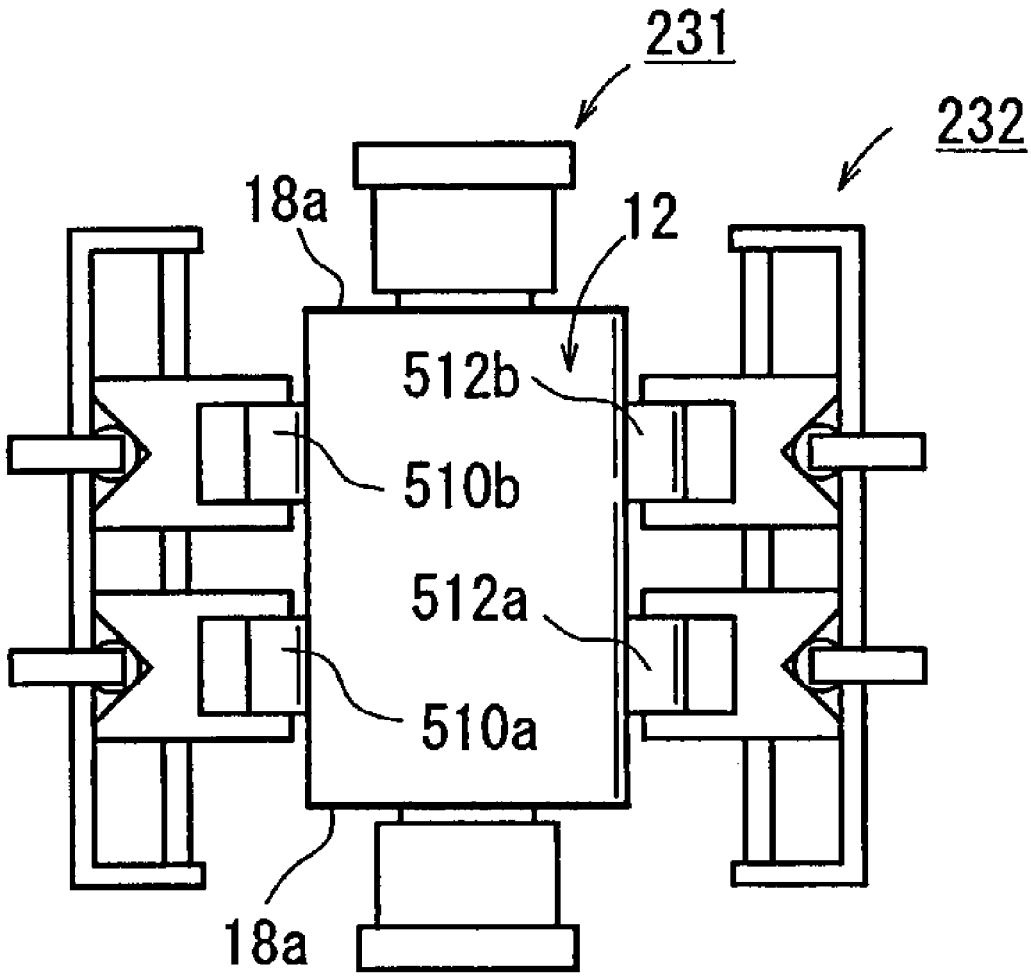
Figure 123:
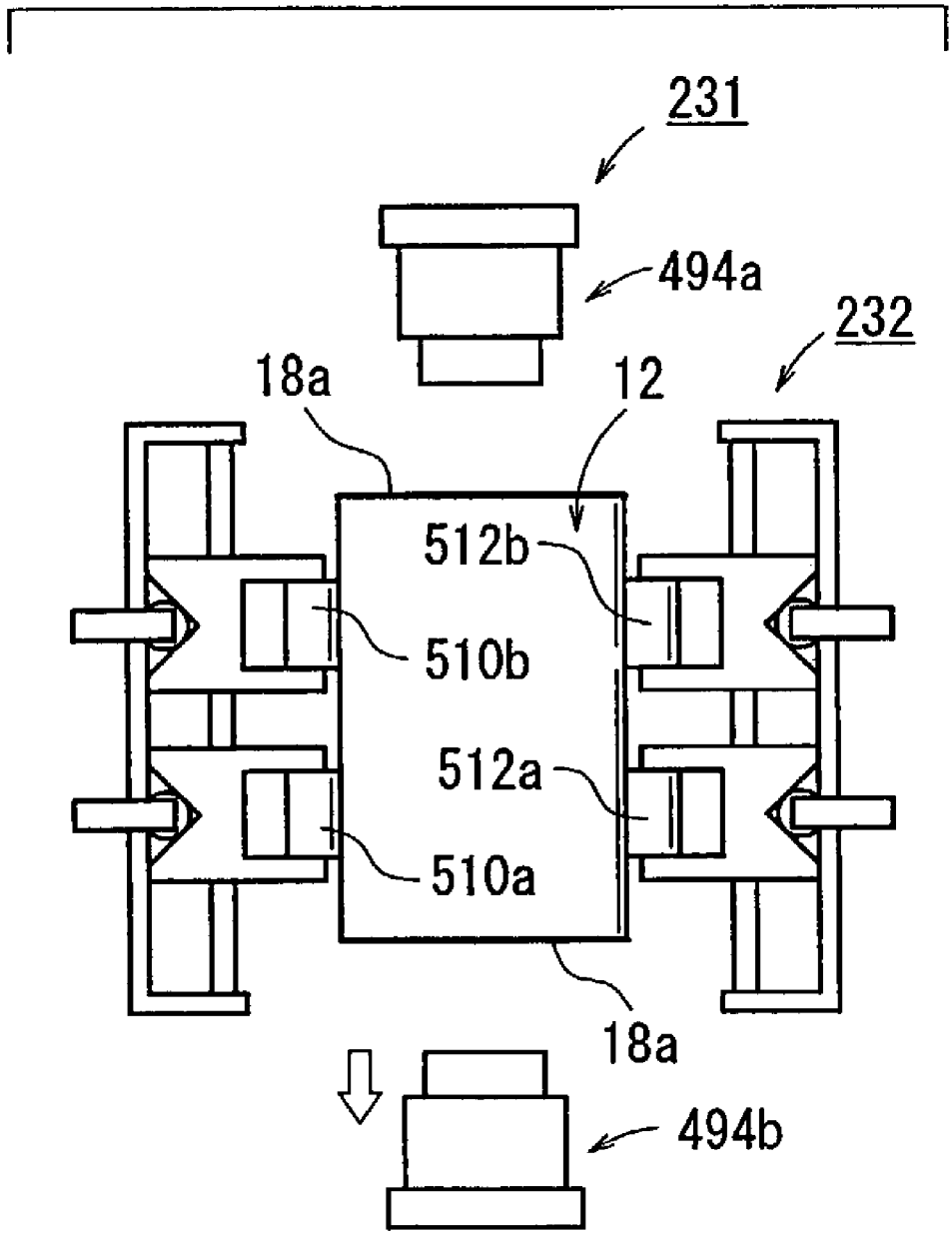

The cylinders 540*a*, 540*b* are actuated to cause the positioning rollers 544*a*, 544*b* to engage in the V-shaped notches 538*a*, 538*b* to position the movable blocks 534*a*, 534*b* in a predetermined position, after which the actuating means 514 is actuated. The first centering rollers 510*a*, 510*b* and the second centering rollers 512*a*, 512*b* are moved toward each other, centering and holding the outer circumferential surface of the photosensitive roll 12 again (see FIG. 121). After the end pressing mechanism 582 is actuated to lower the pressing roller 588 (see FIG. 122), the radially expandable and contractible chucks 498*a*, 498*b* are radially contracted, and the cylinders 490*a*, 490*b* of the inserting mechanism 231 are actuated to move the inserters 494*a*, 494*b* away from the opposite ends of the photosensitive roll 12 (see FIG. 123).

Figure 124:
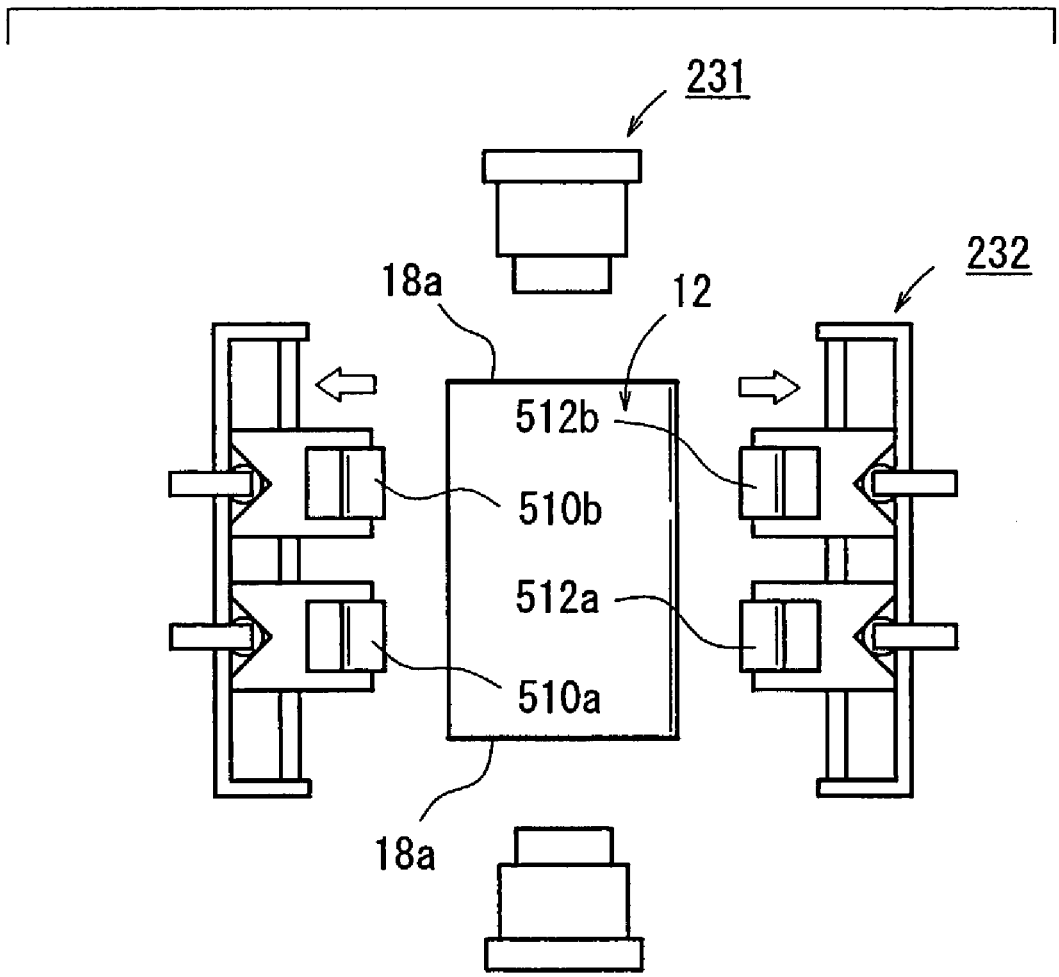

Then, the actuating means 514 is actuated to move the first centering rollers 510*a*, 510*b* and the second centering rollers 512*a*, 512*b* away from the outer circumferential surface of the photosensitive roll 12, which is supported only on the pallet 86 (see FIG. 124). The pallet 86 is now lowered together with the vertically movable plate 578 by the lifting and lowering device 558, and placed on the upper feed conveyors 82*a*, 82*b*, which are moved to deliver the pallet 86 to a next process.

As described above, when the above process of assembling first flanged members 18*a* of caps 40*a* and rings 44*a* and installing them on the opposite ends of a photosensitive roll 12 is successively carried out, all caps 40*a* are removed from the uppermost tray 240*a* in the cap removing region 250 in the first cap supply 234*a*, and the uppermost tray 240*a* is emptied.

As shown in FIGS. 13 and 14, the empty tray 240*a* held by the tray holding means 263 is delivered by the cylinder 265 from the cap removing region 250 to the empty tray stacking region 264, and placed on the lifting and lowering means 252. The empty tray stacking region 264 is supplied with empty trays 240*a* successively from the cap removing region 250, and is lowered one step at a time by the lifting and lowering means 252. After a predetermined number of empty trays 240*a* are stacked in the empty tray stacking region 264, the empty trays 240*a* are delivered to the empty tray unloading region 266 by the belts 248 actuated by the motor 246, and then delivered from the empty tray unloading region 266.

In the first ring supply 236*a*, when all the rings 44*a* stacked around the support post 302 are removed, the turntable 300 is turned to place the support post 302 in a ring supply position, in which a predetermined number of rings 44*a* are set around the support post 302. If the rings 44*a* are used frequently, it is possible to stack a predetermined number of rings 44*a* around each of a pair of support posts 302 on the turntable 300.

According to the first embodiment, first flanged members 18*a*, 18*c*, 18*b* to be installed on the opposite ends of photosensitive rolls 12 may be constructed of 2-inch caps 40*a*, 3-inch caps 40*b*, and rings 44*a*, 44*b*, 44*c*. Depending on the core and outside diameters of photosensitive rolls 12, caps 40*a*, 40*b* and rings 44*a*, 44*b*, 44*c* are selected to assemble first flanged members 18*a*, 18*c*, 18*b*.

It is thus not necessary to manufacture many types, e.g., three types, of first flanged members 18*a* through 18*c* depending on the types of photosensitive rolls 12. While the cost of manufacturing dies and the space of storing dies and the cost of storing dies would be large if the first flanged members 18*a* through 18*c* were injection-molded as single members, the manufacturing and storing costs are effectively reduced according to the first embodiment.

In the first ring supply 236*a*, relatively thin rings 44*a* are stacked around the support post 302. Therefore, rings 44*a* tend to stick to each other and be removed together. According to the first embodiment, the support post 302 has a plurality of ejection ports 304 for ejecting separating air toward the rings 44*a*, and the squeezing member 332 is applied to the surface of the uppermost ring 44*a* attracted by the suction pads 328 of the suction means 308, while at the same time separating air is ejected from the air nozzle 306.

Therefore, even relatively thin rings 44*a* can reliably be removed one at a time by the suction means 308, so that first flanged members 18*a* can efficiently and accurately be manufactured.

Figure 109:
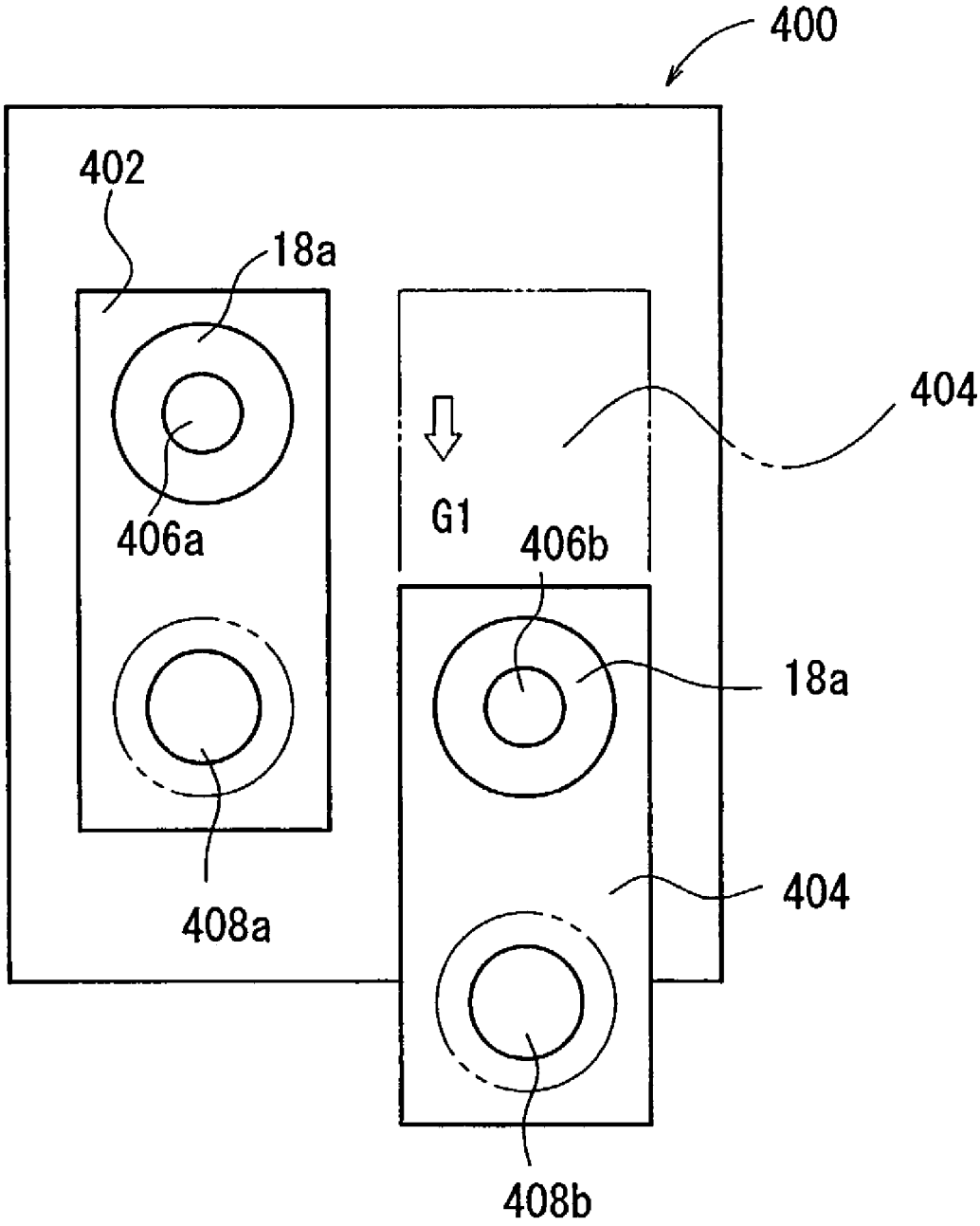
FIG. 109 is a plan view showing the manner in which a movable placement base on the lifter is moved.

The first flanged members 18*a* joined on the first index table 238*a* are successively delivered to the first rests 406*a*, 406*b* of the lifter 400 by the light-shielding member removing means 380. Then, as shown in FIG. 109, the movable placement base 404 is moved in the direction indicated by the arrow G1 to place the two first flanged members 18*a* in diagonally opposite relation to each other, after which the first flanged members 18*a* are gripped by the first and second horizontal feed means 430*a*, 430*b*.

The first and second shutters 410, 412 disposed near the respective lowermost and uppermost positions of the lifter 400 are alternately opened and closed. Therefore, the first flanged members 18*a* can smoothly be delivered, and extraneous light is reliably prevented from entering from the bright chamber 13 in which the flanged member assembling device 226 is positioned into the dark chamber 11 in which the inserting mechanism 231 is positioned.

In the lifter 400, for delivering 3-inch first flanged members 18*b*, the first flanged members 18*b* are successively placed on the second rests 408*a*, 408*b*, and then the movable placement base 404 is moved in the direction opposite to the direction in which it is moved to deliver 2-inch flanged members 18*a*, placing the first flanged members 18*b* in diagonally opposite relation to each other. In the first and second horizontal feed means 430*a*, 430*b*, the their front and rear positions are switched around depending on the positions of the first flanged members 18*b*.

In the first embodiment, when the first flanged members 18*a* are inserted into the opposite ends of the photosensitive roll 12 by the inserting mechanism 231, the outer circumferential surface of the photosensitive roll 12 is centered and held by the centering mechanism 232. Since the photosensitive roll 12 is positioned with respect to its outer circumferential surface, even if the dimensional difference between the inside diameter (core diameter) of the photosensitive roll 12 and the-outside diameter of the first flanged members 18*a* is small, the photosensitive roll 12 and the first flanged members 18*a* can coaxially be aligned with high accuracy.

Even if the outside diameter of the photosensitive roll 12 varies due to variations in the thickness of the photosensitive sheet 14 and the outside diameter of the core 16*a*, it is possible to align the photosensitive roll 12 and the first flanged members 18*a* coaxially with each other to insert the first flanged members 18*a* reliably into the opposite ends of the photosensitive roll 12.

The centering mechanism 232 has the first centering rollers 510*a*, 510*b* and the second centering rollers 512*a*, 512*b* that confront each other across the photosensitive roll 12, and the first centering rollers 510*a*, 510*b* and the second centering rollers 512*a*, 512*b* are displaced toward and away from each other by the actuating means 514.

Therefore, the outer circumferential surface of the photosensitive roll 12 can be positioned highly accurately and reliably with a simple arrangement for thereby installing the first flanged members 18*a* smoothly and efficiently.

In the inserting mechanism 231, the single inserters 494*a*, 494*b* have the radially expandable and contractible chucks 498*a*, 498*b* capable of holding 2-inch first flanged members 18*a*, 18*c* and the radially expandable and contractible chucks 500*a*, 500*b* capable of holding 3-inch first flanged members 18*b*, disposed coaxially with each other, and also have the tapered surfaces 502*a*, 502*b* and 504*a*, 504*b* which are gradually reduced in diameter. The single inserters 494*a*, 494*b* are capable of inserting various first flanged members 18*a* through 18*c* into the opposite ends of the photosensitive roll 12. The inserting mechanism 231 is simplified in structure, and allows the first flanged members 18*a* through 18*c* to be smoothly and reliably installed and removed.

A photosensitive roll 12 with first flanged members 18*a* assembled thereon in the first flanged member inserting station ST2 is fed on a pallet 86 to the end drawing station ST3 by the upper feed conveyors 82*a*, 82*b*. In the end drawing station ST3, as shown in FIGS. 39 and 40, while the pallet 86 is at rest, the cylinder 644 of the pallet lifting and lowering unit 642 is actuated to lift the vertically movable base 648 into engagement with the pallet 86, which is delivered to a position above the upper feed conveyors 82*a*, 82*b*, bringing the photosensitive roll 12 into an end drawing position.

Then, the motor 664 of the drive unit 663 is energized to rotate the drive gear 668 and the ball screw 670 in unison in a given direction. The drive gear 668 rotates the driven gear 672 whose rotation is transmitted through the rotatable shaft 674 to the first gear 676 and then from the second gear 678 meshing with the first gear 676 through the third gear 680 to the second ball screw 682. The first and second ball screws 670, 682 rotate in different directions, causing the first and second nuts 688*a*, 688*b* to move the first and second slide bases 686*a*, 686*b* toward each other.

The first and second chucks 690*a*, 690*b* rotatably supported on the first and second slide bases 686*a*, 686*b* have the openable and closable claws 692*a*, 692*b* inserted into the opposite ends of the photosensitive roll 12. At this time, the openable and closable claws 692*a*, 692*b* are displaced radially outwardly, causing the first and second chucks 690*a*, 690*b* to hold the opposite ends of the photosensitive roll 12.

Then, the actuator 702 of the end drawing mechanism 634 is energized. As shown in FIG. 40, when the motor 708 is energized, the ball screw 710 rotates about its own axis, causing the nut 712 threaded over the ball screw 710 to move the movable base 714 toward the photosensitive roll 12. When the movable base 714 reaches a position where the gripper 700 can grip the end 14*a* of the photosensitive sheet 14, the actuator 702 is de-energized.

Figure 125:
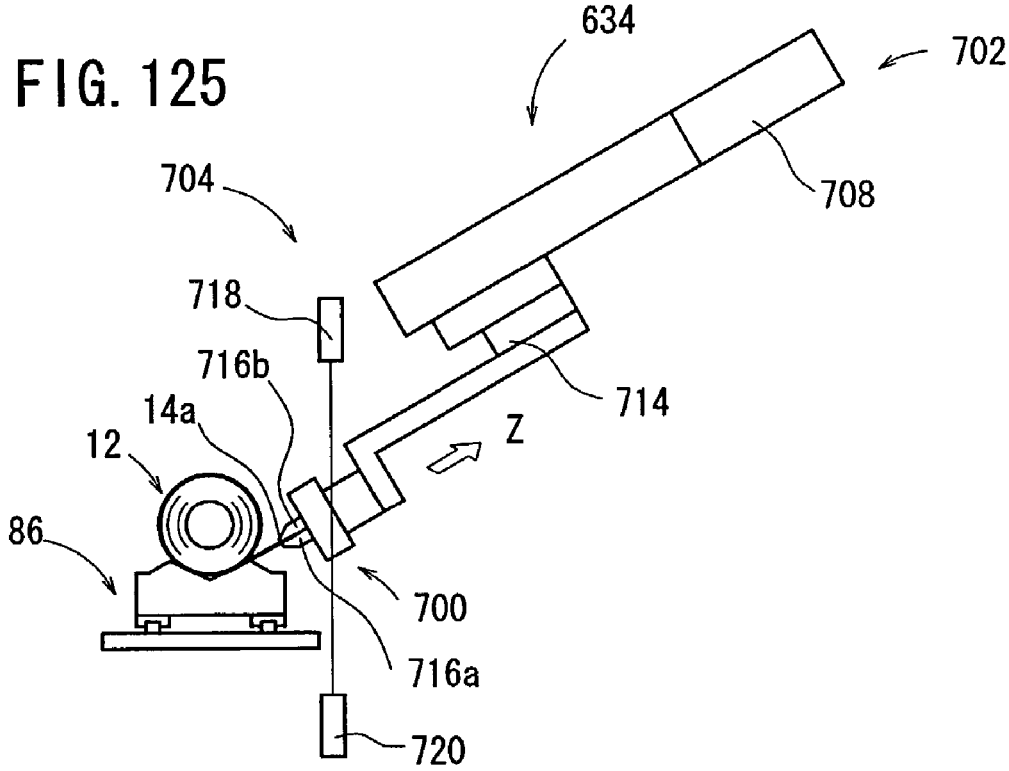

As shown in FIG. 125, the gripping fingers 716*a*, 716*b* of the gripper 700 are closed and grip the end 14*a* of the photosensitive sheet 14. Then, the pallet 86 is lowered a predetermined distance away from the outer circumferential surface of the photosensitive roll 12, and the motor 708 of the actuator 702 is energized in a reversed direction, moving the movable base 714 in the direction indicated by the arrow Z away from the photosensitive roll 12.

Figure 126:
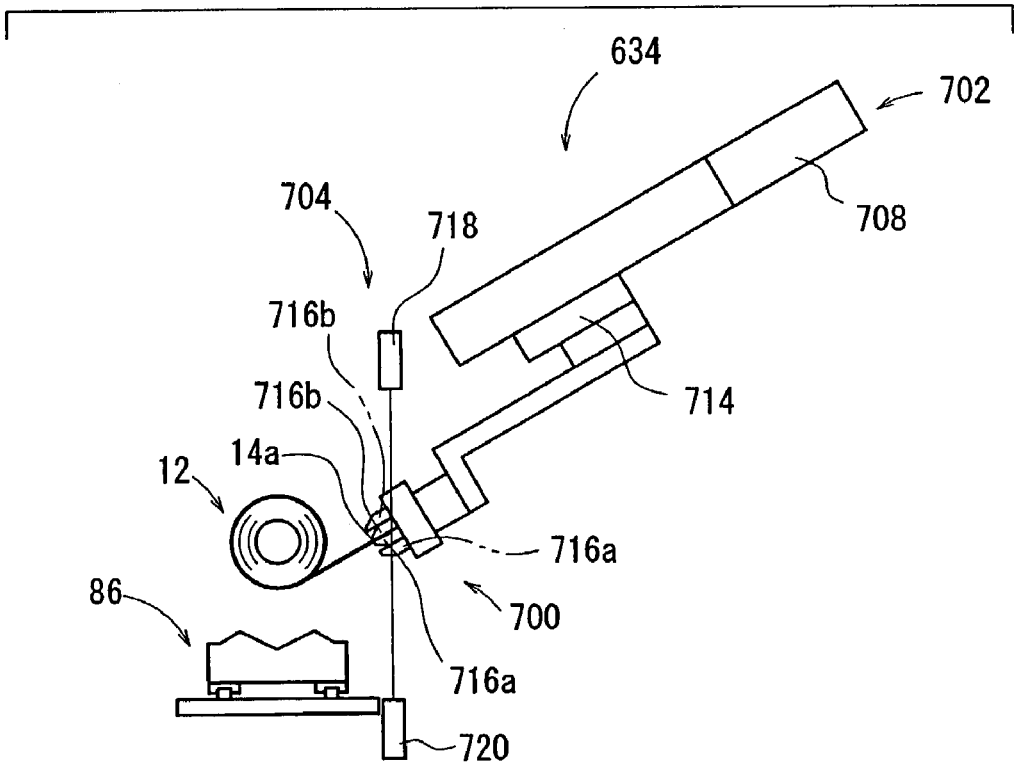

In the detecting assembly 704, an infrared radiation is being emitted from the infrared emitter 718 to the infrared detector 720. When the gripper 700 moves in the direction indicated by the arrow Z and the end 14*a* reaches the path of the infrared radiation, the detecting assembly 704 detects the end 14*a*. In this position, the pallet 86 is lifted a given distance, and the actuator 702 is de-energized, and the gripper 700 is actuated to open the gripping fingers 716*a*, 716*b* to release the end 14*a* (see the two-dot-and-dash lines in FIG. 126).

As described above, in the first embodiment, the end 14*a* of the photosensitive sheet 14 is drawn to a predetermined length by the end drawing mechanism 634 in the end drawing station ST3. Therefore, even if the length of the end 14*a* varies when it is fed in a free state, the length of the end 14*a* can reliably be adjusted to a desired length before a joint tape 20 is applied thereto.

The powder clutch 696 as a tension applying unit is connected to the first chuck 690*a* which supports one end of the photosensitive roll 12 when the end 14*a* of the photosensitive sheet 14 is drawn by the end drawing mechanism 634. Therefore, when the end 14*a* is drawn out, the photosensitive roll 12 is placed under a certain tension, reliably preventing the photosensitive sheet 14 from becoming loose on the outer circumferential surface of the photosensitive roll 12.

After the end 14*a* is drawn out to a given length, the opposite ends of the photosensitive roll 12 are released from the first and second chucks 690*a*, 690*b* of the rotary support mechanism 632, and the motor 644 is reversed. The first and second ball screws 670, 682 rotate in different directions, displacing the first and second slide bases 686*a*, 686*b* away from each other to remove the first and second chucks 690*a*, 690*b* from the opposite ends of the photosensitive roll 12.

The pallet lifting and lowering unit 642 is actuated to lower the pallet 86 with the photosensitive roll 12 placed thereon onto the upper feed conveyors 82*a*, 82*b*. The upper feed conveyors 82*a*, 82*b* are actuated to deliver the pallet 86 from the end drawing station ST3 to the applying station ST4. In the applying station ST4, the pallet 86 is temporarily stopped, and, as shown in FIG. 44, the cylinder 734 of the pallet lifting and lowering unit 730 is actuated. The vertically movable base 738 is lifted to deliver the pallet 86 to a position above the upper feed conveyors 82*a*, 82*b*.

The cylinder 740 of the roller presser 732 is actuated to lower the rollers 744 to press the upper outer circumferential surface of the photosensitive roll 12.

In synchronism with the operation of the pallet lifting and lowering unit 730, the cylinders 752, 760 of the pressing mechanism 636 are actuated. Since the first pressing member 756 is coupled to the cylinder 752 and the second pressing member 764 is coupled to the cylinder 760, the first and second pressers 756, 764 are displaced toward each other, gripping the end 14*a* of the photosensitive sheet 14 on its upper and lower surfaces.

Figure 127:
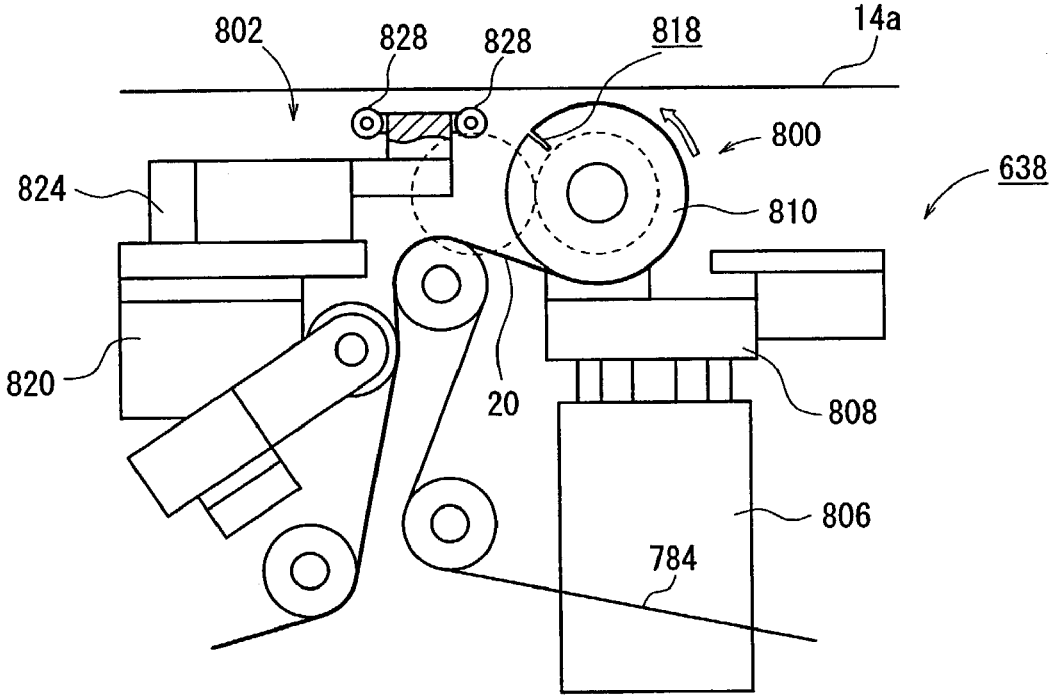

As described above, with the end 14*a* being gripped by the pressing mechanism 636, the applying mechanism 638 is actuated. As shown in FIG. 45, the rotary actuator 814 of the applying means 800 is energized to cause the gear train 816 to rotate the suction roller 810 through a certain angle. The suction roller 810, which is connected to a vacuum source, not shown, draws under vacuum a joint tape 20 against the outer circumferential surface of the suction roller 810. The joint tape 20 is attracted to the outer circumferential surface of the suction roller 810 through a certain angle (see FIG. 127).

The torque motors 790*a*, 790*b* are energized to pay out the separable sheet 784 with joint tapes 20 thereon from the tape payout reel 786, and wind the separable sheet 784 from which joint tapes 20 are removed on the separable sheet takeup reel 788.

Figure 128:
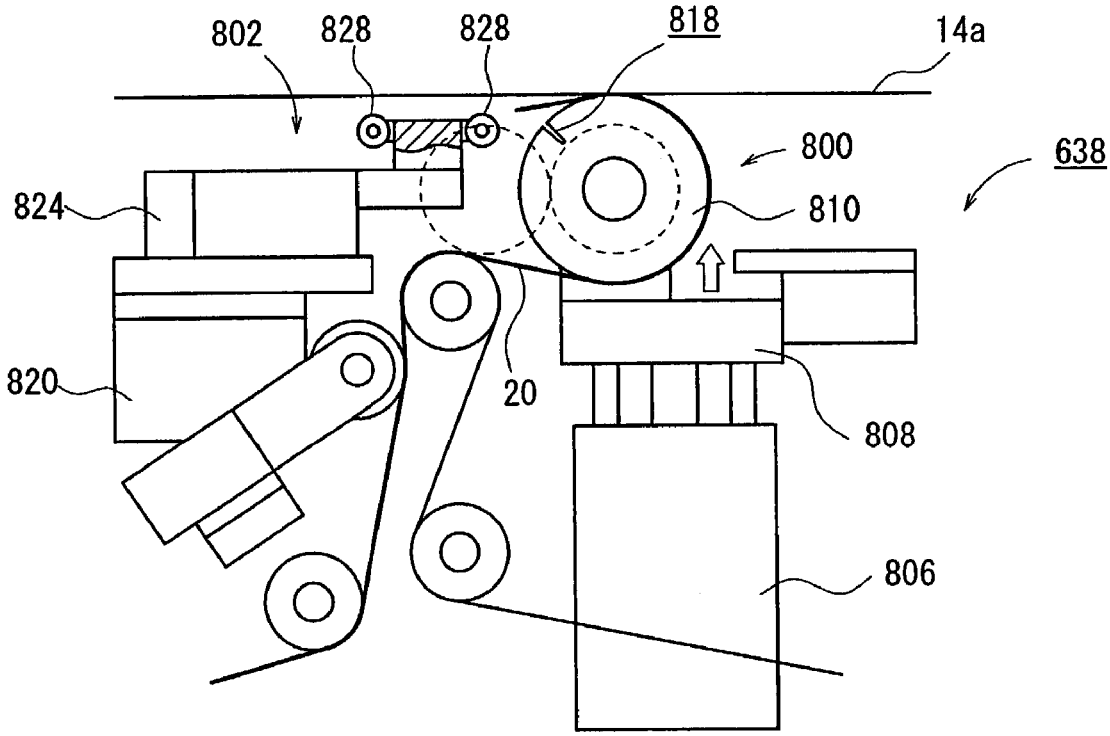
Figure 129:
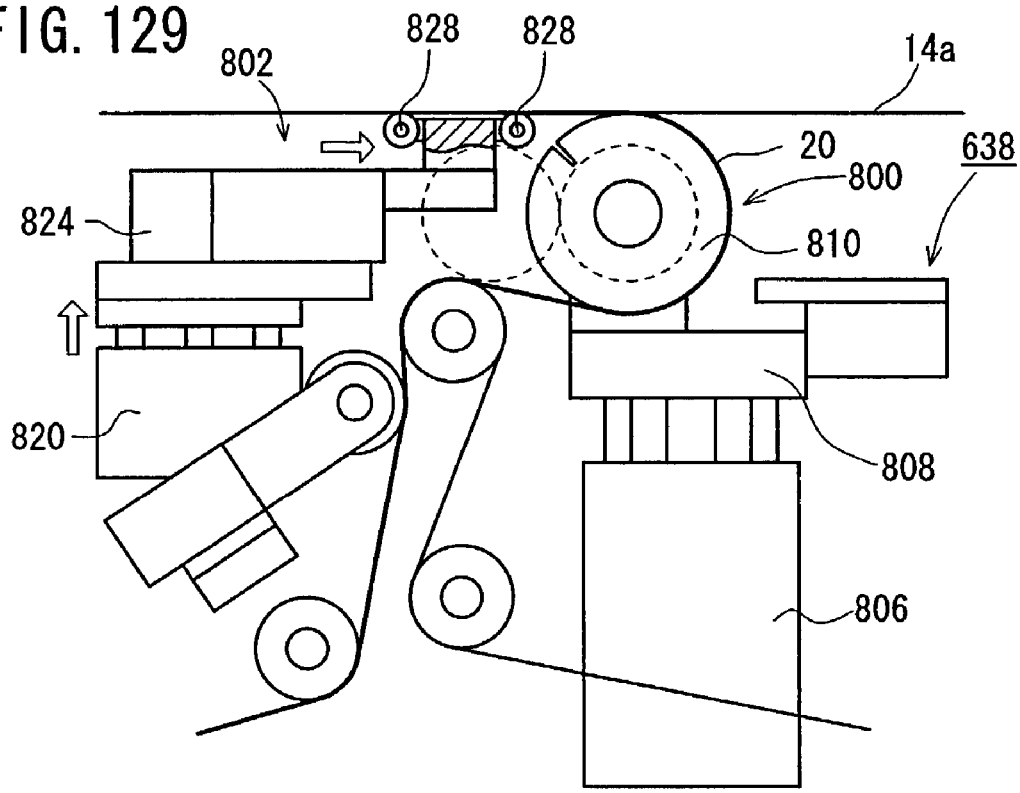

Then, as shown in FIG. 128, the cylinder 806 is actuated to lift the suction roller 810 to press the joint tape 20 attracted to the outer circumferential surface of the suction roller 810 against the end 14*a* of the photosensitive sheet 14, and then the suction roller 810 releases the joint tape 20. The cylinder 824 of the squeezing means 802 is actuated to move the squeezing rollers 828 in unison with the arm 826 toward the suction roller 810, after which the cylinder 820 is actuated to lift the squeezing rollers 828 to press the joint tape 20 against the end 14*a* (see FIG. 129).

Figure 130:
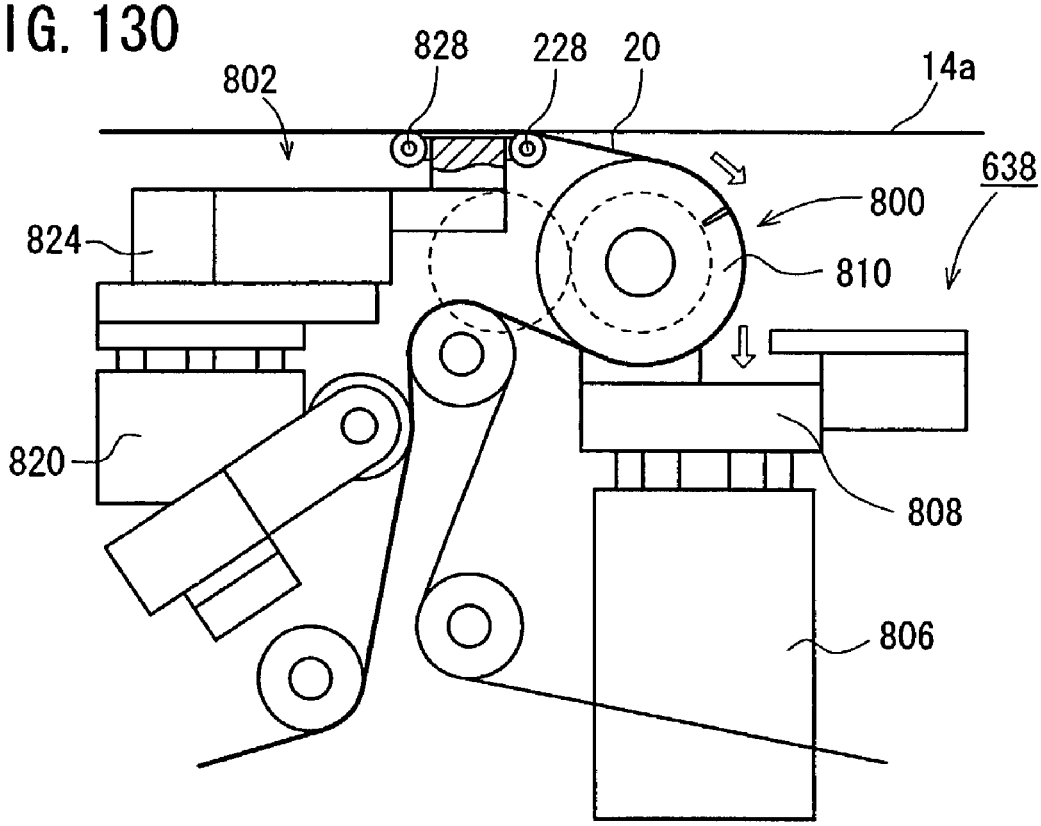

Then, as shown in FIGS. 42 and 43, the motor 772 is energized to rotate the ball screw 776 to move the slide unit 780 along the support member 770 transversely across the photosensitive roll 12 in the direction indicated by the arrow X. When the suction roller 810 runs from one edge to the other of the end 14*a,* the motor 772 is de-energized, and the suction roller 810 is lowered by the cylinder 806 and then rotated by the rotary actuator 814 in the direction indicated by the arrow in FIG. 130.

Figure 131:
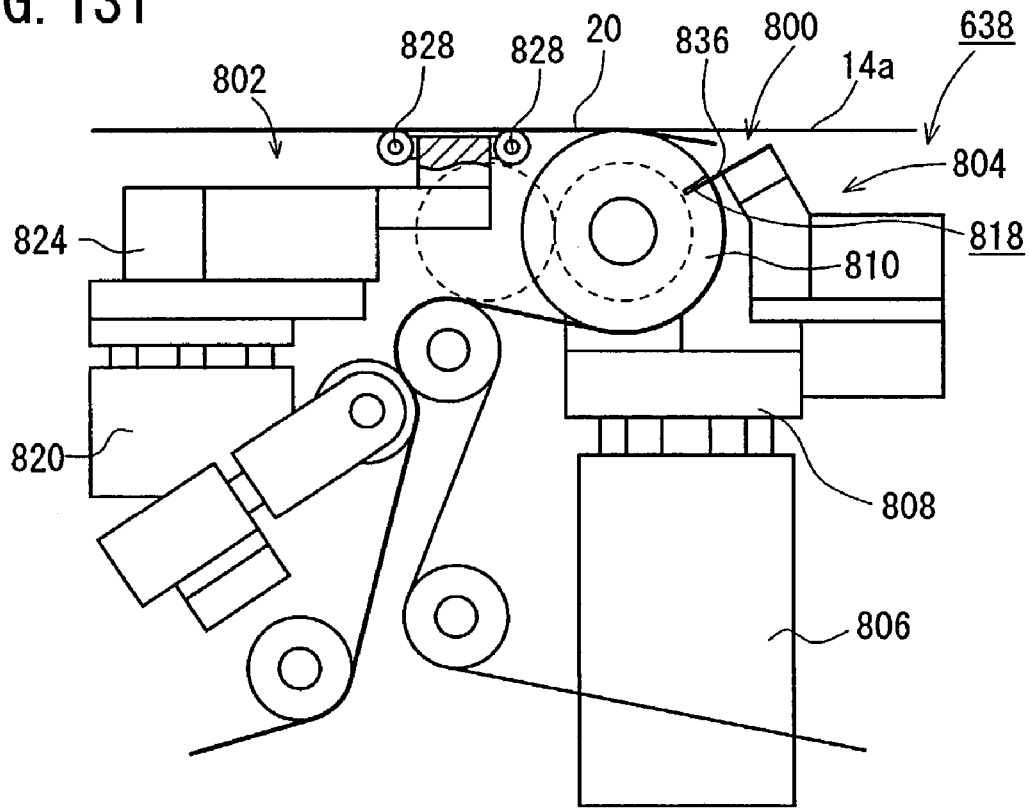

Thereafter, the suction roller 810 starts to draw the joint tape 20, and is lifted by the cylinder 806, after which the cutter 804 is actuated. The cylinder 830 of the cutter 804 is actuated to move the movable plate 834 transversely across the joint tape 20, causing the cutting blade 836 on the movable plate 834 along the cutter guide slot 818 in the suction roller 810 thereby to cut off the joint tape 20 (see FIG. 131). After the cutting blade 836 is returned by the cylinder 830, the suction roller 810 is lowered, and the slide unit 780 is further displaced by the motor 772.

Then, as shown in FIG. 132, the squeezing rollers 828 are lowered by the cylinder 820 and spaced from the suction roller 810 by the cylinder 824. Thereafter, the slide unit 780 is returned to a position to start applying the joint tape 20, by reversing the motor 772. The joint tape 20 is now applied to the reverse side of the end 14*a* over a length which is substantially half the width of the end 14*a*. The cylinders 752, 760 are actuated to displace the first and second pressing members 756, 764 away from each other, releasing the end 14*a* therefrom. The pallet lifting and lowering unit 730 and the roller presser 732 are actuated to transfer the pallet 86 onto the upper feed conveyors 82*a,* 82*b*.

As shown in FIG. 44, the cylinders 842*a,* 842*b* are actuated to lift the feed rollers 844*a,* 844*b* to the same height as the upper feed conveyors 82*a,* 82*b,* so that the pallet 86 can smoothly be transferred over the feed rollers 844*a,* 844*b* onto the upper feed conveyors 82*a,* 82*b*.

In the first embodiment, in the applying station ST4, before the joint tape 20 is applied to the end 14*a* of the photosensitive sheet 14, the opposite surfaces of the end 14*a* are supported by the first and second pressing members 756, 764 of the pressing mechanism 636. Therefore, the end 14*a* can be held reliably in a constant position at all times even if the end 14*a* may be curled or sagging in a different fashion depending on the width of the photosensitive roll 12 and the thickness or type of the photosensitive sheet 14.

Thus, in the first embodiment, the joint tape 20 can accurately and efficiently be applied to the end 14*a* at a desired position by the applying mechanism 638.

In the end drawing station ST3, since the end 14*a* has been drawn in advance to a prescribed length, the joint tape 20 can accurately and efficiently be applied to the end 14*a*. Accordingly, the process of applying the joint tape 20 to the end 14*a* can readily be automatized.

In the rotary support mechanism 632, the first and second chucks 690*a,* 690*b* can be lifted and lowered by the moving unit 652. Therefore, even if the photosensitive roll 12 placed on the pallet 18 has a different diameter, the photosensitive roll 12 can easily be handled by the rotary support mechanism 632. The rotary support mechanism 632 is thus applicable to many types of photosensitive rolls 12 having different widths and diameters, and hence is highly versatile.

After the joint tape 20 is applied to the end 14*a* of the photosensitive sheet 14, the photosensitive roll 12 is fed from the applying station ST4 to the light-shielding leader winding station ST6. In the light-shielding leader assembling station ST5, as shown in FIG. 49, the motor 884 of the skirt member supply unit 862 is energized to cause the belt and pulley means 886 to rotate the payout shaft 882 in the direction indicated by the arrow. Therefore, the strip-like skirt member 864 wound around the payout shaft 882 is paid out through the guide rollers 888 and the dancer roller 890 to the working mechanism 866.

Then, the leading end of the strip-like skirt member 864 is gripped by the gripping means 942. As shown in FIG. 48, the rodless cylinder 930 is actuated to move the movable base 932 toward the joining region P2*a* in the direction indicated by the arrow K1. Then, the lower rodless cylinder 900 of the working mechanism 866 is actuated to move the first movable base 902 in the direction indicated by the arrow K1. Therefore, the punch 918 and the die plate 920 which are supported on the support frame 908 are positioned in a region where the strip-like skirt member 864 is to be blanked (see FIG. 133).

The pressurizing cylinder 910 of the working mechanism 866 is actuated to lower the vertically movable base 914 in unison with the rod 912. The die plate 920 and the punch 918 then produces a diamond-shaped opening 922 and tear-off perforations 924*a,* 924*b* in the strip-like skirt member 864 (see FIG. 50).

Thereafter, the pressurizing cylinder 910 is actuated to lift the punch 918, and the lower rodless cylinder 900 is actuated to move the first movable base 902 in the direction indicated by the arrow K2. The working mechanism 866 is now placed in a given retracted position. The rodless cylinder 980 of the skirt member feeding mechanism 870 is actuated to move the skirt member suction box 984 from the joining region P2*a* to the cutting region P1*a* in the direction indicated by the arrow K2.

When the skirt member suction box 984 is placed below the strip-like skirt member 864 whose leading end is gripped by the gripping means 942 in the cutting region P1*a,* the strip-like skirt member 864 is drawn by the skirt member suction box 984 and attracted against the suction surface (upper surface) of the skirt member suction box 984 under vacuum through suction holes 990. The cylinder 948 of the gripping means 942 is then actuated to move the movable guide 950 upwardly in unison with the rod 956 out of engagement with the strip-like skirt member 864.

After the strip-like skirt member 864 is released from the movable guide 950 and the fixed guide 946, the rodless cylinder 930 is actuated to move the movable base 320 in the direction indicated by the arrow K2 to place the skirt member cutting mechanism 868 in a position to cut off the strip-like skirt member 864. The cylinder 972 of the stopper means 970 is actuated to move the engaging rod 974 upwardly. The engaging rod 974 abuts against the movable base 932 for reliably preventing the movable base 932 from moving.

Then, the cylinder 948 of the gripping means 942 is actuated to cause the fixed guide 946 and the movable guide 950 to grip the cut rear end of the strip-like skirt member 864. The cylinder 960 of the gripping means 944 is actuated to lower the pressing guide 964 to cause the lower pressing surface 968 to press the strip-like skirt member 864 against the skirt member suction box 984. The cylinder 934 of the skirt member cutting mechanism 868 is actuated to move the cutter blade 938 in unison with the rod 936 in the direction indicated by the arrow M1, thus cutting off the strip-like skirt member 864 substantially centrally across the opening 222 along a diagonal line thereof (see FIG. 134).

After the strip-like skirt member 864 is cut off transversely, the cylinder 960 of the holding means 944 is actuated to lift the pressing guide 964 to release the strip-like skirt member 864. The cut-off strip-like skirt member 864 remains attracted to the skirt member suction box 984, and the rodless cylinder 980 is actuated to move the movable base 982 in the direction indicated by the arrow K1. The skirt member suction box 984 which engages the movable base 982 is thus moved from the cutting region P1*a* to the joining region P2*a* while being guided by the guide member 986 (see FIG. 135).

In the light-shielding sheet supply 1080 in the leader feeding station ST14, as shown in FIGS. 31 and 32, the rolled strip-like light-shielding sheet 1082 is loaded as it is supported on the support block 1088 of the carriage 1084. The movable arms 1102*a*, 1102*b* which are spaced from each other are displaced toward each other by the cylinders 1106, 1108. Therefore, the drive shaft 1116 and the driven shaft 1118 on the movable arms 1102*a*, 1102*b* are fitted into the opposite ends of the core 1086 of the rolled strip-like light-shielding sheet 1082.

When the lifting and lowering cylinder 1094 is actuated to move the rod 1096 upwardly, the support plate 1092 is elevated along the vertical surfaces of the walls 1090 by the joint 1098. The rolled strip-like light-shielding sheet 1082 is now lifted off the carriage 1084 by the movable arms 1102*a*, 1102*b* mounted on the support plate 1092, with the opposite ends of the core 1086 being supported by the drive shaft 1116 and the driven shaft 1118. The motor 1110 is energized to cause the chain and sprocket mechanism 1114 connected to the rotatable shaft 1112 to rotate the drive shaft 1116, unwinding the rolled strip-like light-shielding sheet 1082. The unwound strip-like light-shielding sheet 1082 is fed to the joining region P2*a* by the guide rollers 1120.

In the joining region P2*a*, as shown in FIG. 135, the strip-like light-shielding sheet 1082 is attracted to the first and second sheet member suction boxes 1040, 1042 of the sheet member spacing mechanism 874, and the skirt member suction box 984 with the strip-like skirt member 864 attracted thereto is disposed between the first and second sheet member suction boxes 1040, 1042.

Then, as shown in FIG. 56, the lifting and lowering cylinder 1024 of the sheet member holding mechanism 1020 is actuated to lower the vertically movable base 1028 in unison with the rod 1026. The presser plates 1034*a*, 1034*b* mounted on the vertically movable base 1028 by the attachment plates 1032*a*, 1032*b* press and hold the strip-like skirt member 864 against the transversely opposite edges of the skirt member suction box 984 (see FIG. 136).

Then, as shown in FIG. 55, the cylinder 1008 of the cutting mechanism 872 is actuated to lower the cutter blade 1010 to a cutting position. The rodless cylinder 1002 is actuated to move the cutter blade 1010 in unison with the movable base 1004 in the direction indicated by the arrow K1. The cutter blade 1010 is guided by the slit 992 defined in the upper surface of the skirt member suction box 984 to move in the direction indicated by the arrow K1, cutting off the strip-like light-shielding sheet 1082 and the strip-like skirt member 864 together.

When the cutting process performed by the cutting mechanism 872 is finished, the lifting and lowering cylinder 1024 of the sheet member holding mechanism 1020 is actuated to lift the presser plates 1034*a*, 1034*b* in unison with the vertically movable base 1028. Therefore, after the strip-like light-shielding sheet 1082 is released from the presser plates 1034*a*, 1034*b*, the first and second sheet member suction boxes 1040, 1042 are moved away from each other (see FIG. 137). Specifically, as shown in FIG. 57, the first cylinder 1054 of the moving unit 1044 is actuated to move the rod 1054*a* toward the first cylinder 1054, moving the first sheet member suction box 1040 coupled to the rod 1054*a* in the direction indicated by the arrow N2 while being guided by the linear guides 1052*a*, 1052*b*.

The second cylinder 1056 is actuated to move the second sheet member suction box 1042 coupled to the rod 1056*a* in the direction indicated by the arrow N1 while being guided by the linear guides 1052*a*, 1052*b*. The first and second sheet member suction boxes 1040, 1042 are displaced away from each other, moving the cut ends of the strip-like light-shielding sheet 1082, i.e., the light-shielding sheet 26, attracted thereto away from each other (see FIG. 137).

Then, as shown in FIG. 58, the lifting and lowering unit 1064 of the joining mechanism 876 is actuated. The lifting and lowering cylinders 1066, 1068 of the lifting and lowering unit 1064 are operated to lift the first and second heater blocks 1060, 1062 in unison with the vertically movable bases 1070, 1072. The lifting and lowering cylinder 1024 of the sheet member holding mechanism 1020 is actuated to lower the presser plates 1034*a*, 1034*b* in unison with the vertically movable base 1028.

Consequently, as shown in FIG. 138, the cut edges of the light-shielding sheet 26 and the cut strip-like skirt member 864, i.e., the light-shielding shrink films 24, are sandwiched by the first and second heater blocks 1060,1062 and the presser plates 1034*a*, 1034*b*. After elapse of a certain period of time, the light-shielding shrink films 24 are applied to the opposite edges of the light-shielding sheet 26.

In the above joining process, the cutter blade 1010 of the cutting mechanism 872 is placed in an upper position by the cylinder 1008, and thereafter moved in unison with the movable base 1004 in the direction indicated by the arrow K2 into a cutting start position.

In the first embodiment, the cut strip-like skirt member 864 whose width is set to twice the width of the light-shielding shrink films 24 is delivered. After a diamond-shaped opening 922 and tear-off perforations 924*a*, 924*b* are formed in the strip-like skirt member 864 by the working mechanism 866, the strip-like skirt member 864 is cut off transversely by the skirt member cutting mechanism 868. In the joining region P2*a*, the strip-like light-shielding sheet 1082 is superposed on the strip-like skirt member 864, and they are cut off together by the cutting mechanism 872. Then, the cut ends of the strip-like light-shielding sheet 1082 are spaced a distance from each other by the sheet member spacing mechanism 874, after which the transversely split strip-like skirt member 864, i.e., the light-shielding shrink films 24, are applied to the cut ends by the joining mechanism 876.

According to the first embodiment, the amount of scrap produced is much smaller than the conventional process in which light-shielding shrink films 24 are blanked from a sheet, resulting in an increased yield and hence an economical procedure.

Since the strip-like skirt member 864 is cut off to a certain length and then transversely split into light-shielding shrink films 24, it is not necessary to stack light-shielding shrink films 24 unlike the conventional process in which light-shielding shrink films 24 are blanked from a sheet. Accordingly, light-shielding shrink films 24 are prevented from sticking together, and can reliably be applied, one by one, to the end of the light-shielding sheet 26, allowing the light-shielding leader 22 to be assembled efficiently and quickly.

In the joining region P2*a*, the strip-like skirt member 864 cut off to a certain length and the strip-like light-shielding sheet 1082 are superposed one on the other and cut off together by the cutting mechanism 872, after which only the cut ends of the strip-like light-shielding sheet 1082 are spaced a distance from each other. Therefore, the strip-like skirt member 864, i.e., the light-shielding shrink films 24, can be positioned highly accurately and efficiently with respect to the end faces of the cut strip-like light-shielding sheet 1082, i.e., the light-shielding sheet 26, thus producing a high-quality light-shielding leader 22.

The light-shielding shrink films 24 may have a certain orientation (directivity) due to its constituent materials. When the light-shielding leader 22 is pulled to open the light-shielded photosensitive roll 30 as a packaged product, the light-shielding shrink films 24 may be torn apart from the perforations 924*a*, 924*b* in different fashions on left and right portions of the light-shielded photosensitive roll 30. For example, one of the light-shielding shrink films 24 may be torn linearly, whereas the other light-shielding shrink film 24 may be torn in a wavy shape.

Different working devices 4400, 4420, 4440 capable of equalizing the orientations of the light-shielding shrink films 24 applied to the opposite sides of the light-shielding sheet 26 will be described below. Those parts of the working devices 4400, 4420, 4440 which are identical to those of the working device 860 are denoted by identical reference characters, and will not be described below.

As shown in FIG. 139, the working device 4400 has a slitter 4406 for longitudinally slitting the strip-like skirt member 864 delivered from a skirt member supply 4402 into two strip-like skirt members 4404*a*, 4404*b*, and a reversing mechanism 4408 for reversing, i.e., turning upside down, the strip-like skirt member 4404*a*.

The slitter 4406 comprises a disk-shaped lower blade 4410 and a disk-shaped upper blade 4412 which are rotatable about their own axes. The reversing mechanism 4408 has at least two guide bars 4414, 4416 for engaging the strip-like skirt member 4404*a* to forcibly curve or bend the strip-like skirt member 4404*a*.

The working device 4400 thus constructed operates as follows: The strip-like skirt member 864 delivered from the skirt member supply 4402 is longitudinally slit by the lower and upper blades 4410, 4412 as they rotate, producing two strip-like skirt members 4404*a*, 4404*b*. Then, the strip-like skirt member 4404*a* is guided by the guide bars 4414, 4416 and reversed, i.e., turned upside down, thereby and then guided to travel parallel to the strip-like skirt member 4404*b*. Then, the two strip-like skirt members 4404*a*, 4404*b* are blanked together by the working mechanism 866.

Since the strip-like skirt member 4404*a* is reversed, i.e., turned upside down, by the reversing mechanism 4408 and then guided to travel parallel to the strip-like skirt member 4404*b*, the orientations of the strip-like skirt members 4404*a*, 4404*b* are equalized to each other. Consequently, when the packaged product is opened, the strip-like skirt members 4404*a*, 4404*b* are torn in the same fashion. Furthermore, because the two strip-like skirt members 4404*a*, 4404*b* are brought parallel to each other and then blanked together, the strip-like skirt members 4404*a*, 4404*b* are positioned easily and highly accurately with respect to each other.

As shown in FIG. 140, the working device 4420 comprises first and second skirt member supplies 4426, 4428 for delivering two strip-like skirt members 4422, 4424, and a reversing mechanism 4430 for reversing, i.e., turning upside down, the strip-like skirt member 4422 delivered from the first skirt member supply 4426.

The reversing mechanism 4430 comprises a plurality of guide rollers 888. The strip-like skirt members 4422, 4424 are supplied from respective rolls in the first and second skirt member supplies 4426, 4428. When the strip-like skirt members 4422, 4424 are brought parallel to each other, the strip-like skirt member 4422 has its lower surface contiguous to the outer surface of its roll, and the strip-like skirt member 4424 has its upper surface contiguous to the inner surface of its roll.

The surfaces of the strip-like skirt members 4422, 4424 are thus made opposite to each other by the simple arrangement, and their orientations are easily equalized to each other. Since the strip-like skirt members 4422, 4424 are worked on together by the working mechanism 866, the strip-like skirt members 4422, 4424 are positioned with high accuracy.

As shown in FIG. 141, the working device 4440 comprises first and second skirt member supplies 4446, 4448 for delivering two strip-like skirt members 4442, 4444, and a reversing mechanism 4450 for reversing, i.e., turning upside down, the strip-like skirt member 4442 delivered from the first skirt member supply 4446.

The reversing mechanism 4450 is characterized by the direction in which the strip-like skirt member 4442 is paid out and the layout of guide rollers 888. The reversing mechanism 4450 delivers the strip-like skirt member 4442, with its upper surface contiguous to the outer surface of its roll, to the working mechanism 866. The strip-like skirt member 4444 is delivered, with its upper surface contiguous to the inner surface of its roll, to the working mechanism 866.

Therefore, the strip-like skirt members 4442, 4444 are delivered to the working mechanism 866 while being parallel to each other with its surfaces being opposite to each other. The strip-like skirt members 4442, 4444 thus have their orientations equalized to each other, and are positioned highly accurately with respect to each other.

As shown in FIG. 47, the light-shielding shrink films 24 are applied to transversely opposite edges of the light-shielding sheet 26, and the end fastening tapes 28 are applied to the leading end of the light-shielding sheet 26, thus producing the light-shielding leader 22.

As shown in FIGS. 61 and 62, in the end tape supplying and applying mechanism 878, the separable sheet 1178 with an array of end fastening tapes 28 disposed thereon is paid out upon rotation of the tape payout shaft 1182, and only the separable sheet 1178 is wound around the separable sheet takeup shaft 1184 by the guide roller 1186 and the separable sheet bending mechanism 1174. Between the guide rollers 1186, the side edge 1178*a* of the strip-like separable sheet 1178 is bent upwardly by the first and second feed guides 1188, 1190 of the separable sheet bending mechanism 1174.

As shown in FIGS. 63 and 64, therefore, the adhesive-free areas 1180 of the end fastening tapes 28 are exposed out from the side edge 1178*a* of the strip-like separable sheet 1178. When the adhesive-free areas 1180 of the end fastening tapes 28 are detected by the end tape detecting means 1246 (see FIG. 61), the separable sheet payout mechanism 1172 is inactivated, stopping the feeding of the separable sheet 1178.

Then, as shown in FIG. 65, the first and second lifting and lowering cylinders 1222, 1224 are actuated to move the rods 1222*a*, 1222*b* upwardly. The first and second vertically movable bases 1226, 1228 fixed to the rods 1222*a*, 1222*b* are lifted, and the first and second suction heads 1192, 1194 are also lifted in unison with the first and second vertically movable bases 1226, 1228. The suction pads 1238, 1240 mounted on the first and second suction heads 1192, 1194 are brought into abutment against the end fastening tapes 28 applied to the separable sheet 1178, and attract the end fastening tapes 28.

As shown in FIG. 142, the first and second cylinders 1242, 1244 are actuated to displace the rods 1242*a*, 1244*a* vertically downwardly. The first and second pressing members 1196, 1198 fixed to the rods 1242*a*, 1244*a* press the adhesive-free areas 1180 of two end fastening tapes 28 projecting outwardly from the side edge 1178*a* of the separable sheet 1178 against the first and second suction heads 1192, 1194.

The first and second suction heads 1192, 1194 which are swingably supported on the first and second vertically movable bases 1226, 1228 by the pivot shafts 1230, 1232 have their distal ends pushed vertically downwardly by the first and second pressing members 1196, 1198. The first and second suction heads 1192, 1194 are swung downwardly against the resiliency of the springs 1234, 1236, separating the end fastening tapes 28 whose adhesive-free areas 1180 are sandwiched between the first and second suction heads 1192, 1194 and the first and second pressing members 1196, 1198, from the separable sheet 1178. The separated end fastening tapes 28 are then attracted to the first and second suction heads 1192, 1194.

Then, as shown in FIG. 143, the first and second lifting and lowering cylinders 1222, 1224 are actuated to lower the first and second suction heads 1192, 1194 with the end fastening tapes 28 attracted thereto, and the first and second cylinders 1242, 1244 are actuated to lift the first and second pressing members 1196, 1198. The first and second suction heads 1192, 1194 with the end fastening tapes 28 attracted thereto are delivered to a position to apply end tapes to the light-shielding sheet 26.

Specifically, as shown in FIG. 61, the servomotor 1202 of the moving means 1200 is energized to rotate the ball screw 1206 about its own axis to move the movable base 1212 along the guide rails 1210*a*, 1210*b* in the direction indicated by the arrow S. Then, as shown in FIG. 144, the slide member 1220 moves along the guide member 1216 on the movable base 1212 in the direction indicated by the arrow U1, placing the first suction head 1192, for example, in a position below the position to apply end tapes to the light-shielding sheet 26.

Then, the first and second lifting and lowering cylinder 1222 is actuated to lift the first suction head 1192 in unison with the first vertically movable base 1226, pressing the end fastening tapes 28 attracted to the first suction head 1192 against the light-shielding sheet 26. The first suction head 1192 then release the end fastening tapes 28, and is lowered, leaving the fastening tapes 28 applied to the light-shielding sheet 26.

In the first embodiment, the separable sheet 1178 with the end fastening tapes 28 applied thereto is paid out by the separable sheet payout mechanism 1172, and the separable sheet bending mechanism 1174 is operated to forcibly bend the side edge 1178*a* of the separable sheet 1178 upwardly, exposing the adhesive-free areas 1180 of the end fastening tapes 28 out of the side edge 1178*a*.

Then, the first and second lifting and lowering cylinders 1222, 1224 are actuated to lift the first and second suction heads 1192, 1194 to attract the end fastening tapes 28. The first and second cylinders 1242, 1244 are actuated to cause the first and second pressing members 1196, 1198 to press the exposed adhesive-free areas 1180 against the first and second suction heads 1192, 1194, separating the end fastening tapes 28 from the separable sheet 1178.

Since the adhesive-free areas 1180 of the end fastening tapes 28 which are exposed out from the side edge 1178*a* of the strip-like separable sheet 1178 are directly pressed against the first and second suction heads 1192, 1194 by the first and second pressing members 1196, 1198, the end fastening tapes 28 can reliably be removed from the separable sheet 1178. Therefore, the end fastening tapes 28 can reliably be attracted, one by one, to the first and second suction heads 1192, 1194, and can reliably and efficiently be supplied to the leading end of the light-shielding sheet 26.

The adhesive-free areas 1180 of the end fastening tapes 28 which are exposed out from the side edge 1178*a* of the strip-like separable sheet 1178 whose side edge 1178*a* is bent by the separable sheet bending mechanism 1174 are automatically detected by the end tape detecting means 1246. Therefore, the end fastening tapes 28 can reliably be held on the first and second suction heads 1192, 1194, and hence can efficiently be supplied without fail.

The separable sheet bending mechanism 1174 has the first and second feed guides 1188, 1190 disposed one on each side of the separable sheet 1178. Consequently, the separable sheet 1178 can reliably be bent with the simple arrangement. The end fastening tapes 28 can efficiently be removed by exposing the adhesive-free areas 1180 of the end fastening tapes 28.

The end tape removing mechanism 1176 has the first and second suction heads 1192, 1194 and the first and second pressing members 1196, 1198 which can be positioned in confronting relation to each other across the separable sheet 1178. When the first and second suction heads 1192, 1194 and the first and second pressing members 1196, 1198 sandwich the adhesive-free areas 1180 of the end fastening tapes 28 and also when the first and second suction heads 1192, 1194 attract the end fastening tapes 28, the end fastening tapes 28 can reliably and quickly be separated from the separable sheet 1178. The end fastening tapes 28 can thus be easily supplied at a high speed.

The light-shielding leader 22 with the light-shielding shrink films 24 applied to the opposite side edges of the light-shielding sheet 26 is fed to the light-shielding leader winding station ST6 by the light-shielding leader feed mechanism 1302.

Specifically, the first feed unit 1336 will be described below. As shown in FIGS. 67 and 68, the motor 1344 is energized to rotate the first ball screw 1340 about its own axis, causing the nut 1352 threaded over the first ball screw 1340 to move the first feed unit 1336 along the rails 1334*a*, 1334*b* in the direction indicated by the arrow N2. When the clamp means 1360*a*, 1360*b* of the first feed unit 1336 are positioned at the light-shielding leader 22 applied in the joining region P2*a*, the cylinders 1368*a*, 1368*b* are actuated to turn the swing fingers 1364*a*, 1364*b* about the pivot shafts 1366*a*, 1366*b* to lift their distal ends.

Therefore, when the first feed unit 1336 is moved to the light-shielding sheet 26 of the light-shielding leader 22, the opposite edges of the light-shielding sheet 26 are inserted between the fixed fingers 1362*a*, 1362*b* and the swing fingers 1364*a*, 1364*b* (see the two-dot-and-dash lines in FIG. 69). Then, the cylinders 1368*a*, 1368*b* are actuated to close the tip ends of the swing fingers 1364*a*, 1364*b* to cause the swing fingers 1364*a*, 1364*b* and the fixed fingers 1362*a*, 1362*b* to-grip the opposite edges of the light-shielding sheet 26.

The motor 1344 is energized to rotate the first ball screw 1340 in the opposite direction, causing the nut 1352 to move the first feed unit 1336 in the direction indicated by the arrow N1. The light-shielding leader 22 gripped by the first clamp means 1360*a*, 1360*b* is fed in the direction indicated by the arrow N1 to the light-shielding leader winding station ST6 (see FIG. 145).

In the light-shielding leader winding station ST6, the cylinders 1422, 1424 are actuated to lower the light-shielding leader pressers 1418, 1420 to press the opposite ends of the light-shielding leader 22 in the direction indicated by the arrow W against the support surface of the base 1380 (see FIG. 146). The rodless cylinder 1430 of the light-shielding leader holding mechanism 1308 is actuated to cause the movable base 1432 to move the air chucks 1436, 1438 in the direction indicated by the arrow V1.

The air chucks 1436, 1438 grip the winding terminal end of the light-shielding leader 22, and the clamp means 1360*a*, 1360*b* of the light-shielding leader feed mechanism 1302 release the edge of the light-shielding leader 22 in the direction indicated by the arrow N1. The clamp means 1360*a*, 1360*b* are lifted by the vertically movable tables 1358*a*, 1358*b*, and then moved in the direction indicated by the arrow N2 to the joining region P2*a* by the motor 1344.

In the winding position P3*a*, the light-shielding leader 22 is fed as described above, and the pallet lifting and lowering device 1440 is actuated. The cylinder 1442 is actuated to cause the vertically movable base 1444 to lift the pallet 86. When the photosensitive roll 12 is placed in the winding position by the pallet 86, the applying mechanism 1304 and the rotating mechanism 1306 are actuated.

In the applying mechanism 1304, as shown in FIGS. 70 and 71, the first cylinder 1392 of the actuator 1382 is actuated to move the movable base 1394 in the direction indicated by the arrow V1. The cam rollers 1406 mounted on the opposite ends of the cam plate 1404 engage the cam surfaces 1400 in the lower surfaces of the arms 1398. The arms 1398 are now turned vertically upwardly by the cam surfaces 1400 and the cam rollers 1406.

The movable base plate 1384 fixed to the arms 1398 projects upwardly from the lower surface of the base 1380 and is positioned between the end of the base 1380 and the photosensitive roll 12 (see FIG. 147). The end 14*a* of the photosensitive sheet 14 and the joint tape 20 are placed on the movable base plate 1384.

The lifting and lowering cylinder 1386 is actuated to lower the attachment plate 1408 in unison with the rod 1386*a*. The first presser member 1388 presses the end 14*a* of the photosensitive sheet 14 against the movable base plate 1384, and then the cylinder 1414 is actuated to enable the second presser member 1390 to apply the joint tape 20 to the end of the light-shielding leader 22 (see FIG. 148).

The end 14*a* of the photosensitive sheet 14 and the light-shielding leader 22 are now joined to each other by the joint tape 20. The lifting and lowering cylinder 1386 is actuated to move the first and second presser members 1388, 1390 upwardly, and the cylinders 1422, 1424 are actuated to lift the light-shielding leader pressers 1418, 1420, releasing the light-shielding leader 22 (see FIG. 149).

In the rotating mechanism 1306, as shown in FIG. 73, the motor 1464 of the actuator 1463 is energized to rotate the drive gear 1468 and the ball screw 1470 in unison in a given direction. The rotation of the driven gear 1472 meshing with the drive gear 1468 is transmitted through the rotatable shaft 1474 to the first gear 1476, and then from the second gear 1478 meshing with the first gear 1476 through the third gear 1480 to the second ball screw 1482, rotating the second ball screw 1482 about its own axis. Therefore, the first and second ball screws 1470, 1482 rotate in different directions, respectively, causing the nuts 1488*a*, 1488*b* to move the first and second slide units 1486*a*, 1486*b* toward each other.

The first and second chucks 1490*a*, 1490*b* supported on the first and second slide units 1486*a*, 1486*b* are inserted respectively into the opposite ends of the photosensitive roll 12. The opposite ends of the photosensitive roll 12 are held by the first and second chucks 1490*a*, 1490*b*, respectively, and the pallet 86 is lowered a given distance away from the outer circumferential surface of the photosensitive roll 12.

After the photosensitive roll 12 is held by only the first and second chucks 1490*a*, 1490*b*, the motor 1492 is energized to rotate the splined shaft 1493, rotating the first and second chucks 1490*a*, 1490*b* which are operatively coupled to the splined shaft 1493 by the belt and pulley means 1494*a*, 1494*b*.

In synchronism with the rotation of the first and second chucks 1490*a*, 1490*b*, the rodless cylinder 1430 of the light-shielding leader holding mechanism 1308 is actuated. Therefore, the rotation of the first and second chucks 1490*a*, 1490*b* rotates the photosensitive roll 12 to wind the light-shielding leader 22 around the photosensitive roll 12. While the winding terminal end of the light-shielding leader 22 is being gripped by the air chucks 1436, 1438 of the light-shielding leader holding mechanism 1308, the air chucks 1436, 1438 move in the direction indicated by the arrow V1 (see FIG. 150).

When the air chucks 1436, 1438 move nearly to an end of its stroke in the direction indicated by the arrow V1, the rollers 1500*a* through 1500*c* are pressed against the outer circumferential surface of the photosensitive roll 12 by the actuators 1502*a*, 1502*b*. As shown in FIG. 76, the rollers 1500*a*, 1500*b* are caused to project forward by the cylinders 1502*a*, 1502*b*. The roller 1500*c* is moved vertically downwardly by the first cylinder 1506 of the actuator 1504, and thereafter is caused to project forward by the second cylinder 1510. The rollers 1500*a* through 1500*c* now press the light-shielding leader 22 wound around the photosensitive roll 12.

Before the process of winding the light-shielding leader 22 is finished, the air chucks 1436, 1438 of the light-shielding leader holding mechanism 1308 release the light-shielding leader 22. The air chucks 1436, 1438 are then retracted in the direction indicated by the arrow V2 by the rodless cylinder 1430.

When the light-shielding leader 22 is wound around the photosensitive roll 12 as described above, the hot air blowers 1496*a*, 1496*b* mounted on the first and second slide units 1486*a*, 1486*b* are positioned in confronting relation to the opposite ends of the photosensitive roll 12 by the cylinders 1498*a*, 1498*b*. The hot air blowers 1496*a*, 1496*b* then apply hot air to the photosensitive roll 12, thermally shrinking the light-shielding shrink films 24 of the light-shielding leader 22 over the outer circumferential edges of the first flanged members 18*a* (see FIG. 151).

When the light-shielding leader 22 is wound around the photosensitive roll 12 and the terminal end of the light-shielding leader 22 is fixed in position by the end fastening tapes 28, the process of winding the light-shielding leader 22 is finished. Then, the pallet lifting and lowering device 1440 is actuated to lift the vertically movable base 1444 to hold the pallet 86, and the motor 1464 of the rotating mechanism 1306 is energized. The first and second slide units 1486*a*, 1486*b* are moved away from each other, releasing the first and second chucks 1490*a*, 1490*b* from the opposite ends of the photosensitive roll 12 (see FIG. 152). The pallet 86 is lowered onto the upper feed conveyors 82*a*, 82*b*, and thereafter fed to the thermally fusing station ST7.

In the joining region P2*a*, the light-shielding shrink films 24 are applied to the opposite sides of the light-shielding sheet 26, and the end fastening tapes 28 are applied to the leading end of the light-shielding sheet 26, thus producing the light-shielding leader 22. Thereafter, the light-shielding leader 22 is griped by the clamp means 1360*a*, 1360*b* of the light-shielding leader feed mechanism 1302, and fed to the winding position P3*a* in the direction indicated by the arrow N1.

Since the light-shielding leader 22 is gripped by the clamp means 1360*a*, 1360*b*, the light-shielding leader 22 is prevented from being positioned in error unlike the conventional process in which the light-shielding leader 22 is fed to the winding position P3*a* by suction belts or suction pads. Accordingly, the light-shielding leader 22 can be positioned accurately, and the accuracy with which the light-shielding leader 22 is applied to the end 14*a* of the photosensitive sheet 14 is maintained at a desired level.

In the first embodiment, the winding terminal end of the light-shielding leader 22 which is positioned in the winding position P3*a* by the light-shielding leader feed mechanism 1302 is gripped by the air chucks 1436, 1438 of the light-shielding leader holding mechanism 1308. The air chucks 1436, 1438 grip a substantially central area of the light-shielding leader 22 in the transverse direction thereof indicated by the arrow N. When the rotating mechanism 1306 rotates the photosensitive roll 12 to wind the light-shielding leader 22 around the photosensitive roll 12, the air chucks 1436, 1348 grips the winding terminal end of the light-shielding leader 22 and is moved in the direction indicated by the arrow V1 by the rodless cylinder 1416.

When the light-shielding leader 22 is wound around the photosensitive roll 12, the light-shielding leader 22 is reliably prevented from being warped and also from being shifted out of position in its turn. Therefore, the light-shielded photosensitive roll 30 of high quality can be produced with a simple process and arrangement.

In the first embodiment, the system has the rollers 1500*a* through 1500*c* which press and hold the light-shielding leader 22 before the air chucks 1436, 1438 of the light-shielding leader holding mechanism 1308 release the light-shielding leader 22. Therefore, even after the air chucks 1436, 1438 are released from the light-shielding leader 22, the outer circumferential surface of the light-shielding leader 22 is reliably held in position, allowing the light-shielding leader 22 to be wound highly reliably and accurately.

The photosensitive roll 12 with the light-shielding leader 22 wound therearound is fed to the thermally fusing station ST7 by the pallet 86. In the thermally fusing station ST7, as shown in FIG. 78, the servomotor 206 of the lifting and lowering device 2062 is energized to cause the belt and pulley means 2070 to rotate the ball screw 2072 threaded through the nut 2074. The vertically movable base 2076 with the nut 2074 fixed thereto is moved vertically upwardly by the rotation of the ball screw 2072.

The vertically movable plate 2082 is coupled to the vertically movable base 2076 by the guide bars 2078. The vertically movable plate 2082 is lifted in unison with the vertically movable base 2076, and feeds the pallet 86 vertically upwardly to a position above the upper feed conveyors 82*a*, 82*b*. When the photosensitive roll 12 on the pallet 86 reaches a given thermally fusing position, the servomotor 2066 is de-energized.

In the thermally fusing mechanism 2060, as shown in FIG. 82, the cylinder 2130 of the moving mechanism 2129 is operated to place the first heating head 2144, for example, among the first through third heating heads 2144, 2146, 2148, depending on the outside diameter of the photosensitive roll 12, in the thermally fusing position.

Specifically, the cylinder 2130 is actuated to pull in the rod 2132, moving the slide plate 2126 engaging the rod 2132 toward the engaging screw 2142*b* while being guided by the guide rails 2128*a*, 2128*b*. When the end of the slide plate 2126 abuts against and is supported by the engaging screw 2142*b*, the first heating head 2144 is positioned in the thermally fusing position (see FIG. 153).

As shown in FIG. 80, the servomotor 2092 is energized to rotate the drive gear 2096 and the first ball screw 2098 in unison with each other in a given direction. The driven gear 2100 meshing with the drive gear 2096 is rotated, causing the rotatable shaft 2102 to rotate the first gear 2104 and the second gear 2106 meshing therewith, thus rotating the third gear 2108. The second ball screw 2110 coupled to the third gear 2108 is rotated. The first and second ball screws 2098, 2110 are now rotated in different directions.

The first and second bases 2114*a*, 2114*b* are moved toward each other by the first and second nuts 2116*a*, 2116*b*. The first heating heads 2144 mounted on the first and second movable support bases 2122*a*, 2122*b* supported on the first and second bases 2114*a*, 2114*b* are moved to given positions near the opposite ends of the photosensitive roll 12, after which the servomotor 2092 is de-energized.

When the cylinders 2118*a*, 2118*b* of the pressing mechanism 2117 are actuated, the first and second movable support bases 2122*a*, 2122*b* coupled to the rods 2120*a*, 2120*b* are moved toward the opposite ends of the photosensitive roll 12 while being guided by the linear guides 2124*a*, 2124*b*. The second annular protrusions 2150*b*, for example, of the first heating heads 2144 mounted on the slide plates 2126*a*, 2126*b* press given areas of the outer circumferential edges of the opposite ends of the photosensitive roll 12, i.e., the light-shielding shrink films 24.

After the light-shielding shrink films 24 have been heated by the second annular protrusions 2150*b*, the cylinders 2118*a*, 2118*b* are actuated to move the slide plates 2126*a*, 2126*b* away from each other. The second annular protrusions 2150*b* of the first heating heads 2144 are released from the opposite ends of the photosensitive roll 12, whereupon the process of thermally fusing the light-shielding shrink films 24 and the first flanged members 18*a* is finished.

Then, the servomotor 2066 of the lifting and lowering device 2062 is reversed to rotate the ball screw 2072, lowering the vertically movable plate 2082 with the pallet 86 placed thereon. The pallet 86 is now transferred onto the upper feed conveyors 82*a*, 82*b*, and then fed to the inspecting station ST9 by the upper feed conveyors 82*a*, 82*b*.

In the first embodiment, the first and second annular protrusions 2150*a*, 2150*b* are coaxially disposed on the first heating head 2144, and the outer second annular protrusion 2150*b* projects outwardly beyond the inner first annular protrusion 2150*a* (see FIG. 83). Therefore, when the light-shielding shrink films 24 are thermally fused to the outer circumferential edges of the opposite ends of the photosensitive roll 12 by the second annular protrusions 2150*b*, the first annular protrusions 2150*a* do not contact the opposite ends of the photosensitive roll 12.

Since only the second annular protrusions 2150*b* contact the outer circumferential edges of the opposite ends of the photosensitive roll 12, the light-shielding shrink films 24 are effectively thermally fused to the first flanged members 18*a*. The second annular protrusions 2150*b* are of such a dimension corresponding to the outside diameter of the photosensitive roll 12 and can be pressed against the light-shielding shrink films 24 under a constant pressure. Thus, only the light-shielding shrink films 24 can effectively thermally fused to the first flanged members 18*a*, reliably shielding the photosensitive roll 12 against light.

It is only necessary to press the second annular protrusions 2150*b* contact the outer circumferential edges of the opposite ends of the photosensitive roll 12, and it is not necessary to rotate the photosensitive roll 12. As the conventional rotating mechanism for rotating the photosensitive roll 12 is not needed, the packaging sheet bonding device 2060 is relatively simple in overall structure, small in size, and economical to manufacture.

The first heating head 2144 has the first and second annular protrusions 2150*a*, 2150*b* for handling two types of photosensitive rolls 12 having different outside diameters. Therefore, the first heating head 2144 alone is capable of thermally fusing two types of photosensitive rolls 12 having different outside diameters, so that the packaging sheet bonding device 2060 is further made relatively simple in overall structure.

In the first embodiment, the first through third heating heads 2144, 2146, 2148 are mounted on each of the slide plates 2126*a*, 2126*b*, and have the first annular protrusions 2150*a*, 2152*a*, 2154*a* and the second annular protrusions 2150*b*, 2152*b*, 2154*b* which have different diameters. Therefore, the first through third heating heads 2144, 2146, 2148 can handle six types of photosensitive rolls 12 having different outside diameters, making the packaging sheet bonding device 2060 versatile and economical.

For positioning the second heating head 2146 in the thermally fusing position, the cylinder 2136 of the stopper means 2134 is actuated to project the engaging member 2140 forward, and the cylinder 2130 of the moving mechanism 2129 is actuated. Since the slide plates 2126*a*, 2126*b* are coupled to the rod 2132 extending from the cylinder 2130, the end faces of the slide plates 2126*a*, 2126*b* near the first heating heads 2144 abut against and are supported by the engaging member 2140, thus positioning the second heating head 2146 in the thermally fusing position (see FIG. 154).

For positioning the third heating head 2148 in the thermally fusing position, the stopper means 2134 is actuated to retract the engaging member 2140, and the cylinder 2130 is actuated. The end faces of the slide plates 2126*a*, 2126*b* near the first heating heads 2144 abut against and are supported by the engaging screw 2142*a*, thus positioning the third heating head 2148 in the thermally fusing position (see FIG. 155).

In the first embodiment, the first through third heating heads 2144, 2146, 2148 are employed. However, only the first heating head 2144 may be used to thermally fuse two types of photosensitive rolls 12, or the first heating head 2144 may have three or more annular protrusions coaxial with each other, so that only the first heating head 2144 may be used to thermally fuse three or more types of photosensitive rolls 12.

FIG. 156 shows in front elevation a slide plate 2180 which is different in structure from the slide plate 2126.

The slide plate 2180 has a first heating head 2182, a second heating head 2184, and a third heating head 2186 mounted thereon. The first heating head 2182 has a first annular protrusion 2188*a* and a second annular protrusion 2188*b* which are coaxial with each other. The second heading head 2184 has a single annular protrusion 2190. The third heating head 2186 has a first annular protrusion 2192*a*, a second annular protrusion 2192*b*, and a third annular protrusion 2192*c* which are coaxial with each other.

The single annular protrusion 2190 on the second heating head 2184, and the first annular protrusion 2192*a*, the second annular protrusion 2192*b*, and the third annular protrusion 2192*c* on the third heating head 2186 have dimensions corresponding to the outside diameters of different photosensitive rolls 12. Therefore, the first heating head 2182, the second heating head 2184, and the third heating head 2186 may selectively be used to handle six types of photosensitive rolls 12 of different outside diameters. The slide plate 2180 is thus effective to make the packaging sheet bonding device simple in structure.

In the inspecting station ST9, after the light-shielded photosensitive roll 30 is fed by the pallet 86 to a given position and stopped in the packaged state inspecting device 3040, the light-shielded photosensitive roll 30 is positioned in step S1 in FIG. 157.

Specifically, the programmable controller 3122 energizes the motor 3062 to move the lifting and lowering mechanism 3046. When the motor 3062 is energized, the ball screw 3064 is rotated by the belt 3063, lifting the nut 3066 threaded thereover. The rollers 3070*a*, 3070*b* and 3072*a*, 3072*b* mounted on the nut 3066 by the guide rods 3068*a*, 3068*b* are lifted from the gaps in the pallet 86, elevating the light-shielded photosensitive roll 30. When the light-shielded photosensitive roll 30 is elevated a predetermined distance, the outer circumferential surface of the photosensitive roll 30 abuts against the rollers 3116*a*, 3116*b* of the rotating mechanism 3054 disposed thereabove. The distance that the light-shielded photosensitive roll 30 is elevated is set according to the data of the diameter of the light-shielded photosensitive roll 30 which is supplied from the management computer 3120.

After the rollers 3116*a*, 3116*b* abut against the outer circumferential surface of the light-shielded photosensitive roll 30, the programmable controller 3122 energizes the motor 3112 to cause the rollers 3116*a*, 3116*b* to rotate the light-shielded photosensitive roll 30. The tracing roller 3074 to which the reflective displacement detector 3081 is fixed is held against a lower portion of the outer circumferential surface of the light-shielded photosensitive roll 30. The tracing roller 3074 is supported by the spring 3069 and resiliently displaced in response to the displacement of the outer circumferential surface of the light-shielded photosensitive roll 30, thereby keeping the reflective displacement detector 3081 spaced a constant distance from the light-shielded photosensitive roll 30. Therefore, while the reflective displacement detector 3081 is being displaced in unison with the tracing roller 3074, the light detector 3075*b* detects a reflection of the light beam emitted by the light emitter 3075*a* from the light-shielded photosensitive roll 30, thereby detecting a step formed by the end 26*a* of the light-shielding sheet 26. After the light-shielded photosensitive roll 30 is turned 180° after the reflective displacement detector 3081 detects the end 26*a*, the motor 3112 is de-energized. As a result, the end 26*a* of the light-shielding sheet 26 is placed in an uppermost position, whereupon the positioning thereof is completed in step S2.

Then, the programmable controller 3122 positions the imaging units 3052*a*, 3052*b* with respect to the light-shielded photosensitive roll 30 according to the data of the width of the light-shielded photosensitive roll 30 which is supplied from the management computer 3120 in step S3. Specifically, the motor 3076 is energized to rotate the ball screws 3078*a*, 3078*b* coupled by the bevel gears 3079*a* through 3079*c* in opposite directions, causing the first brackets 3080*a*, 3080*b* meshing with the ball screws 3078*a*, 3078*b* to displace the imaging units 3052*a*, 3052*b* to positions depending on the width of the light-shielded photosensitive roll 30.

When the imaging units 3052*a*, 3052*b* are moved closely to the light-shielded photosensitive roll 30, as shown in FIG. 92, the outer circumferential position variation correcting rollers 3100*a*, 3100*b* abut against the outer circumferential surface of the light-shielded photosensitive roll 30, and the end position variation correcting rollers 3104*a*, 3104*b* abut against the end faces of the light-shielded photosensitive roll 30. At this time, as shown in FIG. 91, the distances between the first imaging elements 3088*a*, 3088*b* and the outer circumferential surface of the light-shielded photosensitive roll 30 become constant, and the distances between the second imaging elements 3090*a*, 3090*b* and the end faces of the light-shielded photosensitive roll 30 become constant.

After the above preparatory process is completed, the programmable controller 3122 turns on the first illuminating elements 3092*a*, 3092*b* and the second illuminating elements 3094*a*, 3094*b* in step S4. The programmable controller 3122 issues a command to switch to a skew inspecting program in step S5. The programmable controller 3122 confirms that the emission of light from the first illuminating elements 3092*a*, 3092*b* and the second illuminating elements 3094*a*, 3094*b* is stabilized in step S6. Then, the programmable controller 3122 controls the image processing controller 3130 to measure the end 26*a* with the first imaging elements 3088*a*, 3088*b* in step S7.

The first imaging elements 3088*a*, 3088*b* captures images of the end 26*a* near its corner of the outer circumferential surface which is illuminated by the first illuminating elements 3092*a*, 3092*b* and the second illuminating elements 3094*a*, 3094*b*. The end 26*a* is illuminated obliquely at the illuminating angles shown in Table 1 above by the first illuminating elements 3092*a*, 3092*b* and the second illuminating elements 3094*a*, 3094*b*, so that the end 26*a* can accurately be imaged by the first imaging elements 3088*a*, 3088*b*. The image processing controller 3130 processes the images captured by the first imaging elements 3088*a*, 3088*b* and measures the skewed distance H5 of the light-shielding sheet 26 (see FIG. 86).

Then, the programmable controller 3122 receives the measured result in step S8. The programmable controller 3122 compares the measured distance H5 with a predetermined allowable value to determine whether the measured distance H5 is acceptable or not, and displays the inspected result on the display monitor 3128 in step S9. The inspection of the skewed state of the light-shielding sheet 26 is now completed.

Then, the programmable controller 3122 energizes the motor 3112 to start rotating the light-shielded photosensitive roll 30 in step S10. Then, the programmable controller 3122 issues a command to switch to a program for inspecting a light-shielding shrink film 24 in step S11. After confirming that the rotation of the light-shielded photosensitive roll 30 is stabilized, the programmable controller 3122 controls the image processing controller 3130 to measure the light-shielding shrink film 24 with the first imaging elements 3088*a*, 3088*b* in step S13.

The first imaging elements 3088*a*, 3088*b* captures images of the outer circumferential surface of the light-shielded photosensitive roll 30 near a corner thereof which is illuminated by the first illuminating elements 3092*a*, 3092*b* and the second illuminating elements 3094*a*, 3094*b*. The image processing controller 3130 processes the images captured by the first imaging elements 3088*a*, 3088*b* and measures the width H3 of the light-shielding shrink film 24 at the outer circumferential surface, and also processes an image of the fusion mark T3 of the light-shielding shrink film 24 fused to the light-shielding sheet 26 (see FIG. 87).

The programmable controller 3122 receives the measured result in step S14, determines whether the width H4 and the fusion mark T3 are acceptable or not, and displays the inspected result on the display monitor 3128 in step S15.

While the width H4 and the fusion mark T3 are being determined, the light-shielded photosensitive roll 30 is rotated by the motor 3112 of the rotating mechanism 3054. If the light-shielded photosensitive roll 30 has an eccentricity due to a manufacturing error, then the outer circumferential surface thereof may possibly vary in position. According to the first embodiment, however, since the outer circumferential position variation correcting rollers 3100*a*, 3100*b* abut against the outer circumferential surface of the light-shielded photosensitive roll 30, and a positional variation of the outer circumferential surface of the light-shielded photosensitive roll 30 owing to an eccentricity thereof is absorbed by vertical movement of the second bracket 3086*a* (see FIG. 91), the distances between the first imaging elements 3088*a*, 3088*b* and the outer circumferential surface of the light-shielded photosensitive roll 30 are kept constant at all times, allowing desired images of the light-shielded photosensitive roll 30 to be captured stably.

Then, the programmable controller 3122 keeps the first illuminating elements 3092*a*, 3092*b* turned on, turns off the second illuminating elements 3094*a*, 3094*b*, and turns on the third illuminating elements 3096*a*, 3096*b* in step S16. After confirming that the emission of light from the third illuminating elements 3096*a*, 3096*b* is stabilized in step S17, the programmable controller 3122 controls the image processing controller 3134 to measure the light-shielding shrink film 24 with the second imaging elements 3090*a*, 3090*b* in step S18.

The second imaging elements 3090*a*, 3090*b* captures images of an end face the light-shielded photosensitive roll 30 near a corner thereof which is illuminated by the first illuminating elements 3092*a*, 3092*b* and the third illuminating elements 3096*a*, 3096*b*. The end face near the corner is illuminated obliquely at the illuminating angles shown in Table 1 above by the first illuminating elements 3092*a*, 3092*b* and the third illuminating elements 3096*a*, 3096*b*, so that the end face can accurately be imaged by the first imaging elements 3088*a*, 3088*b* and the third illuminating elements 3096*a*, 3096*b*. The image processing controller 3130 processes the images captured by the first imaging elements 3088*a*, 3088*b* and the third illuminating elements 3096*a*, 3096*b* and measures the width H3 of the light-shielding shrink film 24 at the end face of the light-shielded photosensitive roll 30, and also processes an image of the fusion mark T2 of the light-shielding shrink film 24 fused to the rings 44*a*, 44*b* (see FIG. 87).

The programmable controller 3122 receives the measured result in step S19, determines whether the width H3 and the fusion mark T2 are acceptable or not, and displays the inspected result on the display monitor 3132 in step S20.

While the width H3 and the fusion mark T2 are being determined, the light-shielded photosensitive roll 30 is rotated by the motor 3112 of the rotating mechanism 3054. If the end face of the light-shielded photosensitive roll 30 has an irregularity due to a manufacturing error, then the end face may possibly vary in position. According to the first embodiment, however, since the end position variation correcting rollers 3014*a*, 3014*b* abut against the end face of the light-shielded photosensitive roll 30, and a positional variation of the end face of the light-shielded photosensitive roll 30 owing to an irregularity thereof is absorbed by horizontal displacement of the second imaging elements 3090*a*, 3090*b* (see FIG. 91), the distances between the second imaging elements 3090*a*, 3090*b* and the end face of the light-shielded photosensitive roll 30 are kept constant at all times, allowing desired images of the light-shielded photosensitive roll 30 to be captured stably.

While the light-shielded photosensitive roll 30 is making one revolution in step S21, the programmable controller 3122 keeps the first illuminating elements 3092*a*, 3092*b* turned on, turns on the second illuminating elements 3094*a*, 3094*b*, and turns off the third illuminating elements 3096*a*, 3096*b* in step S22. After confirming that the emission of light from the second illuminating elements 3094*a*, 3094*b* is stabilized in step S22, the programmable controller 3122 repeats the processing from step S13. The outer circumferential surface and the end face of the light-shielded photosensitive roll 30 may be inspected while the light-shielded photosensitive roll 30 is being intermittently rotated through successive angles or continuously rotated.

If the reflective displacement detector 3081 detects one revolution of the light-shielded photosensitive roll 30 in step S21, then the programmable controller 3122 changes the rotational speed of the light-shielded photosensitive roll 30 to a low speed in step S24, and stops the light-shielded photosensitive roll 30 when it is turned 110° from its initial position in steps S25, S26. The programmable controller 3122 stops the light-shielded photosensitive roll 30 for the purpose of positioning same for a next process. The programmable controller 3122 also evaluates the inspected results in step S27, and turns off all the first illuminating elements 3092*a*, 3092*b*, the second illuminating elements 3094*a*, 3094*b*, and the third illuminating elements 3096*a*, 3096*b* in step S28, whereupon the process of inspecting the packaged state is put to an end.

In the hard flanged member supplying station ST15, second flanged members 32 are supplied by a supply mechanism, not shown, and fed by the flanged member feeding device 4066 to the first and second light-shielding member transfer means 450*a*, 450*b* in the second flanged member inserting station ST10. The second flanged members 32 are delivered to the hard flanged member inserting device 4060 by a swinging action of the first and second light-shielding member transfer means 450*a*, 450*b*, and has their inner circumferential surfaces held by the inserting heads 4134*a*, 4134*b* of the hard flanged member inserting device 4060. The photosensitive roll 12 is placed by the centering device 4062 in coaxial alignment with the second flanged members 32 held by the inserting heads 4134*a*, 4134*b*.

The hard flanged member inserting device 4060 is actuated to enable the inserting heads 4134*a*, 4134*b* of the first and second inserting units 4128*a*, 4128*b* to grip the second flanged members 32. As shown in FIG. 95, the motor 4122 is energized to cause the gear train 4124 to rotate the ball screw 4120. The nuts 4148*a*, 4148*b* threaded over the opposite threads of the ball screw 4120 move the first and second inserting units 4128*a*, 4128*b* toward each other upon rotation of the ball screw 4120.

The first and second inserting units 4128*a*, 4128*b* move toward the opposite ends of the photosensitive roll 12 held by the centering device 4062 in the direction indicated by the arrow X1, inserting the ends of the second flanged members 32 held by the inserting heads 4134*a*, 4134*b* into the first flanged members 18*a* on the opposite ends of the photosensitive roll 12 (see FIG. 159). At this time, the tapered tips 64 of the second flanged members 32 are inserted along the inner circumferential surfaces 54 of the first flanged members 18*a*. The tapered tips 64 guide the ridges 68 of the second flanged members 32 to abut against the steps 60 of the first flanged members 18*a*. The motor 4122 is energized to move the first and second inserting units 4128*a*, 4128*b* toward the photosensitive roll 12.

Since the first and second inserting units 4128*a*, 4128*b* operate in the same manner as each other, operation of only the first inserting unit 4128*a* will be described below.

When the first inserting unit 4128*a* moves in the direction indicated by the arrow X1 with the ridges 68 engaging the step 60, the movable base 4152*a* moves toward the presser plate 4186*a* in the direction indicated by the arrow X1 and then stops, as shown in FIG. 159. Therefore, the end of the presser rod 4166*a* of the cylinder 4144*a* abuts against the movable base 4152*a*, and projects toward the presser plate 4168*a* in the direction indicated by the arrow X2. Therefore, the dog 4170*a* on the presser rod 4166*a* turns on the sensor 4172*a*.

Then, the motor 4136*a* is energized to rotate the drive shaft 4174*a*, causing the belt and pulley means 4176*a* to rotate the rotatable shaft 4178*a*. The inserting head 4134*a* coupled to the rotatable shaft 4178*a* by the coupling 4180*a* rotates in unison with the second flanged member 32.

As shown in FIG. 3, when the second flanged member 32 rotates in the direction indicated by the arrow A, the ridges 68 abutting against the step 60 of the first flanged member 18*a* are rotated in the direction indicated by the arrow A, and inserted into the grooves 56 while being guided by the recesses 62. Upon alignment between the ridges 68 and the grooves 56, the second flanged member 32 is moved toward the first flanged member 18*a*. As shown in FIG. 160, the movable base 4152*a* moves toward the unit assembly 4130*a* in the direction indicated by the arrow X1.

Therefore, the presser rod 4166*a* is moved in the direction indicated by the arrow X1 by the cylinder 4144*a*, and the dog 4170*a* is released from the sensor 4172*a*, turning off the sensor 4172*a*.

Therefore, the alignment between the ridges 68 and the grooves 56 is detected, and the inserting cylinder 4138*a* is actuated to move the tubular presser 4154*a* in unison with the rod 4150*a* in the direction indicated by the arrow X1. Therefore, as shown in FIG. 161, the tubular presser 4154*a* presses the distal end of the angle 4160*a*, moving the movable base 4152*a* to which the angle 4160*a* is fixed along the guide rail 4164*a* in the direction indicated by the arrow X1.

The second flanged member 32 whose inner circumferential surface is held by the inserting head 4134*a* supported on the movable base 4152*a* is now inserted into the first flanged member 18*a*. The inserting head 4134*a* then releases the second flanged member 32, and is released from the second flanged member 32 by the inserting cylinder 4138*a*.

In the flanged structure 52 according to the first embodiment, as shown in FIGS. 3 and 4, the first flanged member 18*a* has the plural grooves 56 defined in the inner circumferential surface 54 thereof, and the step 60 of increased diameter disposed on the inner circumferential surface 54 at the inlet ends of the grooves 56, and the second flanged member 32 has the plural ridges 68 extending to a position where they project toward the tapered tip 64. When the second flanged member 32 is guided by the tapered tip 64 and inserted into the first flanged member 18*a*, the straight end faces 68*a* of the ridges 68 abut against and are supported by the step 60 of the first flanged member 18*a*.

When the second flanged member 32 is turned in the direction indicated by the arrow A, the ridges 68 are brought into alignment with the grooves 56, allowing the second flanged member 32 to be inserted into the first flanged member 18*a*. The ridges 68 and the grooves 56 can thus be aligned with each other accurately and reliably, allowing the second flanged member 32 to be inserted highly accurately into the first flanged member 18*a*.

The inner circumferential surface 54 of the first flanged member 18*a* has the recesses 62 defined therein which extend obliquely from the step 60 toward the respective ends of the grooves 56 in the direction indicated by the arrow A in which the second flanged member 32 is rotated upon insertion into the first flanged member 18*a*. When the second flanged member 32 is rotated in the direction indicated by the arrow A, the ridges 68 thereof are guided by the recesses 62 and inserted smoothly and reliably from the step 60 into the grooves 56, and are effectively prevented from moving out of the grooves 56. Therefore, the second flanged member 32 can efficiently be inserted into the first flanged member 18*a*.

On the second flanged member 32, the ridges 68 extend from the straight barrel 66 onto the tapered tip 64. The ridges 68 are thus elongate in the axial direction of the second flanged member 32. When the ridges 68 are inserted into the grooves 56, therefore, the second flanged member 32 can firmly and reliably be retained in the first flanged member 18*a*.

In the hard flanged member inserting device 4060 according to the first embodiment, the inserting cylinders 4138*a*, 4148*b* and the inserting heads 4134*a*, 4134*b* are relatively movably coupled to each other by the floating couplers 4140*a*, 4140*b*. When the second flanged member 32 is pressed toward the first flanged member 18*a* only by the cylinders 4144*a*, 4144*b*, the second flanged member 32 is rotated. When the ridges 68 are aligned with the grooves 56 and the second flanged member 32 is moved into the first flanged member 18*a*, the detectors 4146*a*, 4146*b* are actuated.

The torque applied to rotate the second flanged member 32 is kept at a constant level under the pressure from the cylinders 4144*a*, 4144*b*. Therefore, the ridges 68 can reliably be inserted into the grooves 56 and are prevented from moving out of the grooves 56.

At the time the detectors 4146*a*, 4146*b* detect when the ridges 68 are aligned with the grooves 56 and the second flanged member 32 is moved into the first flanged member 18*a*, the inserting cylinders 4138*a*, 4138*b* are actuated. The tubular pressers 4154*a*, 4154*b* press the distal ends of the angles 4160*a*, 4160*b* in the direction indicated by the arrow X1, inserting the second flanged members 32 gripped by the inserting heads 4134*a*, 4134*b* reliably into the first flanged members 18*a*.

It is thus possible with a simple process and arrangement to bring the ridges 68 into alignment with the grooves 56 reliably and easily and to insert the second flanged members 32 highly accurately and efficiently into the first flanged members 18*a*.

FIG. 162 shows in exploded perspective another flanged structure 4390. Those parts of the flanged structure 4390 which are identical to the flanged structure 52 are denoted by identical reference characters, and will not be described in detail below.

The flanged structure 4390 has a second flanged member 4392 having a plurality of angularly spaced, axially extending ridges 4394 disposed on the straight barrel 66 and projecting radially outwardly, the ridges 4394 having distal ends spaced from the end of the tapered tip 64 toward the flange 70 by a distance Ha.

The second flanged member 4392 is inserted into the first flanged member 18*a*. Specifically, the second flanged member 4392 is guided by the tapered tip 64 until the end of the straight barrel 66 thereof reaches the inner circumferential surface 54 of the first flanged member 18*a*, after which the ridges 4394 abut against and are supported by the step 60. Then, the second flanged member 4392 is rotated in the direction indicated by the arrow A until the ridges 4394 are aligned with the grooves 56, whereupon the second flanged member 4392 is inserted into the first flanged member 18*a*.

With the flanged structure 4390, since the tapered tip 64 guides the second flanged member 4392 until the end of the straight barrel 66 is inserted into the first flanged member 18*a*, the second flanged member 4392 and the first flanged member 18*a* are positioned accurately concentrically with each other. When the second flanged member 4392 is rotated after the ridges 4394 abut against the step 60, the ridges 4394 are aligned with the grooves 56, allowing the second flanged member 4392 to be inserted into highly accurately and reliably the first flanged member 18*a*.

Operation of a data transfer system in the automatic packaging system 10 will be described below.

When a pallet 86 is fed to the transfer station ST1, the programmable controller PLC1 reads identification data stored in the memory medium 138 on the pallet 86 through the data reader 142, and specifies one of the data areas M1 through M30 which corresponds to the identification data. In FIG. 9, because the identification data is "3", the programmable controller PLC1 specifies the data area M3.

Then, as shown in FIG. 8, when a photosensitive roll 12 is fed into the dark chamber 11 and placed on the pallet 86 in the transfer station ST1, the programmable controller PLC1 which controls the transfer station ST1 reads the specification data of the transferred photosensitive roll 12 from the programmable controller, not shown, which controls an upstream working station, in response to a detected signal indicative of the photosensitive roll 12 from the workpiece detector 144, and stores the read specification data in one of the data areas M1 through M30 (the data area M3 in FIG. 9) in the tracking data memory 178.

Similarly, when a photosensitive roll 12 is transferred onto a next pallet 86 in the transfer station ST1, the programmable controller PLC1 stores the specification data of the photosensitive roll 12 in one of the data areas M1 through M30 which is specified by the identification data of the pallet 86. In this manner, the tracking data memory 178 of the programmable controller PLC1 stores the specification data of photosensitive rolls 12 in association with the identification data (pallet number data) of pallets 86. Unless the photosensitive rolls 12 or the light-shielded photosensitive rolls 30 are removed from the pallets 86, the specification data of the photosensitive rolls 12 or the light-shielded photosensitive rolls 30 correspond to and are recognized based on the identification data of the pallets 86.

When the pallet 86 is fed to the next first flanged member inserting station ST2, the programmable controller PLC2 which controls the first flanged member inserting station ST2 reads identification data from the memory medium 138 on the fed pallet 86 through the data reader 142 in response to a detected signal indicative of the photosensitive roll 12 from the workpiece detector 144. The programmable controller PLC2 then reads the specification data of the photosensitive roll 12 corresponding to the read identification data from the tracking data memory 178 of the programmable controller PLC1, and stores the read specification data in the tracking data memory 178 of the programmable controller PLC2. For example, in FIG. 9, the programmable controller PLC2 reads the specification data of the photosensitive roll 12 stored in the data area M1, and stores the read specification data in the tracking data memory 178 of its own. The programmable controller PLC2 controls the control devices of the first flanged member inserting station ST2 according to the stored specification data to insert the first flanges 18*a*, 18*b*, 18*c* into the photosensitive roll 12.

Likewise, the programmable controllers PLC1 through PLC6 read the identification data of fed pallets 86, reads only the specification data of the photosensitive rolls 12 or the light-shielded photosensitive rolls 30 corresponding to the read identification data from the tracking data memory 178 of the programmable controller PLC1, and controls desired operations according to the read specification data.

Unless the pallet 86 and the photosensitive roll 12 or the light-shielded photosensitive roll 30 are separated from each other, when each of the programmable controllers PLC1 through PLC6 reads the identification data of the pallet 86, it reads, with high accuracy, the specification data of the photosensitive roll 12 or the light-shielded photosensitive roll 30 which is identified by the read identification data from the tracking data memory 178 of the programmable controller PLC1, and can control a desired operation according to the read specification data.

The identification data stored in the memory medium 138 are only read by the data reader 142, and are not repeatedly written. Therefore, the identification data are stably stored in the memory medium 138 over a long period of time. Since the data stored in the memory medium 138 are identification data only, the memory medium 138 may store a plurality of identification data for backup against accidental data destruction.

The specification data stored in the tracking data memory 178 include work attribute data managing processed states of photosensitive rolls 12 or light-shielded photosensitive rolls 30 on the pallets 86. The management control by the programmable controllers PLC1 through PLC6 can be performed more reliably using the work attribute data.

Specifically, each of the programmable controllers PLC1 through PLC6 sets a working start flag as work attribute data when the workpiece in the working station starts being processed or worked on, sets a workpiece-present flag when the workpiece detector 144 detects a workpiece in the working station, sets a work completion flag when the operation in the working station is completed, and sets a failure flag when the operation in the working station is a failure.

With the work attribute data thus established, if a desired operation on a workpiece in the working station fails due to some trouble, then since a work completion flag is not set, when the workpiece is fed to the next working station, the programmable controller in the next working station recognizes that the desired operation has not been performed on the workpiece in the preceding working station by confirming the work attribute data. The programmable controller issues a warning indicative to the workpiece trouble to the operator, and suspends the operation on the workpiece.

If the operator forgets to remove the workpiece though a failure occurs due to some trouble in the preceding working station, then the programmable controller in the next station can detect that the problematic workpiece is fed because the failure flag has been set and the workpiece detector 144 detects the workpiece and the workpiece-present flag has been set.

Therefore, since each of the programmable controllers PLC1 through PLC6 reads the specification data and performs the operation only when it confirms that there is a photosensitive roll 12 or a light-shielded photosensitive roll 30 present in the working station, the workpiece is not processed based on different specification data, and any operation is prevented from being performed in the working station when there is no workpiece in the working station. If predetermined code data is set as trouble code data in the tracking data memory 178 when there is no workpiece, then each of the programmable controllers PLC1 through PLC6 can confirm why a photosensitive roll 12 or a light-shielded photosensitive roll 30 is not carried on the pallet 86.

FIG. 163 shows in block form the relationship between working stations for manufacturing light-shielded photosensitive rolls 30 from photosensitive rolls 12 and a control system thereof in the process manufacturing light-shielded photosensitive rolls 30 to which a method of and an apparatus for managing workpieces in an automatic packaging system according to a second embodiment of the present invention are applied. The components which are identical to those of the first embodiment shown in FIG. 8 are denoted by identical reference characters, and will not be described in detail below.

As shown in FIG. 163, control devices in the working stations are controlled by programmable controllers PLC1 through PLC6 having respective control consoles C1 through C6 with touch panels, etc. The control consoles C1 through C4 and the programmable controllers PLC1 through PLC4 may be installed near the working stations in the dark chamber 11 insofar as light emitted from display means, such as touch panels, of the control consoles C1 through C4 does not adversely affect the photosensitive material used.

The programmable controller PLC6 controls the label applying station ST11, the discharging station ST12, and a removed article label issuing unit (recording medium issuing means) 168*a*. The removed article label issuing unit 168*a* issues a removed article label 180 (see FIG. 164) as a recording medium to be applied to a photosensitive roll 12 which is removed from any of the working stations or a light-shielded photosensitive roll 30. The removed article label 180 carries pallet number data 180*a* representing an identification number 140 of a pallet 86 from which a photosensitive roll 12 or a light-shielded photosensitive roll 30 is removed, trouble code data 180*b* representing trouble details, product name data 180*c*, width/diameter data 180*d* of a photosensitive roll 12 or the like, product type data 180*e*, winding direction data 180*f* representing the winding direction of a photosensitive roll 12 or the like, product quality data 180*g*, and lot data 180*h* which are printed in a format visually recognizable by the operator, and workpiece specifying data such as the trouble code data 180*b*, etc. and working data such as the width/diameter data 180*d*, etc. which are printed as a bar code 180*k* in a format that can be read.

Of these programmable controllers PLC1 through PLC6, the programmable controller PLC1 is connected to a management computer 170. The programmable controllers PLC1 through PLC6 are connected to each other through a bus line 171. A bar-code reader 182 for reading the bar code 180*k* printed on the removed article label 180 is connected to the management computer 170.

FIG. 165 shows in block form each of the programmable controllers PLC1 through PLC6. As shown in FIG. 165, each of the programmable controllers PLC1 through PLC6 comprises an input/output unit 172 for sending data to and receiving data from the management computer 170 and the other programmable controllers, an input/output unit 174 for sending data to and receiving data from the control devices in the working stations, a control unit (working data applying means) 176 for controlling the data and performing a control process according to a given control program, a program memory 177 for storing operating programs for the control devices in the working stations which are connected to the programmable controllers PLC1 through PLC6, a tracking data memory 178 for storing tracking data which are specification data relative to photosensitive rolls 12 or light-shielded photosensitive rolls 30 which are fed to the working stations that are controlled by the programmable controllers PLC1 through PLC6, a reentrant article list data memory 183 for storing a list of reentrant article data about registered reentrant articles, and a removed article data memory (working data holding means) 184 for storing removed article data as working data of photosensitive rolls 12 or light-shielded photosensitive rolls 30 which removed from pallets 86. The data stored in the tracking data memory 178 of the programmable controller PLC1 connected to the transfer station ST1 are the same as the data shown in FIG. 11.

The automatic packaging system according to the second embodiment, which is basically constructed as described above, operates as follows:

When a pallet 86 is fed to the transfer station ST1, the programmable controller PLC1 reads identification data stored in the memory medium 138 on the pallet 86 through the data reader 142, and specifies one of the data areas M1 through M30 which corresponds to the identification data. In FIG. 9, because the identification data is "3", the programmable controller PLC1 specifies the data area M3.

Then, when a photosensitive roll 12 is fed into the dark chamber 11 and placed on the pallet 86 in the transfer station ST1, the programmable controller PLC1 which controls the transfer station ST1 reads the specification data of the transferred photosensitive roll 12 from the programmable controller, not shown, which controls an upstream working station, in response to a detected signal indicative of the photosensitive roll 12 from the workpiece detector 144, and stores the read specification data in one of the data areas M1 through M30 (the data area M3 in FIG. 9) in the tracking data memory 178.

Similarly, when a photosensitive roll 12 is transferred onto a next pallet 86 in the transfer station ST1, the programmable controller PLC1 stores the specification data of the photosensitive roll 12 in one of the data areas M1 through M30 which is specified by the identification data of the pallet 86. In this manner, the tracking data memory 178 of the programmable controller PLC1 stores the specification data of photosensitive rolls 12 in association with the identification data (pallet number data) of pallets 86. Unless the photosensitive rolls 12 or the light-shielded photosensitive rolls 30 are removed from the pallets 86, the specification data of the photosensitive rolls 12 or the light-shielded photosensitive rolls 30 correspond to and are recognized based on the identification data of the pallets 86.

When the pallet 86 is fed to the next first flanged member inserting station ST2, the programmable controller PLC2 which controls the first flanged member inserting station ST2 reads identification data from the memory medium 138 on the fed pallet 86 through the data reader 142 in response to a detected signal indicative of the photosensitive roll 12 from the workpiece detector 144. The programmable controller PLC2 then reads the specification data of the photosensitive roll 12 corresponding to the read identification data from the tracking data memory 178 of the programmable controller PLC1, and stores the read specification data in the tracking data memory 178 of the programmable controller PLC2. For example, in FIG. 9, the programmable controller PLC2 reads the specification data of the photosensitive roll 12 stored in the data area M1, and stores the read specification data in the tracking data memory 178 of its own. The programmable controller PLC2 controls the control devices of the first flanged member inserting station ST2 according to the stored specification data to insert the first flanges 18*a*, 18*b*, 18*c* into the photosensitive roll 12.

Likewise, the programmable controllers PLC1 through PLC6 read the identification data of fed pallets 86, reads only the specification data of the photosensitive rolls 12 or the light-shielded photosensitive rolls 30 corresponding to the read identification data from the tracking data memory 178 of the programmable controller PLC1, and controls desired operations according to the read specification data. Those light-shielded photosensitive rolls 30 which have been manufactured normally are discharged from the discharging station ST12 to a next process after product labels with printed product information which are issued in the label applying station ST11 are applied to the light-shielded photosensitive rolls 30.

A process of removing a photosensitive roll 12 or a light-shielded photosensitive roll 30 (hereinafter also referred to as "workpiece") either when its quality defect is discovered or to meet a demand for a quality check while the system is in automatic operation as described above will be described below with reference to FIGS. 166 and 167.

While the system is in automatic operation in step S1*a*, if any of the programmable controllers PLC1 through PLC6 or the management computer 170 outputs a line shutdown command in step S2*a*, then the management computer 170 determines whether the line shutdown command is a shutdown command due to an abnormal condition or not in step S3*a*. The abnormal condition may be an insufficiently light-shielded state of a light-shielded photosensitive roll 30 as detected by the inspecting device 160 or an operation failure of the control devices in the working stations. Removal of a workpiece for a quality check is also treated as an abnormal condition.

If an abnormal condition is determined, then each of the programmable controllers PLC1 through PLC6 confirms the status of the working stations controlled thereby in step S4*a*, and determines whether there is a need for removing a workpiece from the working station or not in step S5*a*.

If it is judged that a workpiece needs to be removed, then the removed article label issuing unit 168*a* is operated to issue a removed article label 180. As shown in FIG. 164, the removed article label 180 carries workpiece specifying data which specifies a workpiece judged as suffering an abnormal condition and working data required for a working process in each of the working stations, the workpiece specifying data and the working data being read from the tracking data memory 178. Each of the programmable controllers PLC1 through PLC6 reads working data relative to a workpiece to be removed from the tracking data memory 178, and stores the read working data in the removed article data memory 184 in step S7*a*.

Then, the management computer 170 indicates to the operator a working station and a pallet 86 from which a workpiece needs to be removed in step S8*a*.

The operator then removes the workpiece from the pallet 86 in the working station indicated by the management computer 170, applies the removed article label 180 issued from the removed article label issuing unit 168*a* to the removed workpiece, and stores the workpiece in the reentrant article storage station ST8 in the dark chamber 11 in step S9*a*.

As shown in FIG. 167, the removed article label issuing unit 168*a* issues two removed article labels 180 which are identical to each other. One of the two removed article labels 180 is applied to a label holder 186, and the other to the removed workpiece. Since the photosensitive roll 12 has the photosensitive material exposed, it is preferable to use an easily peelable removed article label 180 having an acrylic adhesive layer, for example, on the photosensitive roll 12 or to apply the removed article label 180 to an area of the photosensitive roll 12 where the photosensitive material is not susceptible, e.g., a side of the photosensitive roll 12.

Then, the operator resets the system to cancel the system shutdown, and resumes automatic operation of the system in step S10*a*. Specifically, the workpiece detector 144 confirms no workpiece on the pallet 86 from which workpieces need to be removed in step S11*a*. If the workpiece detector 144 judges that there is no workpiece on the pallet 86 in step S12*a*, and if there is a workpiece removal instruction in step S13*a*, then the system resumes its automatic operation in step S1*a*. If a workpiece remains on the pallet 86 from which workpieces need to be removed, then the processing from step S9*a* to step S12*a* is repeated.

If it is judged that a workpiece does not need to be removed in step S5*a*, then the operator confirms an abnormal condition of the workpiece and repairs the workpiece in step S14*a*. Then, the operator confirms again whether the repaired workpiece needs to be removed or not in step S15*a*. If it is judged that the repaired workpiece needs to be removed, then the operator removes the workpiece in step S9*a* and resumes automatic operation of the system. Since the management computer 170 does not give a workpiece removal instruction at this time, the removed article label issuing unit 168*a* automatically issues a removed article label 180 in step S16*a*, and working data of the workpiece to be removed is saved in the removed article data memory 184 in step S17*a*. The operator applies the issued removed article label 180 to the removed workpiece, and stores the removed article in the reentrant article storage station ST8.

If it is judged that the workpiece does not need to be removed in step S15*a*, then the operator resets the system to cancel the system shutdown, and resumes automatic operation of the system in step S18*a*.

A process of reentering the workpiece which has been removed and stored in the reentrant article storage station ST8 into working stations will be described below.

First, the system is set to a reentering mode. Then, it is determined whether a workpiece stored in the reentrant article storage station ST8 can be reentered or not. If the workpiece can be reentered, then the bar-code data 180*k* (see FIG. 164) printed on the removed article label 180 applied to the workpiece and the bar-code data 180*k* printed on the removed article label 180 applied to the label holder 186 are read by the bar-code reader 182, and checked against the data stored in the removed article data memories 184 of the programmable controllers PLC1 through PLC6, producing a reentrant article list, which is stored in the reentrant article list data memory 183. The above process is carried out on each of all workpieces to be reentered.

Then, the programmable controllers PLC1 through PLC6 read the data stored in the reentrant article list data memory 183, and display the reentrant article list on the touch panels of the control consoles C1 through C6. The operator then selects reentrant article data which agrees with the workpiece specifying data recorded on a reentrant article, from the data of the removed article labels 180 on the reentrant article list displayed on the control consoles C1 through C6. When reentrant article data is selected, the selected reentrant article data is stored in the tracking data memory 17 shown in FIG. 17 as working data associated with the pallet 86 in the working station where the workpiece is to be reentered.

Then, the operator resumes automatic operation of the system. Other workpieces are reentered in the same manner as described above.

In the first and second embodiments, the photosensitive roll 12 has been described as a roll to be automatically packaged according to the present invention. However, any of various rolls of paper, synthetic resin sheet, etc. may be used as a roll to be automatically packaged according to the present invention.

With the method of and the system for automatically packaging rolls according to the present invention, the production facility does not require a changeover and the light-shielding leader does not need to be replaced each time a different roll width, roll diameter, or packaged form is used, and hence preparatory operations can be carried out in a short period of time. The overall packaging process is thus carried out with increased efficiency for increased productivity. Since rolls of different sizes and forms do not need to be kept in temporary stock, the space and cost required for keeping such rolls in temporary stock are not required.

Although certain preferred embodiments of the present invention have been shown and described in detail, it should be understood that various changes and modifications may be made therein without departing from the scope of the appended claims.

What is claimed is:

1. A method of automatically packaging various rolls having at least different roll widths, different roll diameters, or different package forms, said method comprising the steps of:

selecting flanged members corresponding to a roll and automatically installing the flanged members respectively on opposite ends of said roll;

automatically applying a tape to an end of said roll in a transverse direction thereof;

automatically processing a packaging sheet to dimensions corresponding to said roll;

automatically applying the processed packaging sheet to the end of said roll with said tape;

rotating said roll to automatically wind said packaging sheet around said roll;

automatically producing said packaging sheet by applying heat-shrinkable skirt members to respective opposite edges of a sheet;

selecting a heating head corresponding to the diameter of said roll, and heating, with said heating head, opposite outer edges of said heat-shrinkable skirt members on respective opposite edges of said packaging sheet wound around said roll to automatically bond the opposite outer edges of said heat-shrinkable skirt members to said roll; and automatically inspecting a bonded state of the opposite outer edges of said heat-shrinkable skirt members, wherein the inspection comprises a measurement of an edge of the packaging sheet to an edge of a flange member on the corresponding side.

2. A method according to claim 1, further comprising the step of:

automatically assembling said flanged member of a cap and a ring which are selected depending on the diameter of said roll.

3. A method according to claim 1, further comprising the step of:

automatically producing said packaging sheet by applying heat-shrinkable skirt members to respective opposite edges of a sheet, and partly applying end fastening tapes to a winding terminal end of said sheet for fixing said sheet to an outer circumferential surface of said roll.

4. The method of claim 1, wherein each element of the flanged members is one of a plurality of elements of various sizes.

5. A system for automatically packaging various rolls having at least different roll widths, different roll diameters, or different package forms, said system comprising an apparatus comprising:

a flanged member installing device for selecting flanged members corresponding to a roll and automatically installing the flanged members respectively on opposite ends of said roll;

a tape member applying device for automatically applying a tape to an end of said roll in a transverse direction thereof;

a packaging sheet working device for automatically processing a packaging sheet to dimensions corresponding to said roll;

an applying mechanism for automatically applying the processed packaging sheet to the end of said roll with said tape;

a packaging sheet takeup device for rotating said roll to automatically wind said packaging sheet around said roll, wherein said packaging sheet working device comprises a skirt joining mechanism for applying heat-shrinkable skirt members to respective opposite edges of a sheet;

a packaging sheet bonding device having a plurality of heating heads selected so as to correspond to the diameter of said roll, for heating opposite outer edges of said heat-shrinkable skirt members on respective opposite edges of said packaging sheet wound around said roll; and a packaged state inspecting device for automatically inspecting a bonded state of the opposite outer edges of said heat-shrinkable skirt members, wherein the inspection comprises a measurement of an edge of the packaging sheet to an edge of a flange member on the corresponding side.

6. A system according to claim 5, further comprising:

a flanged member assembling device for automatically assembling said flanged member of a cap and a ring which are selected depending on the diameter of said roll.

7. A system according to claim 5, wherein said packaging sheet working device comprises:

a skirt joining mechanism for applying heat-shrinkable skirt members to respective opposite edges of a sheet; and an end tape supplying and applying mechanism for partly applying end fastening tapes to a winding terminal end of said sheet for fixing said sheet to an outer circumferential surface of said roll.

8. A system according to claim 5, further comprising:

a pallet for placing said roll thereon; and a feed device for feeding said pallet, said feed device being engageable with and disengageable from said pallet;

wherein said pallet having a pair of placement bases for supporting said roll thereon, said placement bases being positionally adjustable in the transverse direction of said roll; and wherein said feed device having base actuating mechanisms for automatically positionally adjusting said placement bases.

9. The system of claim 5, wherein each element of the flanged members is one of a plurality of elements of various sizes.

10. The system of claim 5, wherein the outer diameter of the flanged members is greater than the inner diameter of the roll.

11. A method of automatically packaging various rolls having at least different roll widths, different roll diameters, or different package forms, said method comprising the steps of:

selecting flanged members corresponding to a roll and automatically installing the flanged members respectively on opposite ends of said roll;

automatically applying a tape to an end of said roll in a transverse direction thereof;

automatically Processing a packaging sheet to dimensions corresponding to said roll;

automatically applying the processed packaging sheet to the end of said roll with said tape;

rotating said roll to automatically wind said packaging sheet around said roll;

automatically producing said packaging sheet by applying heat-shrinkable skirt members to respective opposite edges of a sheet;

selecting a heating head corresponding to the diameter of said roll, and heating, with said heating head, opposite outer edges of said heat-shrinkable skirt members on respective opposite edges of said packaging sheet wound around said roll to automatically bond the opposite outer edges of said heat-shrinkable skirt members to said roll; and automatically inspecting a bonded state of the opposite outer edges of said heat-shrinkable skirt members, wherein the inspection comprises measurements of a width and a height of the heat-shrinkable skirt member around the circumference of the flange member.

12. A method according to claim 11, further comprising the step of:

automatically assembling said flanged member of a cap and a ring which are selected depending on the diameter of said roll.

13. A method according to claim 11, further comprising the step of:

automatically producing said packaging sheet by applying heat-shrinkable skirt members to respective opposite edges of a sheet, and partly applying end fastening tapes to a winding terminal end of said sheet for fixing said sheet to an outer circumferential surface of said roll.

14. The method of claim 11, wherein each element of the flanged members is one of a plurality of elements of various sizes.

15. A system for automatically packaging various rolls having at least different roll widths, different roll diameters, or different package forms, said system comprising an apparatus comprising:

a flanged member installing device for selecting flanged members corresponding to a roll and automatically installing the flanged members respectively on opposite ends of said roll;

a tape member applying device for automatically applying a tape to an end of said roll in a transverse direction thereof;

a packaging sheet working device for automatically processing a packaging sheet to dimensions corresponding to said roll;

an applying mechanism for automatically applying the processed packaging sheet to the end of said roll with said tape;

a packaging sheet takeup device for rotating said roll to automatically wind said packaging sheet around said roll, wherein said packaging sheet working device comprises a skirt joining mechanism for applying heat-shrinkable skirt members to respective opposite edges of a sheet;

a packaging sheet bonding device having a plurality of heating heads selected so as to correspond to the diameter of said roll, for heating opposite outer edges of said heat-shrinkable skirt members on respective opposite edges of said packaging sheet wound around said roll; and a packaged state inspecting device for automatically inspecting a bonded state of the opposite outer edges of said heat-shrinkable skirt members, wherein the inspection comprises measurements of a width and a height of the heat-shrinkable skirt member around the circumference of the flange member.

16. A system according to claim 15, further comprising:

a flanged member assembling device for automatically assembling said flanged member of a cap and a ring which are selected depending on the diameter of said roll.

17. A system according to claim 15, wherein said packaging sheet working device comprises:

a skirt joining mechanism for applying heat-shrinkable skirt members to respective opposite edges of a sheet; and an end tape supplying and applying mechanism for partly applying end fastening tapes to a winding terminal end of said sheet for fixing said sheet to an outer circumferential surface of said roll.

18. A system according to claim 15, further comprising:

a pallet for placing said roll thereon; and a feed device for feeding said pallet, said feed device being engageable with and disengageable from said pallet;

wherein said pallet having a pair of placement bases for supporting said roll thereon, said placement bases being positionally adjustable in the transverse direction of said roll; and wherein said feed device having base actuating mechanisms for automatically positionally adjusting said placement bases.

19. The system of claim 15, wherein each element of the flanged members is one of a plurality of elements of various sizes.

20. The system of claim 16, wherein the outer diameter of the flanged members is greater than the inner diameter of the roll.

* * * * *